United States Patent [19]

Douglas

[11] Patent Number: 4,491,290

[45] Date of Patent: Jan. 1, 1985

[54] TRAIN DEFECT DETECTING AND ENUNCIATING SYSTEM

[76] Inventor: Robert D. Douglas, 2157 Poinciana Rd., Neptune Beach, Fla. 32233

[21] Appl. No.: 406,021

[22] Filed: Aug. 6, 1982

Related U.S. Application Data

[63] Continuation of Ser. No. 050,951, Jun. 22, 1979, abandoned.

[51] Int. Cl.[3] ..... B61L 3/00; G08B 21/00

[52] U.S. Cl. ..... 246/169 A; 246/169 D; 250/340; 250/342; 340/584; 340/600; 340/682

[58] Field of Search ..... 246/169 A, 169 D, DIG. 1, 246/DIG. 2; 340/682, 600, 584; 250/340, 342

[56] References Cited

U.S. PATENT DOCUMENTS

| | | | |
|---|---|---|---|
| 3,226,540 | 12/1965 | De Priest | 340/68 L |
| 3,697,744 | 10/1972 | Howell | 246/169 D |
| 3,812,343 | 5/1974 | Gallagher et al. | 246/169 D |
| 3,994,458 | 11/1976 | Winters | 246/169 D |
| 4,256,278 | 3/1981 | Sanville | 246/169 D |
| 4,323,211 | 4/1982 | Bambara et al. | 246/169 D |

*Primary Examiner*—Glen R. Swann, III

*Attorney, Agent, or Firm*—Arthur G. Yeager

[57] ABSTRACT

A train monitoring system for detecting hot boxes, dragging equipment and the like at the rail site, determining the location on the train of a monitored defect and annunciating the defect and location from a digital automated voice generator to the train crew as well as along a telephone line to a central location. Recording of the defect with time and date of same is provided. The system also has provision for self check via an external simulated train.

20 Claims, 80 Drawing Figures

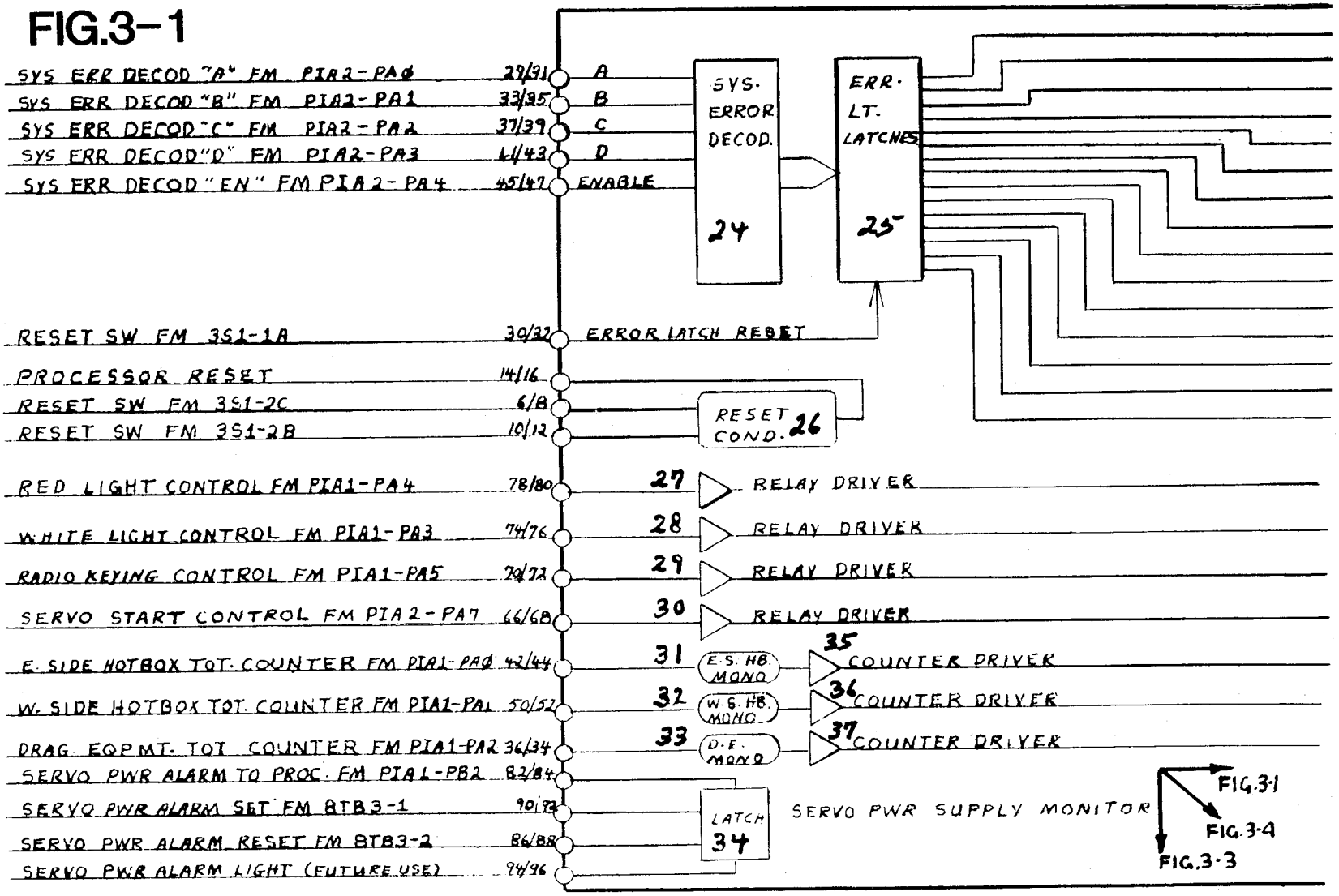
FIG.3-1
SYS ERR DECOD "A" FM PIA2-PA0 29/31
SYS ERR DECOD "B" FM PIA2-PA1 33/35
SYS ERR DECOD "C" FM PIA2-PA2 37/39
SYS ERR DECOD "D" FM PIA2-PA3 41/43
SYS ERR DECOD "EN" FM PIA2-PA4 45/47
RESET SW FM 351-1A 30/32
PROCESSOR RESET 14/16
RESET SW FM 351-2C 6/8
RESET SW FM 351-2B 10/12
RED LIGHT CONTROL FM PIA1-PA4 78/80
WHITE LIGHT CONTROL FM PIA1-PA3 74/76
RADIO KEYING CONTROL FM PIA1-PA5 70/72
SERVO START CONTROL FM PIA2-PA7 66/68
E. SIDE HOTBOX TOT. COUNTER FM PIA1-PA0 42/44
W. SIDE HOTBOX TOT. COUNTER FM PIA1-PA1 50/52
DRAG EQPMT. TOT. COUNTER FM PIA1-PA2 36/34
SERVO PWR ALARM TO PROC. FM PIA1-PB2 82/84
SERVO PWR ALARM SET FM BTB3-1 90/92
SERVO PWR ALARM RESET FM BTB3-2 86/88
SERVO PWR ALARM LIGHT (FUTURE USE) 94/96
A
B
C
D
ENABLE
SYS. ERROR DECOD.
24
ERR. LT. LATCHES
25
ERROR LATCH RESET
RESET COND. 26
RELAY DRIVER 27
RELAY DRIVER 28
RELAY DRIVER 29
RELAY DRIVER 30
E.S. HB. MONO. 31
W.S. HB. MONO. 32
D.E. MONO 33
35 COUNTER DRIVER
36 COUNTER DRIVER
37 COUNTER DRIVER
LATCH 34
SERVO PWR SUPPLY MONITOR
FIG.3-1
FIG.3-4
FIG.3-3

P2
+5V
U9
74150
51
SH2
STB
A
B
C
D
THRU
88EF
+5V
50

NOTES:

1. U3F, U6D, E, F, U7D & U17D UNUSED.
2. INPUT LINES GROUPED AT TOP OF BOARD USING TWO 50 PIN AND ONE 34 PIN CARD EDGE CONNECTORS

P3
74150
U12
+5V
+5V
SH3
$\overline{STB}$
A
B
C
D
$\overline{D_4}$
$\overline{D_3}$
$\overline{D_2}$ 55
+5V
Q3
Q1
R2
U22
555
R3
C1
C2
+5V
R4
C3
U23
74121
R5
SHI-SYS RES
Q2
U19
8T26
D0
D2
D4
D6
SHI-MEM CLK • R/W
(88E • VMA +
8CF • VMA)

NOTES:
1. JUMPERS FOR ADDRESS SELECT MATRIX.
2. PIN 20 TO +5V, 1, 10 & 19 TO COMMON.
3. U8B SECTION UNUSED. U8C, U8D UNUSED INPUTS TIED TO GND.
4. FACTORY SELECTED VALUE NOT USED
5. SELECT ADDRESS IS 88CF. 6. BASE ADDRESS IS 8000

24
ERROR LT RESET TO 3SI-1A
RESET
U1 74154
+5V
PIA 2 PA 0
PIA 2 PA 1
PIA 2 PA 2
PIA 2 PA 3
PIA 2 PA 4
R43
R44
R45
R46
R47
R48
R49
R50
R51
R52
R53
R54
R55
CR1
CR2
CR3
CR4
CR5
C14
C15
C16
C17
C18
C19
C20
C21

NOTE: 1 $\overline{G_1}$ & $\overline{G_2}$ BOTH MUST BE LOW TO ENABLE U1

NOTES:
1. EYLETS FOR OPTIONAL DIODES.
2 U16D, U18C&D UNUSED.

NOTES:

1. 3S1 DPDT MOMENTARY SWITCH.

1A3J3-23
1A3J3-39
1A3J4-5
1A3J4-21
1
2
4
8
M
S
D
P/O R3
9
10
11
12
1
2
4
8
C
3A1-99
+5V
DISP PHONE LINE
3A4-33/35
1
T1
NC
IN
OUT
FL1
IN
OUT
COMMON
3A4-1-4
2

1A3J3-7
1A3J2-41
1A3J2-25
1A3J2-9
8
4
2
1
L S D
3S5
DIFF
HEAT
B A
3
5
P/O R3
13
14
15
16
CR1
CR2
R1
C1
R2
C2
3
DISP PHONE LINE
3A4-25/27
4
DISP PHONE LINE
3A4-29/31

FM PIA#2-PB7
R18
CR11
U8C
U8F
+15V
R17
CR10
20
21
FM PIA#2-PB2
FM PIA#2-PB1
R16
CR9
MX808
U1
SHM-IC-1
U2
R15
CR8
FM PIA#2-PB0
FM PIA#2-PB3
CR7
R14
R9
CR2
18
R4

NOTES:
1. TIE ALL SPARE PINS TO ANALOG COM. AT CARD-EDGE CONNECTOR.
2. COMPONENTS AND GUARD RING AS PER DATEL E.R. HDBK PG. 118-19.
3. DIGITAL COM. ▽ AND ANALOG COM. ▽, SHALL BE RUN SEPERATELY, AND TIE AT THE SUPPLIES AT ONE POINT ONLY.
4. 1 μfd. TANTLUM AND .01 μfd. CERAMIC CAP., LOCATE NEAR CHIP.
5. SECT C. OF U4 NOT USED

NOTES
1-OPTIONAL USE VALUE TO BE SELECTED.
2-U6D,U4BUNUSED. TIE INPUTS TO COMMON.
3-U7D,E,F UNUSED. TIE INPUTS TO COMMON.
4 U10C UNUSED.

EARTH GROUND
+5V REG
COM.
+15V ANALOG
COM. ANALOG
-15V ANALOG
-15 LED
+15 LED
+5 LED
+12V LED
6CR3
6CR2
6CR1
6CR4
TB4
CR4
CR3
CR2
CR5
CR6
6A5
CR1
TB1
TB2
TB3
+12V
FM 3TB3-7
TO SERVO SYS. START 8TB1-5
XK3
K3

SB TO RELAY
N/S TO I/O
PIAI-PBI
13
11
Q2
R43
CR19
R13
U4D
U6B
U6A
7402
U3C
U7D
U7C
RES. = HI
RES. = LO
+5V
C10
U8A
74123
R12
R11
Q1
R41
CR18
NB2 + SB
TO I/O
PIAI-PBI
TO SSI
TEST SW

PIN 13 FOR NB MOVE

13

TRAIN DEFECT DETECTING AND ENUNCIATING SYSTEM

CROSS REFERENCE TO A RELATED APPLICATION

This application is a continuation, of application Ser. No. 050,951, filed June 22, 1979, now abandoned.

FIELD OF THE INVENTION

This invention relates to a train monitoring system for automatic on-line detection of train alarm conditions, such as hot boxes, dragging equipment and the like with determination of alarm condition location, vocal annunciation thereof to the train crew and transmission of the alarm information to a central location for recordation or the like.

BACKGROUND OF THE INVENTION

SUMMARY OF THE PRIOR ART

Hot box detector systems and associated alarm systems are well know in the art. Typical prior art hot box detectors or the like have been capable of detecting the pressure of an alarm condition and to signal the presence thereof by means of an alarm bell or light and to indicate the location of the alarm condition on a graph or counter. The alarm location was available only from the dispatcher's office which was remote from the train. In order to overcome this problem, a system was devised by DePriest, U.S. Pat. No. 3,226,540, wherein the location of a hot box was reported directly to the train crew immediately after detection thereof as well as to the train dispatcher. One disclosed means of reporting a hot box is an uncoded verbal message.

These prior art systems detected hot box alarm conditions by comparing temperatures on journals on opposite sides of each axle.

The prior art systems therefore failed to detect a hot box condition when both journals were in an overheated state. The prior art also registered an alarm condition based upon fixed temperature differential measurements of journals. This procedure failed to take into account ambient conditions wherein the journal box could be in hot, tropical environs or cold, arctic environs. Also, sun radiated heat has an appreciable effect on the apparent heat radiated from a journal box.

Train trucks at present utilize both sleeve bearings and roller bearings on their axles. Roller bearings radiate approximately twice the apparent heat as compared with sleeve or friction bearings when sensed by the optical heat sensing equipment. The prior art makes no provision for determining the type of bearing being used on the truck under test and have effected a compromise solution which leads to erroneous test results.

SUMMARY OF THE INVENTION

In accordance with the present invention, the above and other problems of the prior art are overcome and functions not available in the prior art are provided. The invention relates to a train monitoring system for detecting hot boxes, dragging equipment and the like at the rail site, determining the location on the train, on a car by car basis, of a monitored defect and annunciating the defect and location thereof from a digital automated voice generator to the train crew as well as along a telephone or radio link to a central location or dispatcher. Recording of the defect with time and date is provided.

Alarm conditions of journals or hot boxes are determined by sensing the heat from each journal on both sides of a car and averaging the two lowest readings on each side of the car under test, this being the normal average heat (NAH) for that side of the car. All of the heats sensed for that side of the car are then compared with NAH multiplied by a predetermined factor and, if this term is exceeded, an alarm condition exists and is annunicated. The NAH is stored in the data bank for use with the next car, the stored NAH term being continually averaged with the NAH detected for the next car under test, the NAH term in the data bank thereby being continually updated.

Since the NAH sensed for a normal roller bearing is essentially twice the value sensed for a normal sleeve bearing, the system will check a new NAH against those previously stored. If the ratio is approximately 2:1 or 1:2 it can be determined whether the new NAH is for a roller bearing or a sleeve bearing. The data bank retains a NAH for each type of bearing and updates only with the NAH corresponding to the bearings on the car then under test.

The system is designed whereby the system determines when a car enters and leaves the test area and collects all data in this interim. All calculations are made on-line after a car leaves the test area and before the next car enters the test area. Testing is done on a car by car basis.

BRIEF DESCRIPTION OF THE DRAWINGS

FIGS. 5-1 to 5-4, 6-1 to 6-4, and 7-1 to 7-4 comprise a circuit diagram of the input interface 1A3 printed circuit board of FIGS. 2-1 to 2-4;

FIGS. 8-1 to 8-4 and 9-1 to 9-4 comprise a circuit diagram of the system timing function 1A4 printed circuit board of FIGS. 2-1 to 2-4;

FIGS. 10-1 to 10-4, 11-1 to 11-4 and 12-1 to 12-4 comprise a circuit diagram of the voice memory 1A5 printed circuit board of FIGS. 2-1 to 2-4;

FIGS. 13-1 to 13-4 and 14-1 to 14-4 comprise a circuit diagram of the totalizing counter drivers, relay drivers and fault light control 3A3 printed circuit board of FIGS. 3-1 to 3-4;

FIGS. 15-1 to 15-3 is a circuit diagram of the Unit 3 front panel;

FIGS. 16-1 and 16-2 is a circuit diagram of the audio output filter 3A10 printed circuit board;

FIGS. 17-1 to 17-4 is a circuit diagram of the 8 channel multiplexer, sample and hold and A-D convert 3A2A printed circuit board of FIGS. 3-1 to 3-4;

FIGS. 18-1 to 18-4 is a circuit diagram of the audio amplifier and control 3A4 printed circuit board of FIGS. 3-1 to 3-4;

FIGS. 19-1 to 19-4 is a circuit diagram of the power supplies and relays of Unit 6;

FIGS. 20-1 to 20-4 and 21-1 and 21-2 comprise a circuit diagram of the input interface 3A1 printed circuit board of FIGS. 1-1 to 1-4.

DETAILED DESCRIPTION OF PREFERRED EMBODIMENT

Figure 1:
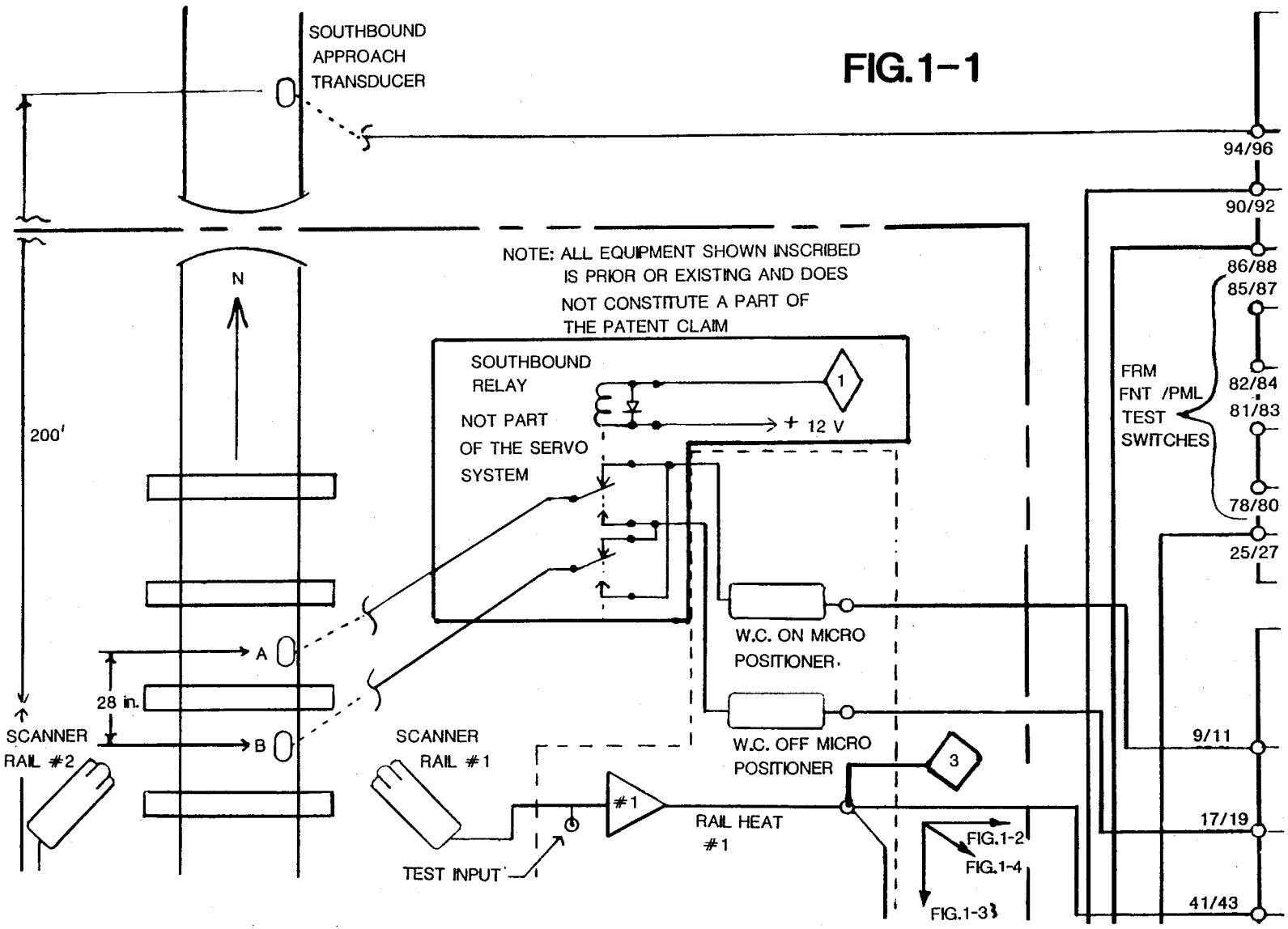
FIGS. 1-1 to 1-4, 2-1 to 2-4, 3-1 to 3-4, and 4-1 to 4-4 comprise a block diagram of the entire defect detector in accordance with the present invention.
Figure 22:
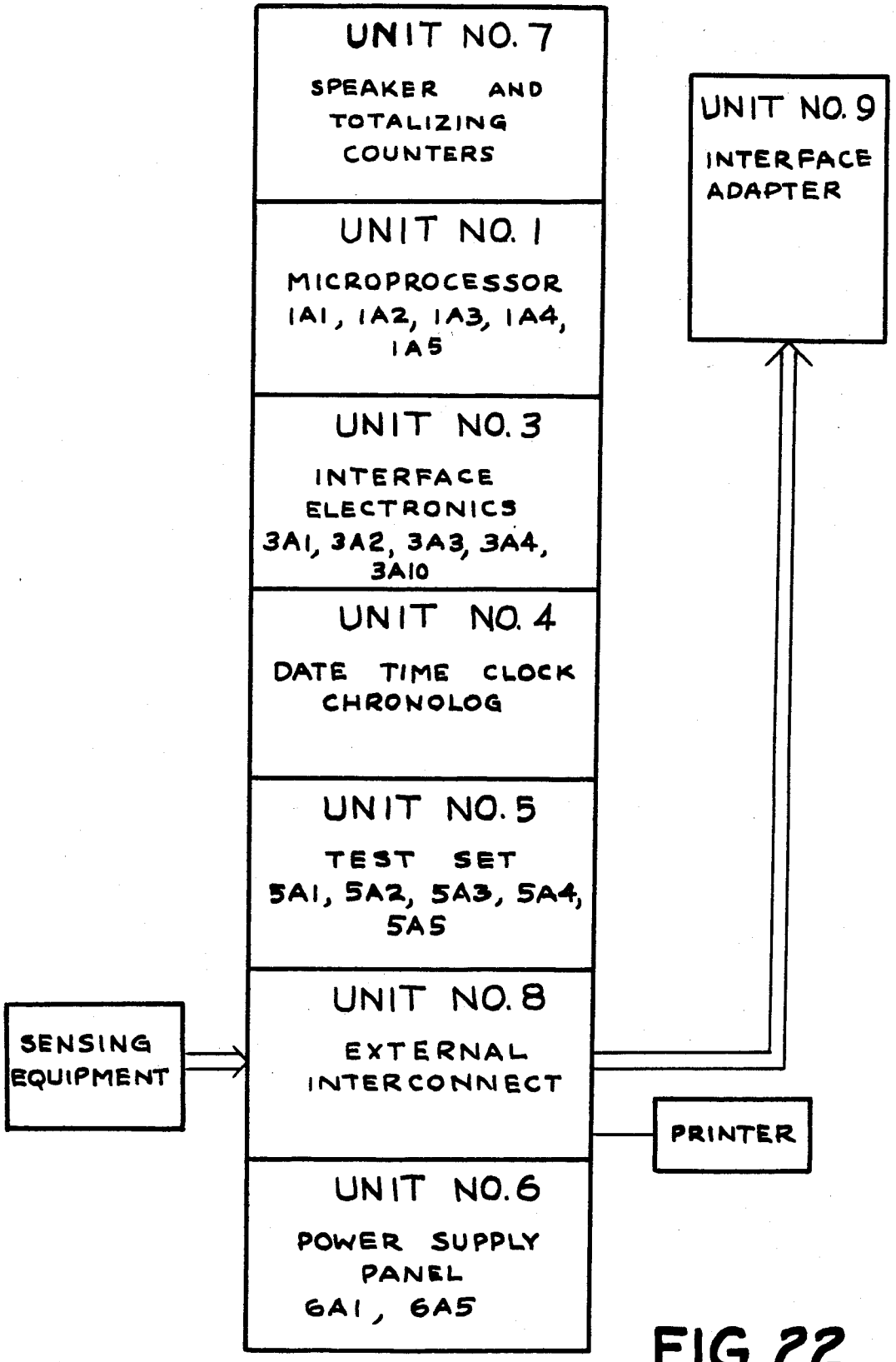
FIG. 22 is a diagram of the units required to provide a complete system in accordance with the present invention.

Referring first to FIG. 22, there is shown a diagram of the several units which form a complete monitoring system in accordance with the present invention. Input data from a passing train is sensed by the sensing equipment at the track side. Thus sensing equipment is also shown in FIG. 1 and includes all components on said figure except those on the 3A1 and 3A2 printed circuit boards, the southbound relay and attached micropositioners and the dragging equipment switch. This sensing equipment is well known in the art and sold by Servo Corporation of America. Accordingly, the sensing equipment and its operation will not be discussed in detail.

Unit 7 includes speakers and mechanical totalizing counters. Connections are shown to these components from the detailed circuit diagrams, however the speakers and counters themselves have not been described because they are standard commercial off the shelf items.

Figures 1, 2:
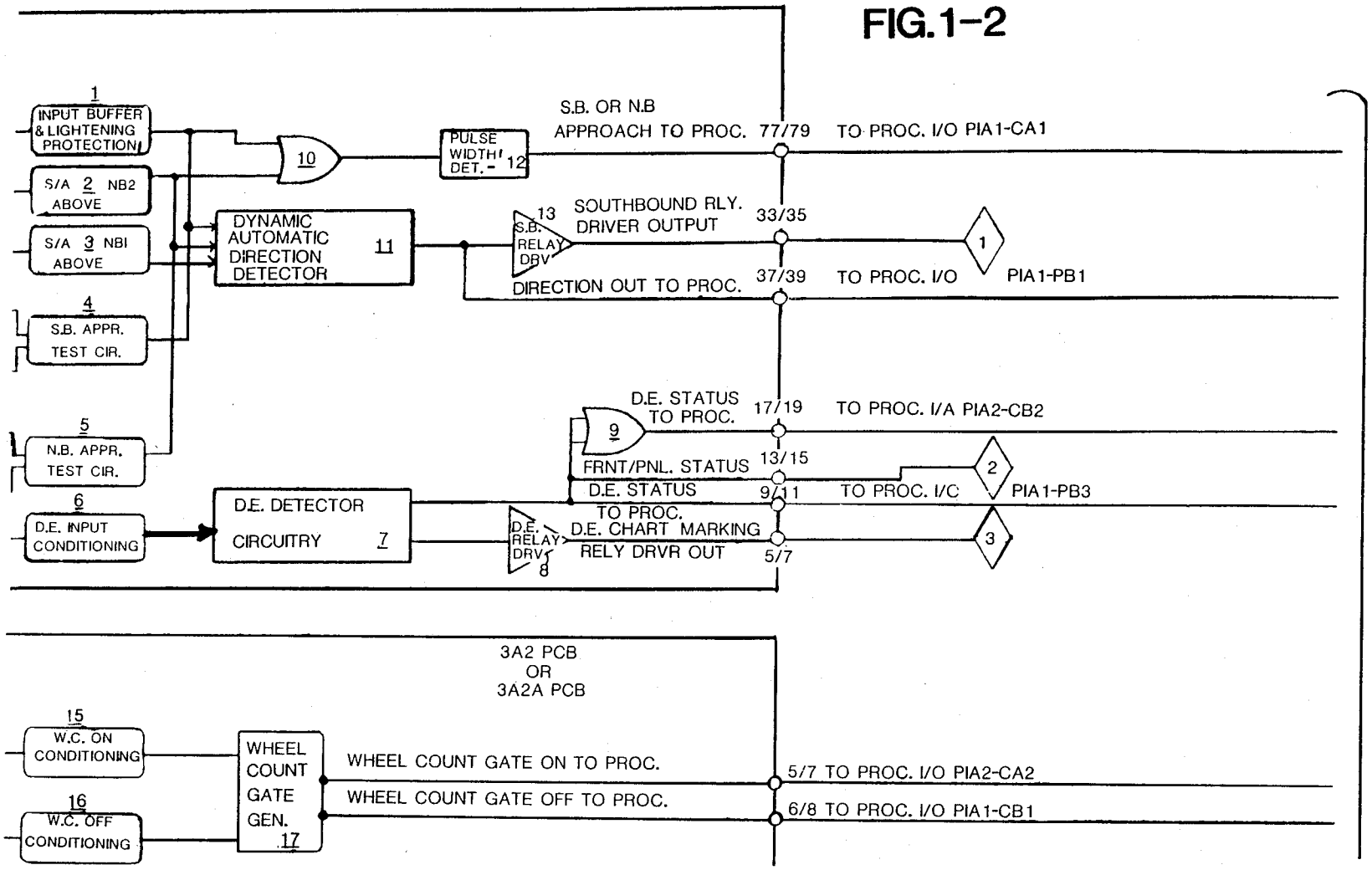

Unit 1 comprises the microprocessor components and support elements therefor shown on FIG. 2 and includes printed circuit boards 1A1, 1A2, 1A3, 1A4 and 1A5.

Unit 3 contains the interface electronics for interfacing from the system to the sensing equipment. Unit 3 includes printed circuit boards 3A1, 3A2, 3A3, 3A4 and 3A10.

Unit 4 is a data time clock which provides a month, day, hour and minute printout for the system. This is a commercial, off the shelf item, a typical unit being manufactured by Chronolog Corp. This unit will therefore not be discussed.

Unit 5 is a programmable test set which does not form part of the monitoring system itself, but simulates a train whereby the system can be tested for defects when it is not performing a monitoring function. A block diagram of the test set is shown in FIG. 4.

Unit 8 is merely a connection block to connect the system elements to the external world, such as the sensing equipment, the printer and unit 9. It is composed entirely of electrical connectors and contains no active circuit elements.

Figures 1, 19:
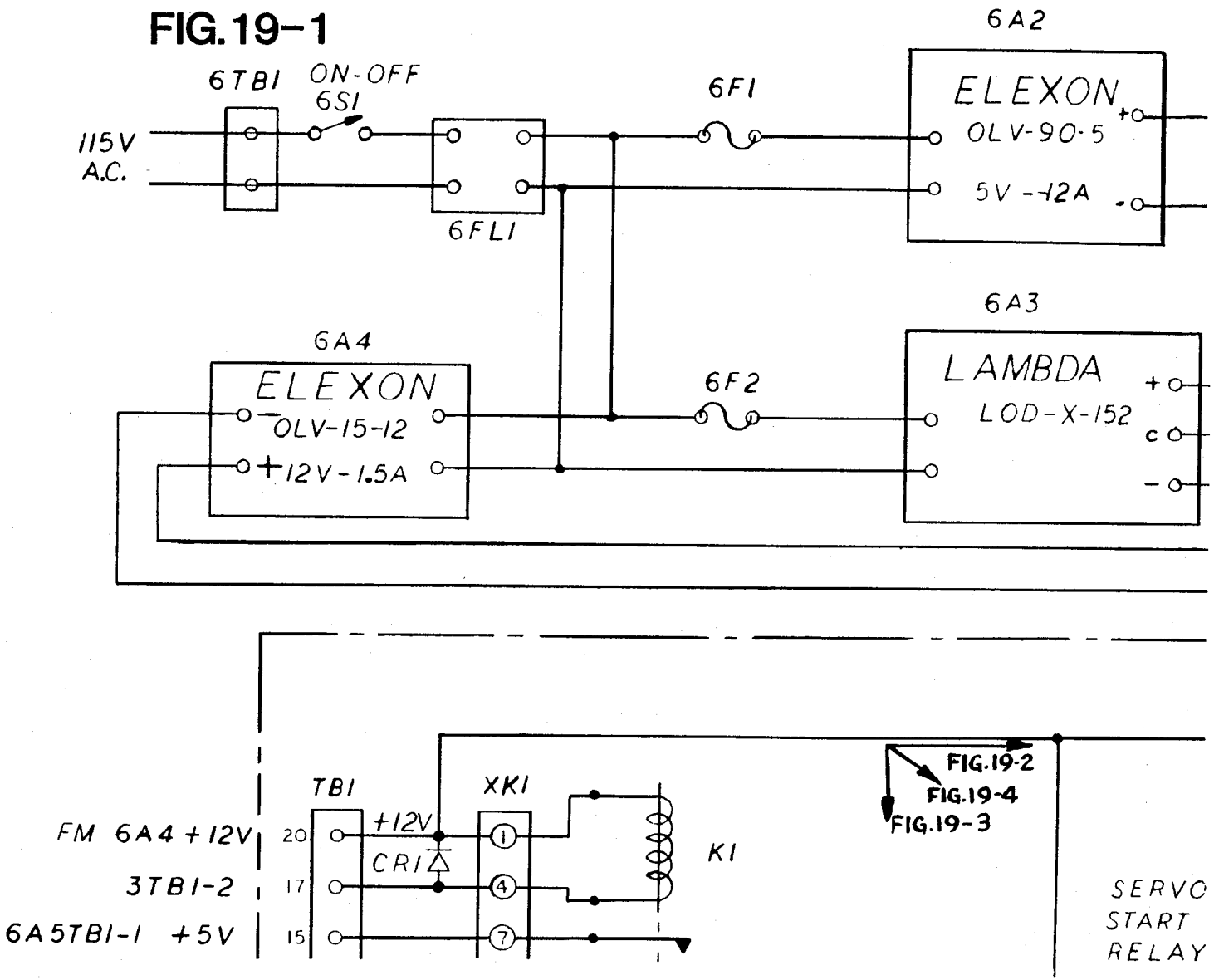
Figures 2, 19:
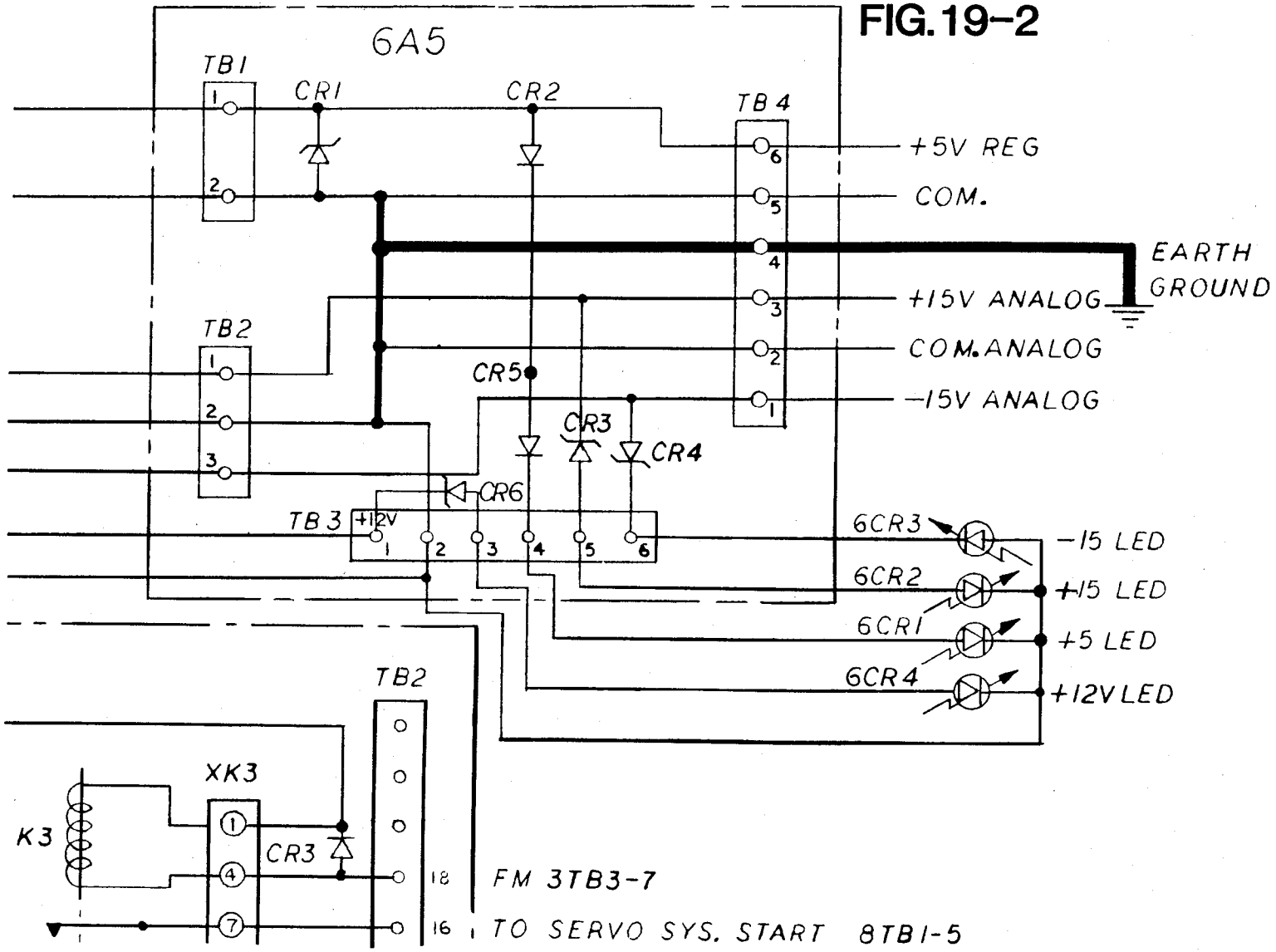
Figures 3, 19:
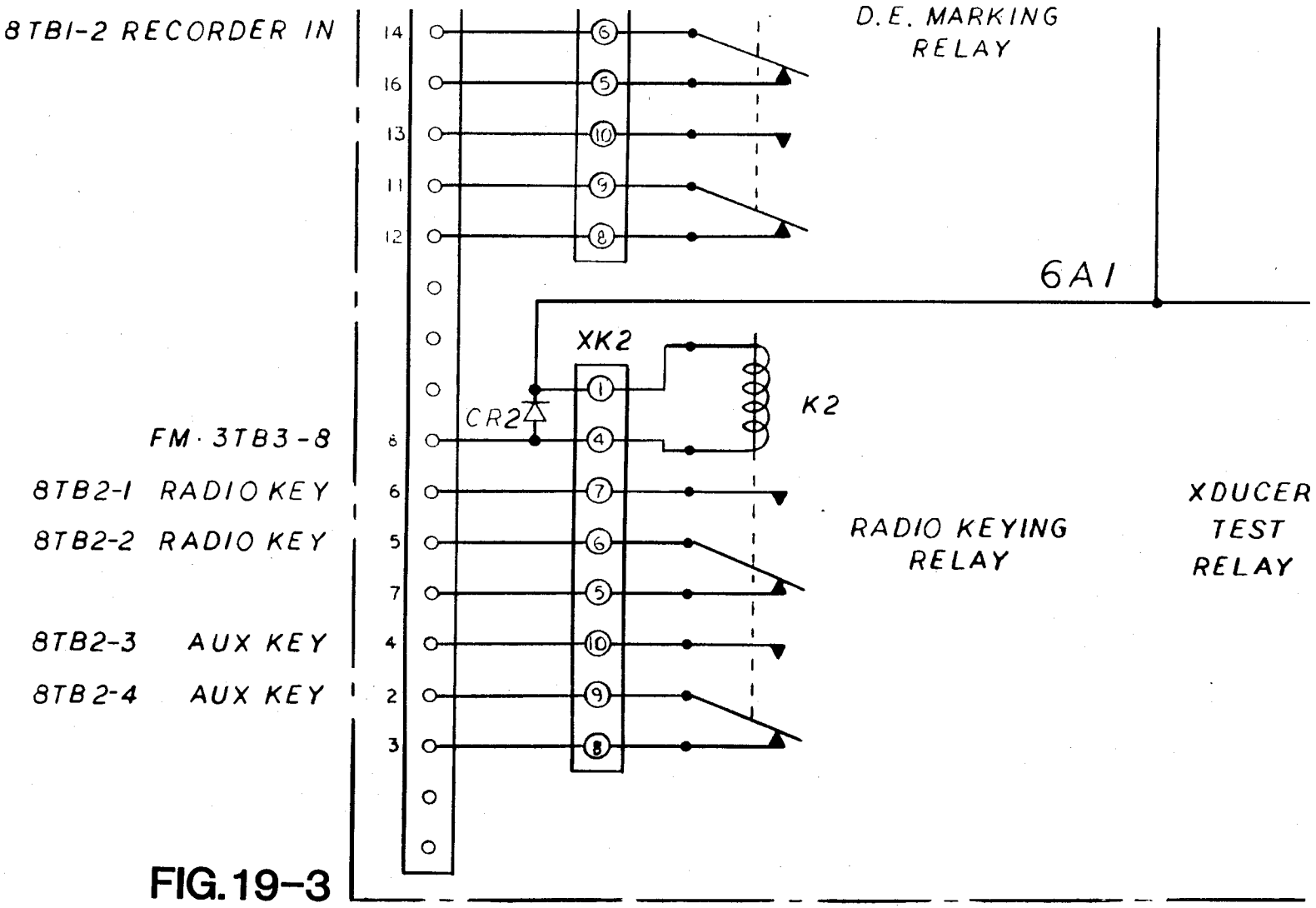
Figures 4, 19:
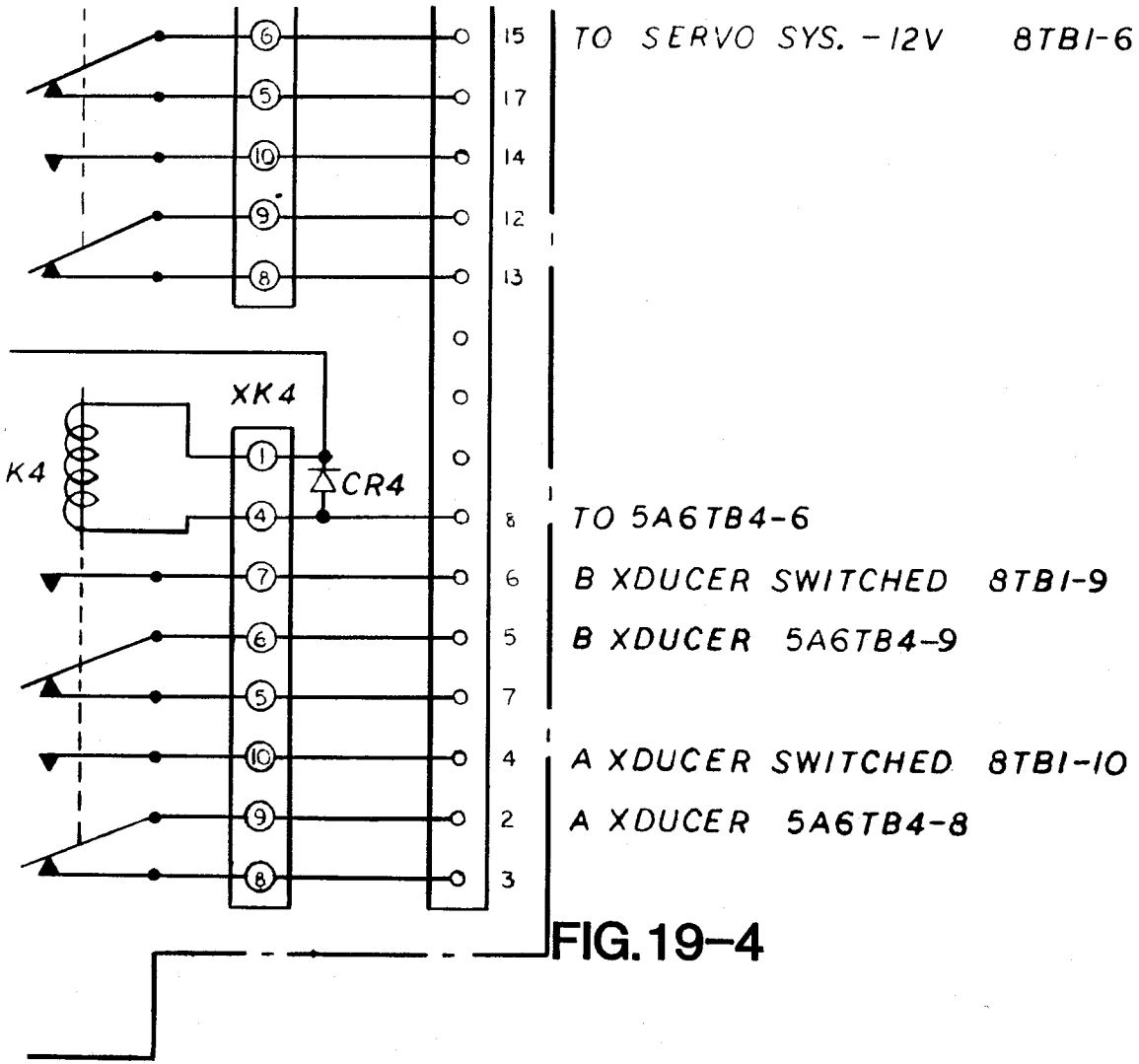

Unit 6 is the power supply panel shown in detail in FIG. 19. It contains all of the power supplies for the system.

Unit 9 is remote from the system and does not form a part of the invention. For this reason, it will not be discussed in detail. This unit connects to the dispatcher central and the radio to communicate with the train via VHF.

Figures 1, 20:
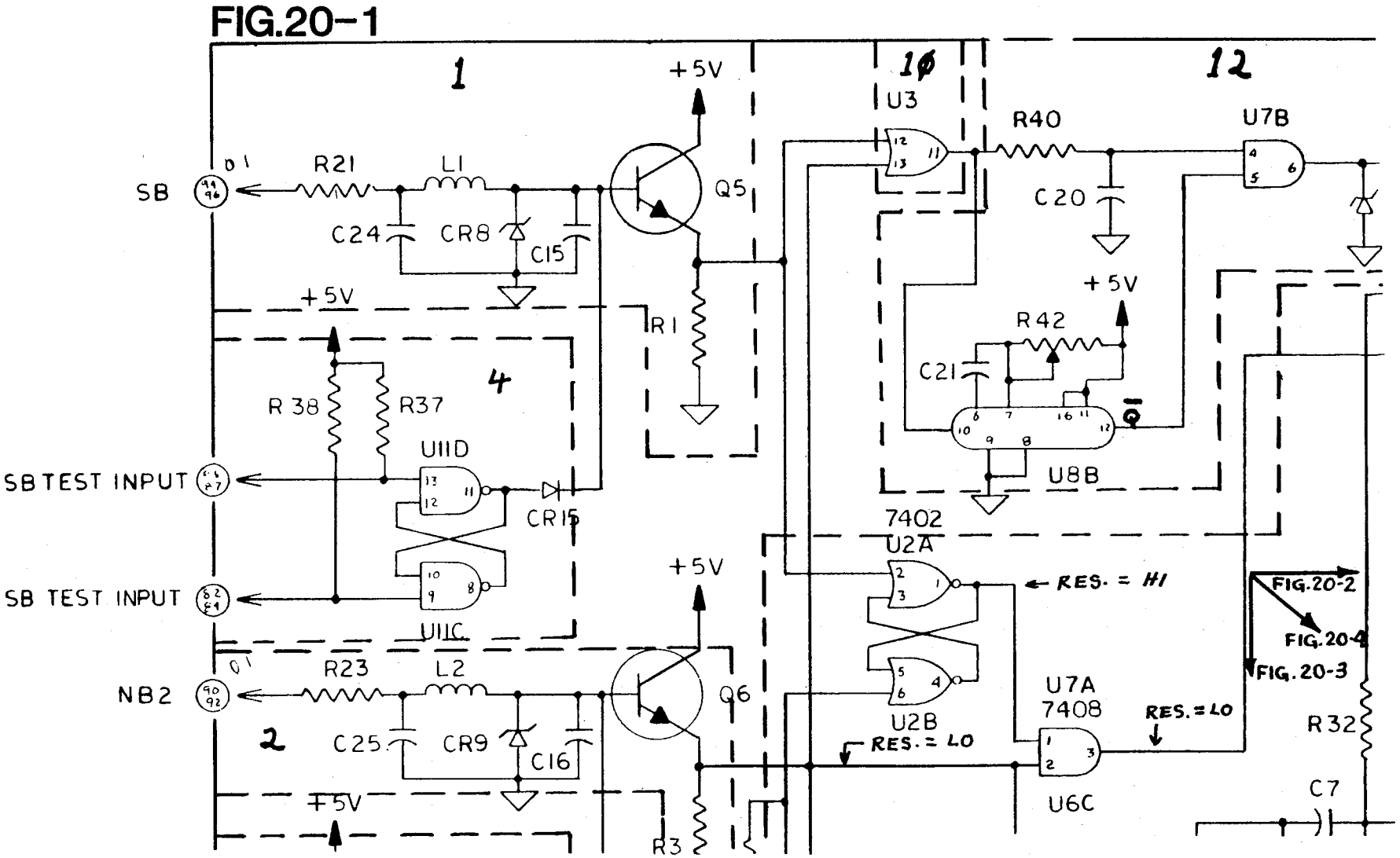
Figures 2, 20:
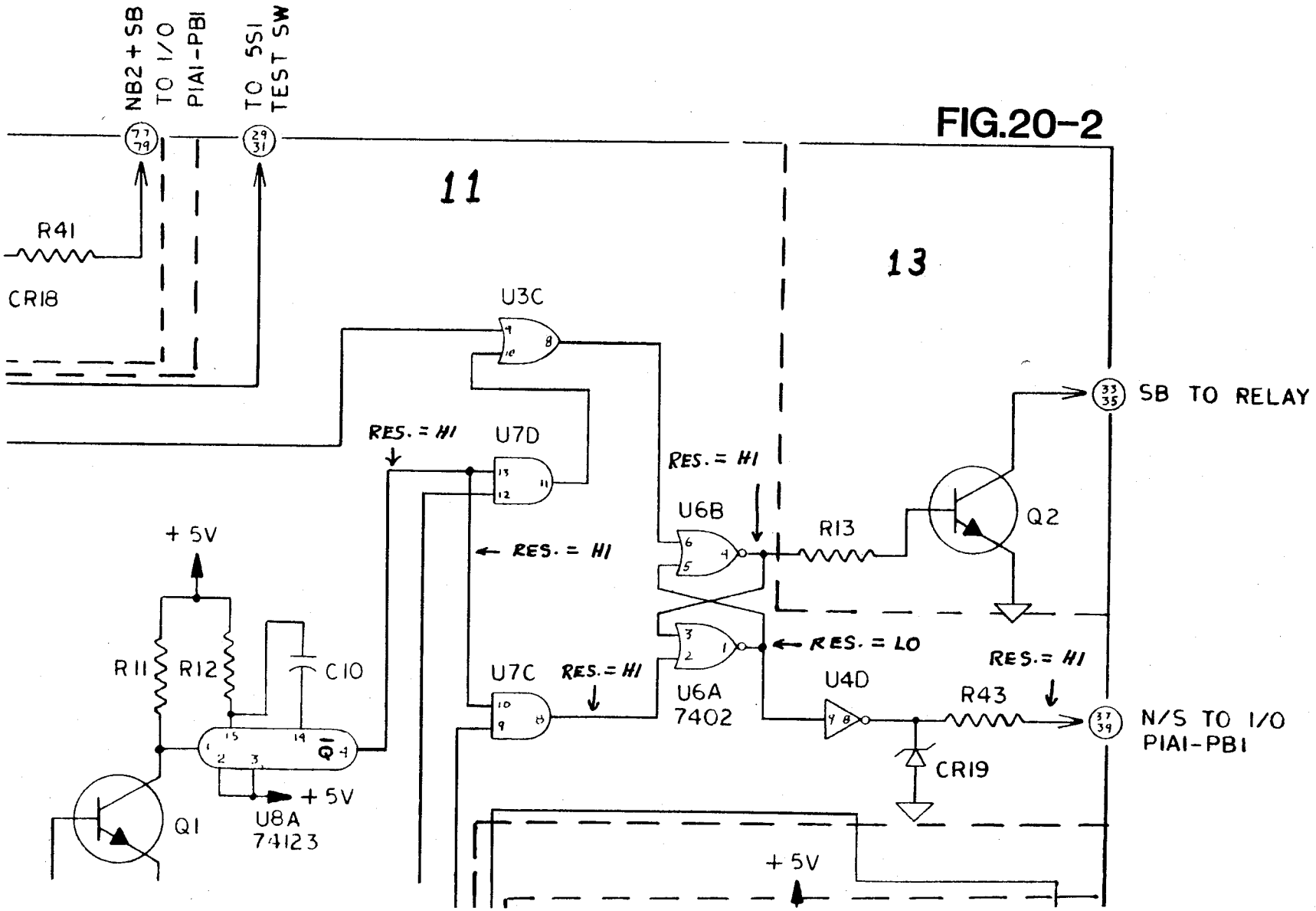
Figures 3, 20:
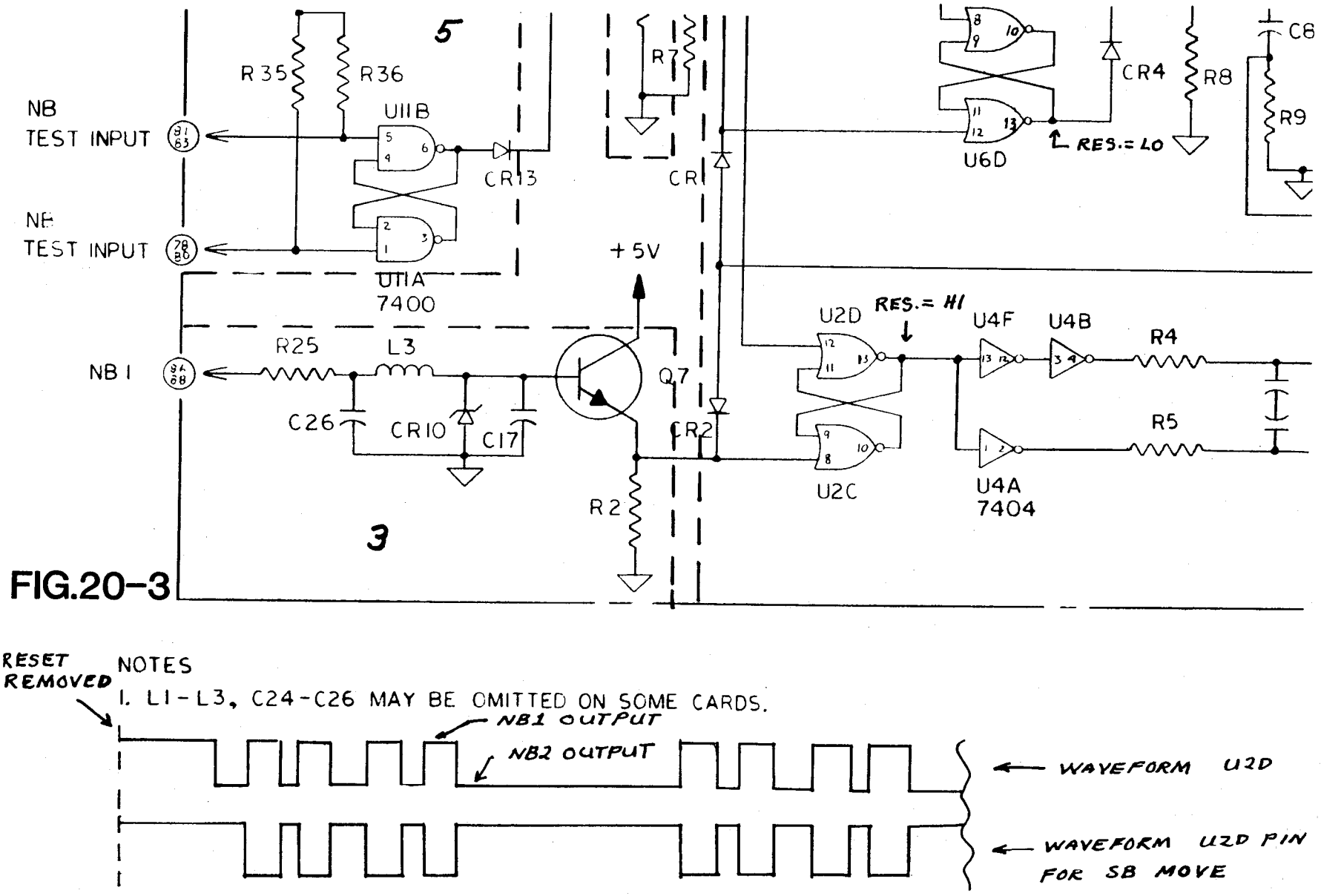
Figures 4, 20:
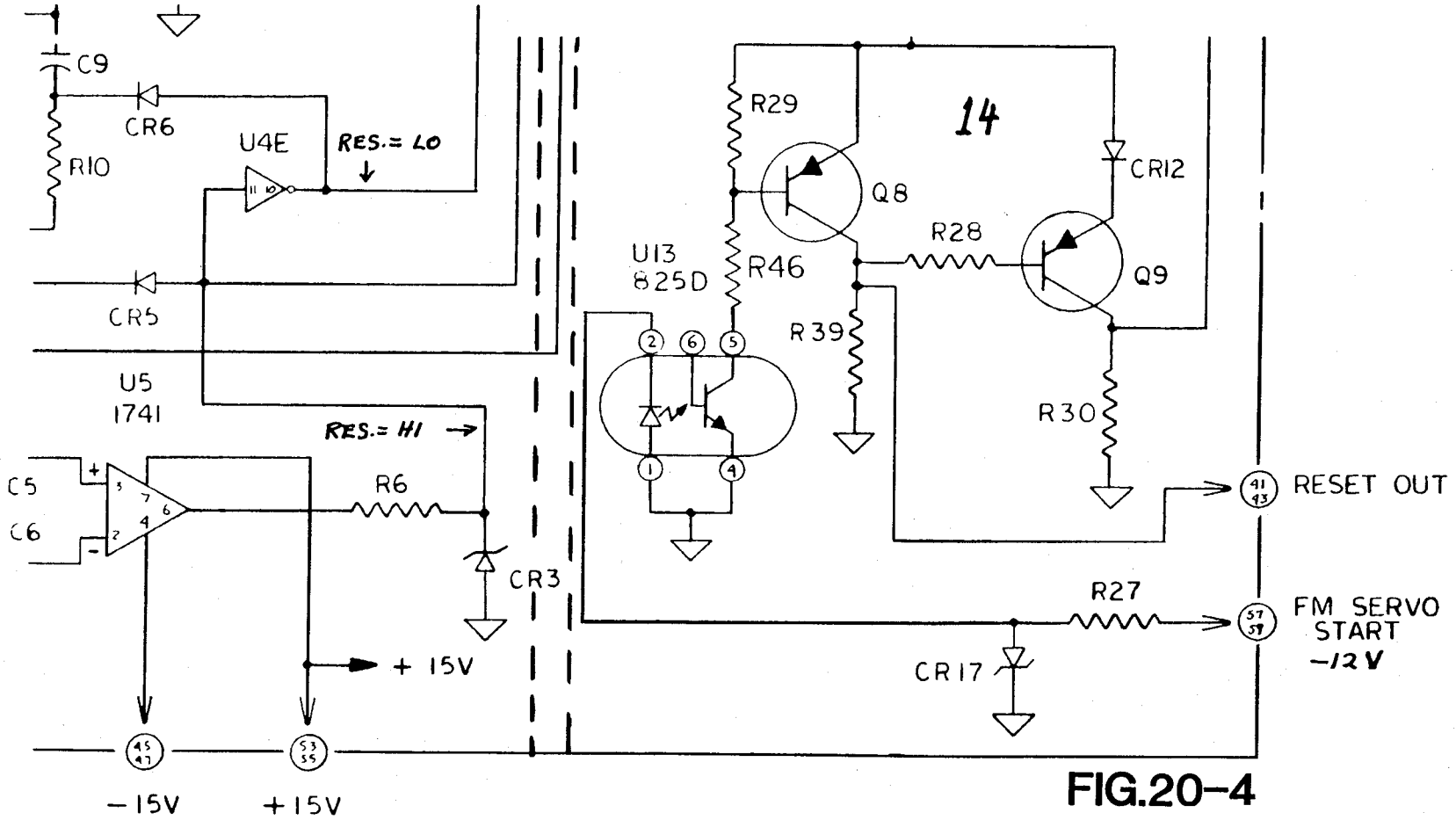
Figures 1, 21:
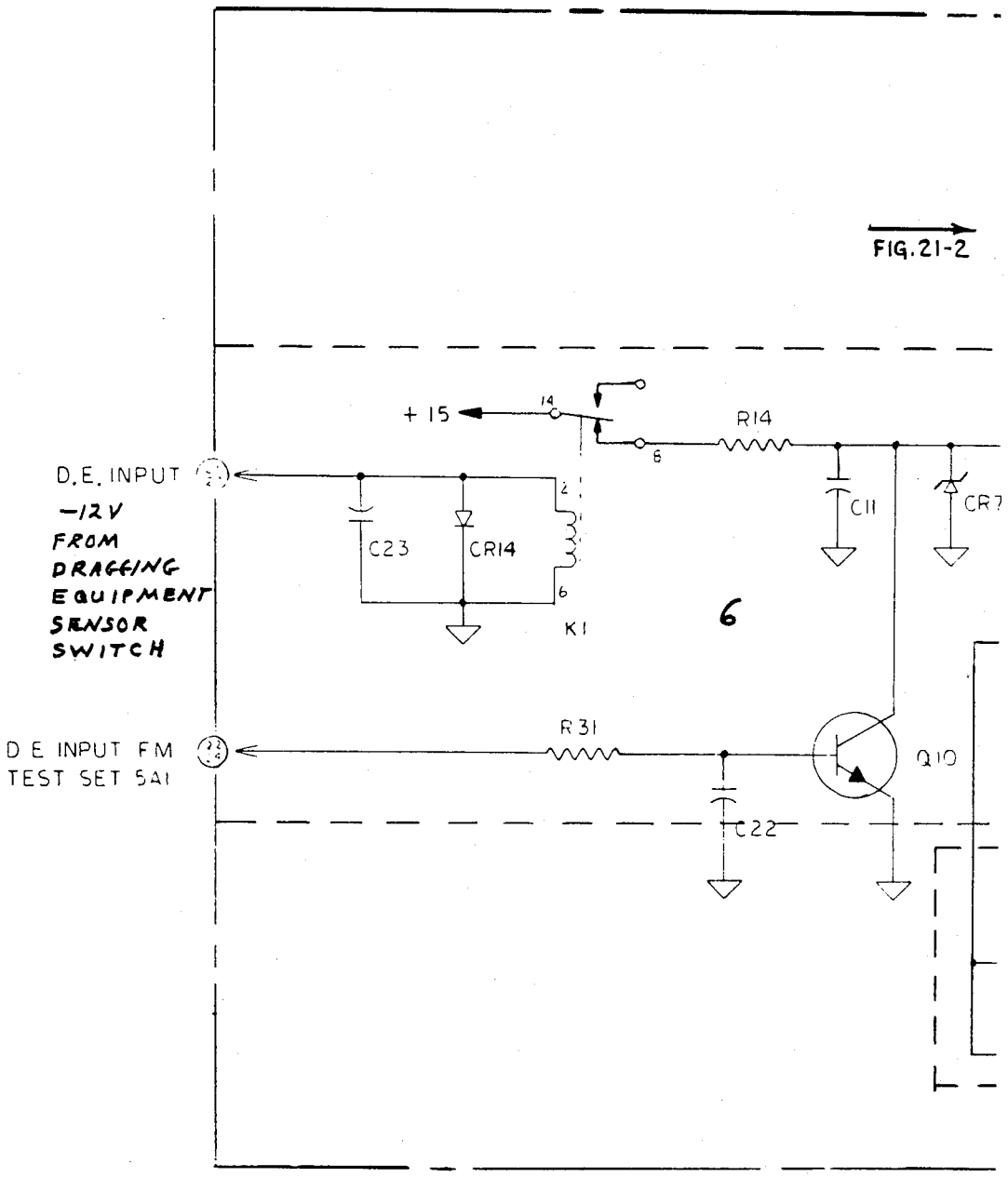
Figures 2, 21:
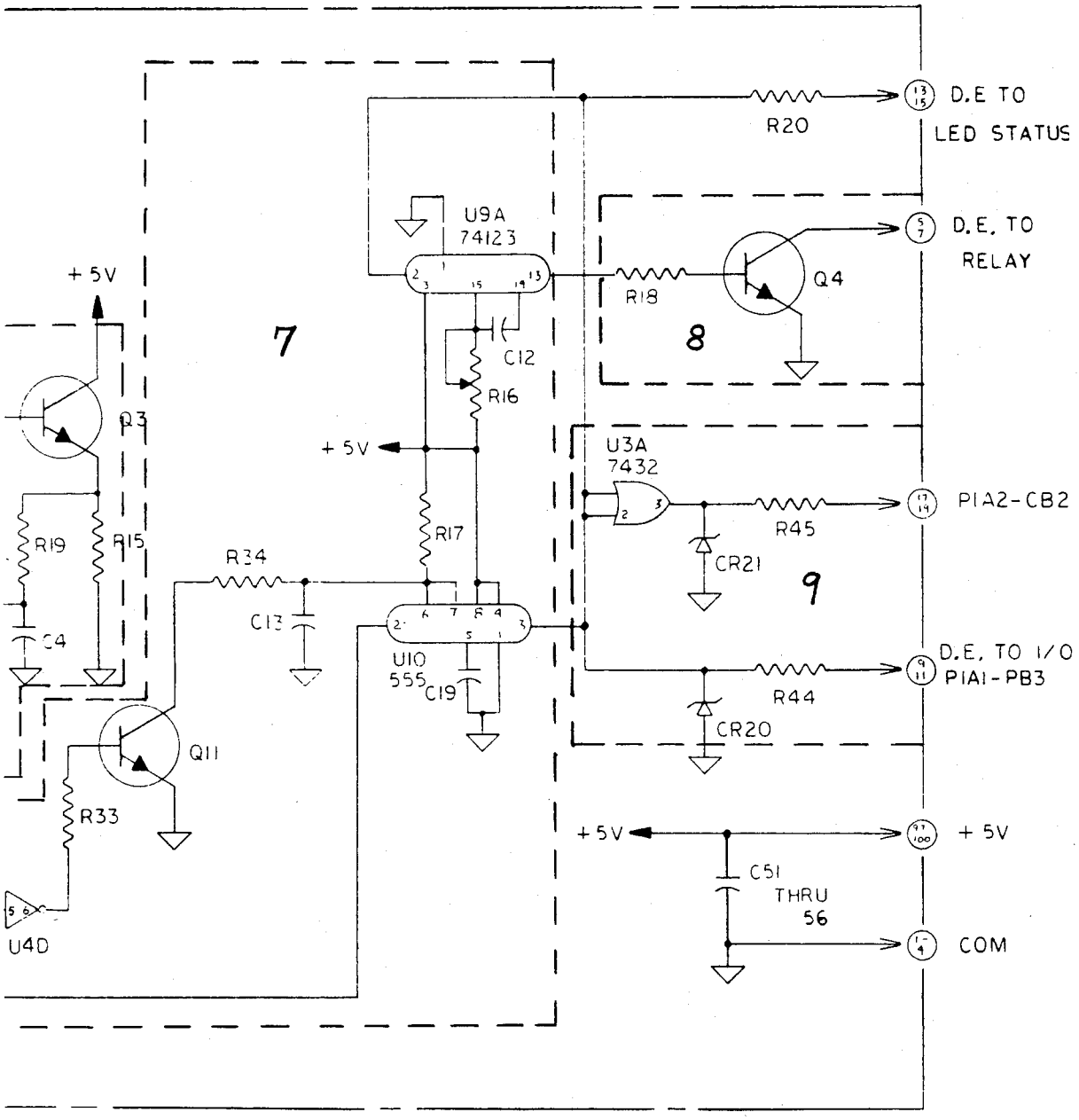

FIGS. 1 to 4 are block diagrams describing in block diagram form the total system of the present invention. FIGS. 5 to 21 are schematic diagrams of the corresponding printed circuit boards of FIGS. 1 to 4. Now, for example, looking at drawing FIG. 1, specific interface circuit boards are drawn bounded or inscribed within individual little blocks and there are specific corresponding schematic diagrams represented by the block diagrams. For instance, looking at about the center of the figure, top, there is an inscribed block with Devtronics 68178 system input interface 3A1 PCB, drawing number 178-003-1, which refers to its corresponding schematic (FIGS. 20 and 21). This block diagram so titled represents the functional description or block diagram description of the printed circuit board input interface 3A1 and of course included in this package is a supporting detailed schematic of the 3A1 printed circuit board (FIGS. 20 and 21). The next item down is the system input interface 3A2 PCB or 3A2A PCB, and is referenced to FIG. 17. Now, on this specific block diagram (FIG. 1), everything to the left of these two printed circuit boards is external to the system. The dragging equipment switch and southbound relay are shown for signal flow and continuity. The input sensors are mounted along side the railroad track. The electronic processing equipment (Servo Corp. pulse processing equipment) that supplies the information to the processor system is mounted in the small house adjacent to the track containing the processor system. Now, for a word of description of how these block diagrams shown are put together, FIG. 1 shows the input interface from the external sensor equipment and shows its corresponding outputs that will output to the central processor unit (FIG. 2). FIG. 2 is a block diagram of the processor unit itself with all the supporting printed circuit boards that exist in the processor cabinet or main frame. For convenience of designating system units, we have chosen the processor to be a unit 1 of the system, for example, unit 3 is the unit that contains and houses all the input and output supporting interface electronic circuitry, that is interface external to the processor unit itself. Unit 4 is essentially an external unit that is purchased and incorporated into this system. It is a calender, date, time clock and it is designated unit 4 and simply provides month, day and time information from this unit for use in utilization in the computer print-out information. Unit 5 of the processor system is the unit containing the test set that is utilized to completely test the system, in other words, a test set that synthesizes and is programmable from a keyboard and simulates a train such that one can test the processor system as if a train were passing the site. Unit 6 is a unit containing all the power supplies that are used to support our electronics. Unit 7 is simply a panel that houses a local speaker and three mechanical counters that totalize the number of defects counted by the system and are designated east side, west side, and dragging equipment. That is, there is a totalizing counter to count the number of hot boxes (overheated journals) detected on the east rail, a totalizing mechanical counter to totalize the number of defects or hot boxes detected on the west rail and a totalizing mechanical counter to provide the total number of dragging equipments detected. Unit 8 of this system is merely a panel with the input-output terminals to the external world where all cabling from the external world is tied in to the system. Unit 9 is a designated to represent various external and peripheral interface boxes that are utilized to, for instance, key the VHF radio that communicates with the train, and keys the dispatcher's telephone lines such that audio annunication is placed on a telephone line to a central dispatcher. There is a box that is interconnected with the telephone ringing in the house such that the dispatcher can, at his election, choose to ring off, in essence disconnect, annunication of his phone line. This is called dispatcher ring off. In summary, therefore, there are nine basic units that comprise the total micro processor system.

The military standard system of designating units and sub units for the system is used. For instance, a referenced PC board designator such as 1A5 is a printed circuit board which is part of unit 1 and A meaning an assembly or sub assembly of unit 1 and it is the 5th sub assembly of unit 1. Therefore, 1A5 represents a sub assembly of unit 1. Likewise, unit 3A1 is a first sub assembly designated in unit 3. Now, looking more specifically at FIG. 3 of the block diagrams there are two printed circuit boards of unit 3 that are involved in output interface, that is, output from the processor going out to the external world. Now, proceeding to FIG. 4 of the block diagram, there is a complete block diagram describing the automated programmable test set used in testing the micro processor system. In summary, the four sheets of block diagrams provide a functional or block overview of the micro processor automated voice defect detector system.

A word on the software. At present, the software is documented at the source level and, of course, at the machine object code level which runs the system. The total software package required to run this system is contained in 6K of memory.

Now, looking at FIG. 1 of the block diagrams, and, specifically, looking at the functional blocks described in the 3A1 printed circuit board, there are numeral designations for each of the functional block symbols inscribed on the 3A1 printed circuit board. A corresponding layout has been made on the detailed printed circuit schematic diagram, FIG. 10. The corresponding circuitry relating back to the block diagram is noted and will be used in the discussions of this system.

Now, to begin at the external sensor inputs, progressing from the sensors to the input interface printed circuit boards 3A1 and 3A2, through the input interface circuitry and out to the central processor units, these outputs will be followed to the central processor unit. And, of course, once it has been input to the central processor unit, the information is then under the control of the software and will be processed and handled by the instructions placed in the six chips that contain the operating software for the system.

To begin the technical detailed discussion, looking at the block diagram, FIG. 1, and at the railway or railside, note that 200 feet to the north and 200 feet to the south of the infrared heat sensing scanners, mounted on the railway, there are two wheel pickup transducers bolted to and mounted on the rail nearest the defect detector house. The northernmost transducer is labeled the southbound approach transducer. The southern most transducer is labeled the northbound 1 and northbound 2 transducer. The northbound pickup transducer is in essence a split or dual section transducer and it is used in the automatic, dynamic true direction sensing circuitry that will be discussed later. Assuming a train is approaching the site traveling southbound, the lead wheel on the engine will pass over the southbound approach transducer first. As a wheel passes over the face of the transducer, a biphasic monosinusoid is generated and that monosinusoid is fed into the system refer to the block and 3A1 PCB (FIGS. 20 and 21 the biphasic monosinusoid is input to that printed circuit board on pins 94 and 96, of the 3A1 circuit board and then is processed through the input interface circuitry. We will discuss in detail the various elements involved in generating this approach pulse which will leave the 3A1 printed circuit board by terminal 77 and 79 and will be input to the processor via the peripheral interface adapter (PIA) on the central processor computer board itself. Now, in conjunction with FIG. 1 of the block diagrams, FIGS. 20 and 21 are noted, which is the detailed circuit schematic of the 3A1 printed circuit board, and if the block diagram is followed in the first block labelled #1 called the input buffering and lightning protection circuitry. Referring to the detailed schematic, and the block of components that are inscribed by the red dash line and labelled #1, discussion of the elements begins in the block 1.

Looking at the detailed circuit schematic, the biphasic monosinusoid then arrives at pin 94 and 96 and passes through circuit components R21, L1 onto the base of Q5. Circuit components C24, CR8, and C15 in that block are lightning and transient protection components. CR8 is a zener diode and is chosen to clamp the base voltage at Q5 so that it does not rise to a level that will damage the logic components that follow the transistor Q5. Transistor Q5 is a high voltage buffer transistor capable of absorbing higher transient voltages than the following logic circuit that is driven by its output. The biphasic monosinusoid will essentially be clipped and only the positive portion of the biphasic sinusoid will be passed by transistor Q5 onto OR gate U3 which is inscribed in block 10. U3 is a standard TTL OR gate logic. The representative positive going portion of the approach monosinusoid is passed through OR gate U3 and is fed into block 12. Block 12 acts as a pulse width detector or discriminator, in that, a pulse has to exceed a given pulse duration before it will be passed onto its output on pin 77 annd 79 to the peripheral interface adapter of the processor. The purpose of the pulse width detector is to eliminate very fast and sharp extraneous transients and spurious pulses due to lightning and other interference sources.

The time that is set on the pulse width detector at present is a nominal 2 milliseconds. In other words, an input pulse must have a time duration greater than 2 milliseconds in order to pass through the pulse width detector discriminator circuitry. This circuit operates in the following manner. After the positive going approach pulse leaves pin 11 of U3, it is split up into two paths of propagation through the pulse width detector circuitry. One path is directly connected from pin 11 of U3 to pin 10 of U8B. U8B is a typical TTL monostable multivibrator with its pulse width adjustable by component R42. In this case it is set for a nominal pulse width of 2 milliseconds. The other path of propagation for the same signal is through R40 onto input pin 4 of U7B which is a standard TTL AND gate circuit. The monostable vibrator U8B has its output (the $\overline{Q}$ side), connected to pin 5 of U7B AND gate. As a pulse arrives at pin 10 of U8B, the monostable multivibrator, pin 12 will drop from a high to a low level voltage, thereby disabling any output from occuring at pin 6 of U7B AND gate. The other path of propagation through R40 and R20, which are time delaying components, has delayed the arrival of the same pulse such that it arrives in time slightly later than the setting of the $\overline{Q}$ of the monostable U8B. Therefore, no output can be derived at pin 6 of the AND gate until the time duration on the monostable U8B has been accomplished. When the time has run on the monostable, then pin 12 of U8B returns to a high level and if, in fact, the time duration of the initiating pulse is greater than the 2 milliseconds of U8B, then an output pulse will be derived at the pin 6 output AND gate of U7B and this output pulse is now fed through R41 to pin 77 and 79 of the 3A1 printed circuit board which is then fed to the peripheral interface input adapter of the microprocessor computer board. Components R41 and CR18 are surge or lightning protection components such that peak voltages introduced back in from pin 77 and 79 are clamped and protect the logic circuit U7B.

As each wheel presses the southbound pickup transducer, a similar action occurs, a test is made of each wheel passing the transducer to make sure that it meets the minimum pulse width duration time. The occurrence of the leading edge of an approach pulse leaving pin 77 and 79 of the 3A1 printed circuit board will interupt the microprocessor unit and alert it to the fact that there is the possibility of an approaching train. When there is no train passing, the microprocessor system reverts to a self diagnostic routine and runs the various and multiple self diagnostic checks while no train is passing the site. Therefore, an interrupt from this output interrupts the self diagnostic routine such that the processor will then place a call and service an approach routine which will recognize the approaching train.

The following sequence will occur as the train passes an approach transducer. The processor will look for and count four axles by the approach transducer and, after the completion of the fourth axle, a white light is illuminated external to the house simultaneous to the illumination of the white light, the servo system will receive its turn on command from the processor system and the Servo Corp. strip chart recorder will be activated and ready to record on the thermal recorder the sensed heat pulses that are fed from the front end infrared heat sensing and pulse processing amplifier circuitry of the Servo Corp. Now, if, in fact, a train is approaching from the opposite direction, in other words a northbound train, similar action occurs at the northbound transducer and through the northbound 2 section input signal conditioner and lightning protection and buffering circuitry which is noted on the block diagram contained in block 2 and on the detailed schematic in the inscribed block labelled block 2. The emitter output of Q6 in the inscribed block 2 has an output that is fed to pin 13 of OR gate U3 in block 10 and an exact similar action as described for the southbound move will occur on a northbound move to alert the processor of an approaching train. The circuit operation of the microprocessor starting with the Servo Corp. system will be discussed in the output circuit interface.

Examining block diagram FIG. 1 and looking at block 13, there is a southbound relay driver buffer amplifier that operates a relay labelled southbound relay. Referring to the detailed circuit schematic on the 3A1 PC board, the inscribed components in block 13 comprise a relay driver to operate the southbound relay. The convention adopted for operating the southbound relay, which we will be discussed in more detail, is that after reset time and during no train activity, the southbound relay will normally be energized or set up for a southbound move or direction. If, in fact, an opposite of move occurs, that is, a northbound move occurs, then there is an automatic sensing of direction and the southbound relay is deenergized i.e., deenergized state of the southbound relay corresponds to an northbound train move. The southbound relay is external to the system and is used to pole change the outputs of the rail mounted A and B transducers of the servo system so that proper optical infrared scanning will be accomplished corresponding to the proper direction of movement of the train. The system merely detects the direction of movement and provides the relay drive to properly position the pole changing relay called the southbound relay which is external to the system (FIG. 1). A corresponding direction control to the processor unit is utilized and, looking directly below block 13 on the circuit schematic, components U4D, R43, CR19, are feeding the output pin 37 and 39 which is labelled north-south to the input output peripheral interface adapter of the microprocessor unit. This is the output for a corresponding direction of move of the train that is utilized by the microprocessor for determining the direction of move of the train.

Now, noting on the block diagram and the schematic diagram, inscribed blocks 4 and 5 are input circuitry to signal condition a switch input such that, from the test panel of unit 5 of this system, by operating a push button switch, one can simulate (for testing) an approaching train either in the southbound or the northbound direction. Circuit components inscribed in block 4 and 5 are a typical cross connected NAND gate DC latch for debouncing the contact bounce of the input switch. The outputs of the corresponding blocks 4 and 5 are injected into the normal southbound and northbound circuitry paths for generating an approach pulse or pulses to the computer processor circuitry.

Now, referring again to the block diagram and to the detailed circuitry schematic, there is dynamic automatic direction detector circuitry in the inscribed block 11. The purpose of the automatic detector circuit is such that if, in fact, a normal approach has occured and a train stops on the defect detector site such that its length may be straddling both the southbound and the northbound approach transducers, after system timeout, the train can start such that either the northbound or the southbound transducer may be activated initially. Due to the random geometry of the train and its wheel spacing, no guarantee can be assumed that a proper direction by the circuitry will occur on start up after the train has stopped straddling both the northbound and the southbound approach transducers. Therefore, the circuitry contained in block 11 is unique and has not heretofore been available and is unique to this system.

The heart of the action of the automatic direction detector circuitry is based on the operation of the split section northbound 1, northbound 2 transducer input. As a preface to the technical discussion, the quiescent or normal state of the southbound relay driver circuitry which is fed from the output of the automatic direction detecting circuitry, when there is no train activity, will be examined. If, in fact, system reset has occured, there is no train activity. Looking in the circuit schematic of the inscribed block 11 and looking at the crossconnected NOR latch circuit U6B and U6A with U6B pin 4 driving the southbound relay driver transistor Q2, it is in the normal condition. The latch U6 A and U6B is set such that the output of pin 4 is high, turning on transistor Q2 and therefore energizing the southbound relay for its normal condition. The opposite side of the NOR latch, (the not side) which is pin 1 of U6A, is then fed through inverter U4D, inverted to a high, and is fed to the processor input/output peripheral interface adapter from pin 37 and 39, such that, for a southbound direction, the output at pin 37 and 39 is high.

At this time it should be noted that a reference to a high and a low voltage signal condition throughout the discussion of this equipment is such that a high condition corresponds to a digital one or a binary one and a low condition corresponds to a digital zero or a binary zero condition. Positive true logic is conventionally used throughout the system.

Now, for purposes of understanding the operation of the dynamic automatic direction detector circuitry, assume that a train has made a normal approach onto the defect detector site and has topped straddling both north and south bound approach transducers and system timeout has occurred such that our system is in a totally reset condition. Examine the reset circuitry and the initial state of all the circuitry in this reset condition. Examining the schematic diagram for printed circuit 3A1, the lower right hand corner is block 14 and the inscribed components, which are not necessarily explicitly shown in the block diagram, but implied, are the reset circuit components that set up the printed circuit board 3A1 to its proper reset (initial) state. Looking at the lower right hand corner of the circuit schematic for the inscribed block 14, note an input from the Servo Corp. system called a servo start. During servo run time or start time the input voltage level at this board is approximately minus 12 volts. If the servo system has timed out and is not running, that is, no train activity, then the input voltage at pin 57 and 59 is zero. This servo start voltage is normally fed into optocoupler U13 such that with zero volts (the resent condition), the emitting element of the optocoupler is inactive or non radiating. Therefore, the transistor receptor portion of the optocoupler, which feeds pins 5 and 4 of the optocoupler U13, will be non-conducting and at this time the base voltage of Q8 at the junction of R29 and R46 will rise to plus 5 volts, thereby cutting off or causing Q8 to be in a non-conducting condition. When Q8 assumes a non-conducting condition, the base of Q9 is then returned to common through R28 and R39, causing base current to flow in Q9, turning on into a conducting condition, and the voltage across R30 will rise toward plus 5 volts which is the reset voltage to reset the circuitry on the 3A1 printed circuit board. Following the reset voltage at the collector of Q9 to the various circuits, it will be observed that, through diode CR2, cross-connected NOR latch circuitry U2D and U2C receives a positive or a high level at pin 8 of U2. Therefore, pin 13 of U2 will assume a high state as a result of this input reset voltage. Also observe that through diode CR1 the high positive reset level is felt at pin 12 of cross-connected NOR latch U6D and U6C. A high reset level at pin 12 of U6D causes pin 13 of U6D to assume a low reset condition. Continuing on, the high level reset voltage is felt at pin 6 of cross-connected NOR latch U2B and U2A. A reset high on pine 6 of U2 causes a reset high on pin 1 of U2A. As a result of the initial reset conditions as explained, noting the circuit schematic diagram for the 3A1 PC board, notations corresponding to the reset states of all the interior logic through to the output latch U6B and U6A which sets up the initial condition of the southbound relay and the initial direction input to the processor system are shown.

Now, assume that a train has stopped straddling the approach transducers and starts to proceed in a northerly direction. Examine the inputs of the northbound 1 and northbound 2 transducer to the automatic detector direction detector circuitry in the action that follows to automatically sense the true direction of motion of the train. As the train begins to move in a northward direction, the transducer outputs will eventually reach a level such that the input circuitry will respond to the outputs of the approach transducers and the detected outputs of the southbound and northbound approach pulses will occur at the output pin 77 and 79 to the processor unit. After the processor has counted four such transducer approach pulses, then the servo system is started. Looking at the circuit schematic down in the extreme right hand corner of the inscribed block 14, a minus 12 volts start up voltage will be received from the servo system. This in turn will cause the emitter portion of the optocoupler to emit, turning on the transistor portion, causing the transistor in the optocoupler to conduct and will reverse the initial reset conditions such that, at the output transistor Q9, there is now a low level. That is, the high level reset has been removed allowing the circuitry to follow any input response.

Assume that at the time, the reset condition is removed there is a pulse inadvertently arriving from the southbound approach transducer before a pulse arrives from the northbound transducer. If the normal southbound circuitry is followed beginning at pin 94, 96 on the circuit schematic, the pulse follows through to the emitter of Q5 and from the emitter of Q5 to pin 2 of NOR latch 2A 2B. A southbound pulse at pin 2 of U2A will set this latch in a reverse condition than its condition at reset time. Pin 1 of the U2A will now assume a low state. Therefore the output of U7A AND gate has not changed its state. Its state was a normal low condition. Therefore, no action occurs beyond the AND gate U7A and inadvertently the system remains with a southbound direction move set on the southbound relay, which, of course, is an incorrect direction of move assumed by the input circuitry at this time.

Now, also, randomly occurring at removal of reset are pulses arriving from the northbound 2 section of the split northbound transducer and following the input from the northbound transducer to 3A1 PC board card edge pin 90 and 92 through its input signal condition and to the emitter output of Q6, we will follow on over to NOR latch U6C and U6D. The first northbound 2 pulse, after reset condition has been removed, will cause NOR latch U6C and U6D to assume the opposite state than that which was initialized due to reset. The change of state of this latch is now coupled through CR4,C7 to the base of Q1, Q1 being an input conditioner for monostable U8. Monostable U8 has a time constant of about 10 seconds. Now the change of state due to the first northbound 2 pulse that occurs after reset has been removed will set monostable U8. The Q output at pin 4 of the monostable U8A will now assume an opposite state from reset conditions. In other words, will assume a low state at this time. Now that the monostable U8A has assumed a low state, you will observe that pin 13 of AND gate U7D and pin 10 of AND gate U7C now assume a low state, thereby disabling or prohibiting any output from U7D and U7C from occurring at this time. Therefore, the initial set on the southbound relay is now held, whereas any initial condition set on the southbound relay is now prohibited from changing until the time on U8A, which is set for approximately 10 seconds, has elapsed. This feature is incorporated to give the train time to pick up enough speed to ensure reliable and consistent operation of the circuitry due to proper amplitude input from the direction or approach transducers. The southbound relay should not change states rapidly after stable operation of the input circuitry has been achieved.

During the 10 seconds lock out, the following action will occur due to inputs from the split section northbound transducer sections, northbound 1 and northbound 2 in the following circuit components which are described in more detail in FIG. 20. Refer to NOR latch U2D, U2C, inverter amplifiers U4A, U4F, U4B, R4, R5, C5, C6, operational amplifier U5 and the R6 and CR3. Also refer to the outputs of Q6 and Q7 which are the corresponding emitter outputs of northbound 2 and northbound 1 transducer input conditioning circuitry. Northbound 2 emitter buffer Q6 drives pin 12 of NOR latch U2D and emitter Q7 northbound 1 conditioning circuitry drives pin 8 of U2C. U2D and U2C form a typical cross-connected DC NOR latch. The output state of the latch will follow the set and reset conditions occurring on pin 12 and pin 8 which are resultant inputs from northbound 1 and northbound 2 split transducers. The initial reset conditions of latch U2D at pin 13 was established to be a high level. Now, as the train proceeds in a true north direction, a wheel passing the face of the split northbound transducer will geometrically have to enable or induce a biphasic monosinusoid in northbound 1 section of the transducer first. The NOR latch U2D, U2C, as a result of a wheel passing a northbound transducer section, will remain in its high condition at the output pin 13. As the wheel (immediately after passing northbound 1 section) passes over northbound 2 section, an opposite condition occurs at the output pin 13 of U2D. In other words, an input to the latch U2D from northbound 2 section causes the output pin 13 to assume a low condition at this time. The next wheel on the same truck passes northbound 1 transducer section and causes the output at pin 13 to go high at this time. Immediately, as the same wheel passes northbound 2 transducer, the output at pin 13 assumes a low state.

Examining the two wave forms at the lower left hand portion of FIG. 20, there are illustrated the two wave forms that will occur at output pin 13 of U2D, depending on the true moving direction of the train. The topmost wave form is a wave form corresponding to a northbound move, and it will represent basically the geometry of construction of the wheels on a railroad card. In other words, a typical car is represented by two wheels in the lead truck, a long space between lead truck and rear truck, and two wheels in the rear truck of the same car. In the wave form, assume for a northbound move a wave form such that the duty cycle of that wave form is less than 50%. In other words, the on time (or the high state) is less than 50%. Now examining the wave form for a southbound move, a complementary or opposite wave form will be generated and its duty cycle is now greater than 50%. In other words, for a southbound move, the duty cycle or the on time (or the high state) input to pin 13 of U2D is greater than 50%. So, in summary, at the output pin 13 of U2D, depending upon the direction of movement of a train, there is a wave form that is much less than 50% duty cycle or much greater than 50% duty cycle.

The following components, U4A, U4B, U4F, R4, R5, C5, C6 and U5 comprise a duty cycle detector. The duty cycle detector operates such that when the duty cycle of the input wave form to U5 is less than 50%, then pin 6 of U5 assumes a low state. In other words, for a northbound move, the output state of U5 assumes a low condition. For a southbound move in which the duty cycle presented to U5 is greater than 50%, the output state of pin 6 of U5 becomes a digital high as long as the duty cycle remains significantly greater than 50%. Therefore, the heart of the automatic true direction sensing circuitry is accomplished by the duty cycle detector, its associated circuitry and inputs from the northbound 1 and northbound 2 split section transducers.

Now to discuss the concurrent following section as the train has moved in a northbound direction. The proper wave form of the duty cycle detector U5 corresponding to northbound movement as assumed provides a low state at output pins 6 of U5. Resistor R6 and CR3 clamp the level of the output pulse such that the output swings essentially from ground to no greater than +5 volts to be compatible with the following TTL logic. Following from the junction of R6 and CR3, the output of the duty cycle detector is fed to a junction and there are three paths of propagation for this condition or state leaving this junction. One path is through CR5, another path is through U4E and another path is directly to pin 9 of AND gate U7C. Now, immediately after U5 has assumed a low state or at the concurrent changing of state of U5, the change of state is coupled through CR5, through C8 into the base Q1 and onto monostable multivibrator U8A which is the lockout multivibrator. This will again, as previously described, sets a 10 second lockout period such that, concurrent with the changing of state of the duty cycle detector, the southbound relay is inhibited from changing of state until the 10 second time delay on the lockout monostable U8A has elapsed. Again, this enables the duty detector to stabilize and assume a stable state corresponding to the true direction of movement of the train. Now, if after 10 second has elapsed and it is established that there is a low state at the output of the duty cycle detector, the low state appears at pin 9 of AND gate U7C and this low state at pin 9 of U7C inhibits any further output from occurring on pin 8 of AND gate U7C. The other path of propagation is through U4E which will invert the low state occurring at the output of the duty cycle detector and the output of U4E at pin 10 will now assume a high state of high level. Examining the action of AND gate U7D, as previously stated, after a 10 second time has elapsed, U8A monostable will reset to a reset condition. In other words, the $\overline{Q}$ output at pin 4 will assume a high state. Pins 13 and 12 of U7D AND gate now have a high state. Therefore, a high state will be assumed at the output pin 11 of AND gate U7B. The high state will be fed to pin 10 of OR gate U3C. This output will be ORed and will be fed from pin 8 of U3C to pin 6 of U6B. Pin 6 of U6B now has a high input fed to this pin, causing the latch U6B and U6A to change state. Now pin 4 reverts to a low state, corresponding to a northbound move. The low state at pin 4 of U6B will then disable or cut off transistor Q3, permitting the southbound relay to deenergize to its northbound condition of the southbound relay. Also, correspondingly, at pin 1 of U6A, a high state is provided which, when fed through inverter U4D, is passed on to the processor as a low state corresponding to a northbound move.

The preceeding has been a description of a typical operation of the dynamic automatic direction detector and its associated circuitry. In summary, if a train has stopped on the defect detector site, straddling both approach transducers, system timeout occurs and, if the train begins to move, and an improper direction has been set on the southbound relay, the automatic dynamic direction detection circuit, after a time interval of 10 to 20 seconds, will sense the true direction of motion of the train and will correct an improper set on the southbound relay.

Referring to the 3A1 print circuit board detail schematic FIG. 21, and also referring to FIG. 1, the dragging equipment input condition and detecting circuitry of the system will be discussed. The dragging equipment input, which comes from the dragging equipment sensor mounted out on the railroad track, is input to the printed circuit board on pin 25 and 27 of the 3A1 printed circuit board (FIG. 21). The input from the dragging equipment sensor is minus 12 volts that is then used to energize relay K1 on the 3A1 printed circuit board for a normal condition. If the train passes the dragging equipment switch site and any mechanical obstructions in the undercarriage are hanging too low and about to come into contact with the rail bed itself, this dragging equipment will operate the dragging equipment sensor switch which will momentarily open up and remove the minus 12 volts input at pin 25, 27 on the 3A1 printed circuit board. Relay K1 on the 3A1 printed circuit board is actually shown in an energized condition such that, if the dragging equipment switch has been activated, K1 will momentarily deenergize, opening contacts 14 and 8 on the relay K1. Opening the contacts 14 and 8 on K1 will cause transistor Q3 to cut off momentarily and, as Q3 is cut off, the input to U4D in the inscribed block 7 now goes to a low state and the input to U10 at the same time goes to a low state, causing the following action to be taken in the dragging equipment detector circuitry.

The dragging equipment detector circuitry inscribed in block 7 is comprised of U4D, R33, Q11, R34, C13, U10, C9, R17, R16, C12 and U9A. The active components U4D, Q11 and U10 form a resettable monostable multivibrator circuit and the output of U10 on pin 3 then feeds another section of the defect detector circuitry U9A. In other words, pin 3 of U10 is fed to the input of U9A on pin 2. Now U9A has a single shot nonresettable monostable multivibrator with a time constant that is determined by R16 and C12 such that the time can be adjustable so that a step mark can be placed on channel 1 of the chart recorder indicating where in the train the dragging equipment signal has occurred and the width of the step that is recorded on channel 1 is determined by the time constant of R16 and C12.

Now, going back to the output of the resettable monostable U10, leaving pin 3, there is an output via CR20 and R44 to the card edge pins 9 and 11 which is the dragging equipment input to the peripheral interface adapter of the computer board. Note also that in block 9 on the schematic diagram (FIG. 21) there is a buffered output also through U3A, R45 out to card edge pin connector 17, 19 to the peripheral interface adapter of the processor. These two outputs, fed into the processor, are utilized in recognizing that a dragging equipment condition has occurred at the railside. Also, following the output of U10 resettable monostable, there is an output through R20 to the PC board card edge pin 13, 15 and this output is fed to a unit 3 status panel which is used in the event that the dragging equipment switch has become defective or open. Then the dragging equipment LED status light will be eliminated continuously due to the fact that the resettable monostable multivibrator U10 will be set in a permanent "on" condition in the event that the dragging equipment sensor switch becomes open and inoperative at the railside.

Referring to inscribed block number 8 (FIG. 21), there is a relay driver comprised of R18 and Q4 and this transistor is used to operate a relay K1 on unit 6A1 (FIG. 19). This relay is utilized to pick up plus 5 volts that is fed to the strip chart recorded on channel 1 to place a step mark on the base line of the strip chart recorder, indicating where the dragging equipment has occurred in the train. This now completes the description of all of the components and functions on the 3A1 printed circuit board referenced on FIGS. 20 and 21.

Referring now to the other input printed circuit board, 3A2A (FIG. 17) with reference to block diagram FIG. 1, basically the 3A2A printed circuit board is used to input condition the "wheel count on" and the "wheel count off" inputs from the rail side A and B transducers. Inputs are also received from the output of the Servo Corp. system heat pulse processing amplifiers for rail 1 and rail 2. The computer samples the heat from the journals and roller bearings as they pass through the optical scanning field of the optical scanners and the system is "gated" on by the wheel count on or the A rail mounted transducer and the scanning time is terminated by a wheel of the train pasing the B wheel count off transducer. During this time, the 8 channel analog multiplexer, (which at present is utilizing only two channels) scans both rails and both sides of the train for heat on the journals passing the scanning field of vision. The output of the analog multiplexer is fed to a sample and hold circuit where it digitizes each sample to an 8-bit word that is fed to the microprocessor.

Now, to examine the action of wheel count on and wheel count off beginning at the railside transducers A and B following through the servo system to the 3A2 PC board involving blocks 15, 16 and 17, as the train has passed by the approach transducer for instance, in a southbound move, the train first passes the southbound approach transducer, alerting the processor that a train is on the approach. The processor will count four wheels by the approach transducer and, at this time, will start the strip chart recorder of the Servo Corp. system and also illuminate the white light external to the defect detector house. The processor continues to count and look for a minimum of eight wheels which pass the approach transducer before the wheel arrives to initiate the A transducer at the scanner. Now, the first wheel passing the A transducer generates the typical biphasic monosinusoid that is input to the servo system (noted on block diagram FIG. 1) and will operate a highly sensitive micropositioning relay which will then generate a minus 12 volt pulse that is fed into the wheel count on conditioning circuitry on the 3A2A PC board at card edge pin 9 and 11. Looking at detailed circuit schematic FIG. 17, beginning at the dard edge input pin 9 and 11, there is a minus 12 volt pulse arriving concurrently with the wheel passing the A transducer. This 12 volt pulse is fed to optocoupler U5 and is optically coupled and isolated and fed to transistor Q1, the latter merely being a buffer amplifier whose output from the emitter of Q1 is then fed to contact debouncing latch U4 in the inscribed block 17. U4 is a typical cross connected NAND latch circuit.

As a wheel passes the A transducer, the cumulative action through the optocoupler and Q1 causes a low level condition to occur at pin 1 of U4A NAND gate latch. Concurrently, with the minus 12 volt pulse occurring at pin 9 and 11 (which is a wheel could on) at pin 17 and 19, wheel count off removes minus 12 volts from pin 17 and 19. Therefore the cumulative action through U6 optocoupler and Q2 buffer amplifier results in a high level condition at pin 5 of U4B NAND gate latch. A low condition on pin 1 and a high condition on pin 5 of the U4A and U4B NAND gate latch causes the latch to set the wheel count gate such that, at the output pin 3 of U4A, a high condition or a digital high level is fed out through R12 to the printed circuit board card edge pin 5 and 7 labelled wheel count gate on, to the peripheral interface adapter. The "wheel count gate on" pulse to the peripheral interface adapter P1A#1-CA2, acts as an interrupt to the processor and initiates a heat processing routine that is called to process and look for heat fed to the system from the pulse processing amplifiers of the servo system, the levels of these signals, of course, being directly proportional to the temperature or heat radiated from the external housing of the journal and axels of the train. Now, as has been indicated, with the leading edge of the "wheel count gate on" pulse, the processor has interrupted and called in a heat processing routine that now starts the heat sampling process required to collect the heat being sampled.

Figures 1, 17:
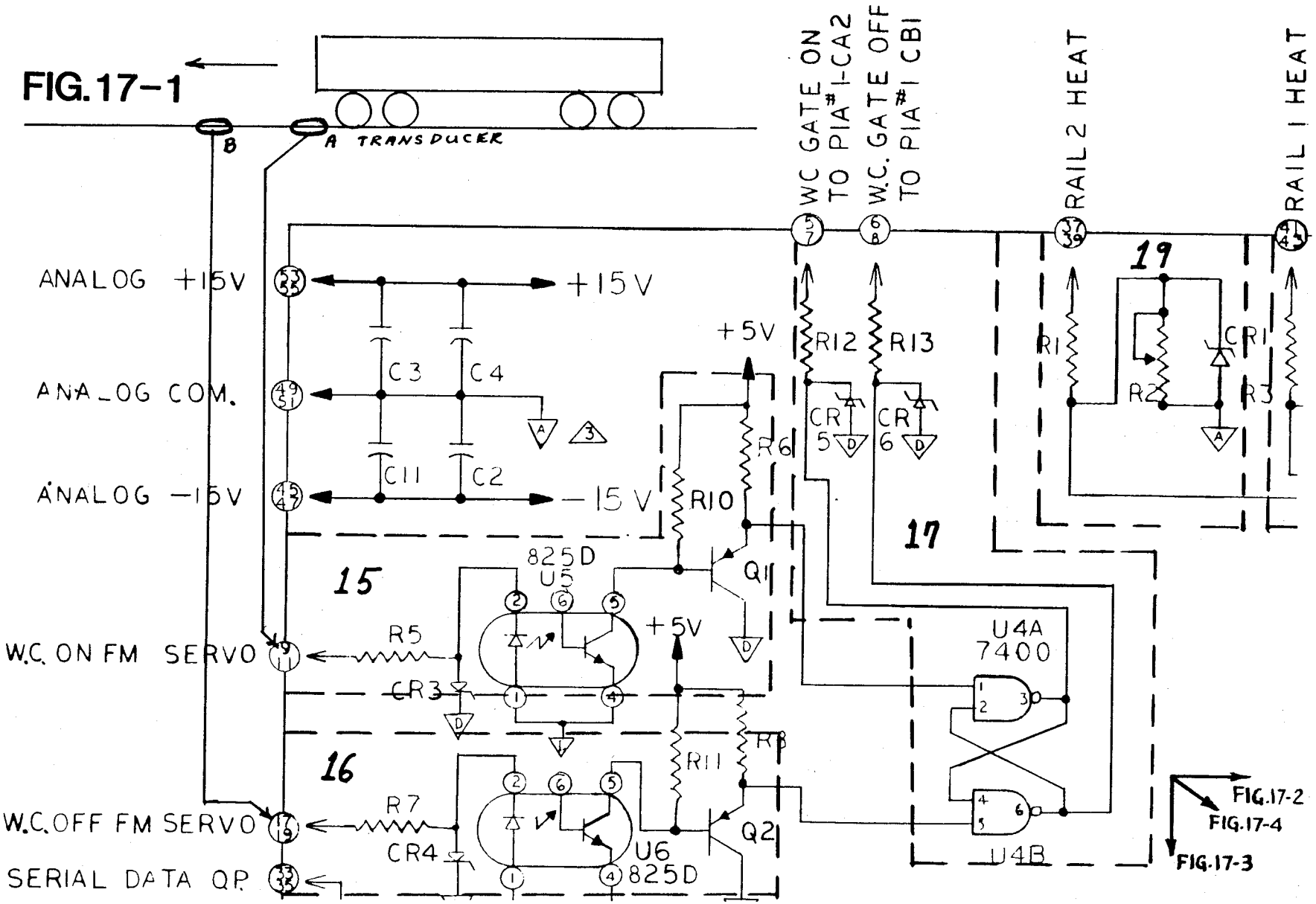
Figures 2, 17:
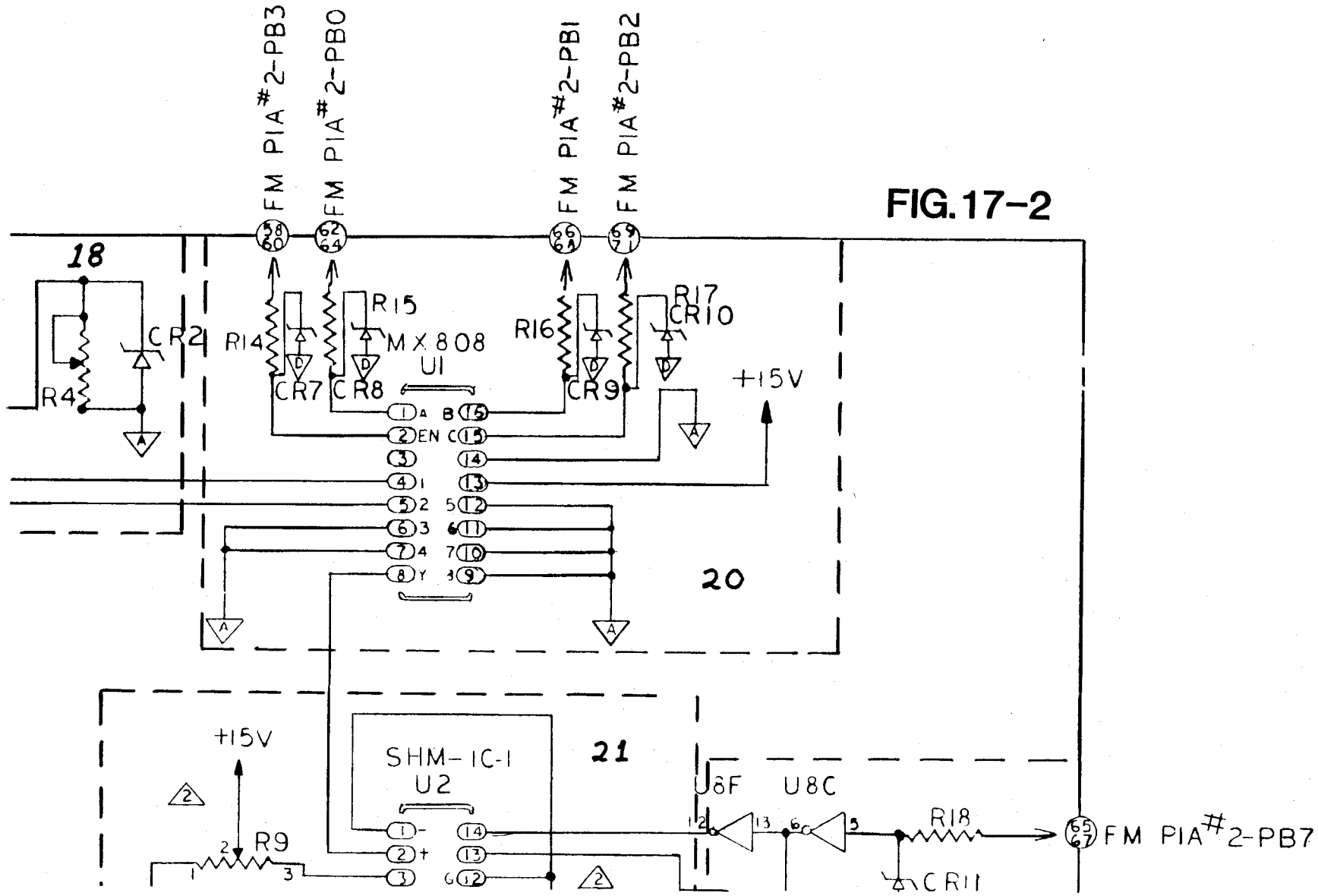
Figures 3, 17:
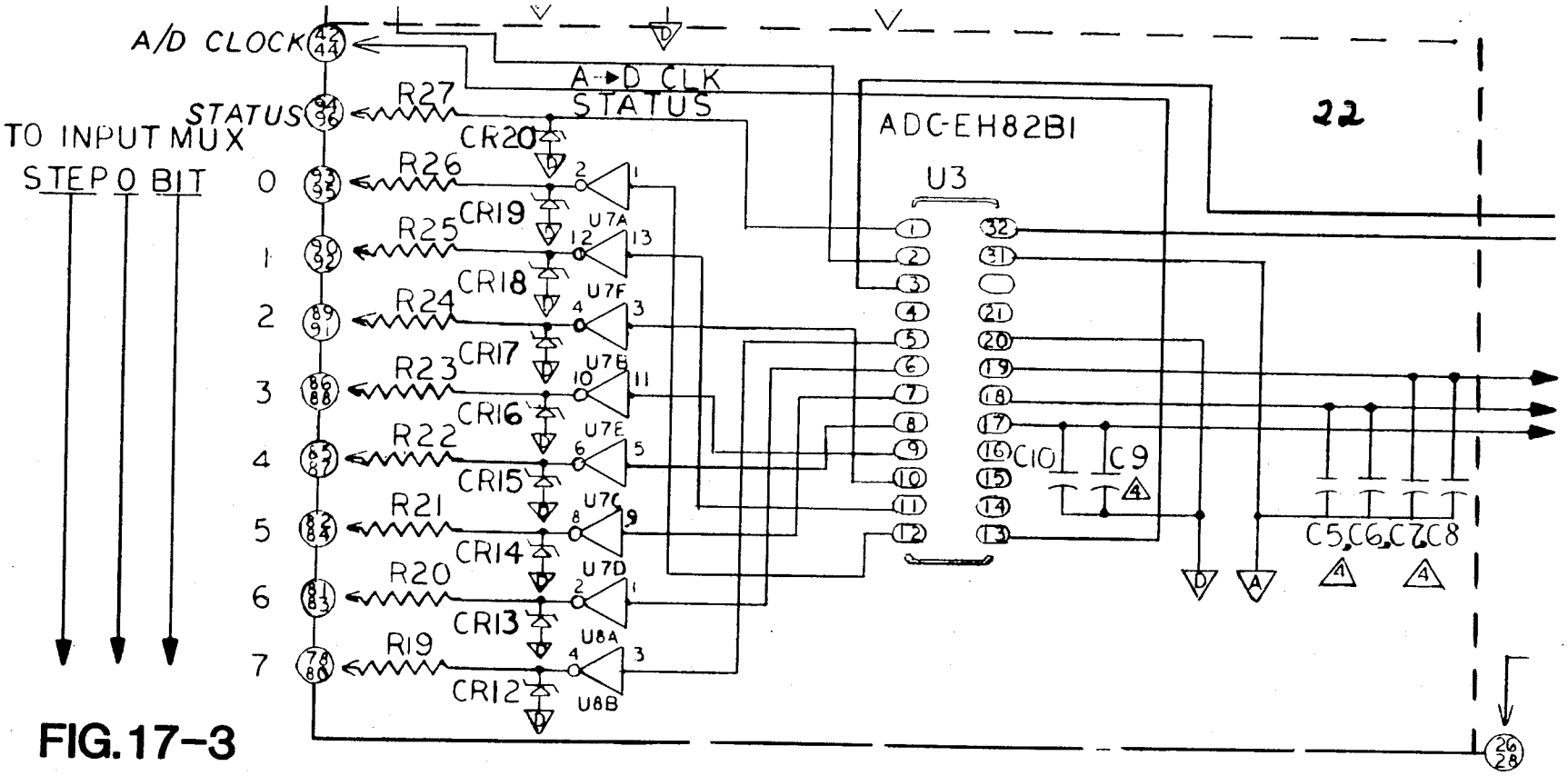
Figures 4, 17:
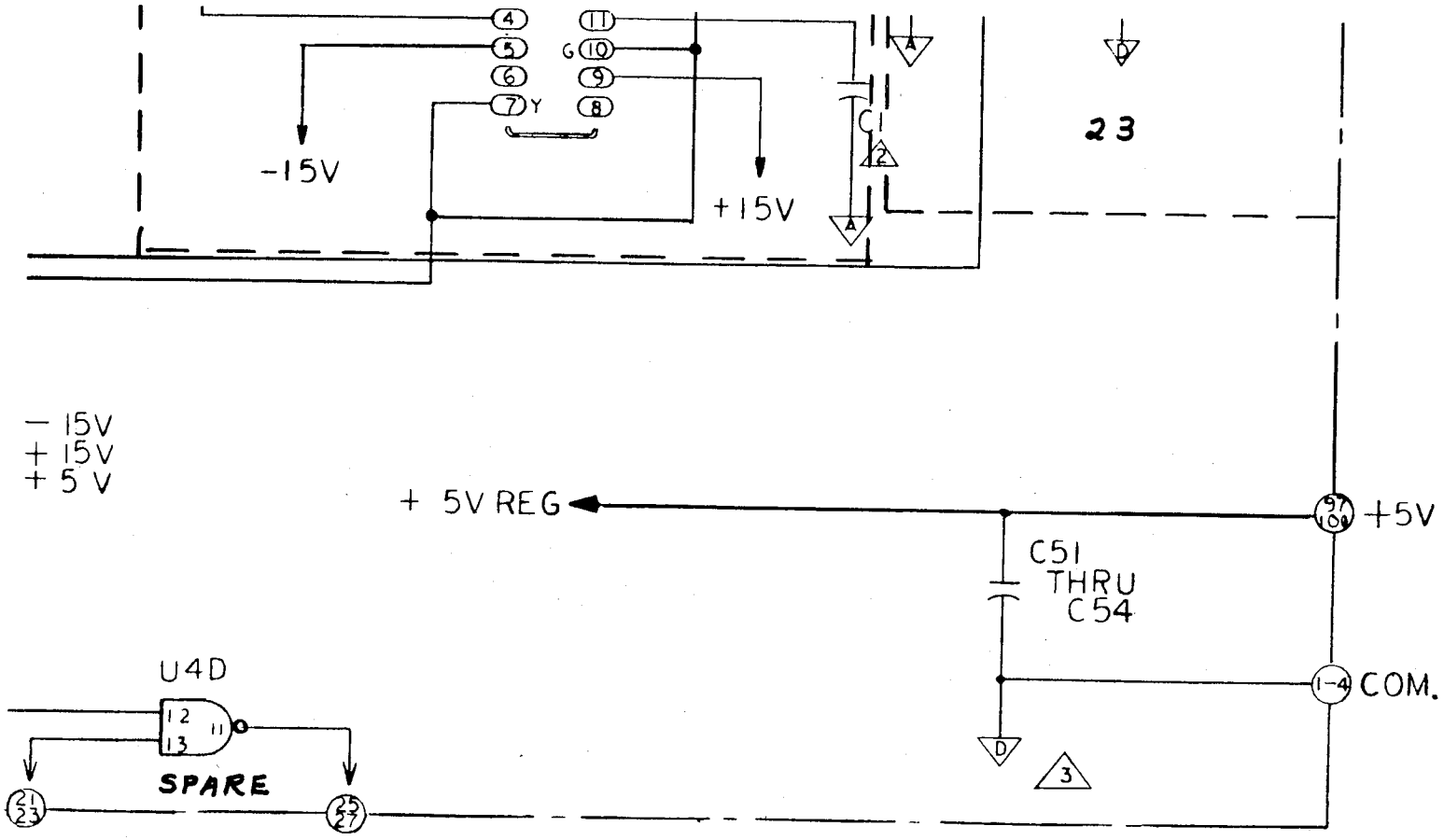
Figures 1, 18:
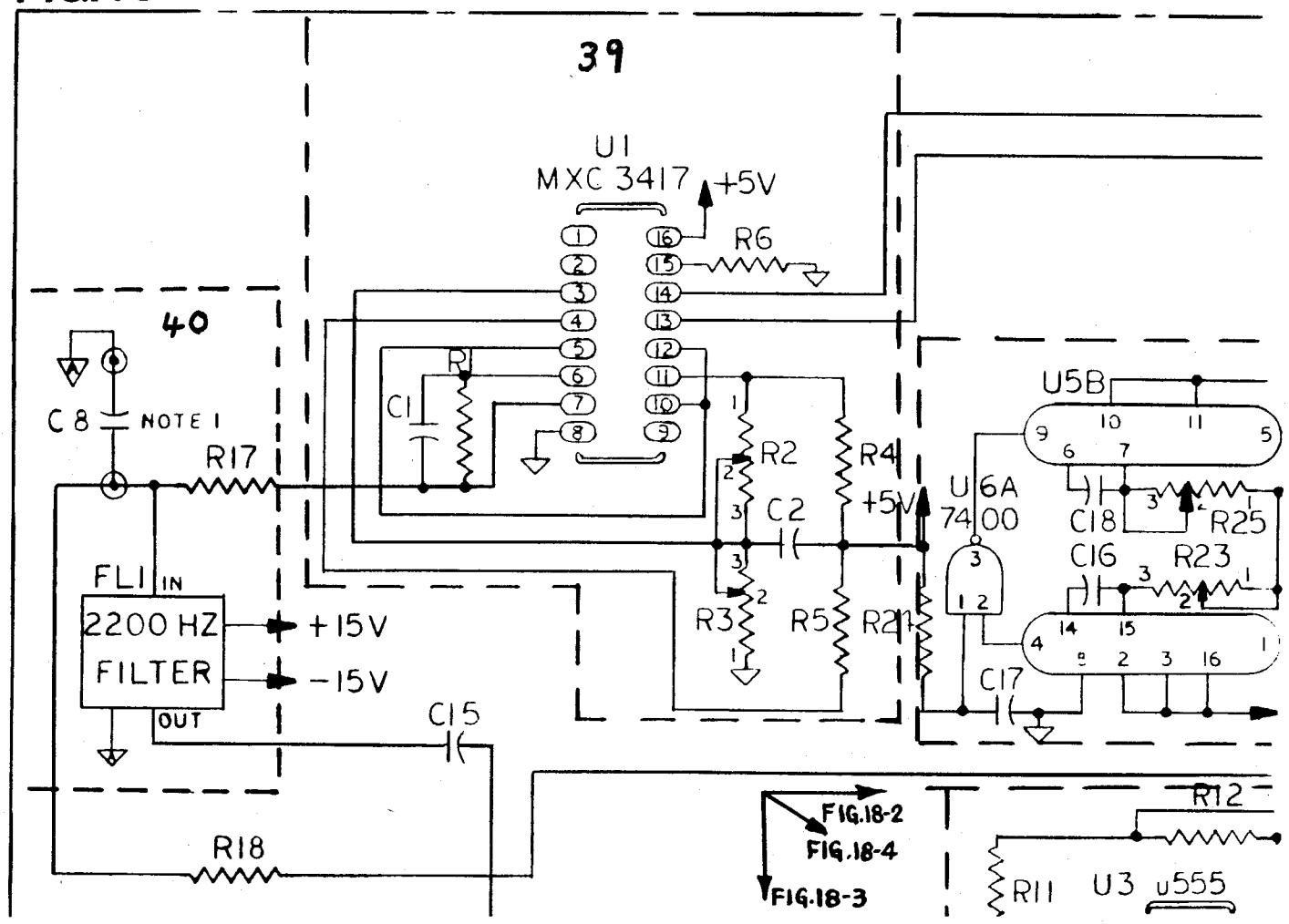
Figures 2, 18:
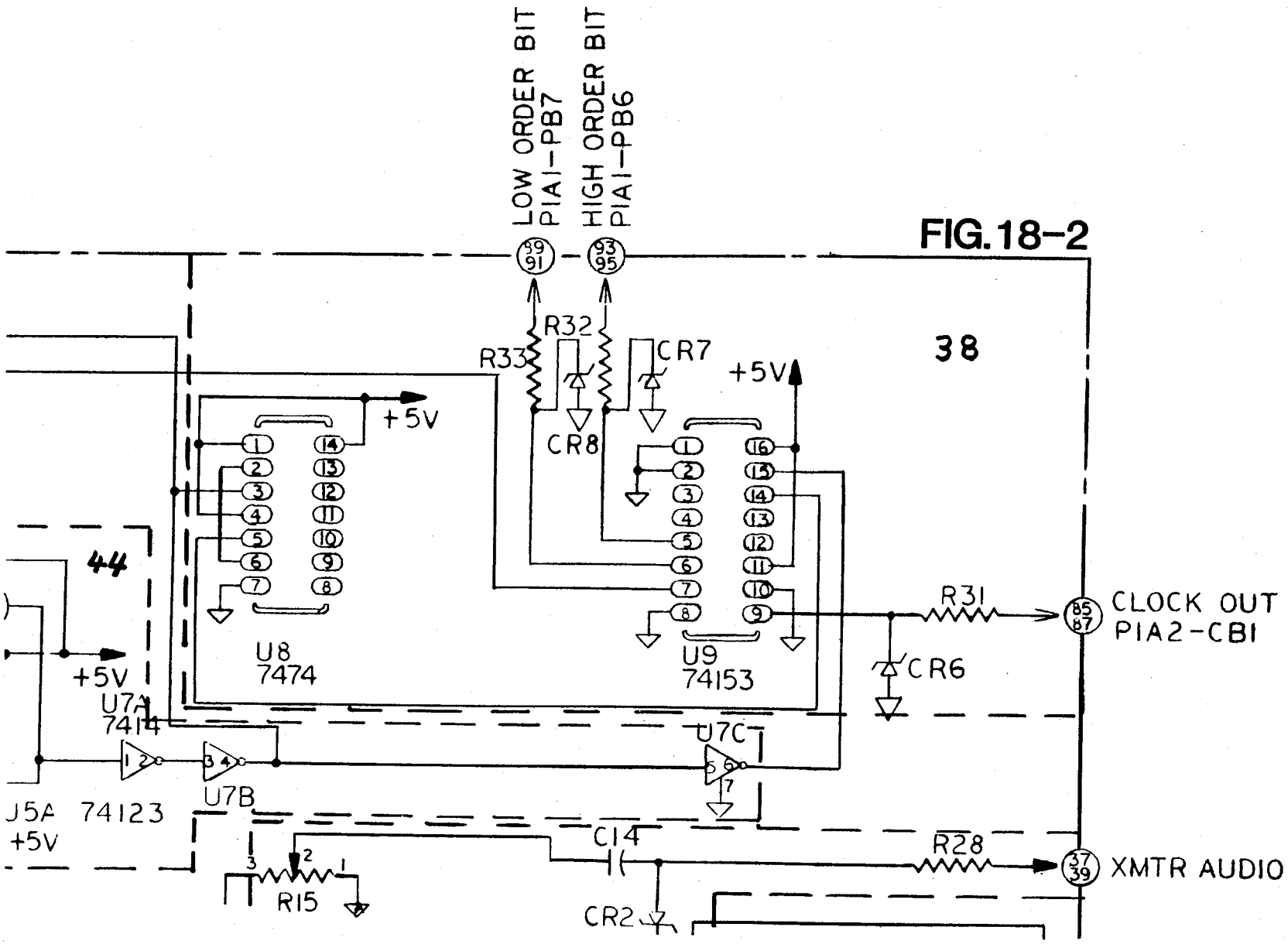
Figures 3, 18:
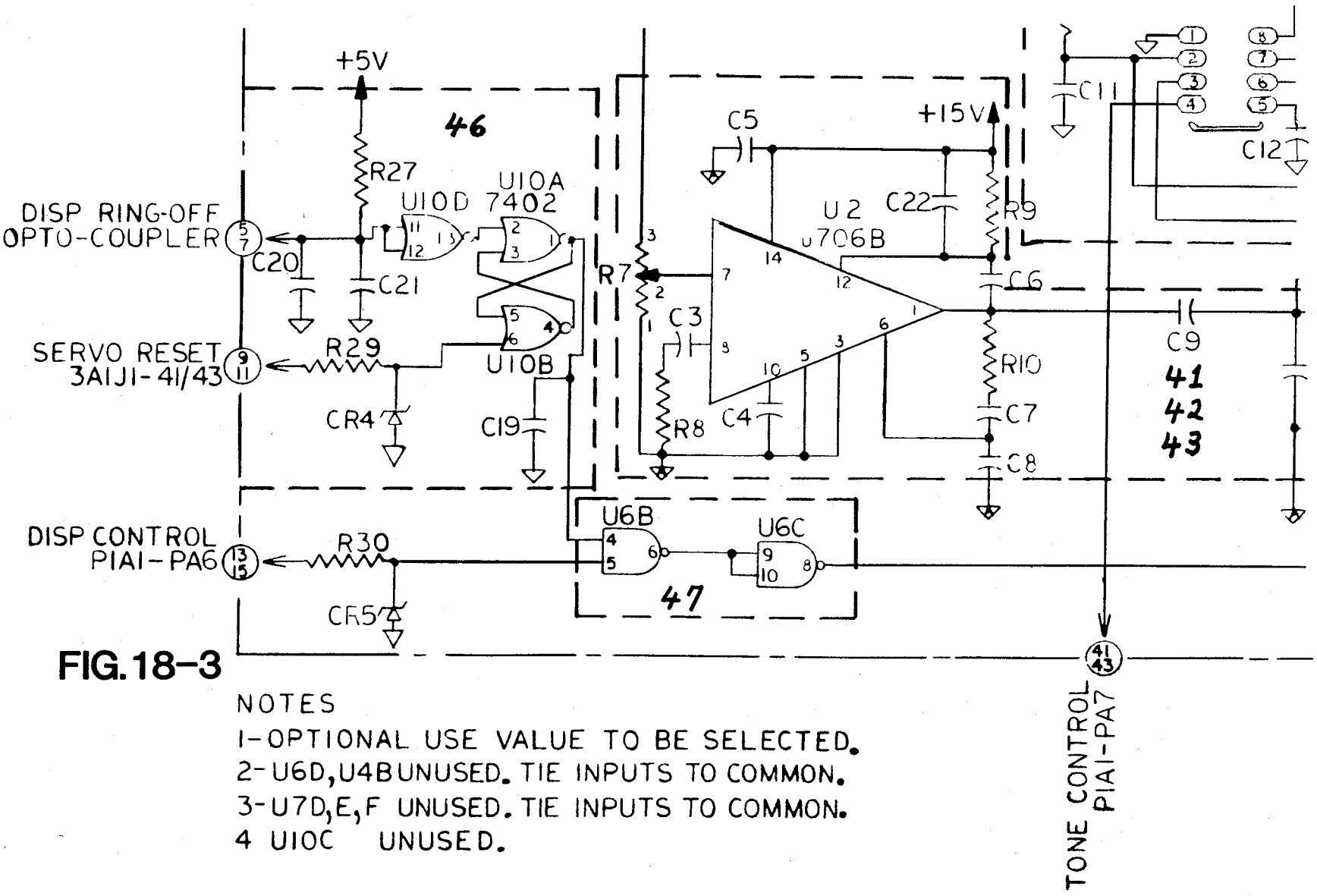
Figures 4, 18:
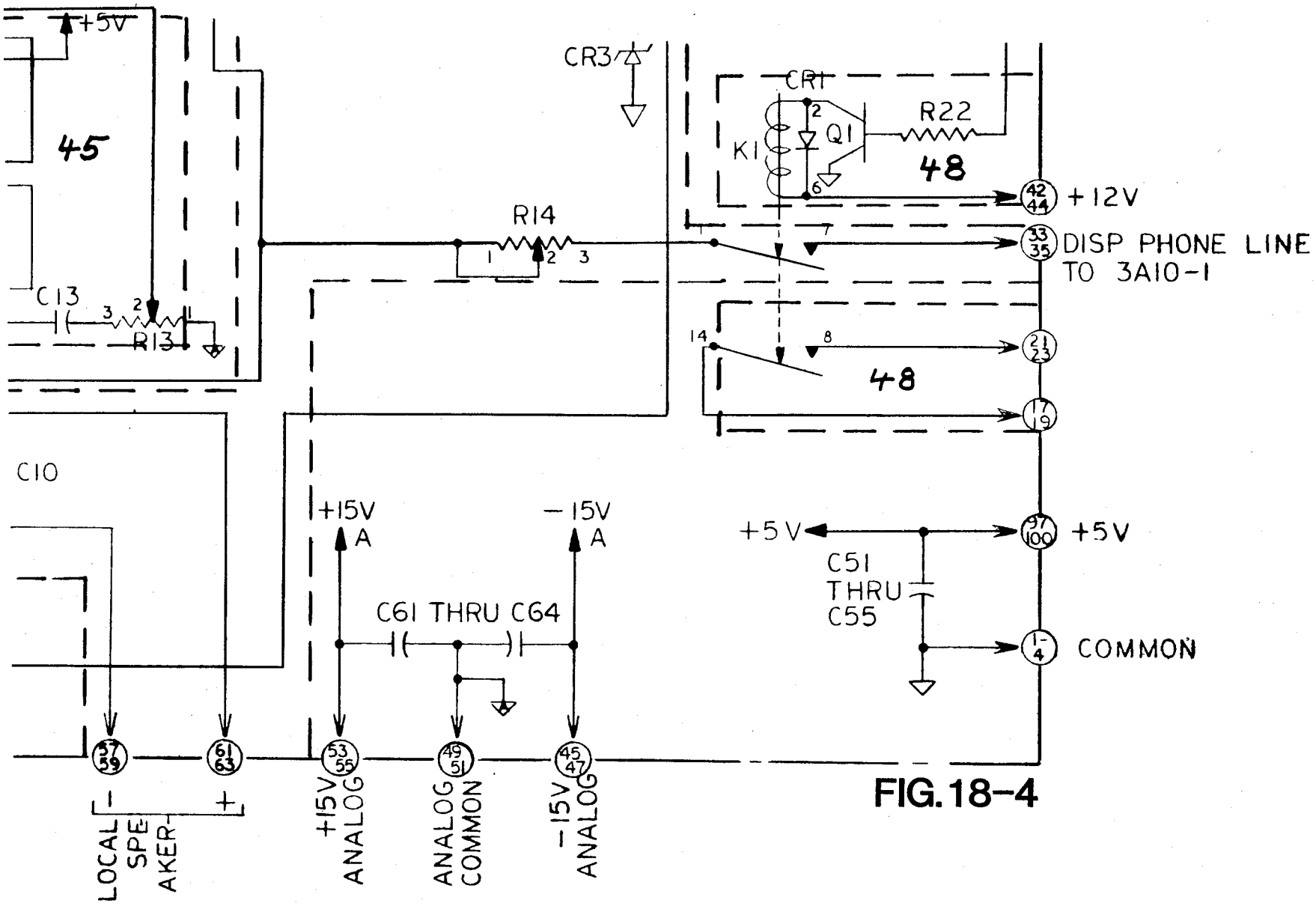

The heat processing technique employed will be discussed in detail hereinbelow. As the wheel leaves the face of transducer A and passes through the optical scanning field of rail 1 infra red heat sensing scanner and rail 2 infra red heat sensing scanner, the wheel eventually arrives at transducer B, whose input is fed (in a similar manner as the "wheel count on") to the card edge of printed circuit board 3A2A at pin 17 and 19. The "wheel count off" pulse from the servo system is a minus 12 volt condition and, until anchor wheel of the train passes the face of transducer A, "wheel count gate off" remains in a continuous minus 12 volt input level at pin 17 and 19 of 3A2A printed circuit board (FIG. 17). This minus 12 volt "wheel count gate off" input at 17 and 19 of the card edge fed through optocoupler U6 and Q2 buffer amplifier, causes a cumulative low level to be presented at pin 5 and U4B NAND latch and, correspondingly, since the minus 12 volts has been removed from the wheel count on input at pin 9 and 11 of the card edge, there is a cumulative action that results in a high at pin 1 of U4A NAND latch. The resulting output condition of the latch is such that pin 3 of the NAND latch feeding wheel count gate on is now returned to the low state and pin 6 of the U4D NAND latch has returned to the high state. This cumulative action of the wheel passing from the A transducer to the B transducer has essentially caused a single pulse gate to appear at pin 5 and 7 of the 3A2A printed circuit board, with a complementary output of the same pulse occurring at pin 6 and 8 of the 3A2A printed circuit board. This single gate pulse has now been counted by the processor as one wheel or one axle having passed through the field of vision of scanning of the scanner. A counting action will occur through the entire train such that all axles are counted as a result of passing the A and B transducers. Therefore, a total axle count of the train will be kept and annunciated and, as a result of any defect or overheated axle bearing being detected by the processor system, a count of axles from the rear of the train will be determined and annunciated to the train crew by VHF radio, including the axle number at which the overheated axle bearing has occurred with the axial count being given from the rear of the train. Also, as the wheel has passed from the surface of the A transducer to the surface of the B transducer, the finite transit time from A to B has been measured by the computer processor and the distance from the A to the B transducer being known (28 inches) this is used in an algorithm to determined the actual speed of the train as it passes the A and B transducers. The processor has a length of train algorithm utilized in calculating the length of the train passing the site and it is given in feet at the printout. The algorithm uses the principle that the time between wheels arriving at the A transducer at a known speed, which has been calculated, is used to calculate the distance between wheels and is summed over the entire length of the train to result in a total length being printed at the computer printout in feet.

Now, let us examine in some detail the action that occurs in order to collect the heat while a given wheel is passing from transducer A to transducer B and the circuitry involved in heat processing in those components inscribed in blocks 18, 19, 20, 21, 22, and 23. Looking at block 18 of FIG. 17, the heat processed by the servo system infra red heat sensing scanner and pulse processing amplifiers for rail 1 side is input to the 3A2A printed circuit board at terminals 41 and 43. Components R3 and R4 are used to scale a maximum 80 volt signal to a maximum 10 volt signal level compatible with the logic system. The scaled down heat level at the junction of R3 and R4 is fed to pin 4 of U1 which is an 8 channel analog multiplexer inscribed in block 20. Looking again at block 19 at the card edge pin 37 and 39, rail 2 heat is input through its scaling components R1, R2 and the junction of R1, R2 is then fed to pin 5 of U1, the 8 channel multiplexer inscribed in block 20. Six other spare channels on this 8 channel analog multiplexer are not used and are for future use. They are tied to analog common ground at this time. The eight channel multiplexer positioning is controlled by a 3 line binary coded control which are pins 1, 15 and 16 of U1 and pin 2 is an enable pin that receives its input from the computer processor board itself. These pins 1, 2, 15, and 16, enable the 8 channel multiplexer and position it to the proper channel at the proper time for sampling heat. For example, as the wheel is passing the surface of the A transducer and the interrupt has occurred and the heat processing routine has been called, the multiplexer will be set up to sample channel 1 for heat such that the output from the computer processor board at 3A2A card edge pins 58–60, 62–64, 66–68 and 69–71 now have the proper states to position the multiplexer such that it is sampling the input heat from rail 1 which is fed into the multiplexer on pin 4 and will, at this tme, appear at its output pin 8. This output is fed to the sample and hold circuit in the inscribed block 21 (FIG. 17). The control for the sample and hold circuitry in block 21 is controlled by the circuitry in block 23 which controls the sample and hold of the heat information as well as a command to the analog to digital converter inscribed in block 22 to convert the information to an 8 bit digital word for use by the processor. Now, as the heat sample has progressed through the 8 channel multiplexer from pin 8 of U1 into the sample and hold circuit U2, pin 2 the processor at card edge pin 65 and 67 has output a digital high command signal which is now fed to pin 14 of the sample and hold circuitry and the sample that is being taken is used to charge the hold capacitor C1 which is fed from pin 11 of U2 sample and hold device. Capacitor C1 is charged during the sample time and, at the end of the sample time, the computer processor will then feed a low level condition at pin 65 and 67 which will then cause the sample and hold circuit to hold the charge that has been stored on capacitor C1. That charge stored on capacitor C1 is fed from the output pin of the sample and hold circuit U2 on pin 7 to the input of analog to digital converter U3 which is inscribed in block 22. Simultaneous to the command to hold the charge stored on capacitor C1, the conversion command which comes from U8C, pin 6 in block 23, is now fed over to pin 3 of U3 of the A to D converter in block 22, beginning the digitization process and, at the end of its conversion cycle, the digital output word is present at pins 93–95, 90–92, 89–91, 86–88, 87–87, 82–84, 81–83 and 78–80 of the card edge of the 3A2A printed circuit board. This digital representation of the instantaneous sample of heat just taken is now fed to 1A3 digital multiplexer board (FIGS. 5 to 7) in the microprocessor system, the operation of which will be examined.

After approximately 8 microseconds have elapsed since the beginning of the sampling of the first heat sample from rail 1 side, the 8 channel multiplexer will be set up on command from the computer processor to position itself to rail 2 side and a sample of heat from rail 2 is taken in a similar manner as just previously described for rail 1. Therefore, alternate samples are taken from side 1 and side 2 during the entire transit time of the journal from the face of the A transducer until it arrives at the face of the B transducer. A "wheel count gate off" will terminate heat processing. The 8 bit word output from the A to D converter is in a standard straight binary format. The transit time from the A to B transducer for a train moving at a rate of 100 miles per hour has been calculated to be about 15.9 milliseconds. In 15.9 milliseconds the processor will have taken a minimum of 290 samples of heat from the journal passing the fild of vision of the scanners. Likewise, as the speed of the train decreases, the number of samples taken increases. The number of samples take is therefore inversely proportional to the speed of the train passing the A and B transducers. This concludes the discussion of the input circuitry.

Before discussing in detail the processor system itself, the output interface circuitry will be discussed to see what actions are involved in the output of the processor system in performing its job.

Figures 1, 2, 3:
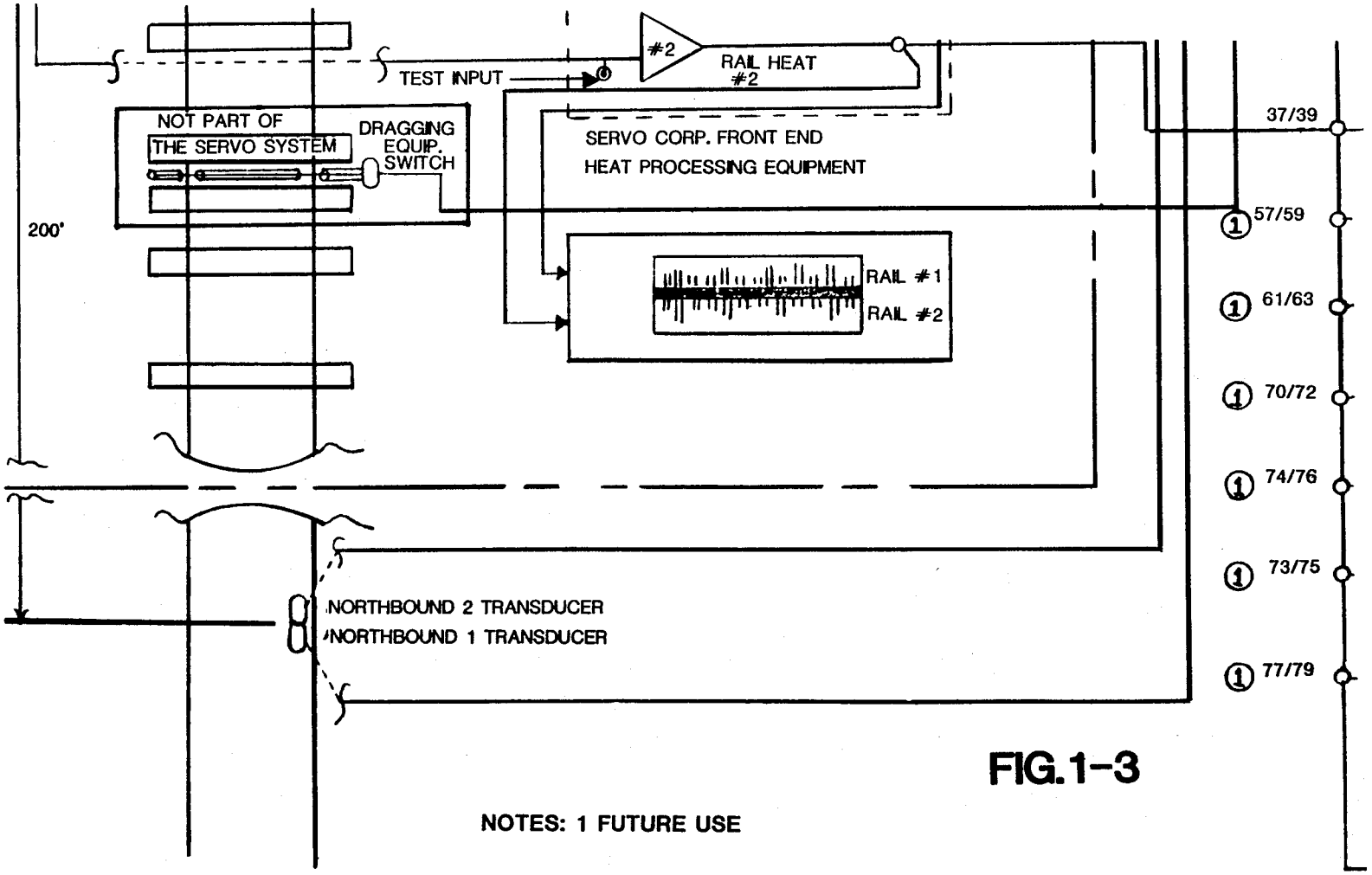
Figures 1, 2, 3, 4:
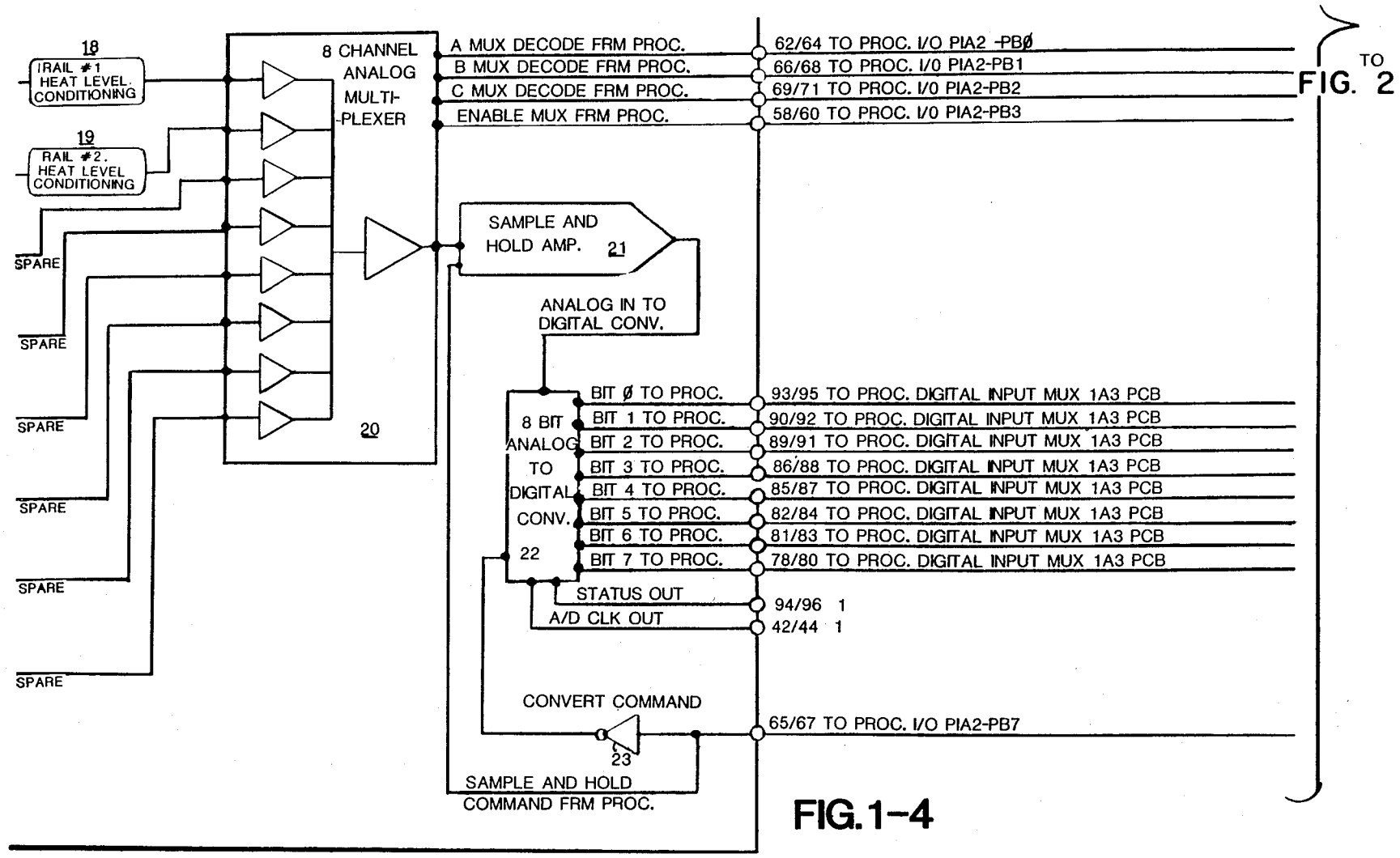
Figures 1, 2:
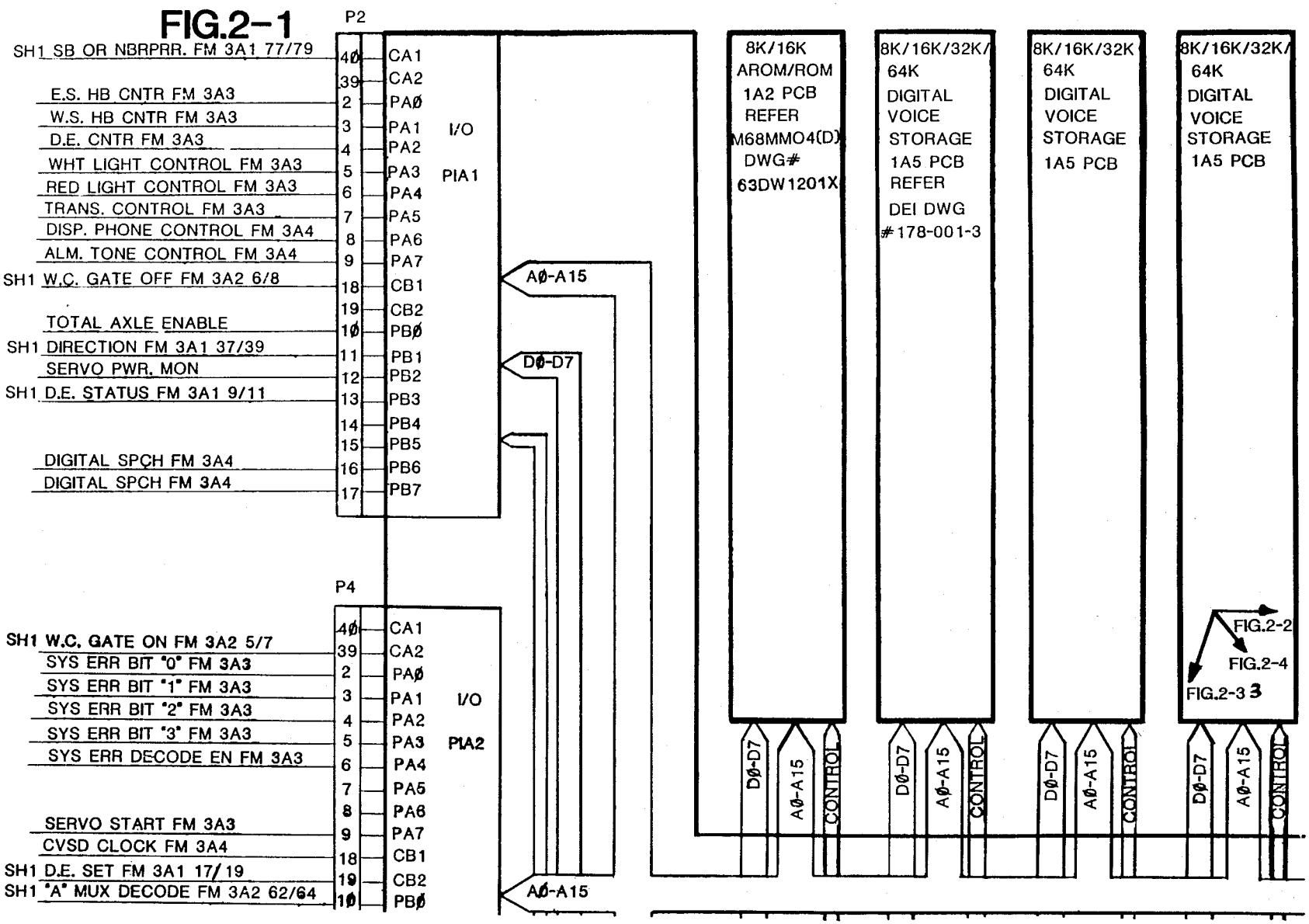
Figure 2:
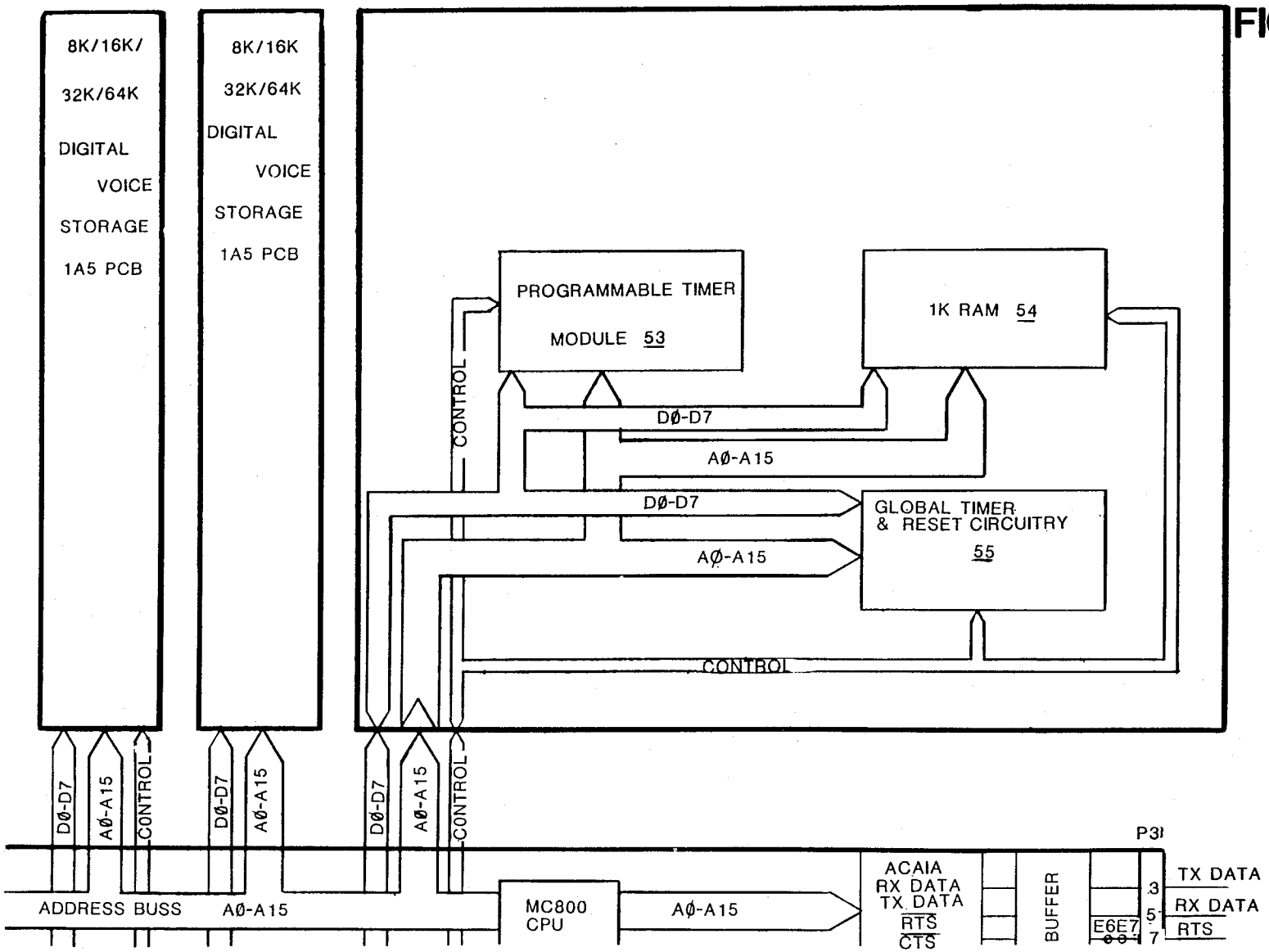
Figures 2, 3:
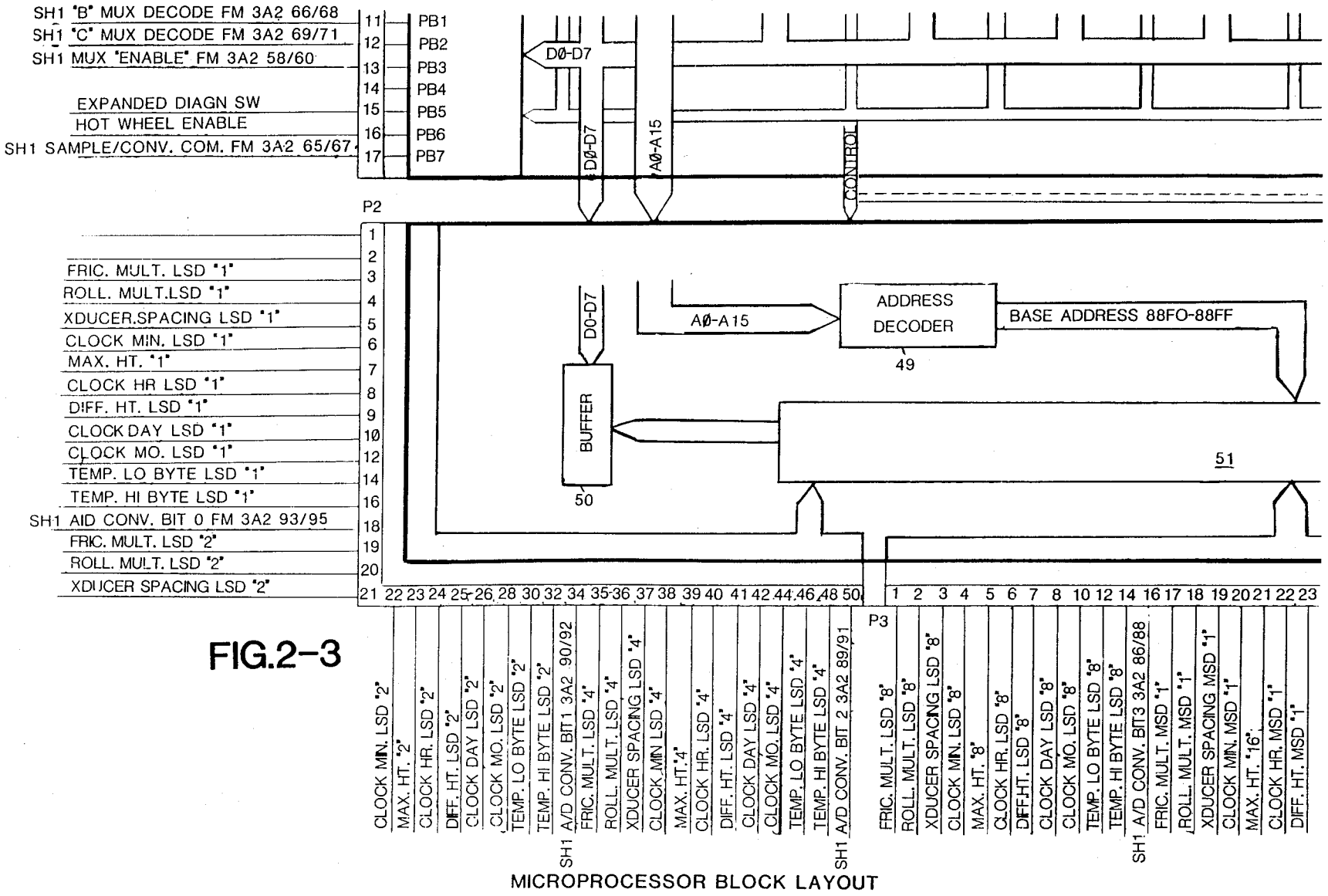
Figures 2, 3, 4:
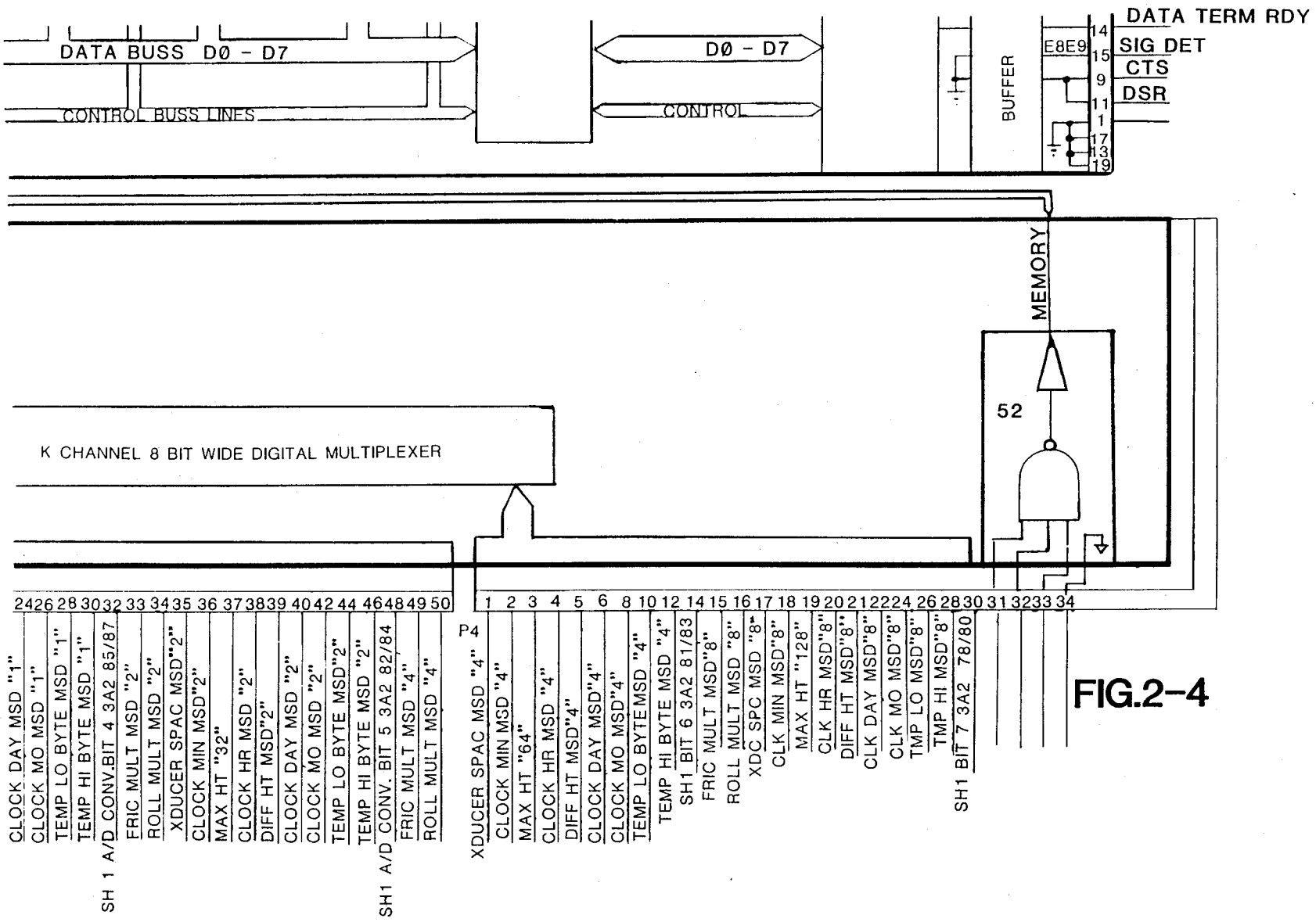
Figures 2, 3:
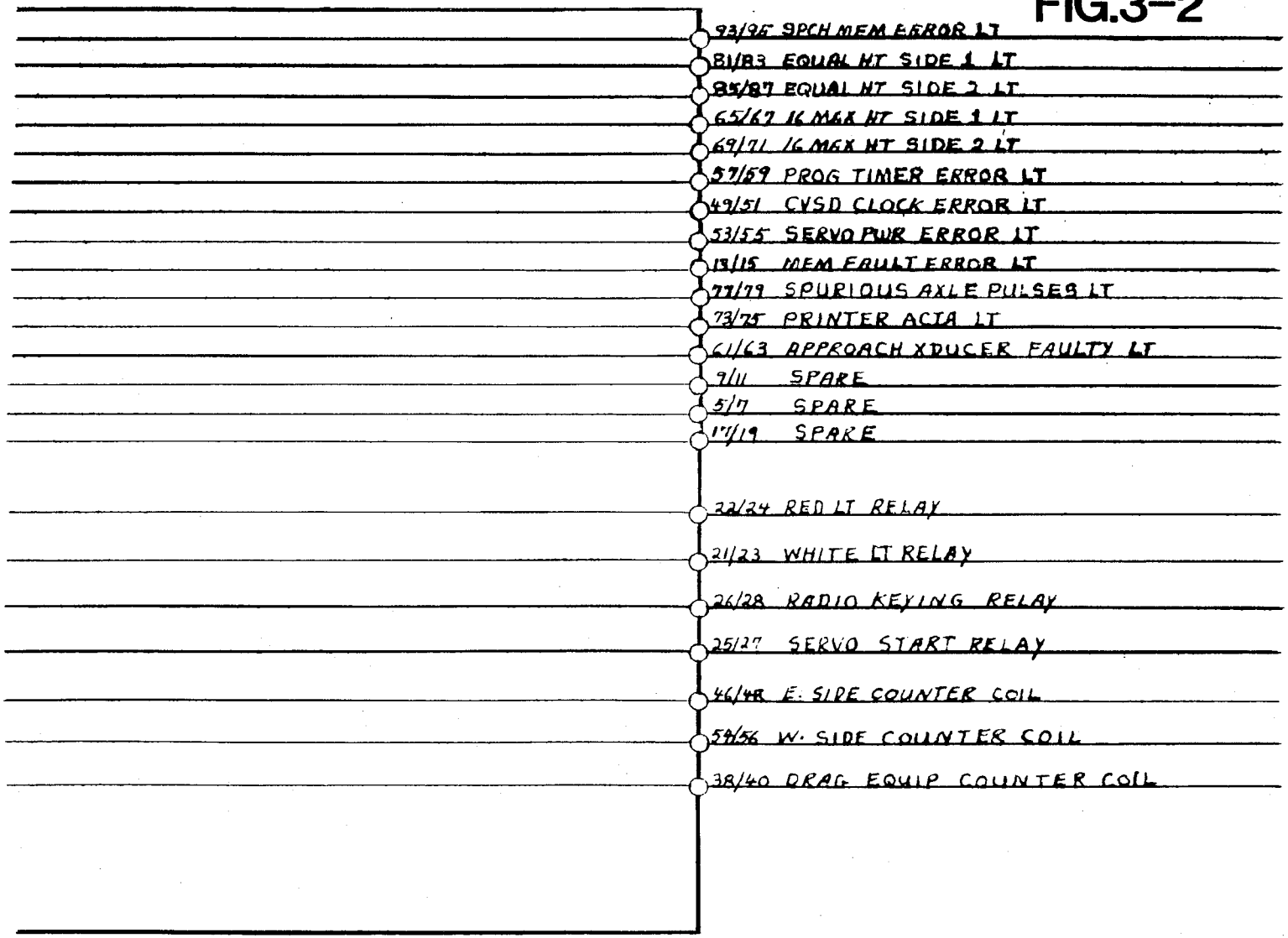
Figure 3:
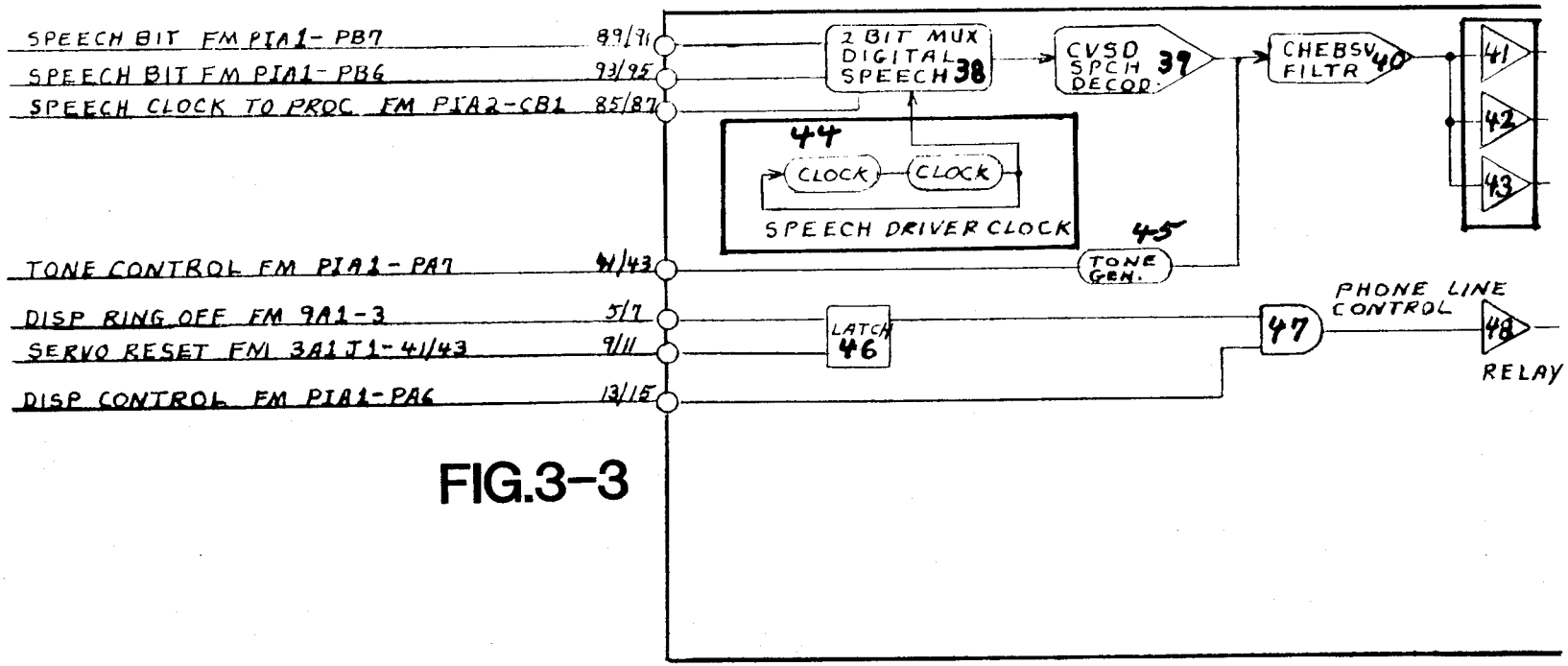
Figures 3, 4:
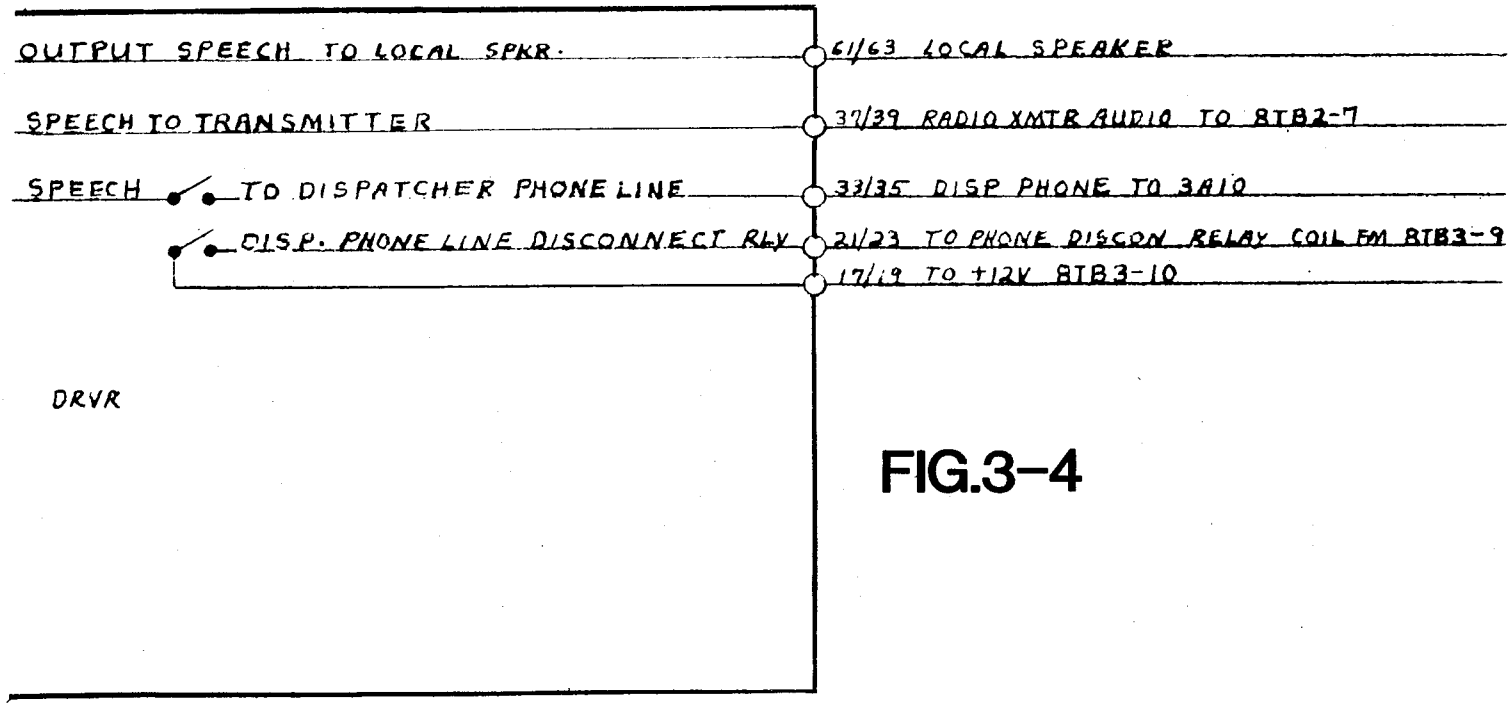
Figures 1, 4:
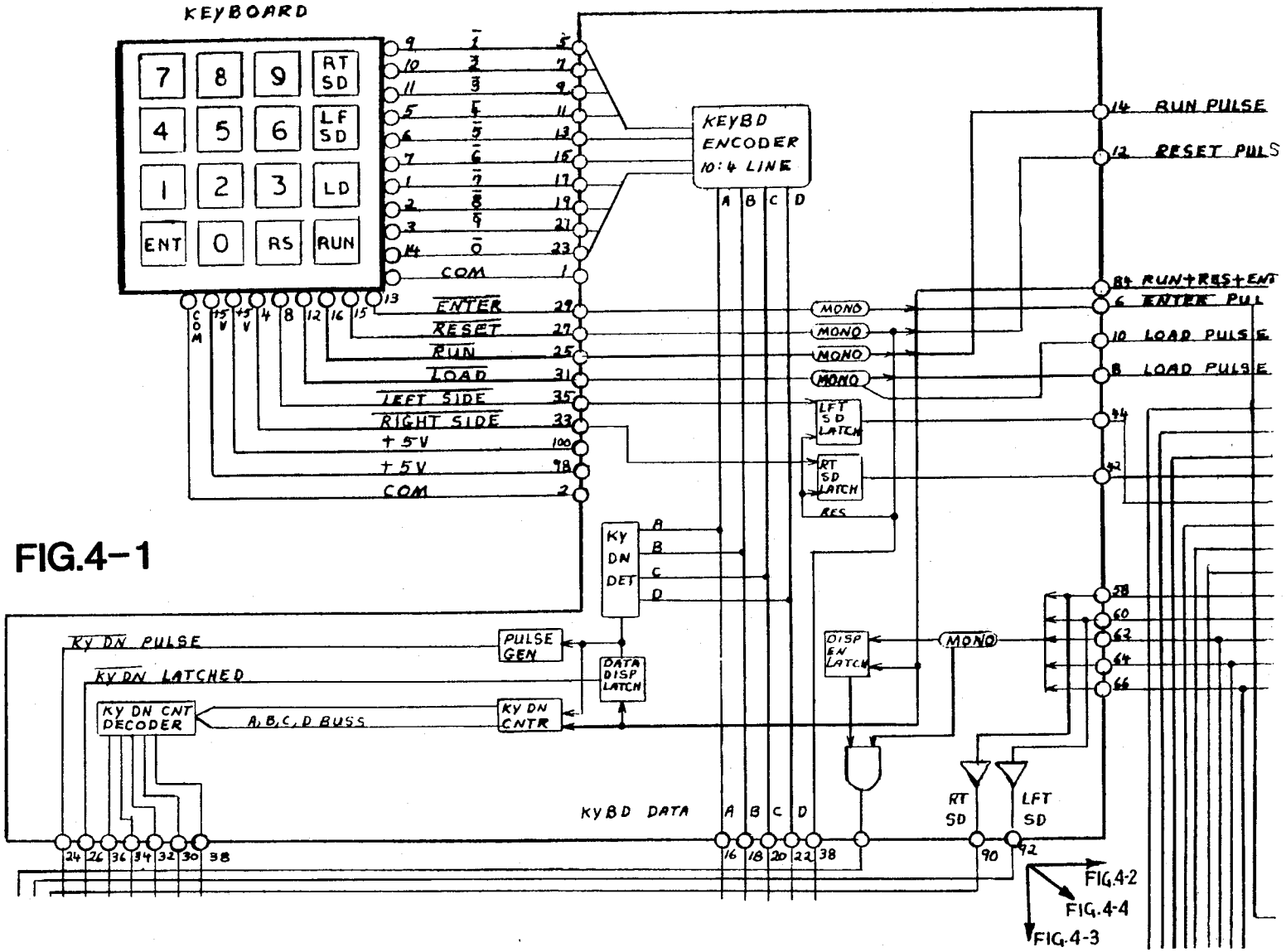
Figures 2, 4:
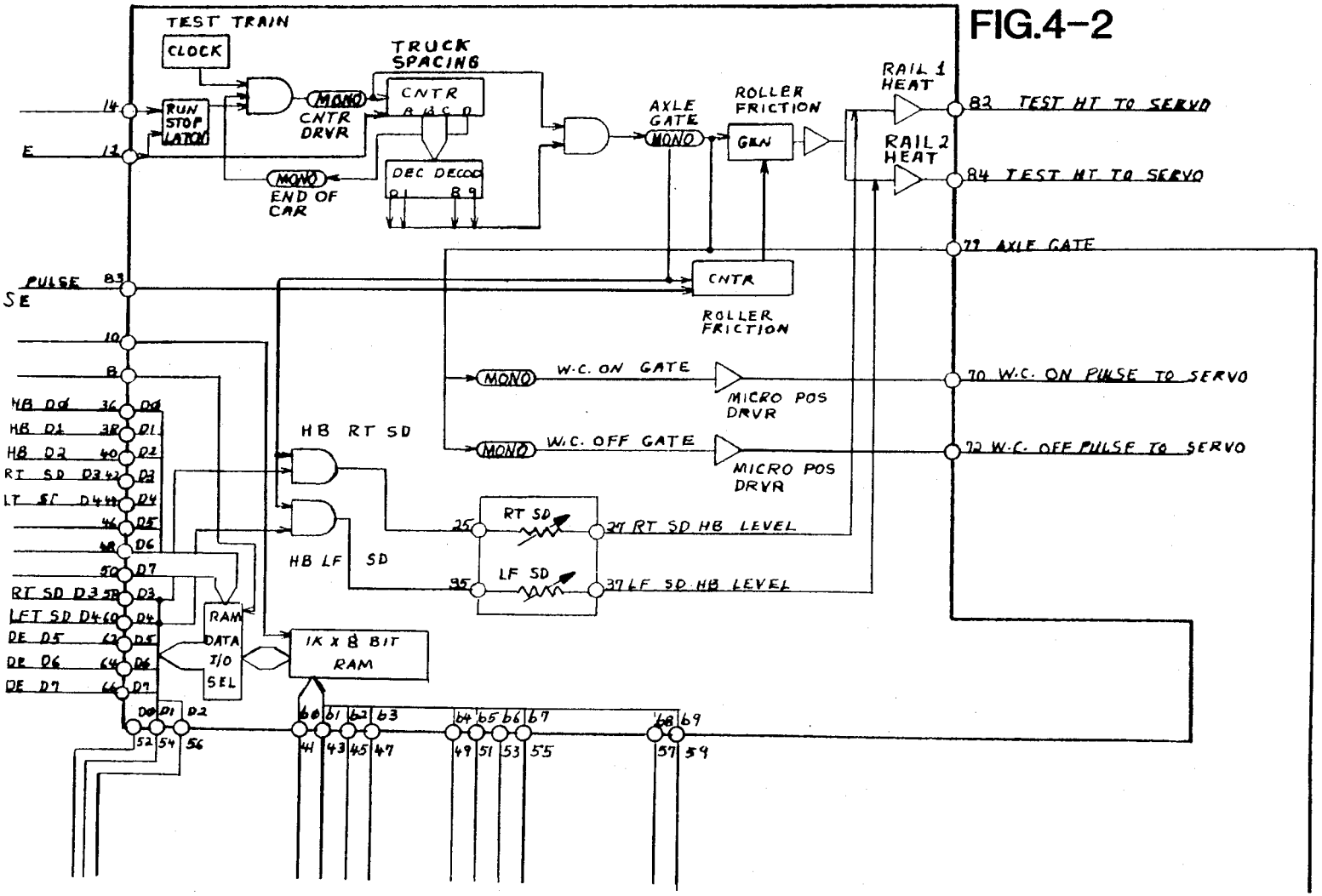
Figures 3, 4:
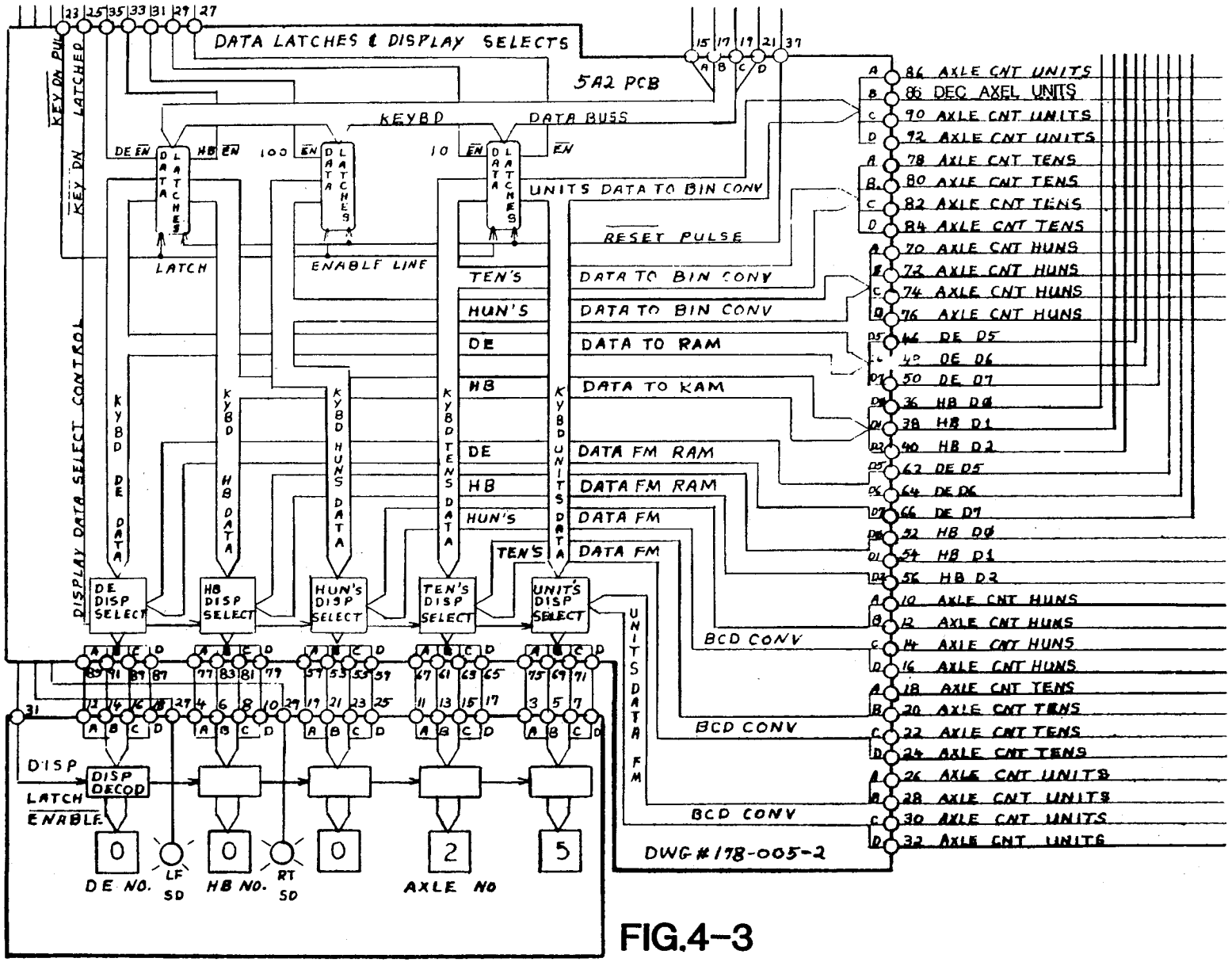
Figure 4:
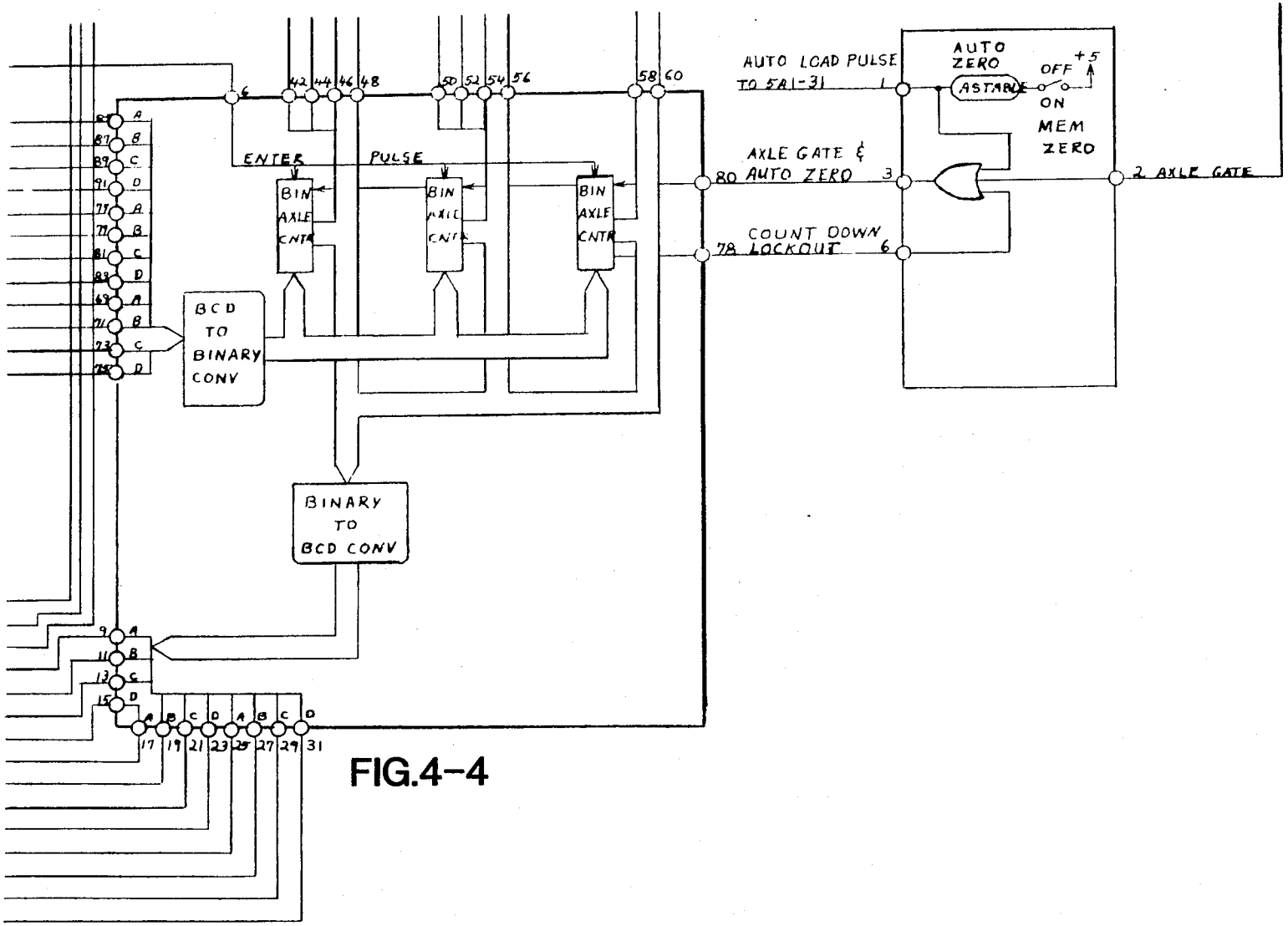
Figures 1, 13:
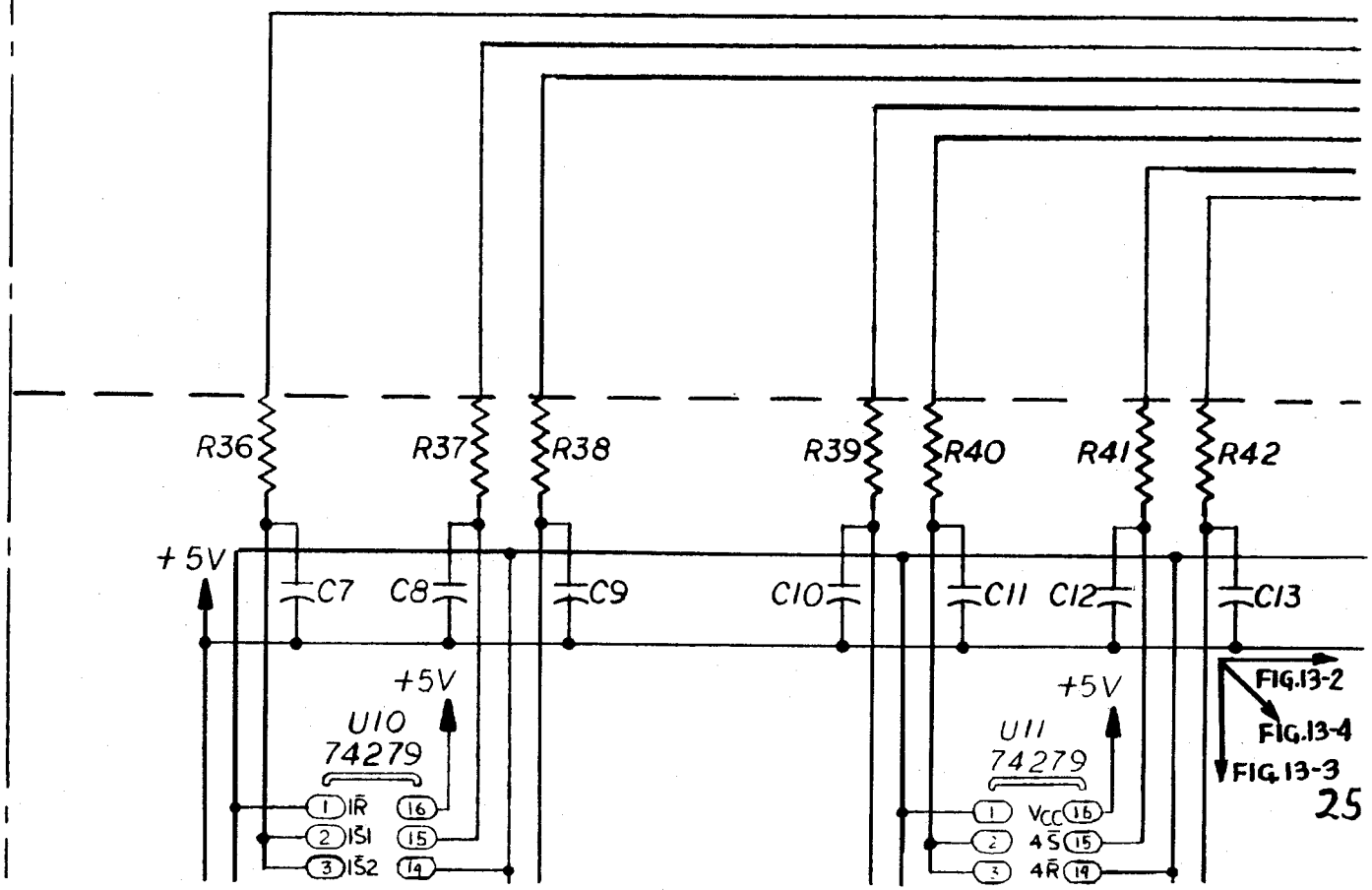
Figures 2, 13:
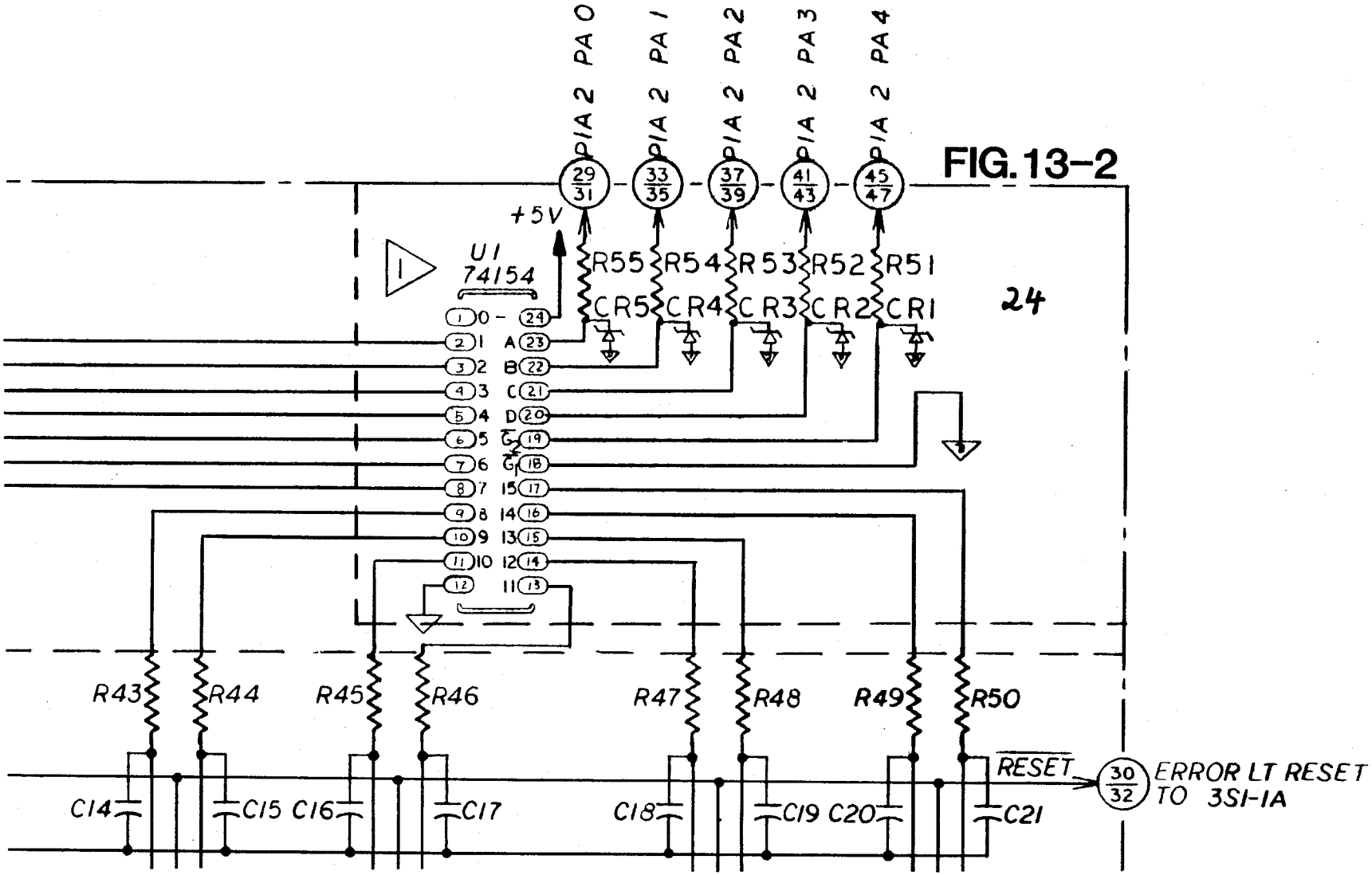
Figures 3, 13:
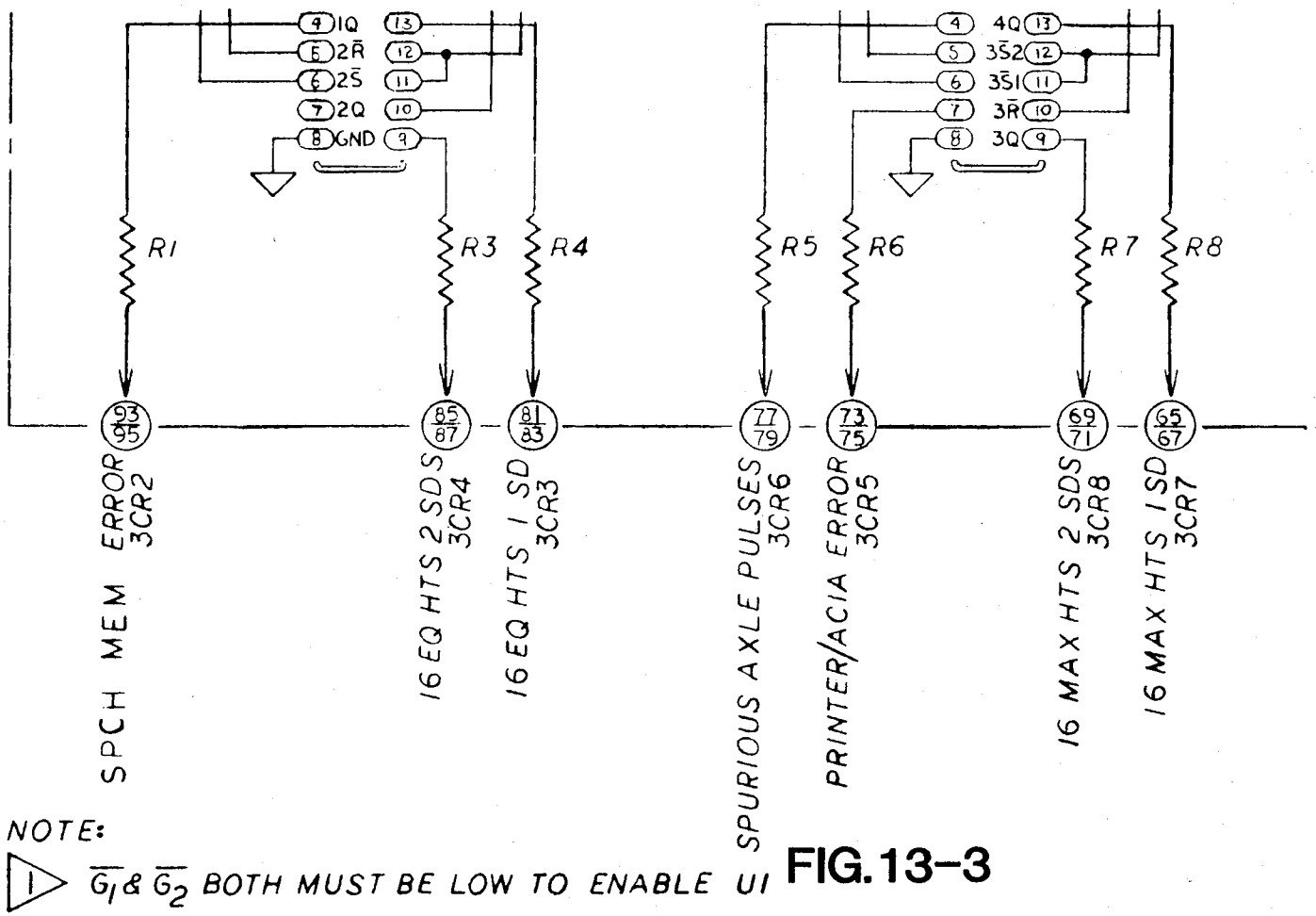
Figures 4, 13:
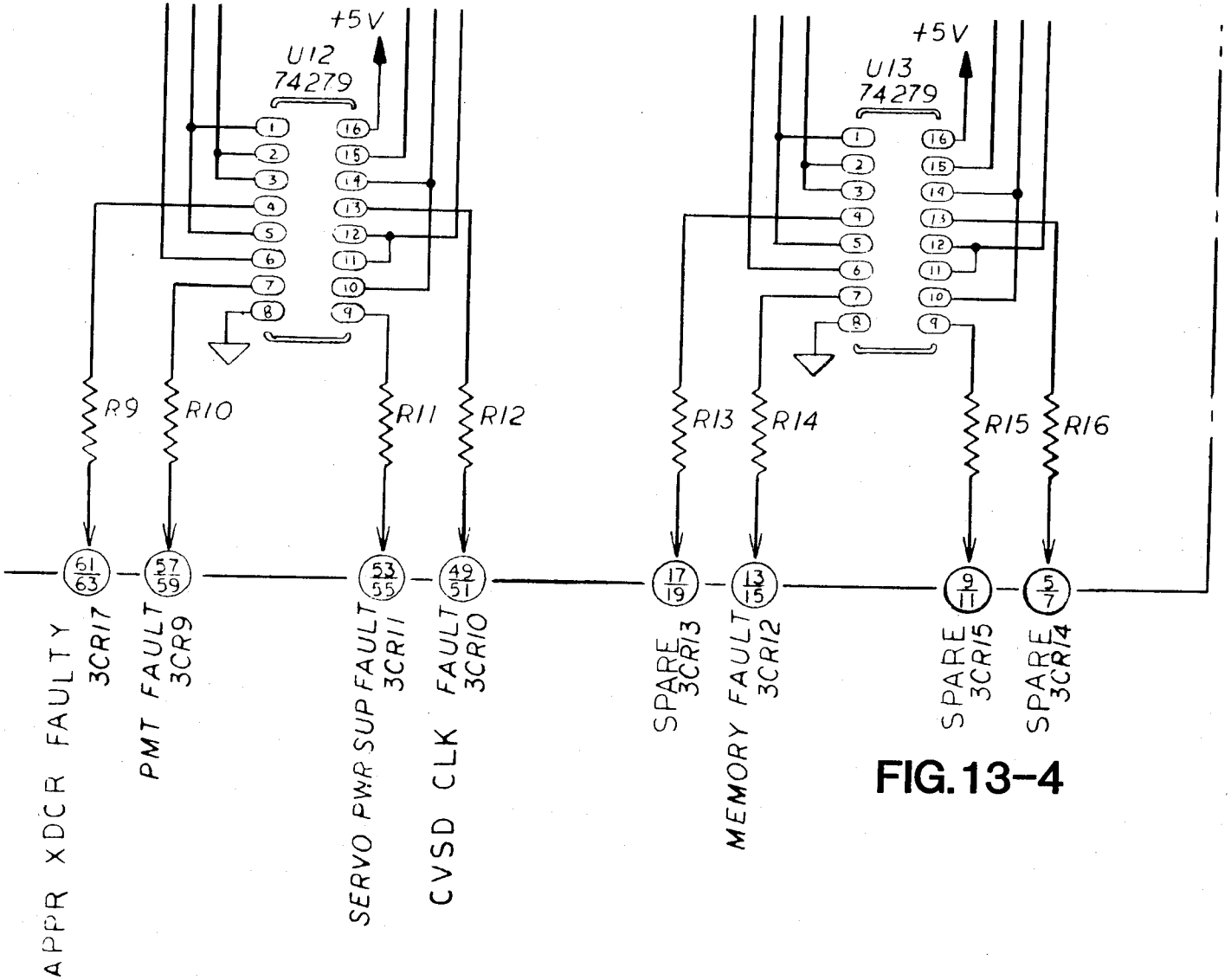
Figures 1, 14:
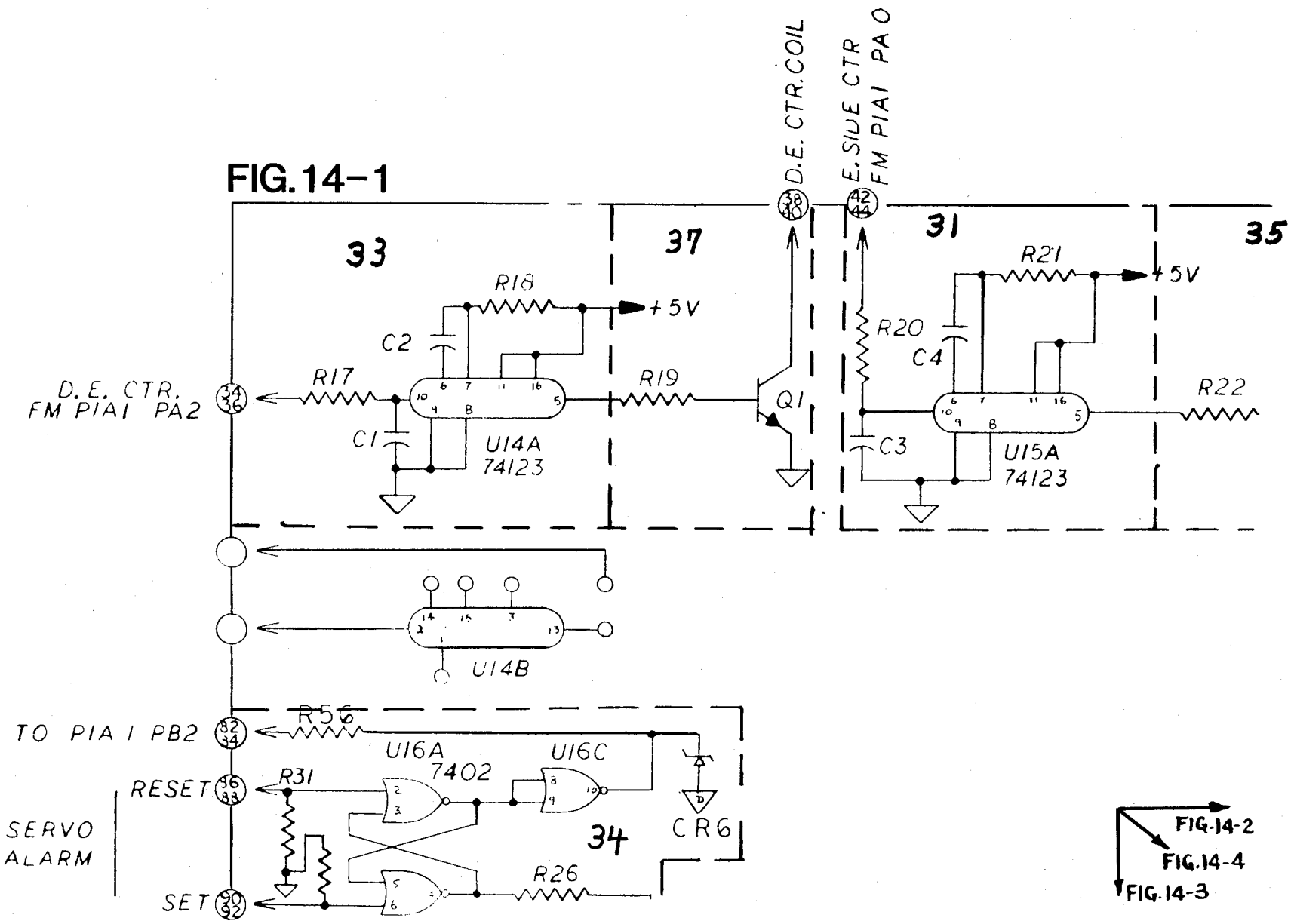
Figures 2, 14:
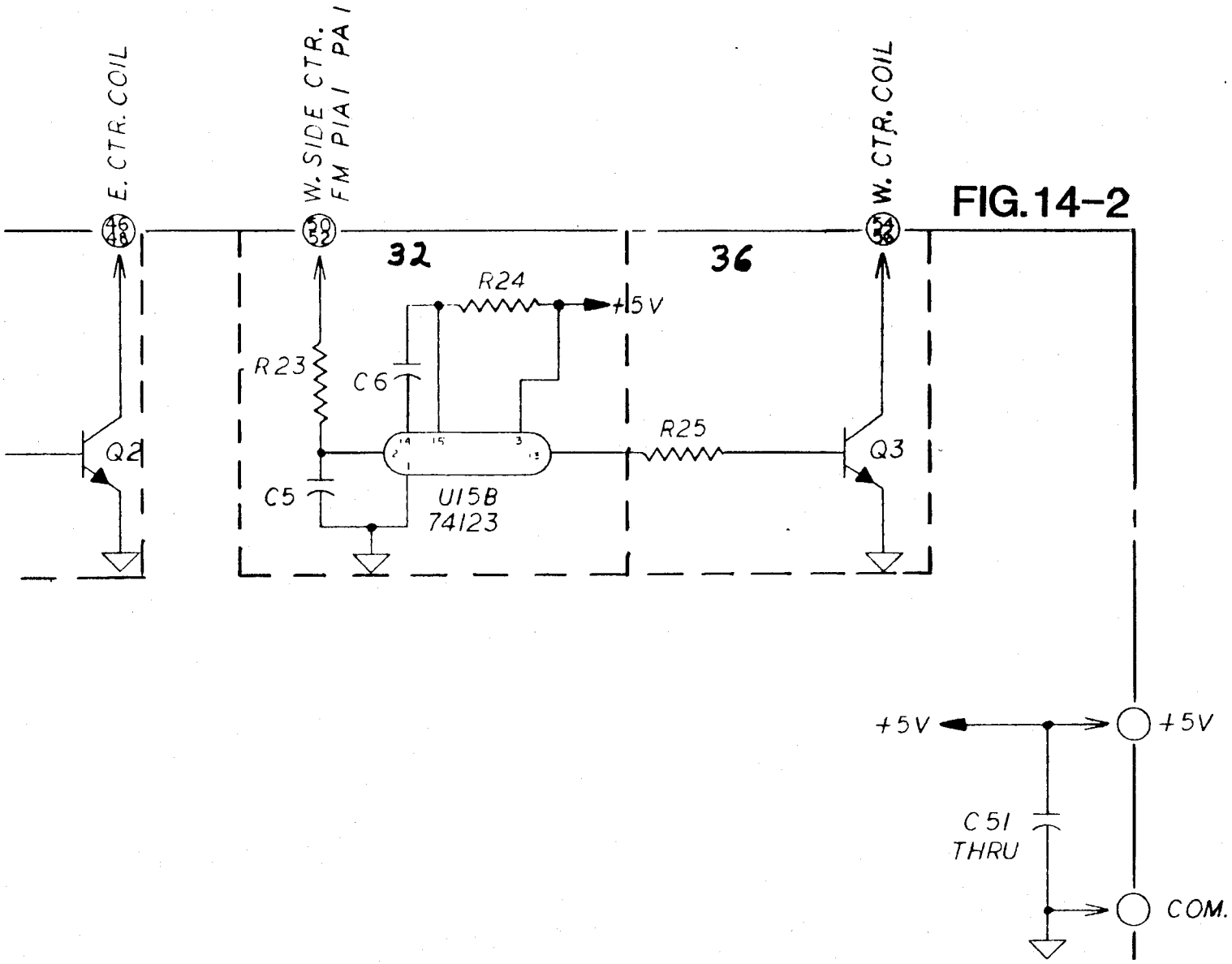
Figures 3, 14:
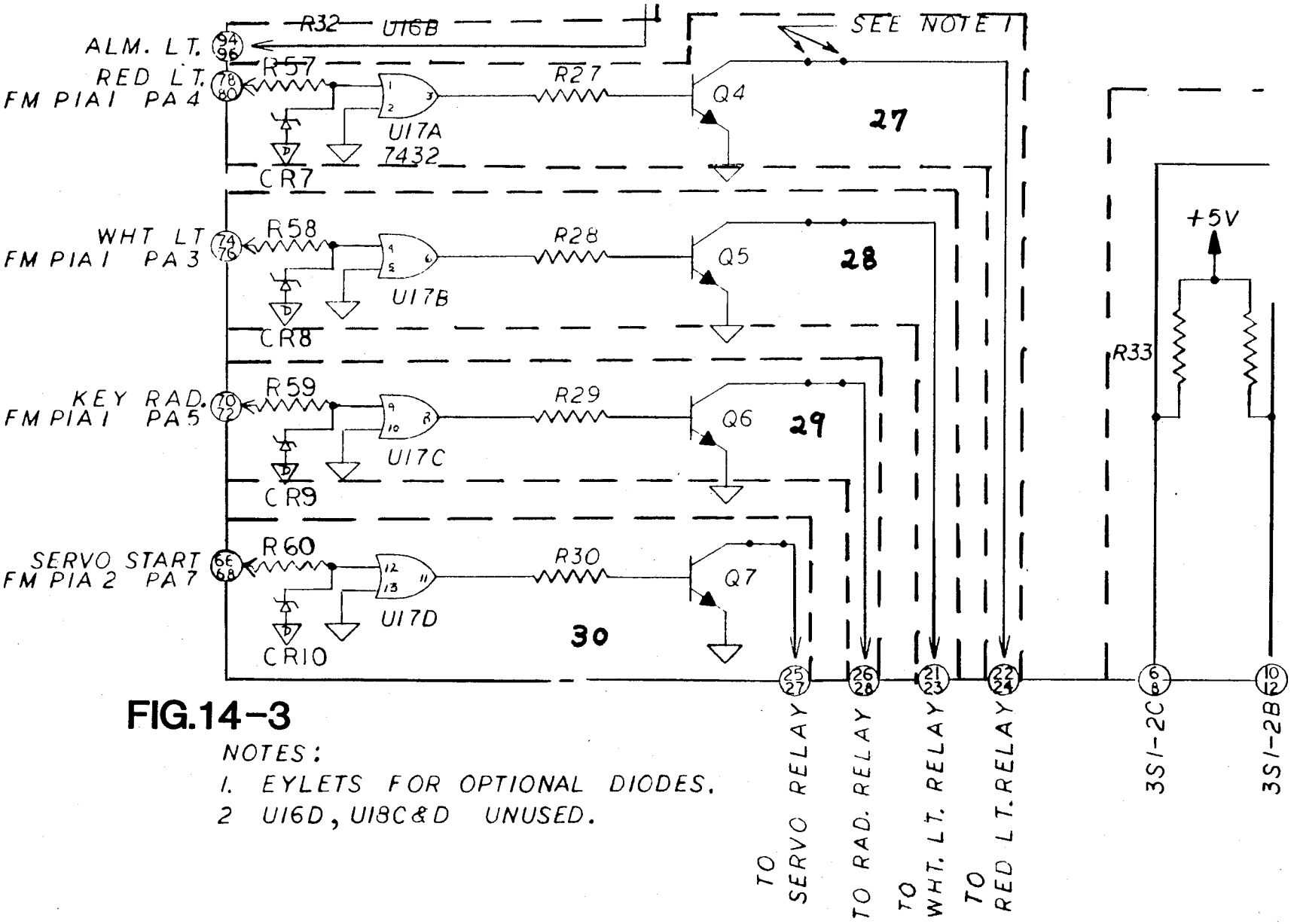
Figures 4, 14:
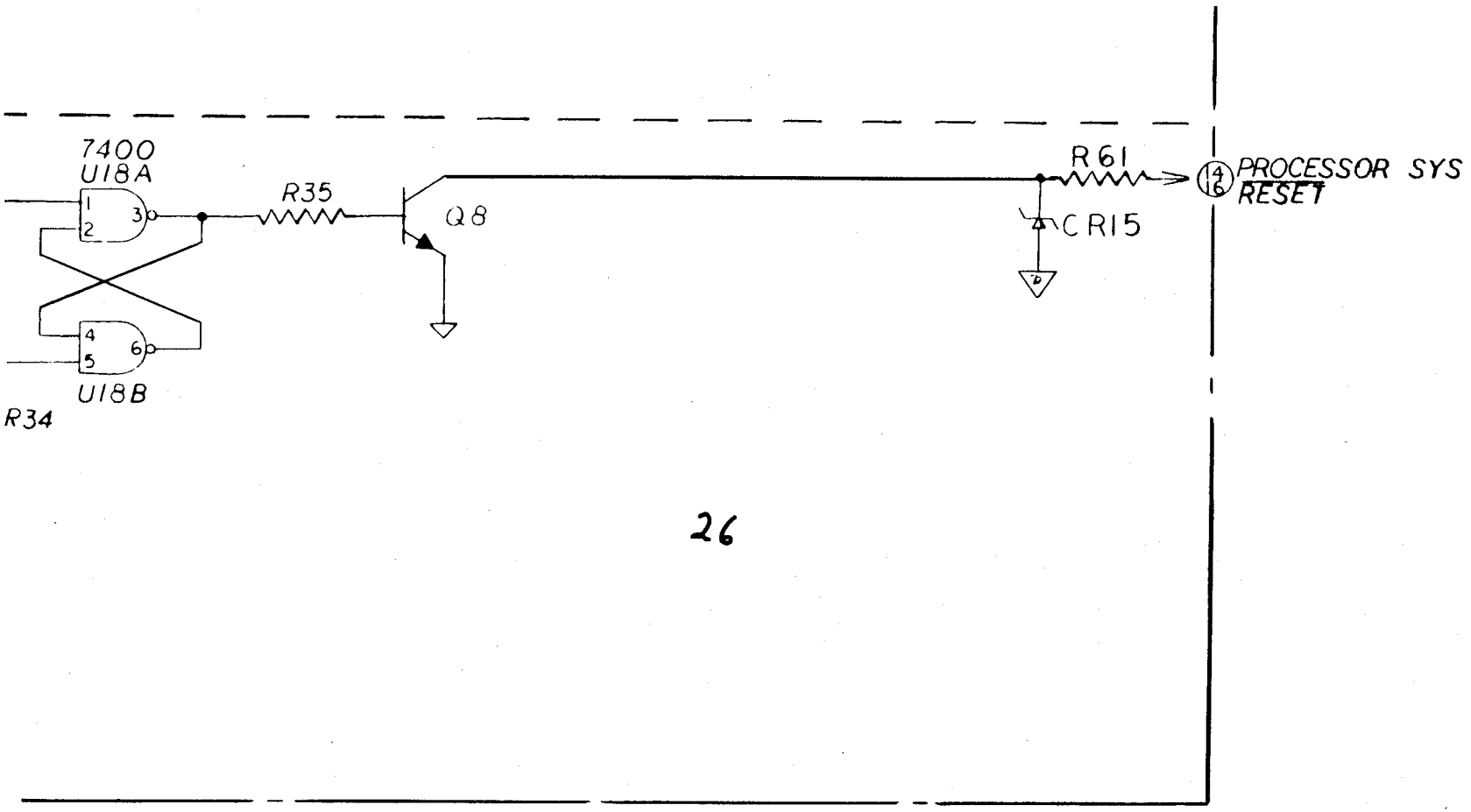

Referring to block diagram FIG. 3, and also detail circuit schematic diagram FIGS. 13 and 14 which is the output interface 3A3 printed circuit board, the 3A3 printed circuit board is used to illuminate a set of error lights which provide an indication of the condition of the processor or what it has found during any self diagnostic routines. In other words, any system malfunctions that have been detected will have a corresponding error light illuminated on unit 3 front panel, indicating the malfunction of malfunctions found during the diagnostic checks of the processor. In looking at the block diagram, FIG. 3, the circuitry involved in the error light display panel are those components inscribed in blocks 24 and 25. At block 26, there is a reset conditioning circuit that will reset the error lights that have been illuminated on the front panel and also reset the processor system at that time. Block 27 is a relay driver circuit that will illuminate or turn on a red light that is mounted external to the defect detector house and is observed by the train crew to indicate that a defect has occurred during passage of the train. A red light condition is a mandatory stop condition for the train. Looking at block 28, there is a white light control that will enable the white light that is external to the DD house and is illuminated at approach time and is observed by the train engine crew to insure that the defect detector site indeed is active and responding to the approach of the train. In block 29 there is a radio keying relay driver which, at the proper time, will key the VHF radio transmitter that transmits the voice of the annunciated portion of this system to the engine crew i.e., both the caboose and the engine. Referring to block 30, there is a servo start control relay driver and, on command from the processor system, the servo start relay will start the servo system chart recorder and initiate other activity that must occur prior to or upon the approach of the oncoming train. The servo system is external to the processor system. Looking at the block diagram, circuit components 31 and 35, there is circuitry involved in updating totalizing counter, a mechanical totalizing counter that is installed in unit 7 to totalize the number of defects encountered on the east rail. Also in blocks 32 and 36, there is the circuitry necessary to update the totalizing counter for defects encountered on the west rail. In block 33 and 37 there is the circuitry involved in updating the dragging equipment totalizing counter. In block 34 there is a latch or signal conditioning necessary to condition a servo power supply alarm input. Some systems may have a power supply monitor attached to the servo system monitoring critical power supplies and, if these power supplies are out of tolerance, an alarm is sent to condition the latch circuitry inscribed in block 34 and alert the processor that there is an out of tolerance power supply condition existing in the basic servo system.

Referring to the detailed circuit schematic on 3A3 printed circuit board, FIG. 13, looking at the circuitry inscribed in block 24, there is a four line to 16 line multiplexer and the card edge pins 29–31 corresponding to the A line of the four line output code, pins 33–35, corresponding to the B line of the input four line code, pins 37–39, corresponding to the C line of the input four line code and pins 41–43 corresponding to the D line of the four line input multiplexer control. These four lines are straight binary coded and cause positioning of the D coded positioning of the decoder, to positions 0 through 15. Pin 45–47 from the microprocessor P1A2–PA4 is an enable gate and is enabled at the time an error function is to be decoded. The output of the 4 to 16 line decoder drives the dual section latches inscribed in block 25. For instance, if a speech memory error malfunction has occurred in the processor, a corresponding setting of the speech memory error latch occurs illuminating the front panel light by the following action:

The processor, upon detecting the speech memory error, will send a four bit binary code on the lines 29–31, 33–35, 29–31, 33–35, 37–39 and 41–42 to the 16 line decoder and the binary code will be such that output pin 2 of the 16 line decoder will have a low condition set at this time which is input to U10 in the inscribed block 25 and will set the latch that will illuminate the speech memory error light on the front panel of unit 3 in the output at the card edge lower left hand corner via pins 93–95. Any other corresponding malfunction will occur in similar manner and illuminate the corresponding error light on the front panel. After the error condition has been corrected, the error light on the front panel may be reset by operating the reset switch on the front panel of unit 3. Referring to the circuit schematic FIG. 13, of the 3A3 PC board on the extreme right hand side on pin 30–32, a reset line comes from the front panel reset switch that resets the dual latches and resets any illuminated front panel error light.

Referring to FIG. 14 of the 3A3 printed circuit board and at the circuit inscribed in block 26, the signal conditioning latch necessary to condition the reset switch input from unit 3 front panel to reset the computer processor itself is shown. Components U18A and U18B form a switch debouncing latch, driving transistor Q8, which drives a processor bus reset line. When the front panel switch is operated at reset position, the processor system reset line will assume a low state at the output pin 14–16, thereby causing a resetting condition of the computer processor system.

Referring to the inscribed block 27, the circuitry necessary to turn on the red light or the red light relay control circuitry is shown. The processor, upon finding a fault while the train is passing the site, will illuminate the red light via the information from P1A1–PA4 input to the card edge pin 78–80. A high condition will exist at pin 1 of U17A, causing a high condition to occur at pin 3 of U17A, turning on transistor Q4. The Q4 output at card edge pins 22–24 then operate a red light control relay on unit 6, 6A1 circuit board. The energizing of this red light control relay will then cause the external red light relay to turn on and illuminate the external red light. Looking at block 28, the circuit inscribed there is used in a similar manner as the red light control circuitry to control an external white light upon the train making an initial approach to the defect detector site after four axles have been counted past the approach transducer. The computer processor output from P1A1–PA3 to the card edge connector pins 74–76 will receive a high level that will then enable the white light control circuitry to illuminate the external white light, indicating the system is responsive to the approaching train.

Examining the circuit inscribed in block 29, the control circuitry necessary to key the VHF radio used in communication with the train crew is set forth. The processor, upon detecting a malfunction as the train is passing the site, will enable a thousand cycle alarm tone. The transmitter keying control circuitry will then be enabled, the transmitter keyed and the thousand cycle tone will be transmitted to the train crew, alerting them that a defect has been encountered in the train. The total axle count and the count from the rear of the train can not be given until the train has cleared the site, but the alarm tone is an alert that a defect has been encountered. The keying of the radio relay occurs in a similar manner as the other control circuits for the red and while light.

Inscribed in block 30, is the circuitry necessary to turn on the servo system which starts the strip chart recoder and other functions required to initialize for the oncoming train. After four approach pulses have been counted by the approach transducers, the servo system is started. The servo system start control from the processor comes from P1A2–PA7 to the card edge 66–68. A high level at the input of the control circuitry will cause the servo start relay to be energized and the servo. system will then be started.

Referring to blocks 33 and 37 of the circuit schematic, block 33 is a monostable multivibrator whose function is to initiate a pulse to driver transistor Q1 in block 37 for a time duration sufficient and amplitude sufficient to update the dragging equipment totalizing counter coil. After the passage of the train, the dragging equipment defect has occurred at printout time on the printer. The computer processor, via P1A1–PA2 to the card edge 34–36, will send a pulse to the monostable that will update the dragging equipment counter circuits in blocks 31 and 35 operate in a similar manner as to circuits in blocks 32 and 36.

Referring now to the block diagram FIG. 3 and the 3A4A printed circuit board (FIG. 18) of this block diagram, an important and significant feature of this system is the ability to store digitally in the microprocessor memory circuitry, digitized human voice, and recover the digitized human voice and reconstruct it into an intelligible vocal annunciation. Central and key to this process is the circuitry contained on the 3A4A printed circuit board. Referring to blocks 38, 44, 39 and 40, the basic elements that constitute the conversion of the digital voice information into analog vocal speech are shown. Block 45 is a tone generator that is used and introduced into the vocal speech channel to alert both the dispatcher phone line as well as to the radio transmitter (to the train crew) that a defect has been encountered in the passing of the train. In blocks 46, 47, 48 there is the circuitry that controls the vocal annunciations that are placed on the dispatcher's phone line and sent to the central dispatcher.

Referring to block 38 on the circuit schemaic for 3A4A printed circuit board the circuitry necessary to receive two bit parallel paired information and multiplex this information to a single line serial output is shown. The digital voice information is stored in the computer memory in parallel 8 bit straight binary word form. The processor will feed the speech bits, the bits comprised of the parallel 8 bits, out to the parallel to serial multiplexer U9 in two bit pairs until all 8 bits have been converted from parallel to serial format. The serial format or serial output of U9 parallel to serial converter will occur on the pin 7 of U9 and is fed to the circuitry inscribed in block 39. The circuitry inscribed in block 39 is the circuitry that actually converts the now serial digital bit stream back to analog vocal information and the output of the analog vocal information leaves the chip U1 on pins 6 and 7, is fed through a filter circuit R1 C1 and out to block 40 through R17. The chip inscribed in block 39 is an MXC 3417 which is a continuously variable slope delta modulator (CVSD), a chip manufactured by Motorola Corporation. But the operation of the MXC 3417 is detailed in the Motorola literature. The circuitry contained in inscribed block 40 is composed of an active 6 pole Tchebycheff low pass filter designed to reduce the digitization or quantization noise contained in the vocal speech output of the MXC 3417 chip. The 3 db upper roll off band pass point has been chosen to be 2200 hertz. The output of the Tchebycheff filter FL1 in block 40 is then passed through C15 onto the circuitry inscribed in blocks 41, 42, 43. The chip U2 contained in blocks 41, 42, 43 is an integrated circuit, audio, 5 watt amplifier chip and is used to drive the local speaker at pins 57–59 and 61–63 at the card edge output as well as to drive through potentiometer R15 and C14 and R28 transmitter audio output at card edge pin 37–39 to the radio VHF transmitter communicating with the train crew. There is also a signal through potentiometer R14 and through contacts 1 and 7 of K1 in block 43 to the dispatcher phone line on 33–35.

Contained in inscribed block 45 is an astable multivibrator utilizing U3 555 precision timer which generates the 1 kilohertz alarm tone. The tone level is controlled by the potentiometer R13. The output of R13 is fed back to the input of our Tchebycheff filter FL1 in block 40 to be introduced into the audio channel output stream. The circuit elements just discussed will operated in the following manner.

Upon detection of a defect while the train is passing, if a defective condition is established by the processor, then a 1,000 hertz alarm tone is immediately placed on the dispatcher's phone line and also on the radio transmitter output. The tone generator inscribed in block 45 will receive an enable command from the P1A1–PA7 of the microprocessor system, at pins 41–43, thereby at that time enabling the astable 1,000 hertz tone generator inscribed in block 45 to alarm and alert the train crew and the central dispatcher. At that time, the P1A1–PA6 dispatcher control output from the microprocessor will be input to pins 13–15 of the card edge and will appear at the circuitry inscribed in block 47. Upon initiating the tone, if the dispatcher has not rung off or dialed the house telephone for ring off purposes, then the high level appearing at pin 5 of U6B will appear as a high level at the output pin 8 of U6C and following this digital control line to block 48, resistor R22 and Q1 comprise a relay driver that will energize relay K1, closing relay contacts 1 and 7 of K1 on the 3A4A PC board (FIG. 18) inscribed in block 43. The tone alarm will be output to the dispatcher's phone line via card edge connector terminal 33–35.

Referring to block 46 in the inscribed circuitry, the dispatcher ring off circuitry, which gives the dispatcher the capability, upon his election, to ring his line off so that the annunciation is removed from his phone line and to the card edge pins 5–7 there is a dispatcher ring off from an optocoupler circuitry, circuit 9A1. If the dispatcher dials the telephone installed in the defect detector site house, a low level digital input signal will be received at pins 5–7 of the card edge connector on the 3A4A board, thereby causing a low level input to NOR circuit U10D. The resultant output from NOR latch U10A and U10B is such that a low condition or a low level will be present at pin 1 of U10A. This low level input is now fed out to U6B, pin 4 and, when pin 4 on U6B assumes a low state, a following low state condition will exist at output pin 8 of U6C. This deenergizes the dispatcher's phone line relay and the dispatcher's phone line relay is further inhibited until servo reset time.

Referring to card edge connector pins 9–11, there is the servo reset input coming from input interface board 3A1J1 pins 41–43 of FIG. 20. At servo reset time the input digital level at pin 9–11 goes low, thereby causing the latch U10A and U10B to reset, such that there is a high level at pin 1 of U10A and thereby a high level at pin 4 of U6B, enabling NAND gates U6B and U6C. Afer the train has cleared the site and approximately 6 seconds after the last wheel of the train passes the A and B transducers (FIG. 17), the Servo Corp. system will time out and, approximately four seconds after servo time out time, the processor will begin its annunciation routine. If there has been no defect in the passing train the processor will annunciate a no defect condition to the train. If a defect or several defects (up to 5 hot boxes or 5 overheated axles or journals and up to 3 dragging equipments) have been detected during the passage of the train then the vocal annunciation will identify the defects consecutively and annunciate the number from the rear of the train corresponding to the defect that has been detected. This vocal annunciation is transmitted to the train crew via VHF radio and also to the central dispatcher via the dispatcher phone line, unless the dispatcher has rung off the annunciation. This concludes the discussion of the output interface circuitry.

Figures 1, 5:
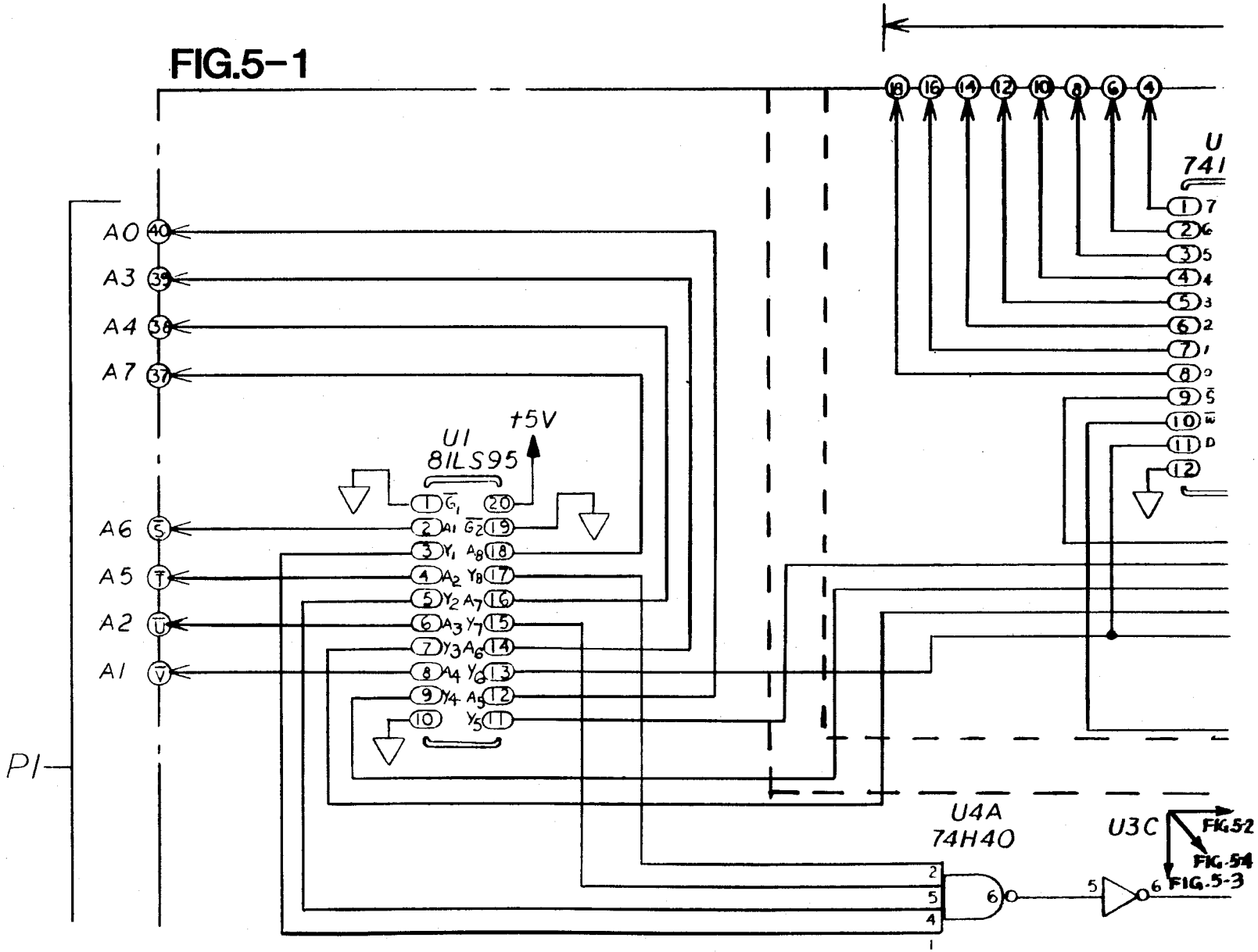
Figures 2, 5:
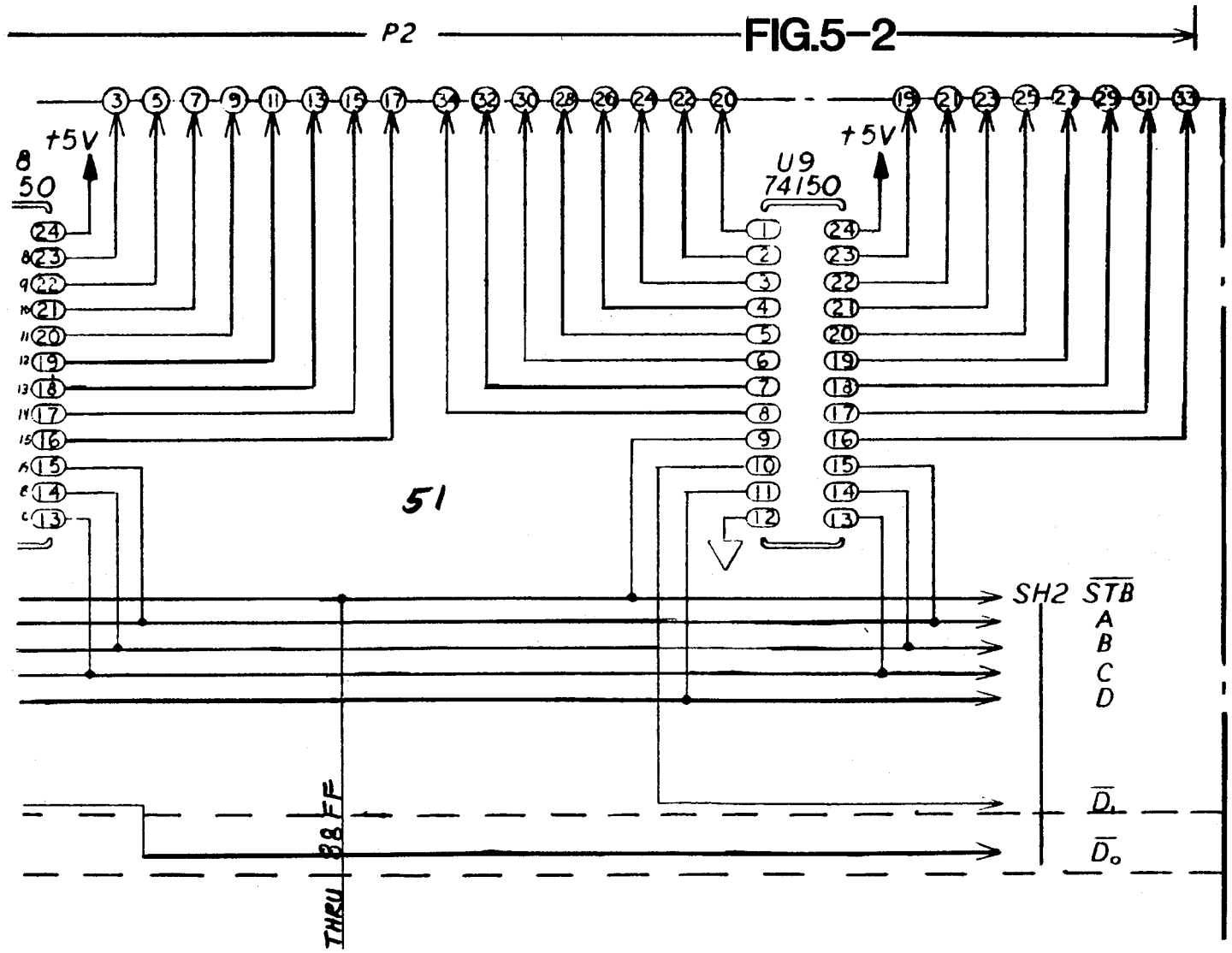
Figures 3, 5:
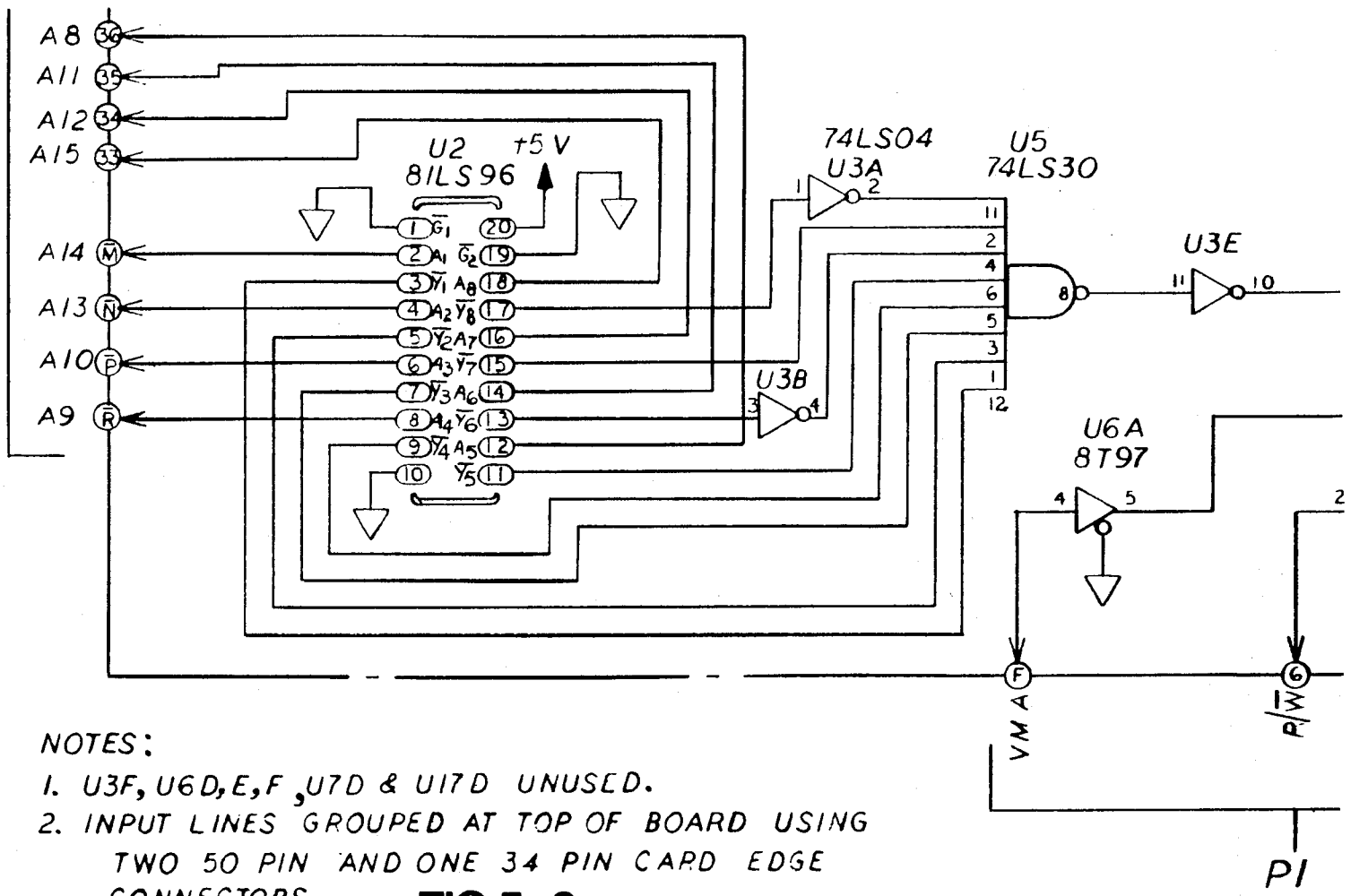
Figures 4, 5:
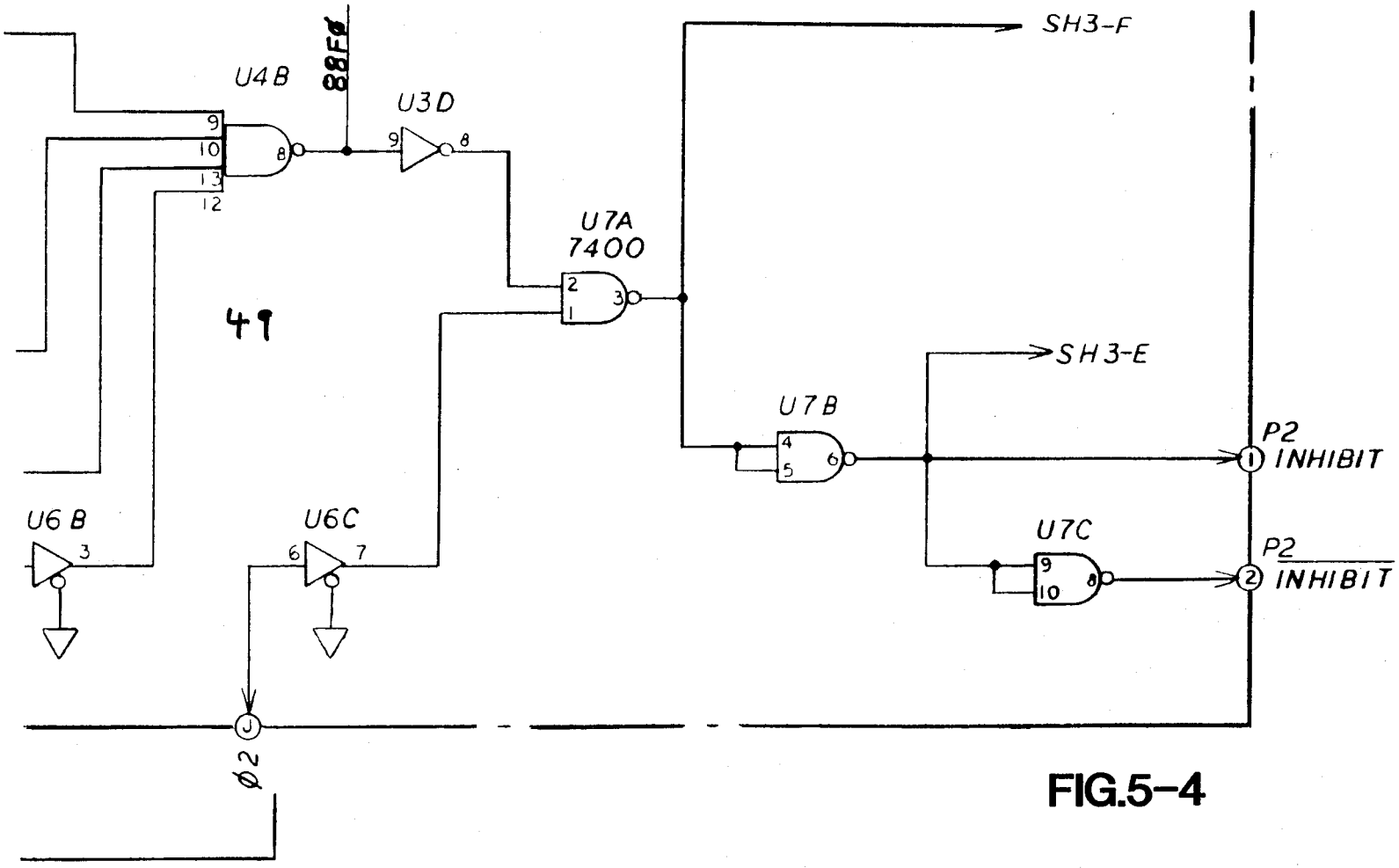
Figures 1, 6:
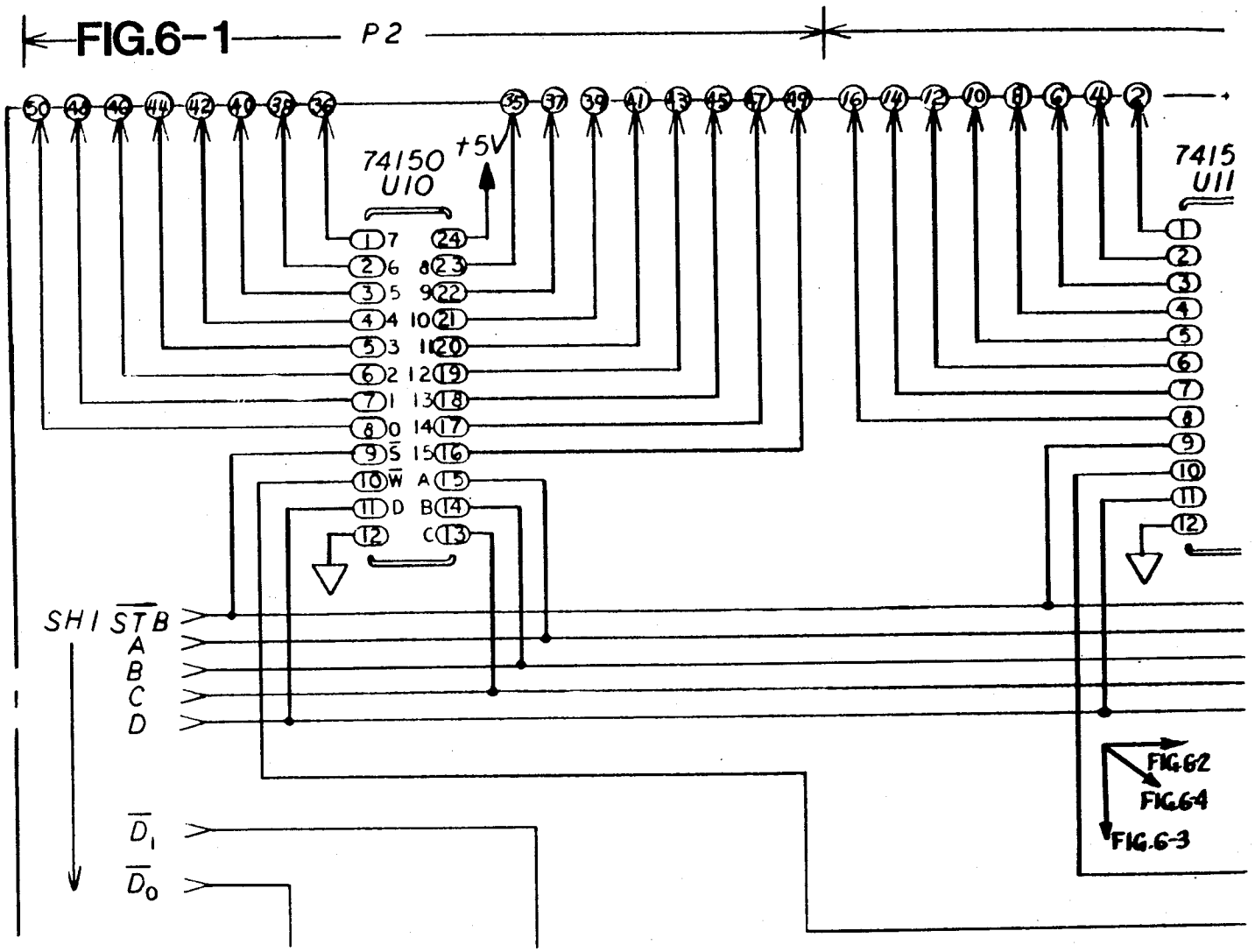
Figures 2, 6:
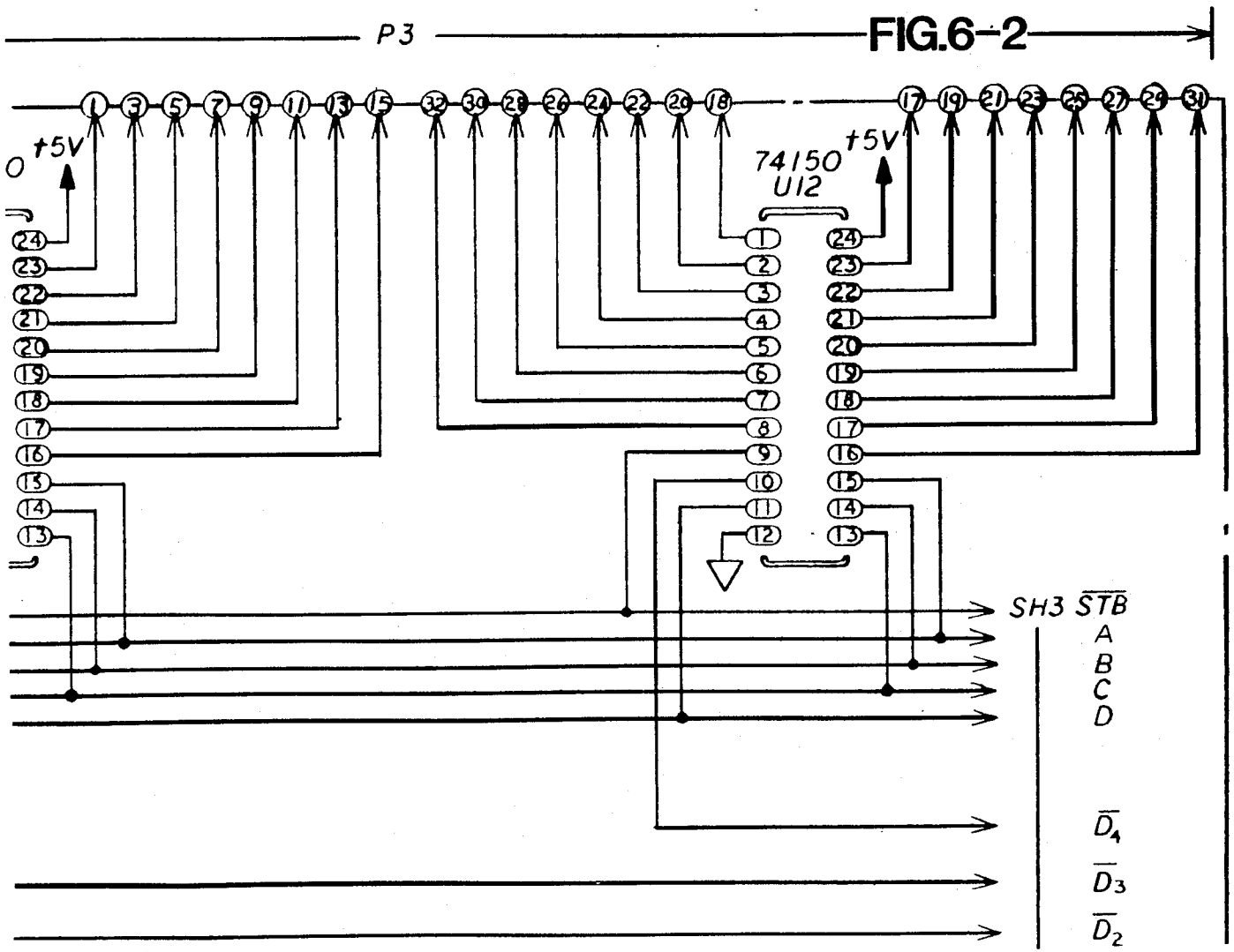
Figures 3, 6:
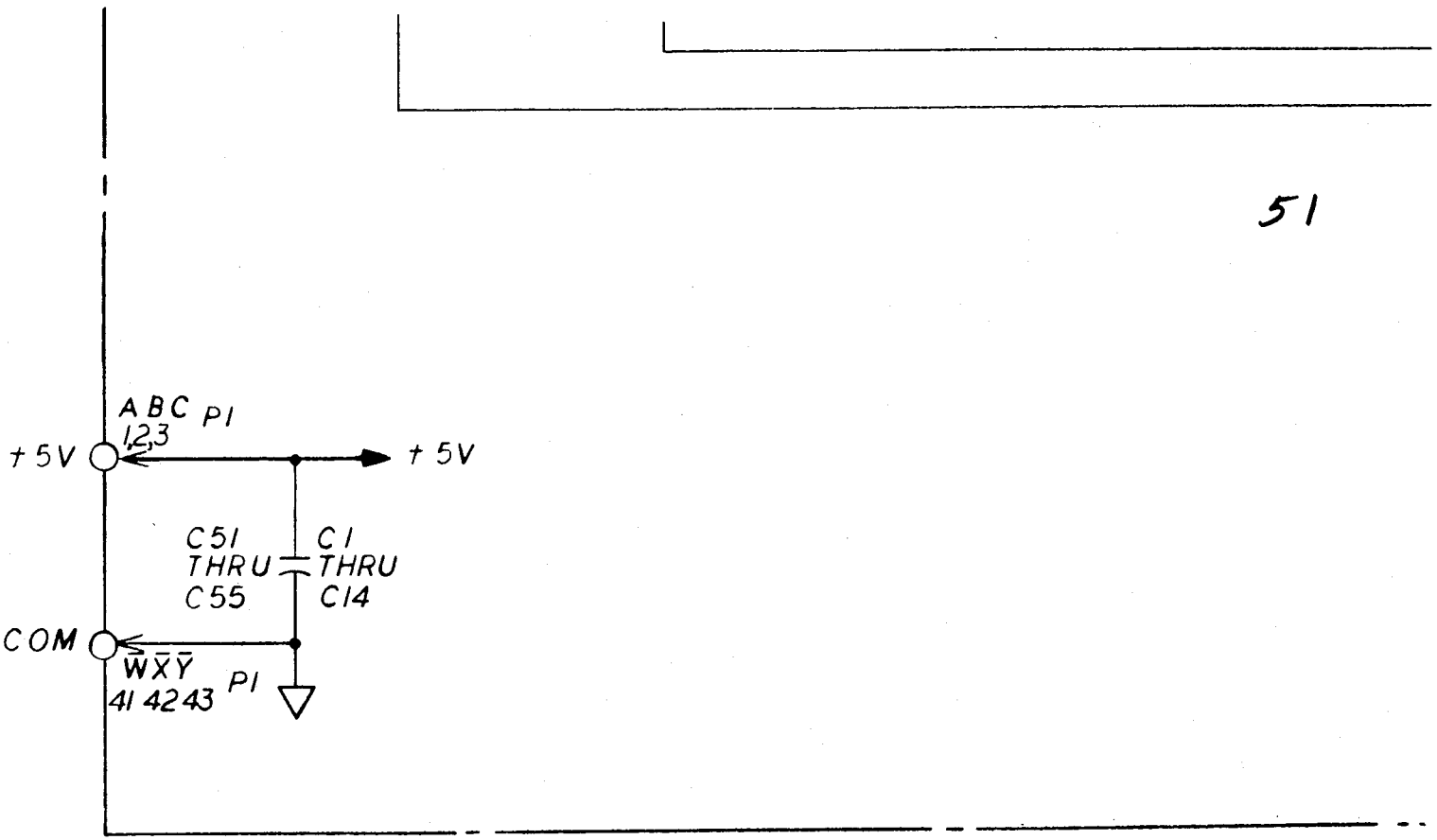
Figures 4, 6:
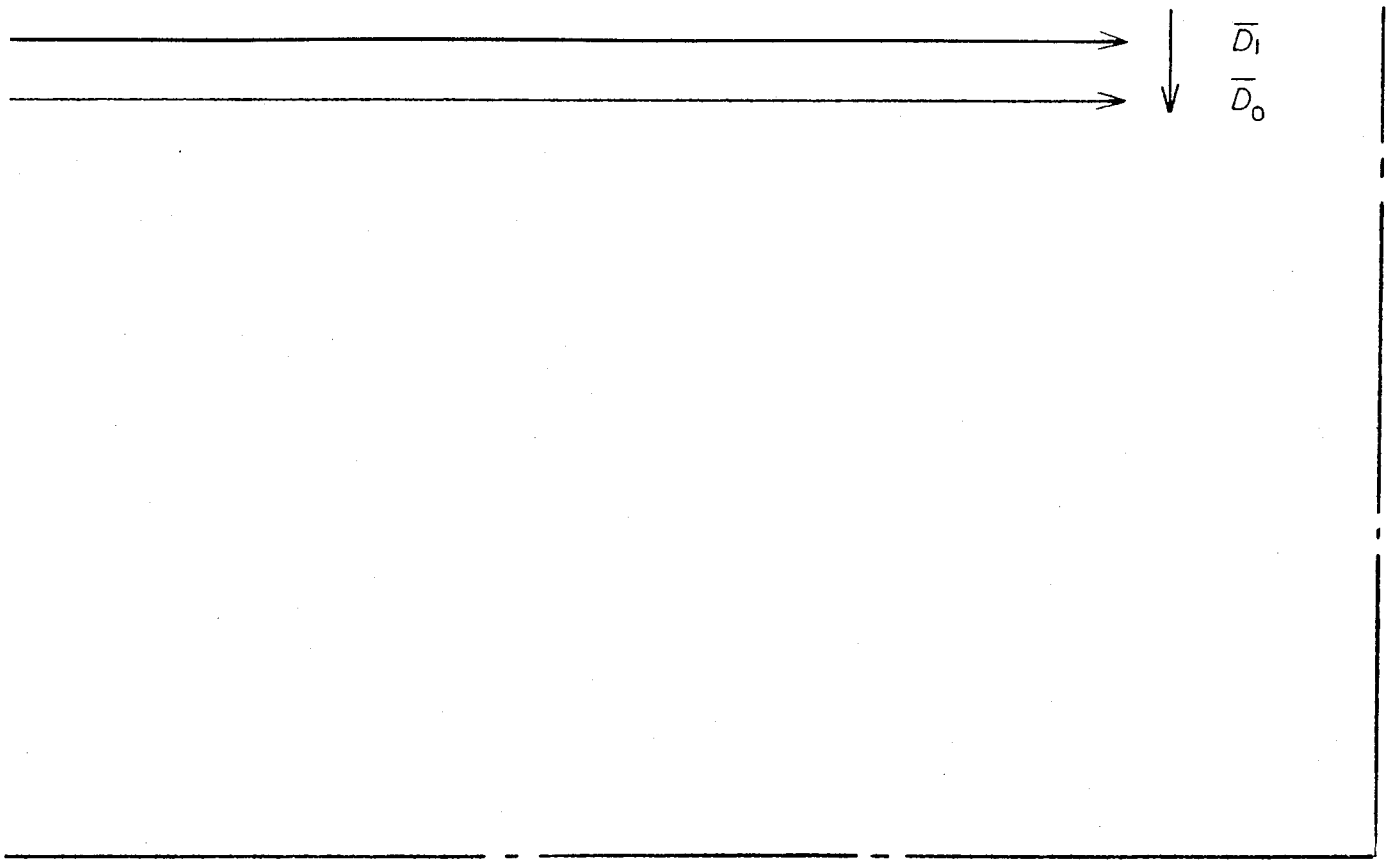
Figures 1, 7:
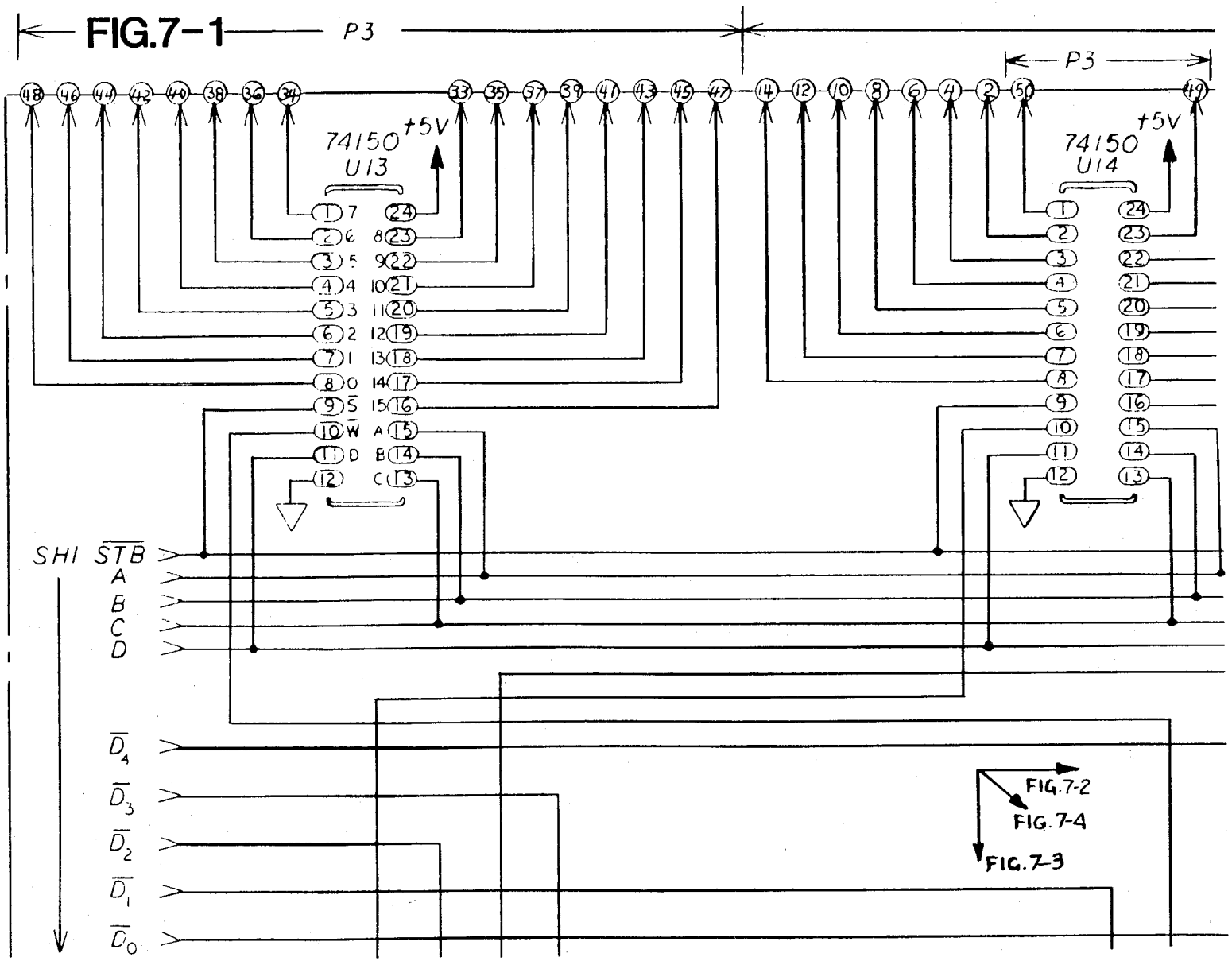
Figures 2, 7:
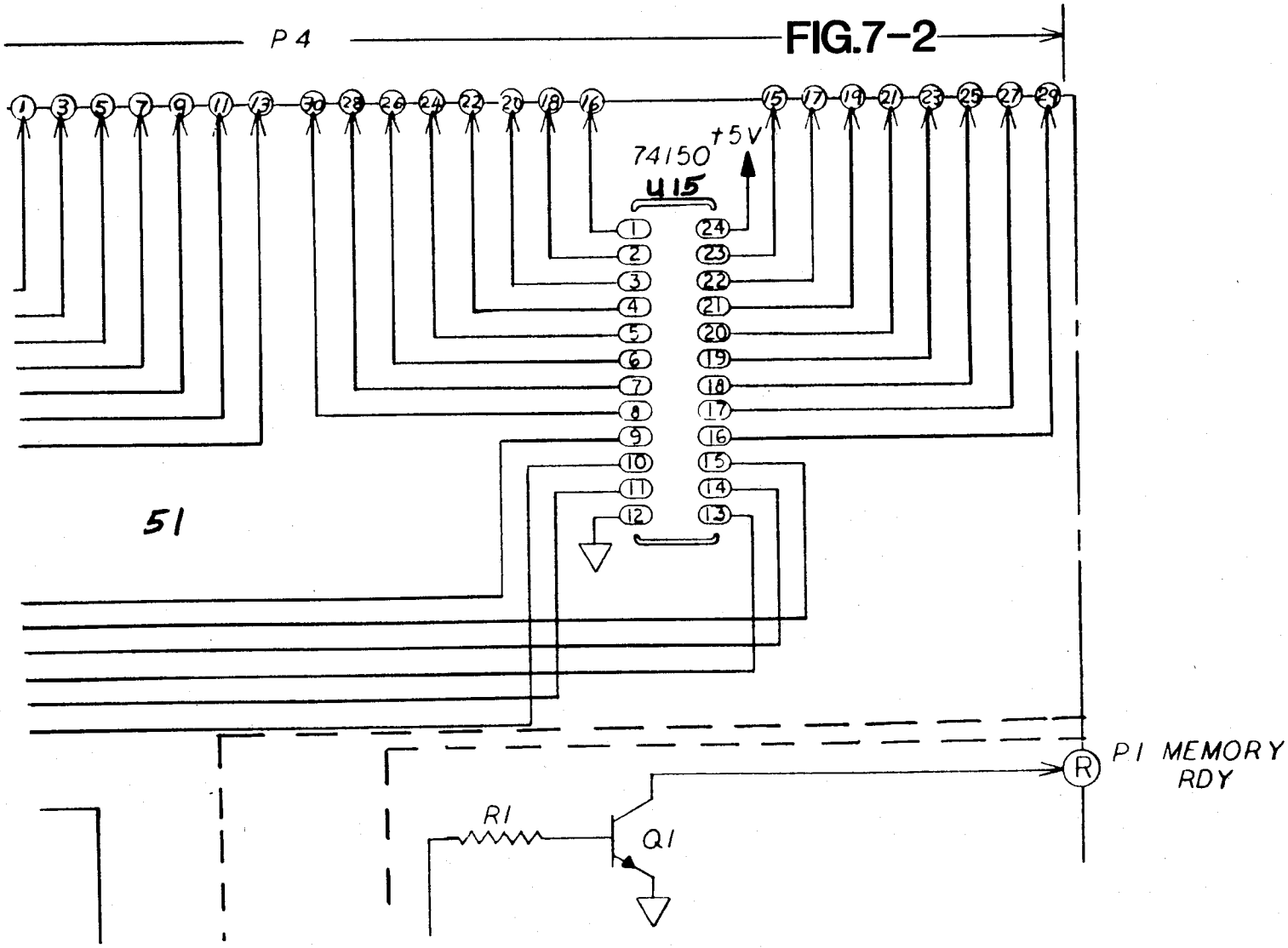
Figures 3, 7:
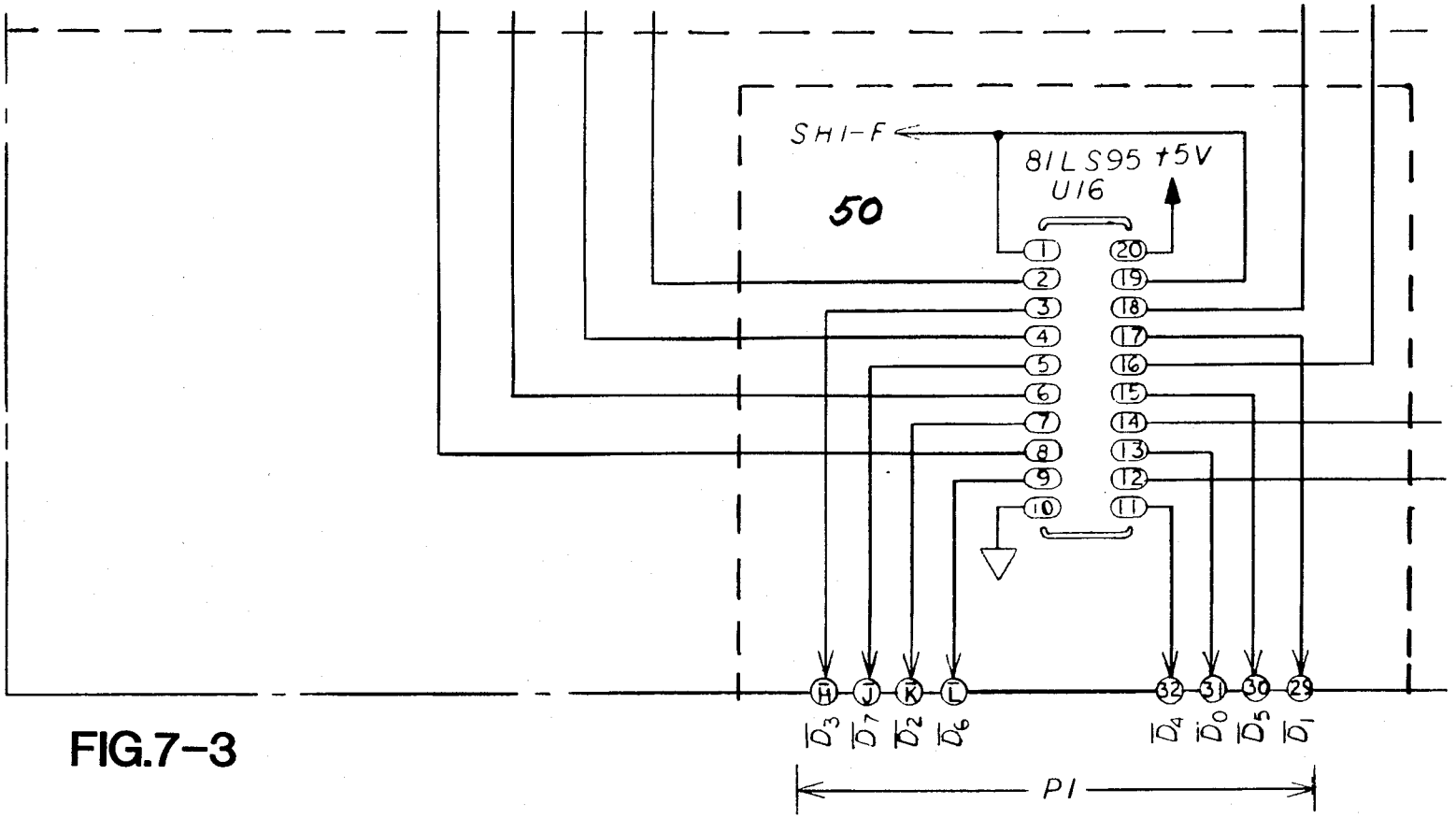
Figures 4, 7:
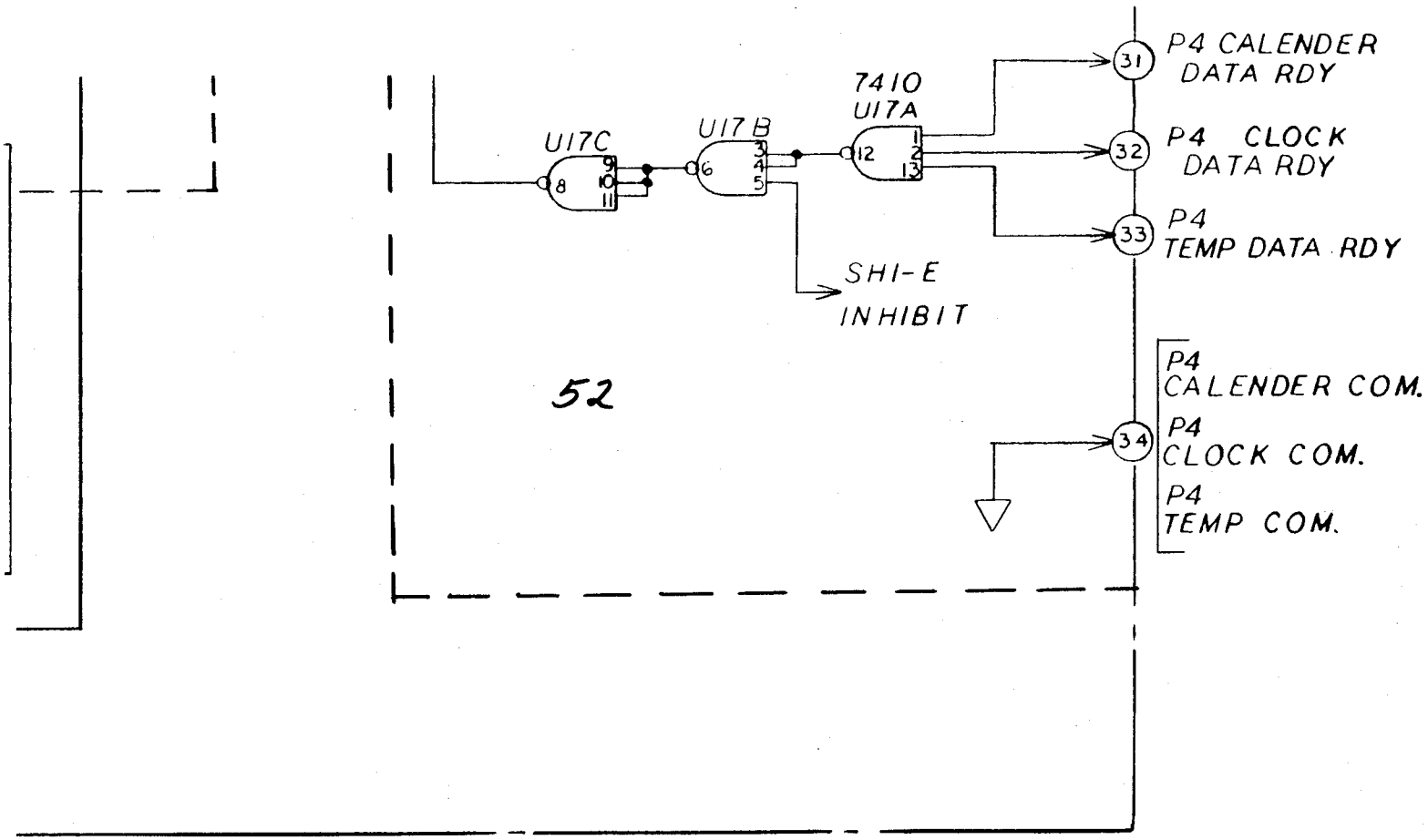

Attention will now be directed to the microprocessor system in those circuit boards used to support the microprocessor system with reference to FIG. 2 of the block diagrams. An overview of the circuit boards contained in the microprocessor main frame itself will first be provided. The microprocessor main frame is a typical bus interconnected digital computer microprocessor system. All circuit boards plug into the interconnecting bus system for interconnection between different circuit boards plugged into the main frame. The microprocessor circuit board itself has been labelled the 1A1 printed circuit board and a detailed circuit schematic of this microprocessor board can be found in the Motorola M68MM01A documentation drawing number 63W1227X. The processor is contained on the circuit board housing two peripheral interface adapter chips labelled PIA1 and PIA2 and these two chips contain the electronics necessary to interface input and output-wise with the external world. All of the output interface occurs through PIA1 or PIA2. Some of the input interface occurs through PIA1 and PIA2. Additional input information is interfaced with the processor system bus structure through the digital multiplexer board we labelled IA3 PC board (FIGS. 5 to 7). The IA3 PC board receives digital input information that is in the standard 8 bit wide format and is capable of handling 16 channels of digital information. This information is multiplexed into the bus structure of the microprocessor system and the information is then assimulated by the microprocessor and used in its processing functions.

Figures 1, 8:
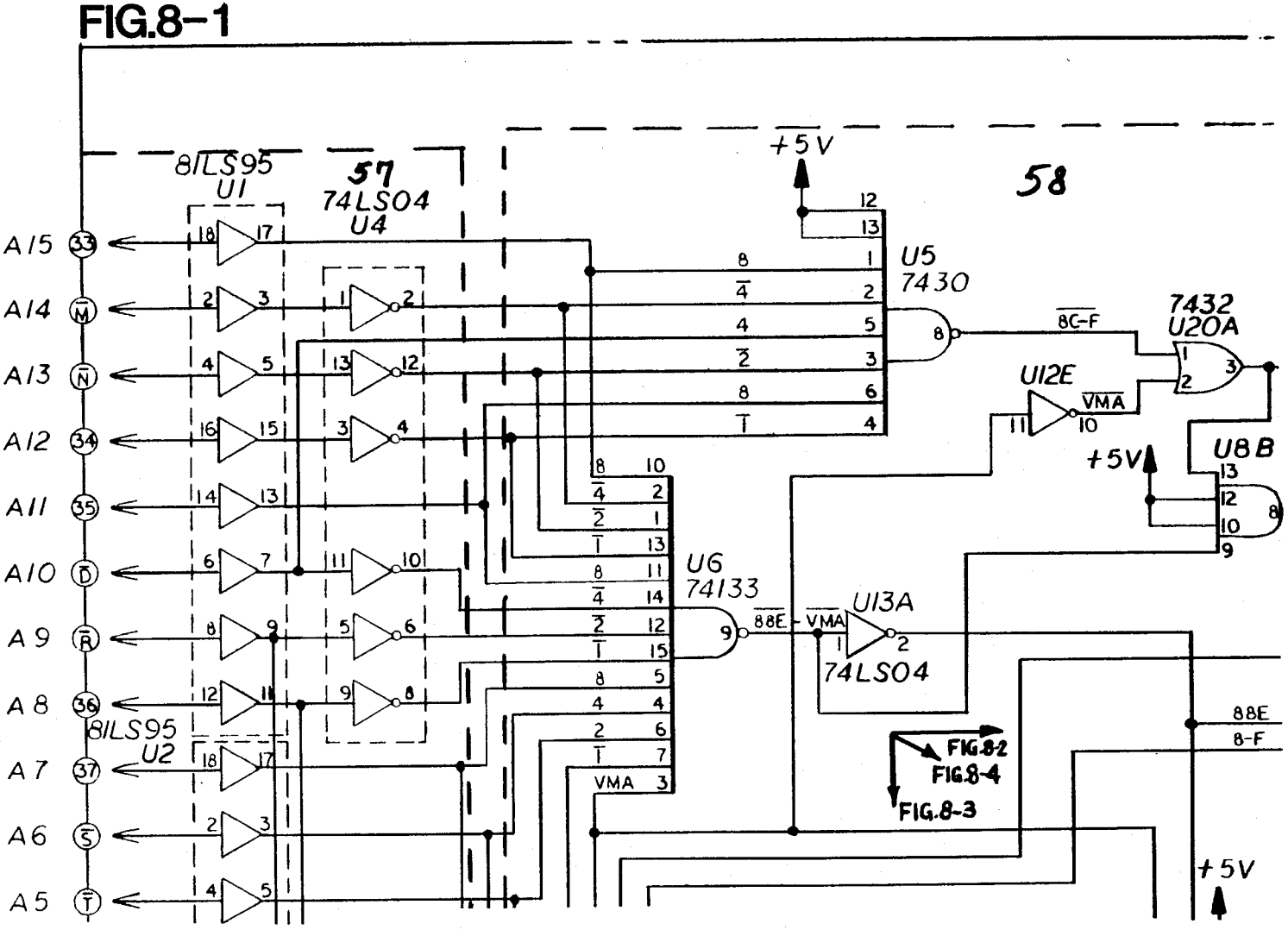
Figures 2, 8:
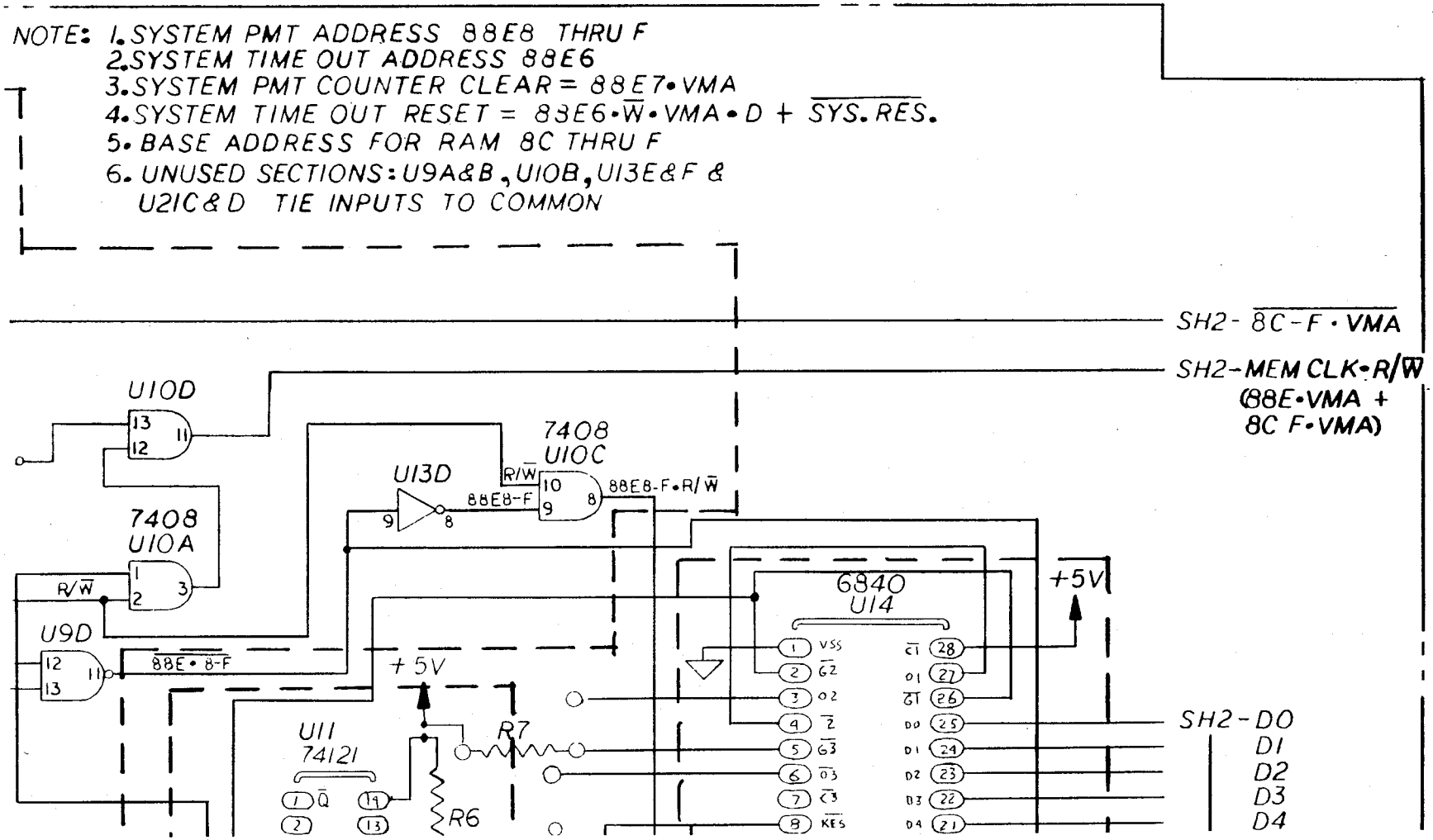
Figures 3, 8:
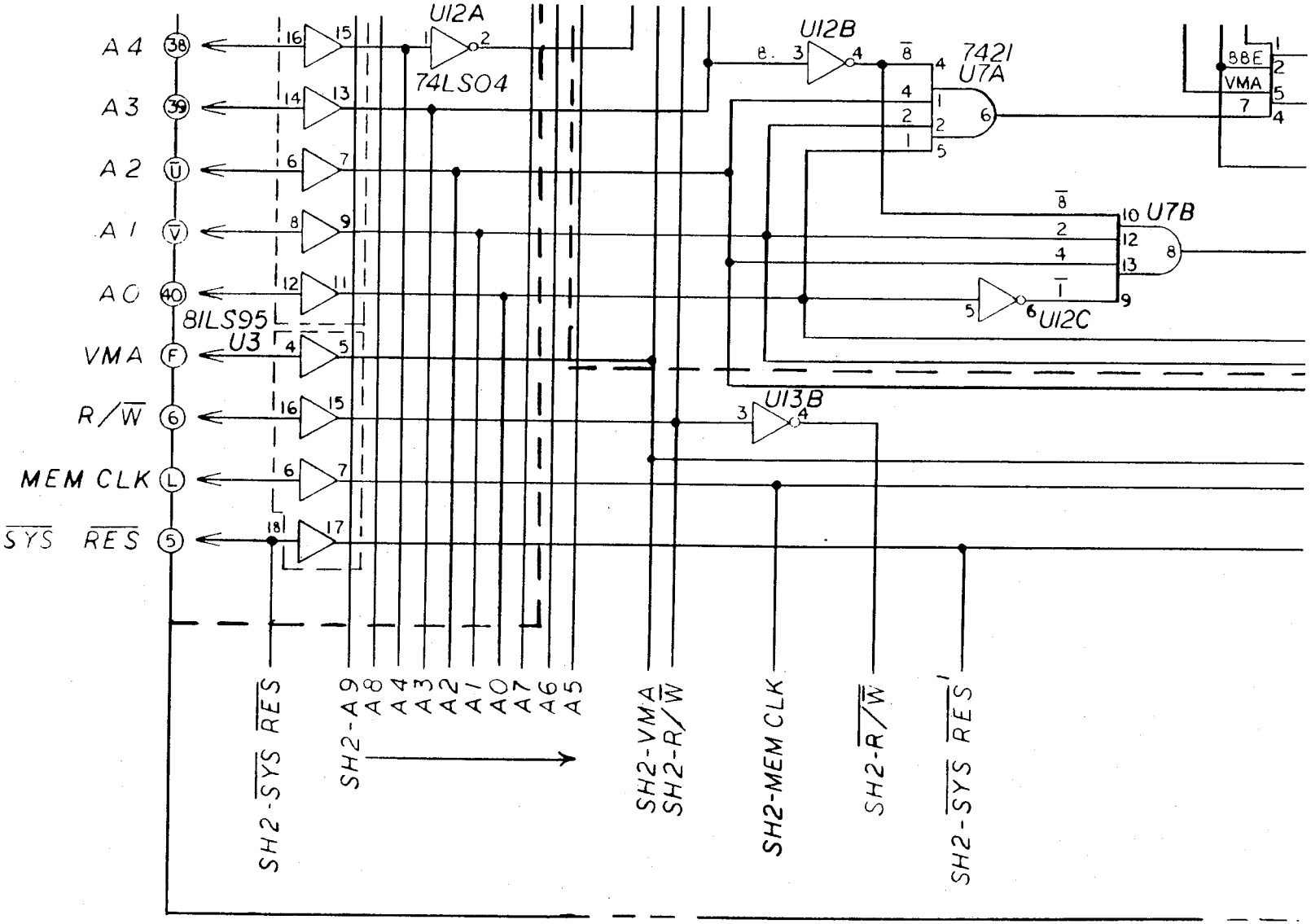
Figures 4, 8:
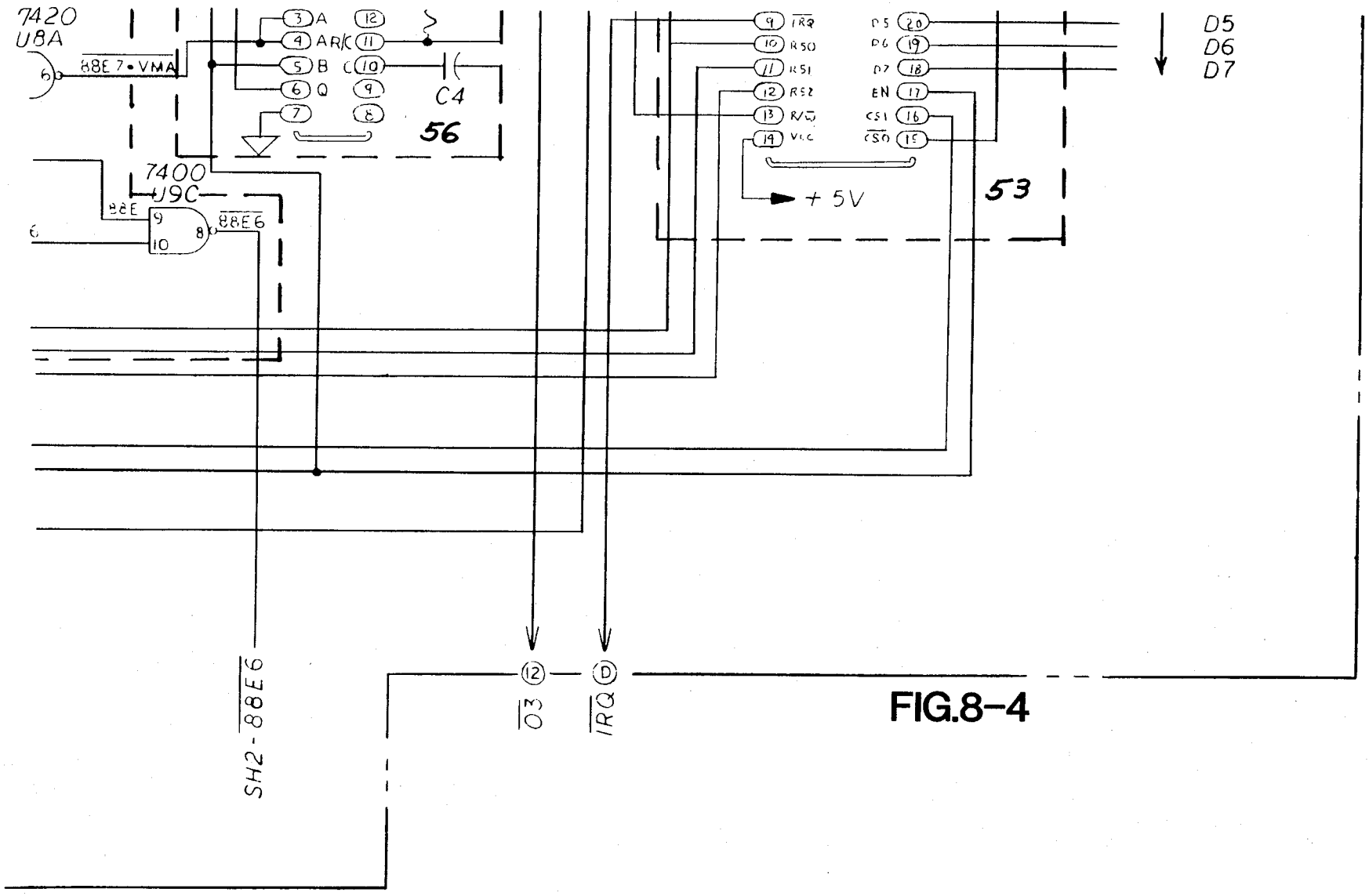
Figures 1, 9:
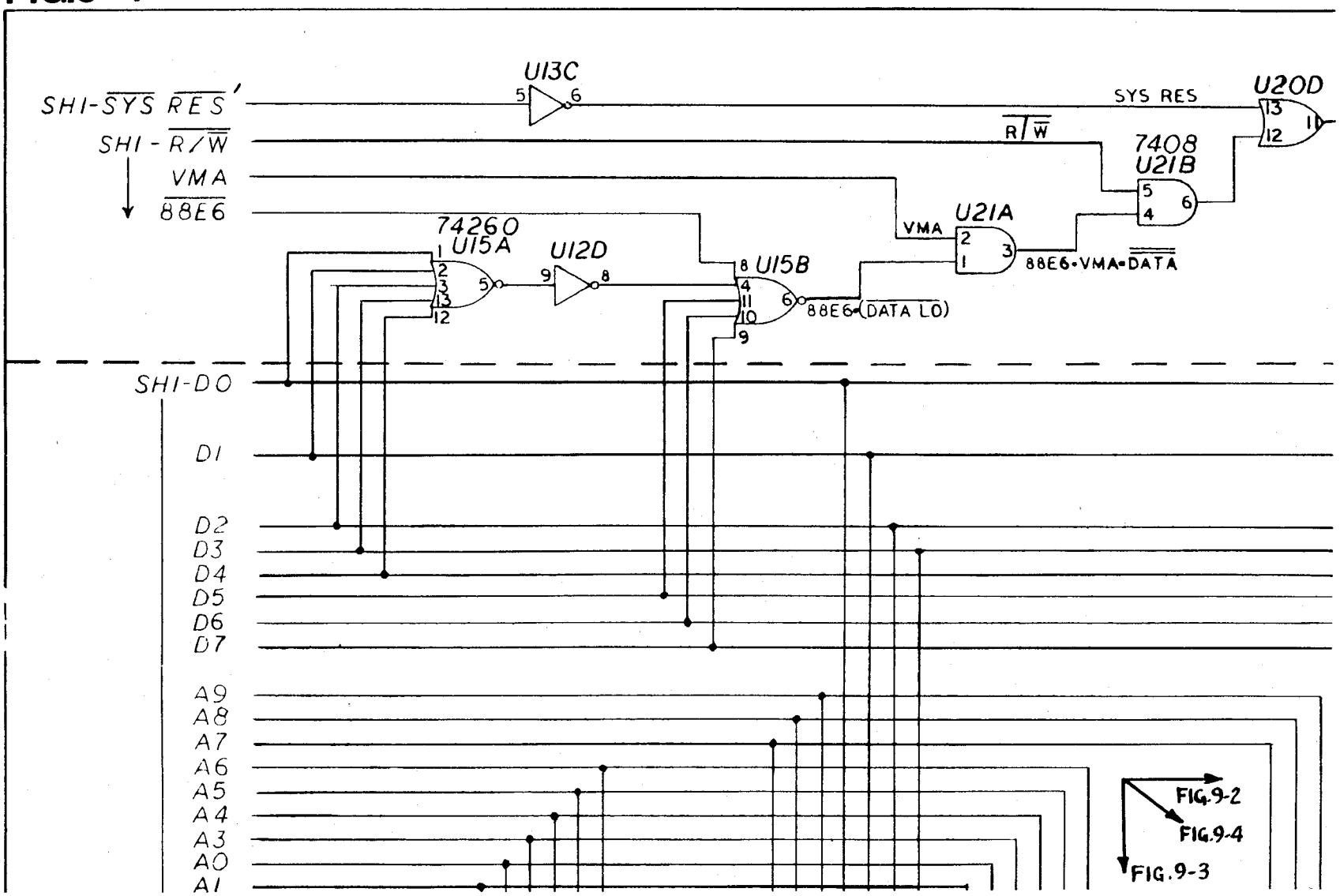
Figures 2, 9:
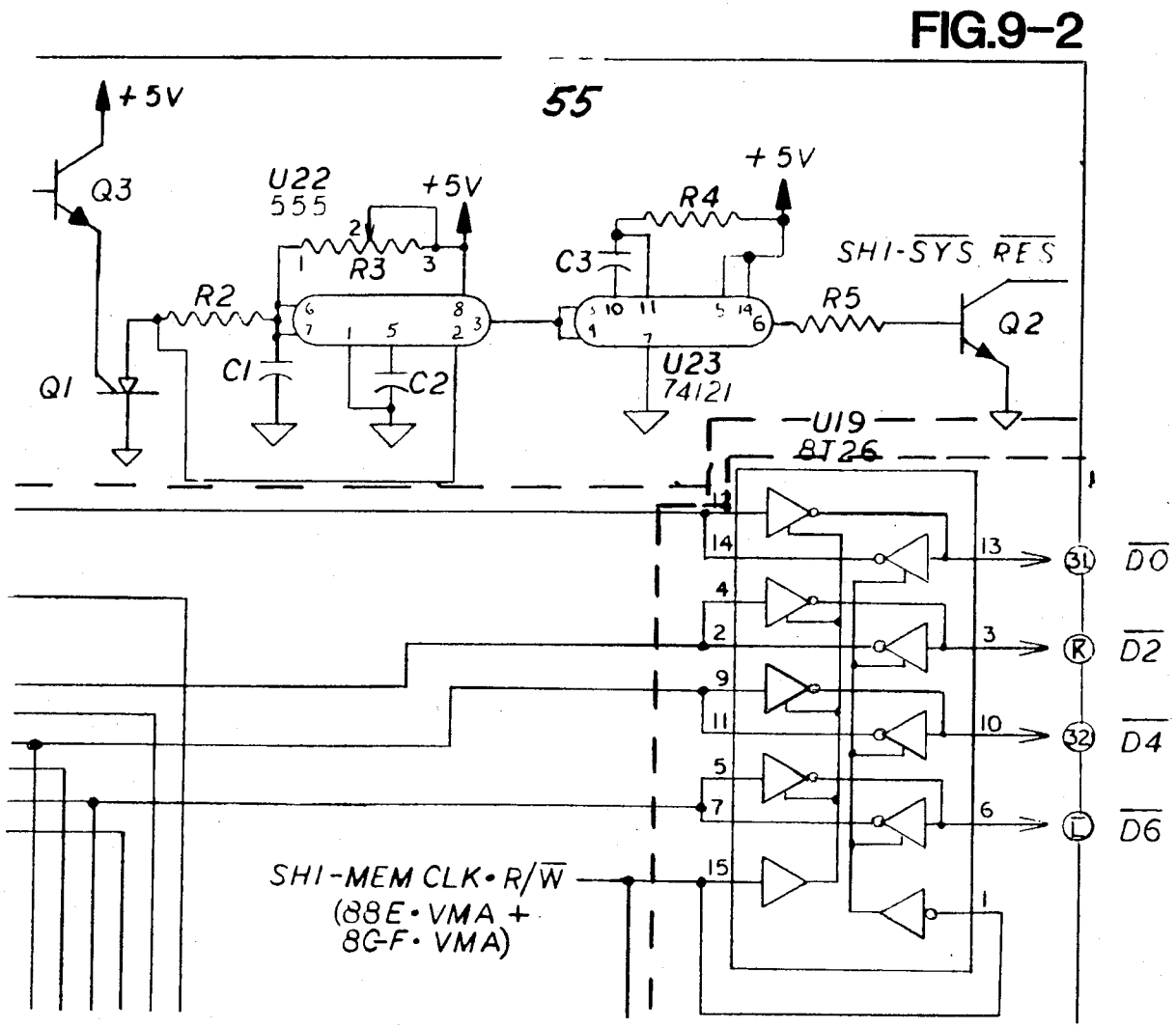
Figures 3, 9:
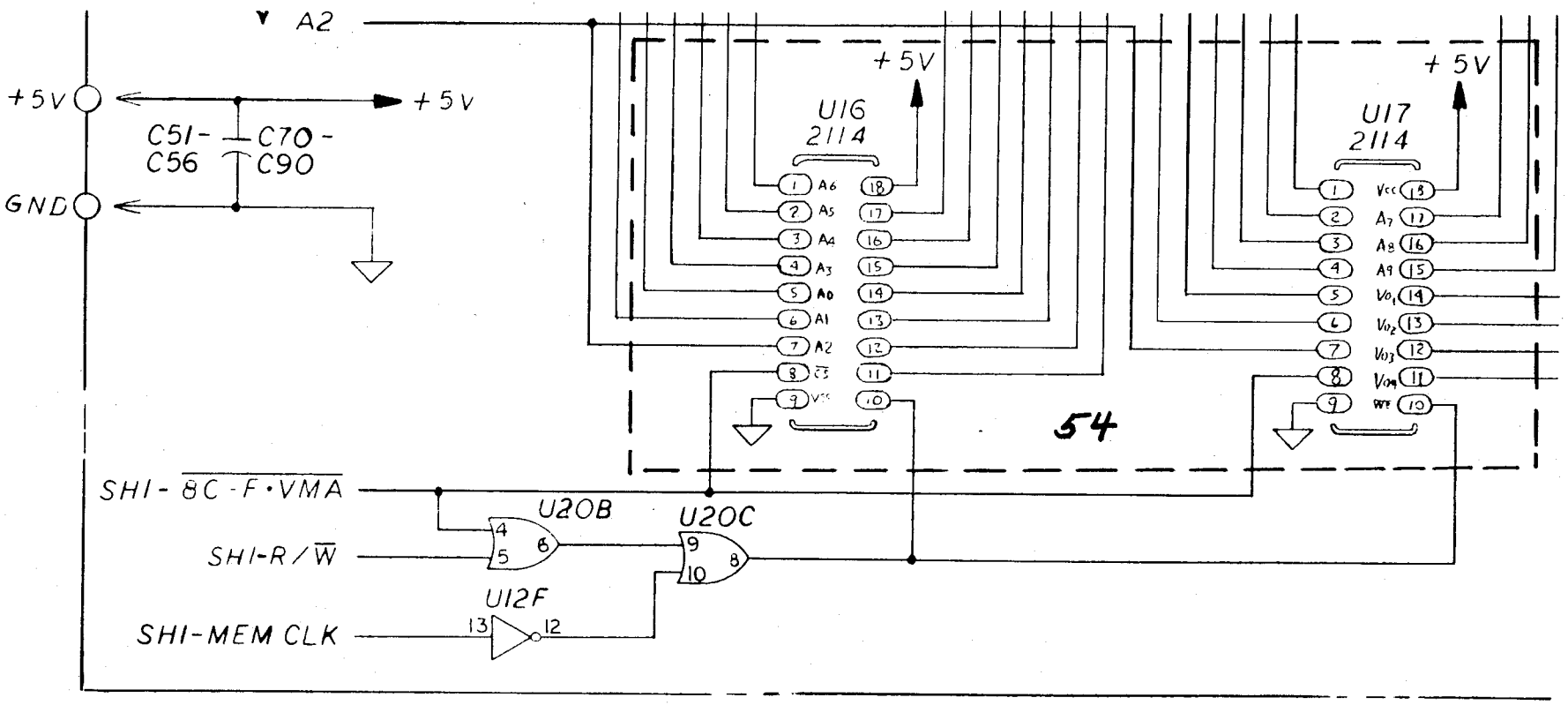
Figures 4, 9:
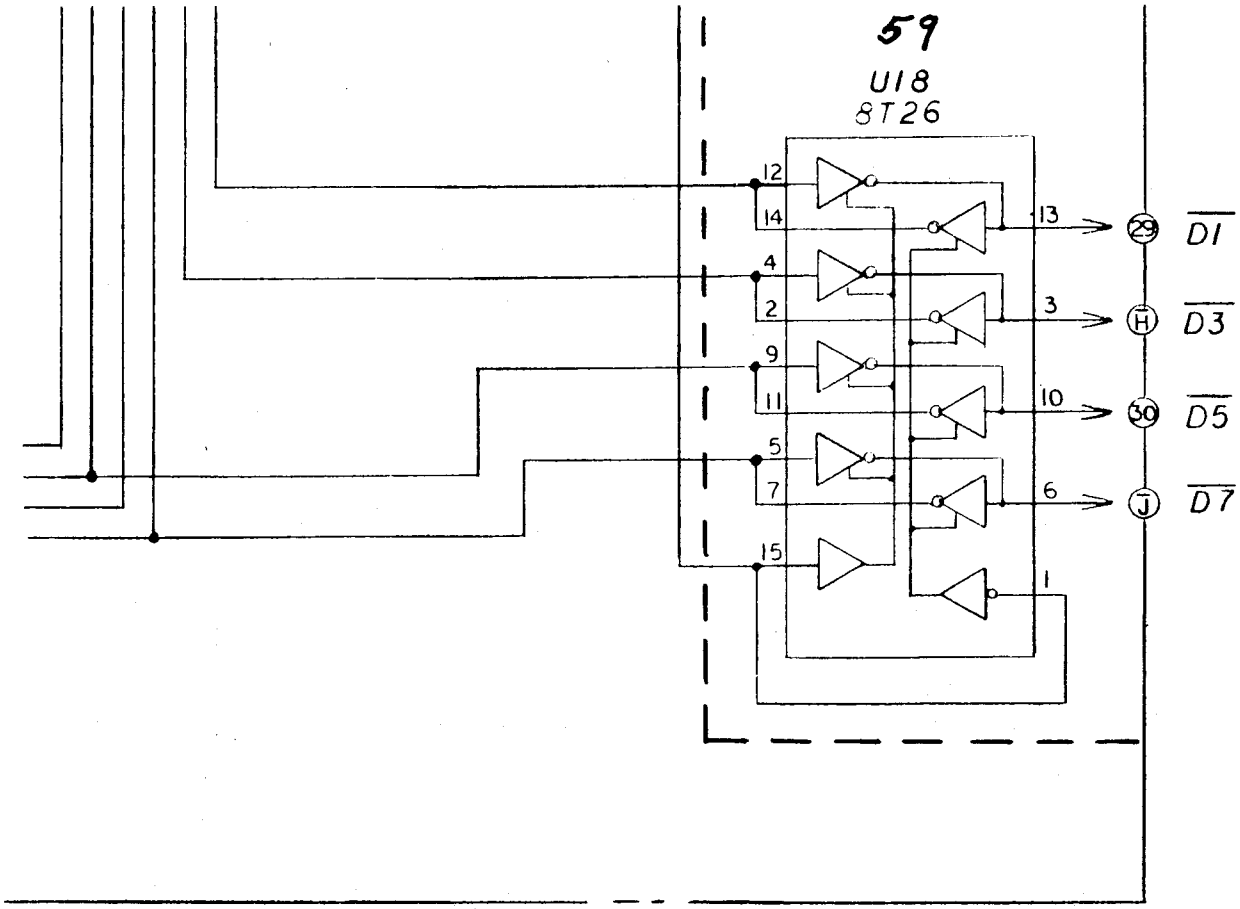

Referring again to the microprocessor board itself, (which is called the monoboard) the monoboard contains the peripheral interface adapters called PIA1 and PIA2. It houses the central processor unit chip the M6800 microprocessor chip itself. It houses the 1K of random access memory used in scratch computations by the processor. It also houses four ROM chips for program storage. The processor board also houses the ACIA which is an asynchronous communications interface adapter. This chip is used to drive the external printer. The next board housed in the microprocessor system is a circuit board designated the 1A4 printed circuit board (FIGS. 8 and 9). This circuit board houses a programmable timer module used in the basic timing control necessary for executing the software instructions performed by the central processing unit. Also on the 1A4 card is an additional 1K by 8 bit RAM for additional scratch and computational purposes as well as a global timer and reset circuitry which will be discussed in more detail below.

Figures 1, 10:
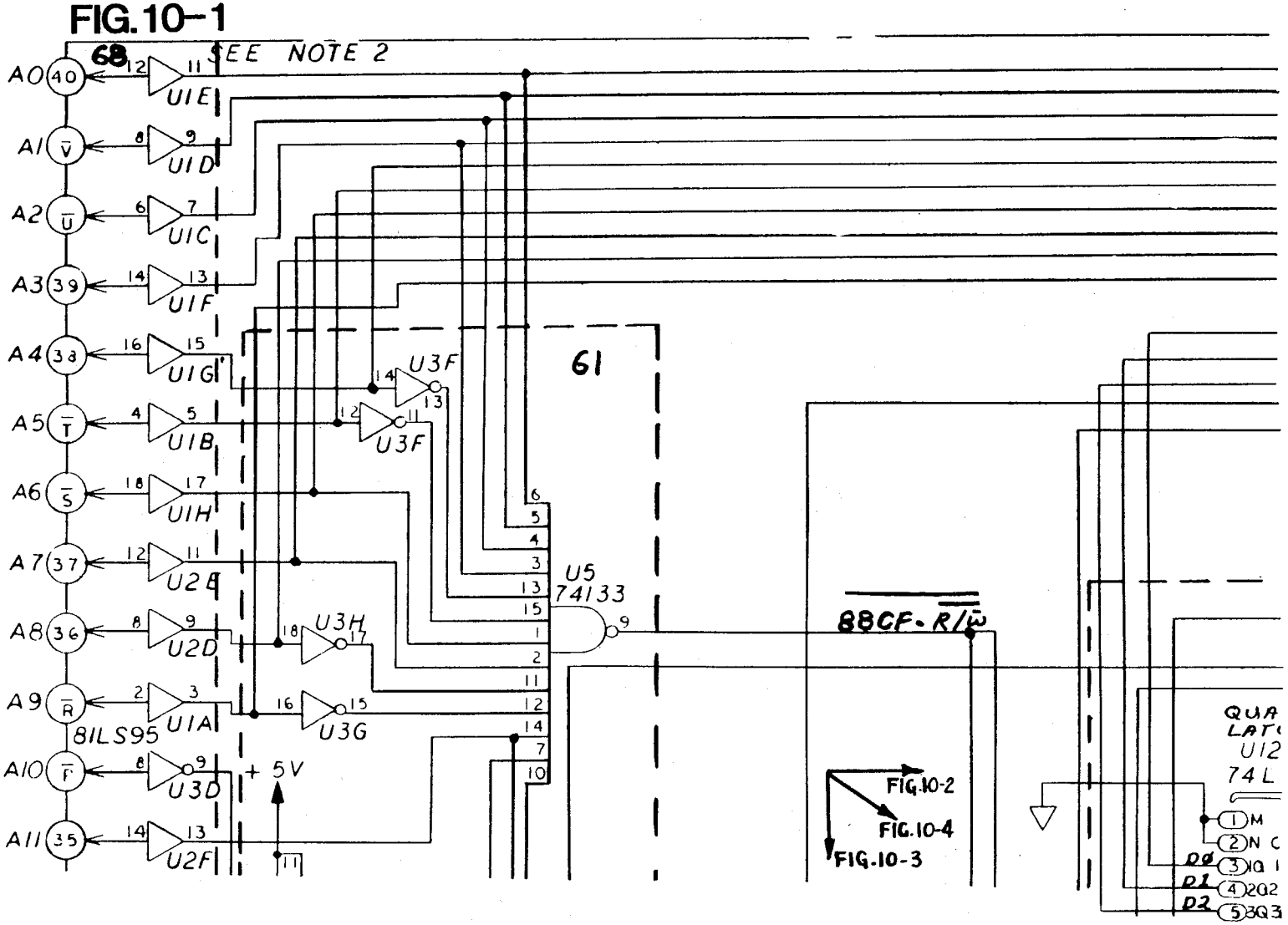
Figures 2, 10:
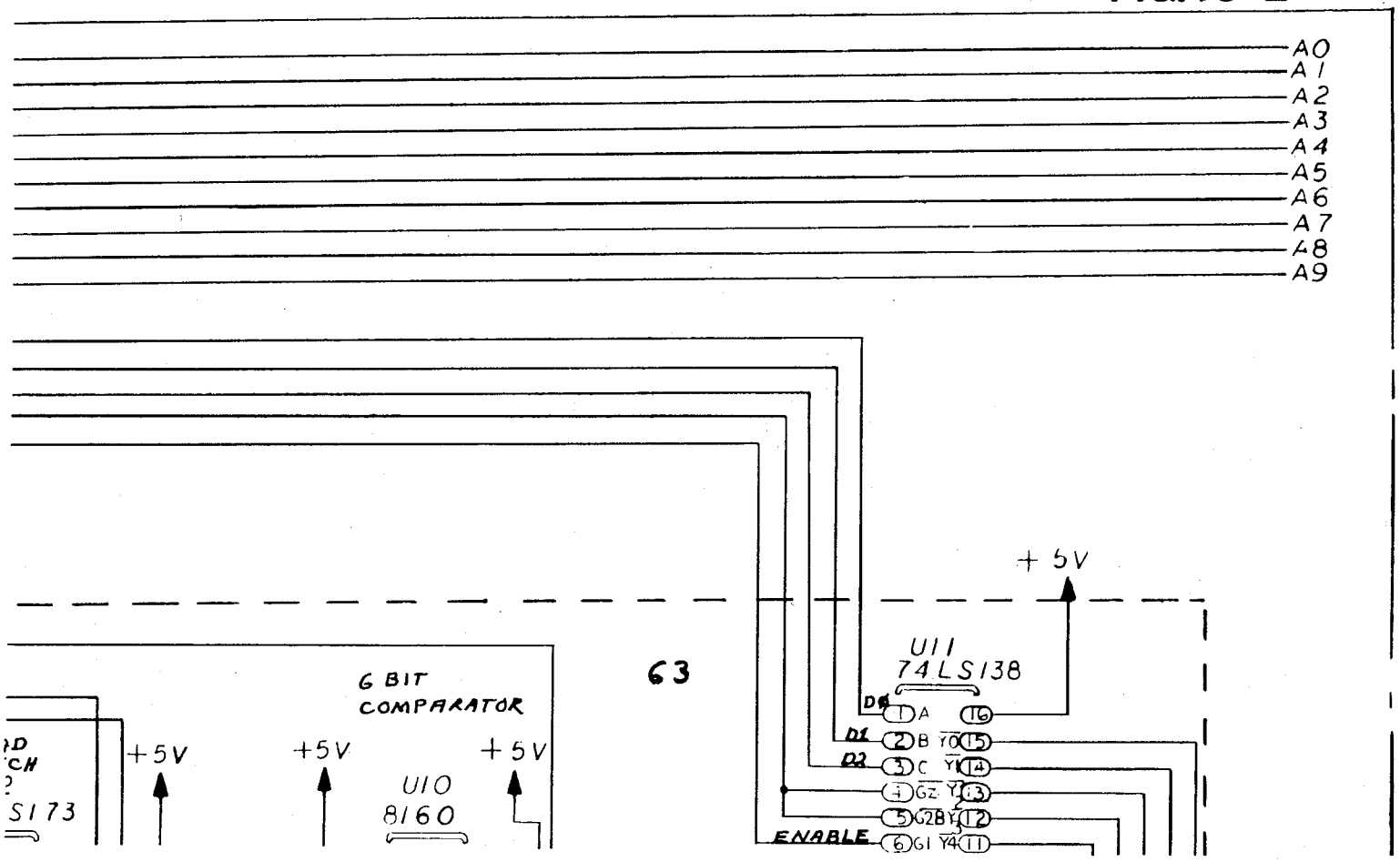
Figures 3, 10:
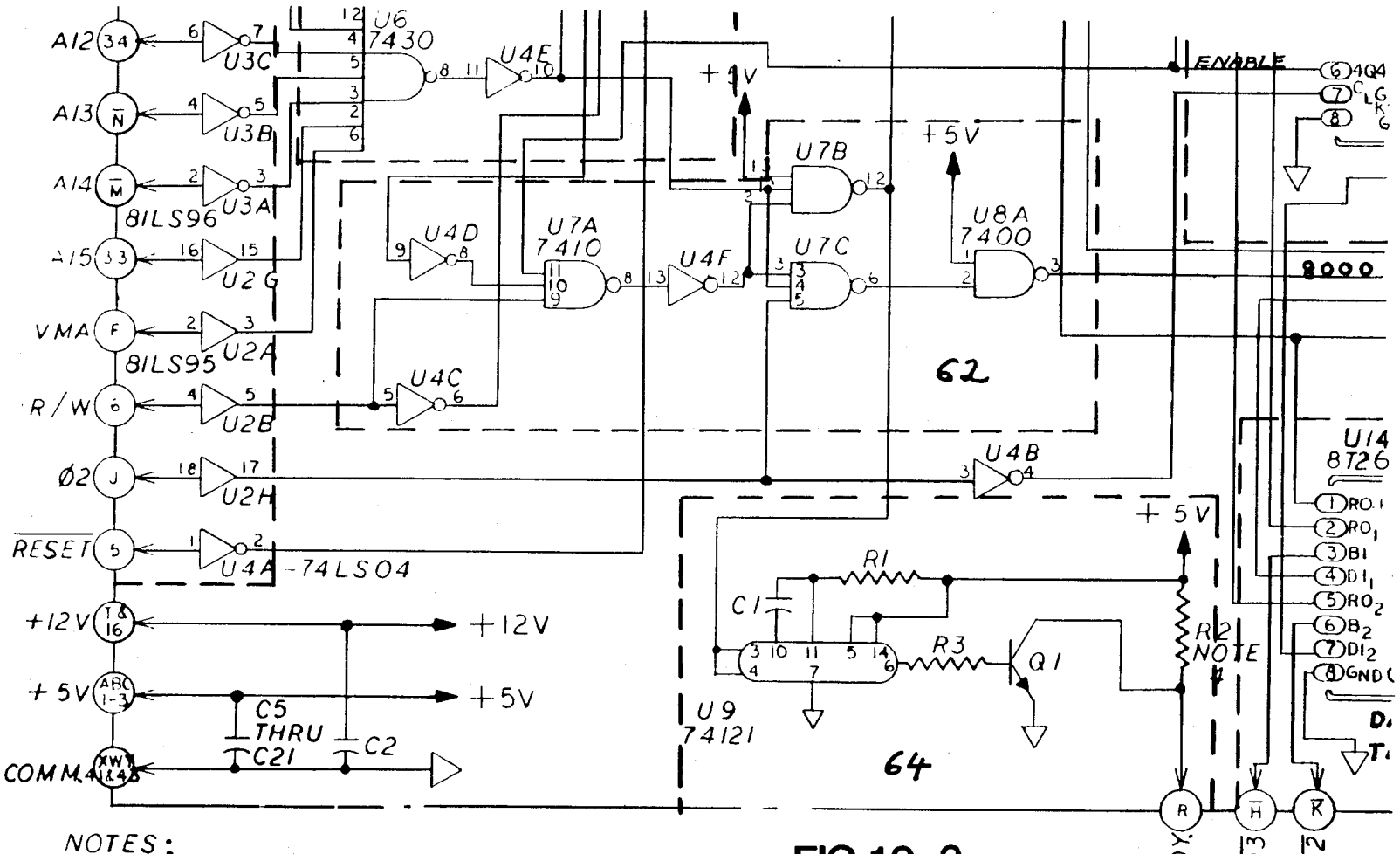
Figures 4, 10:
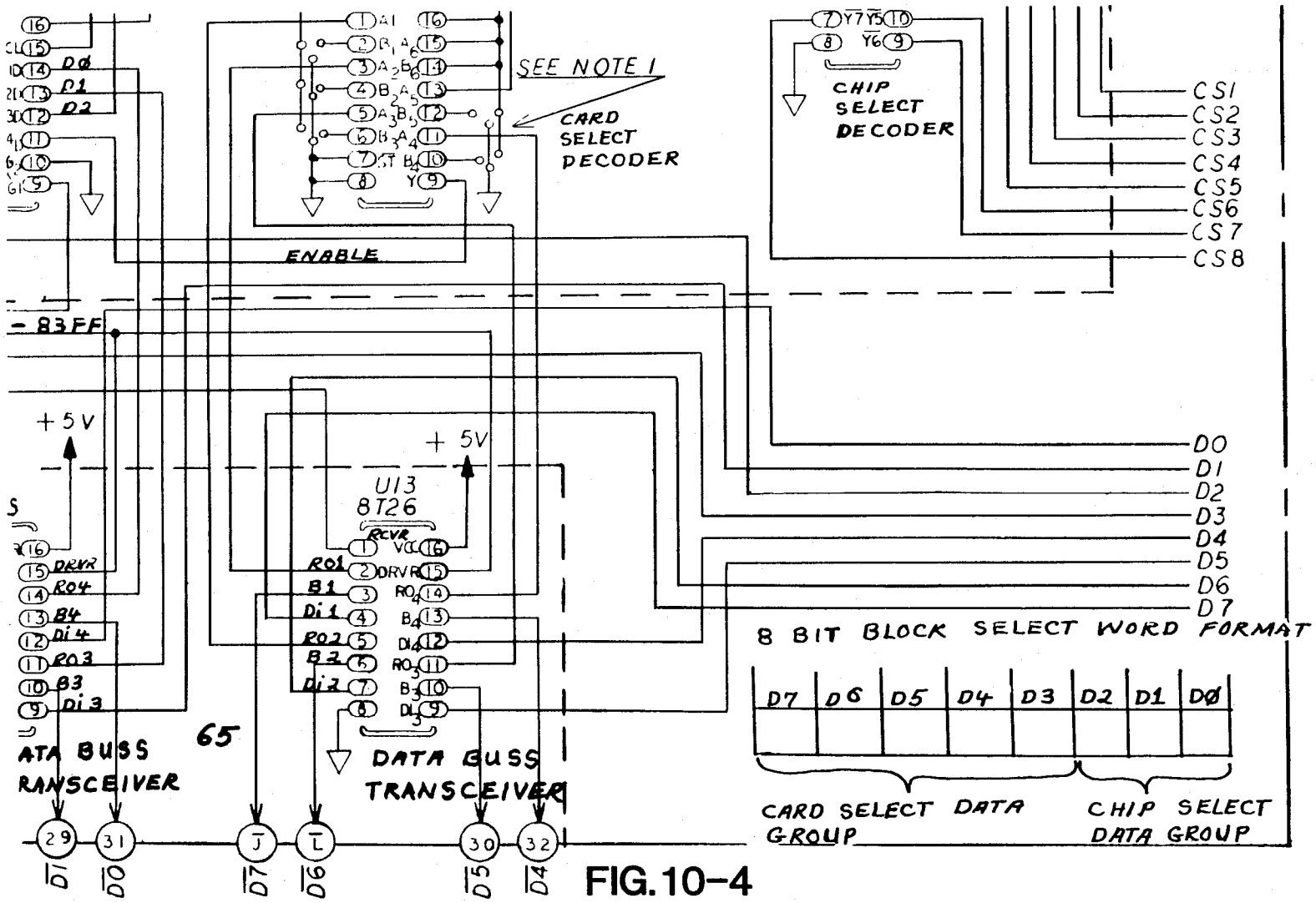
Figures 1, 11:
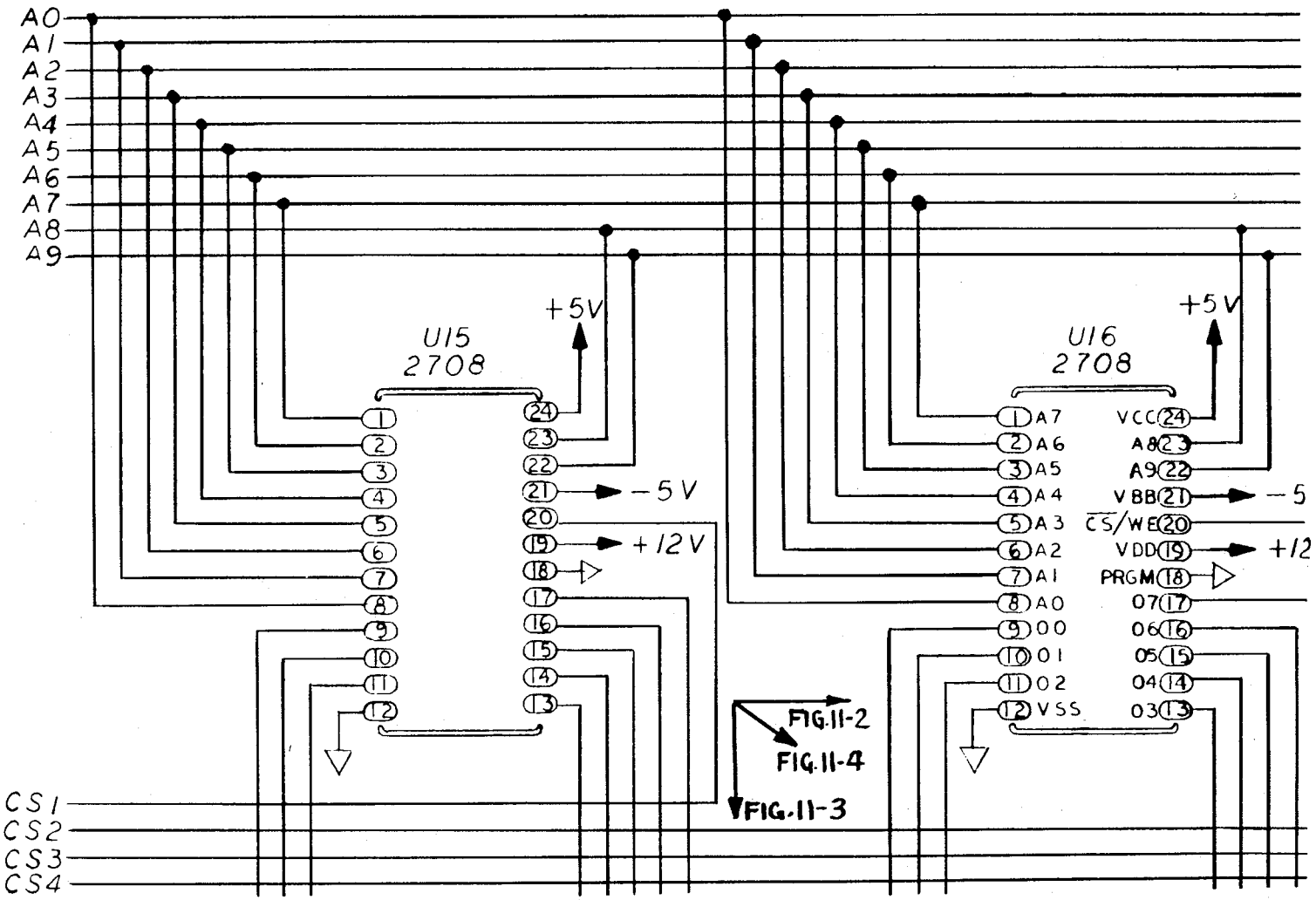
Figures 2, 11:
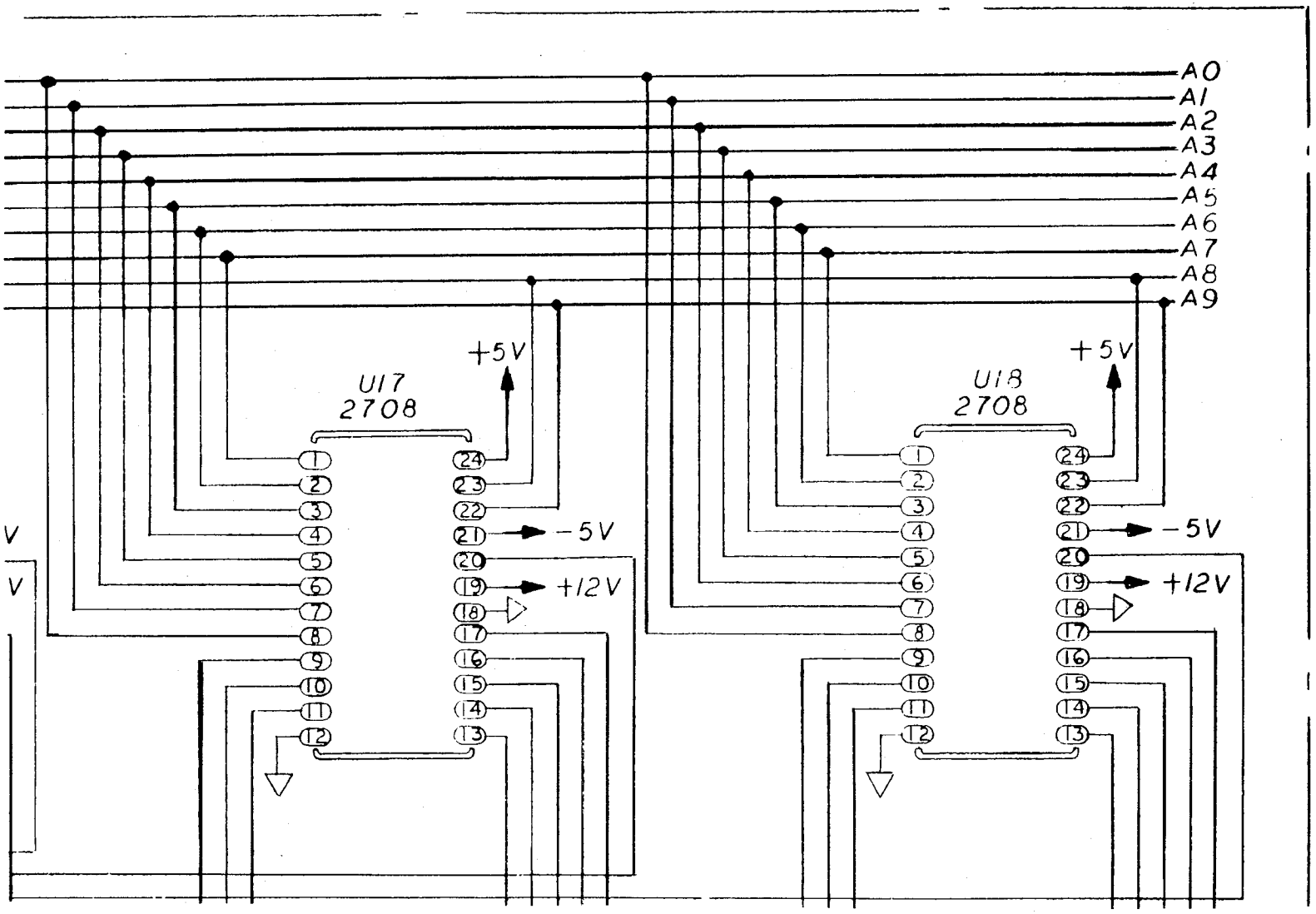
Figures 3, 11:
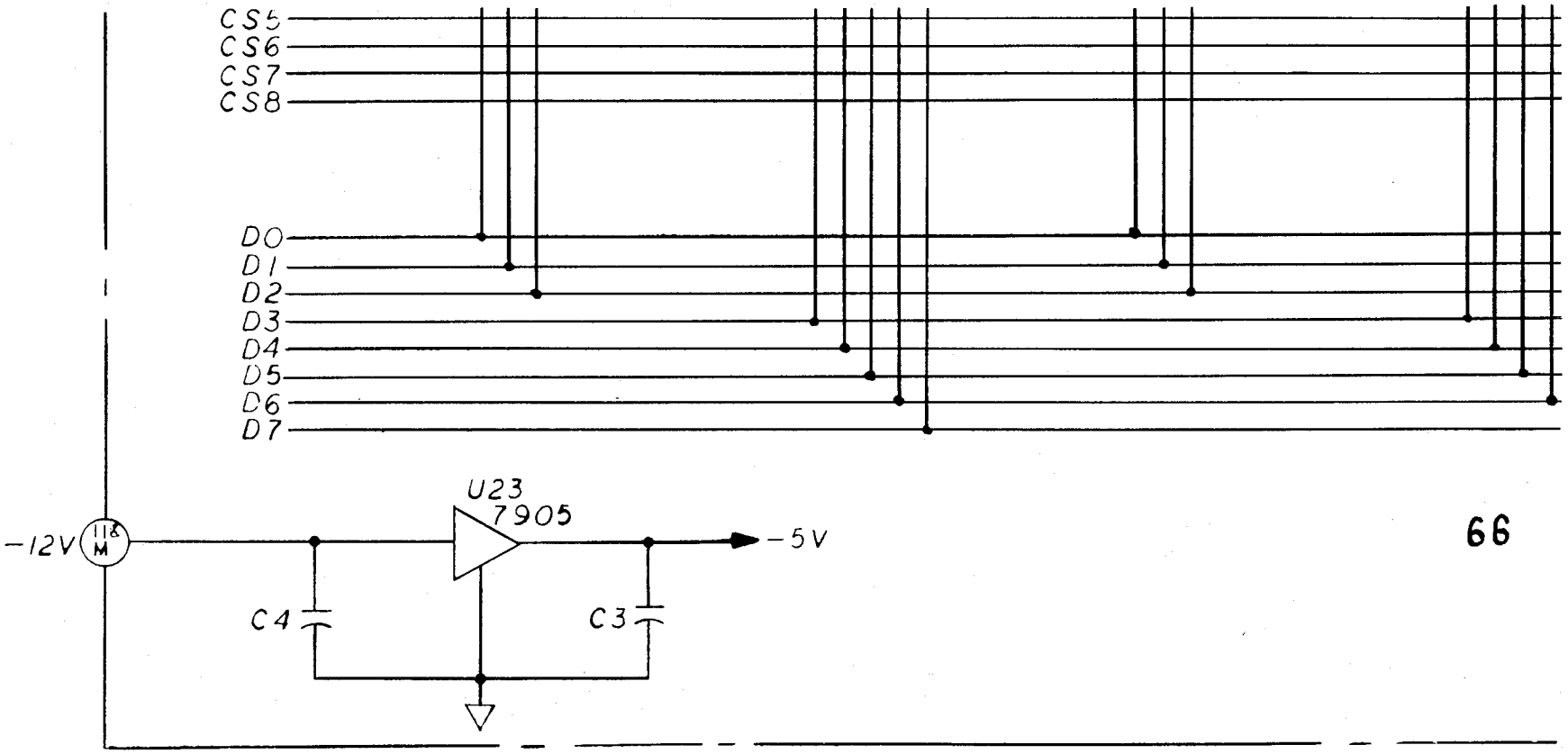
Figures 4, 11:
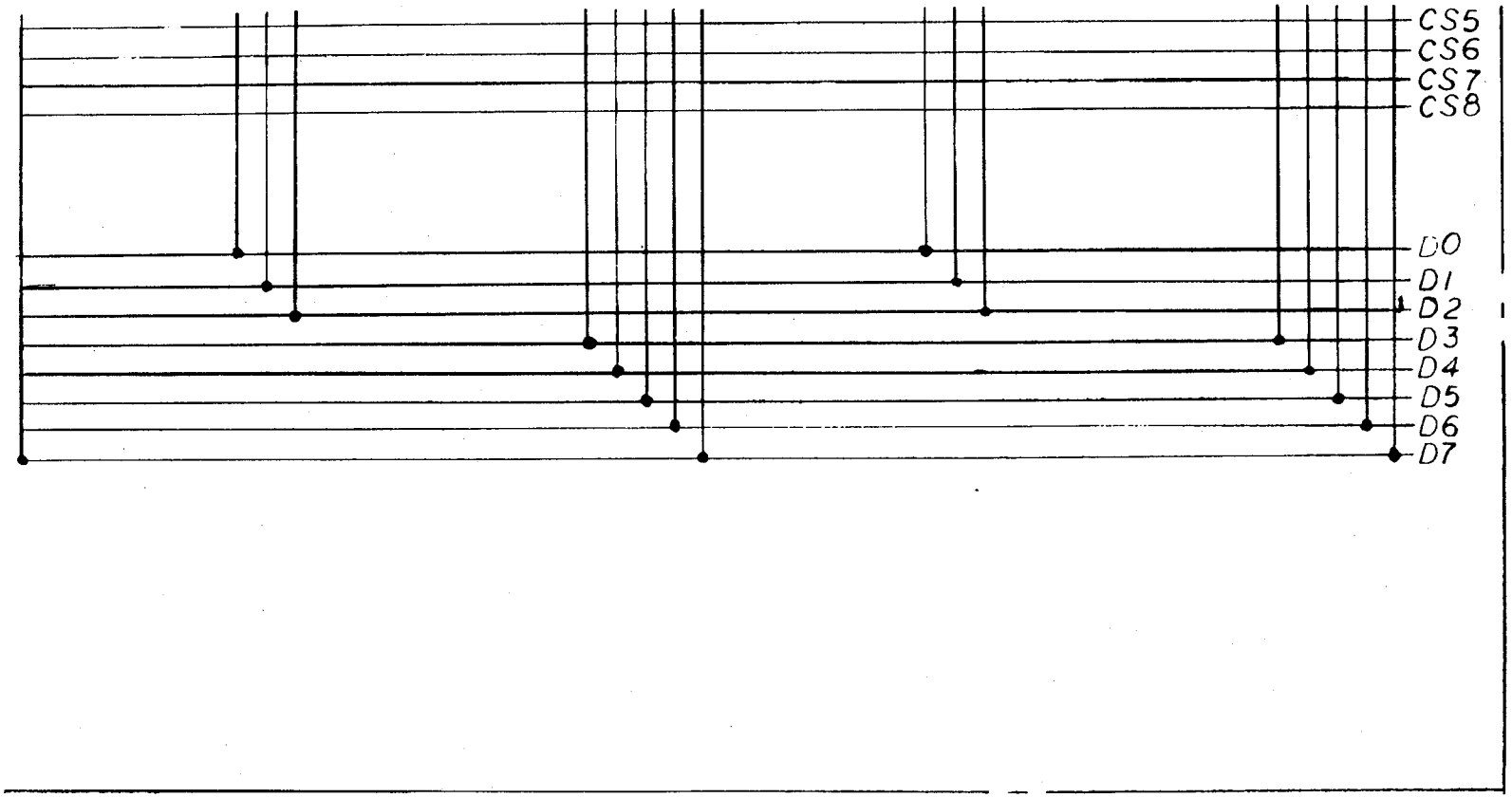
Figures 1, 12:
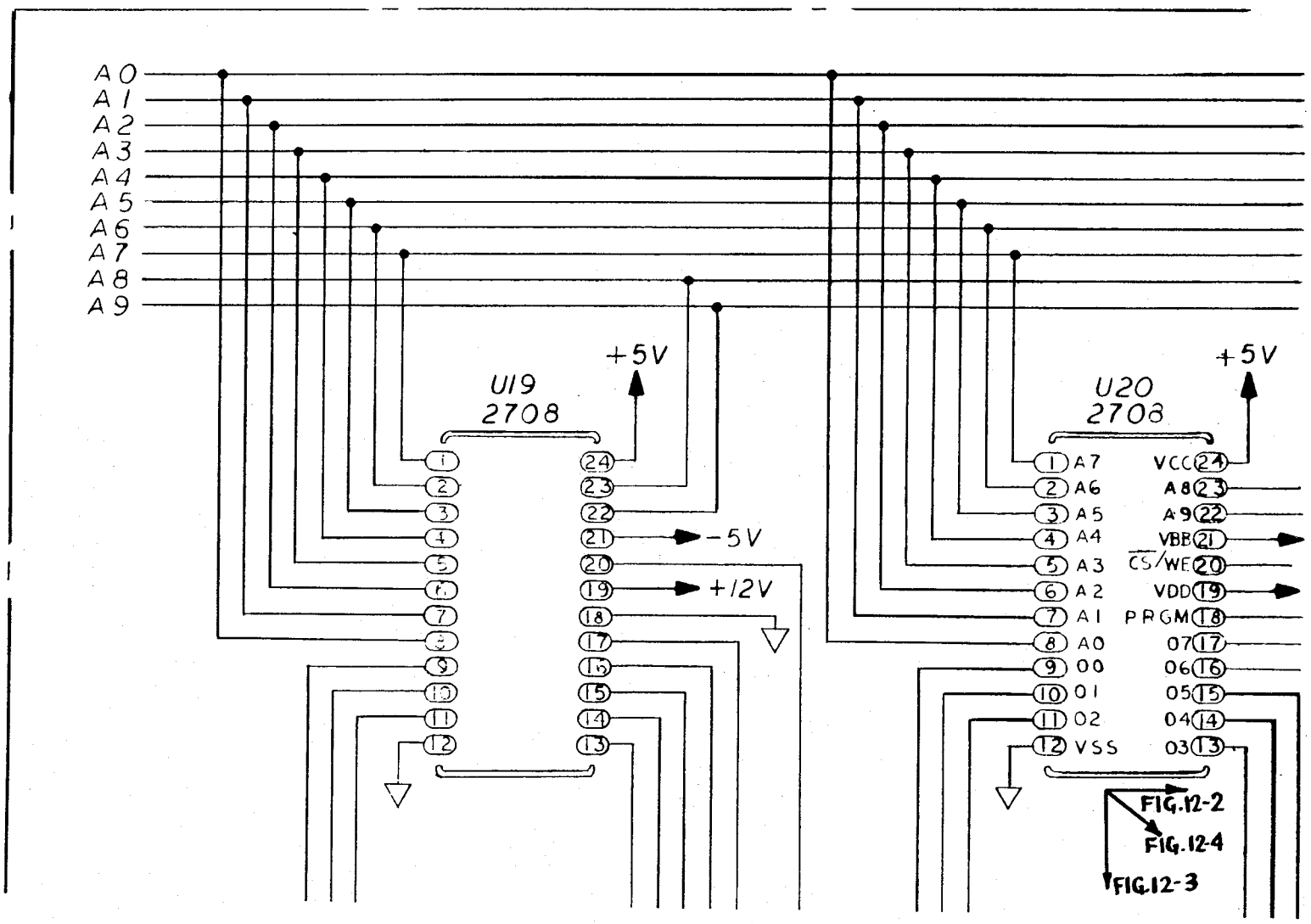
Figures 2, 12:
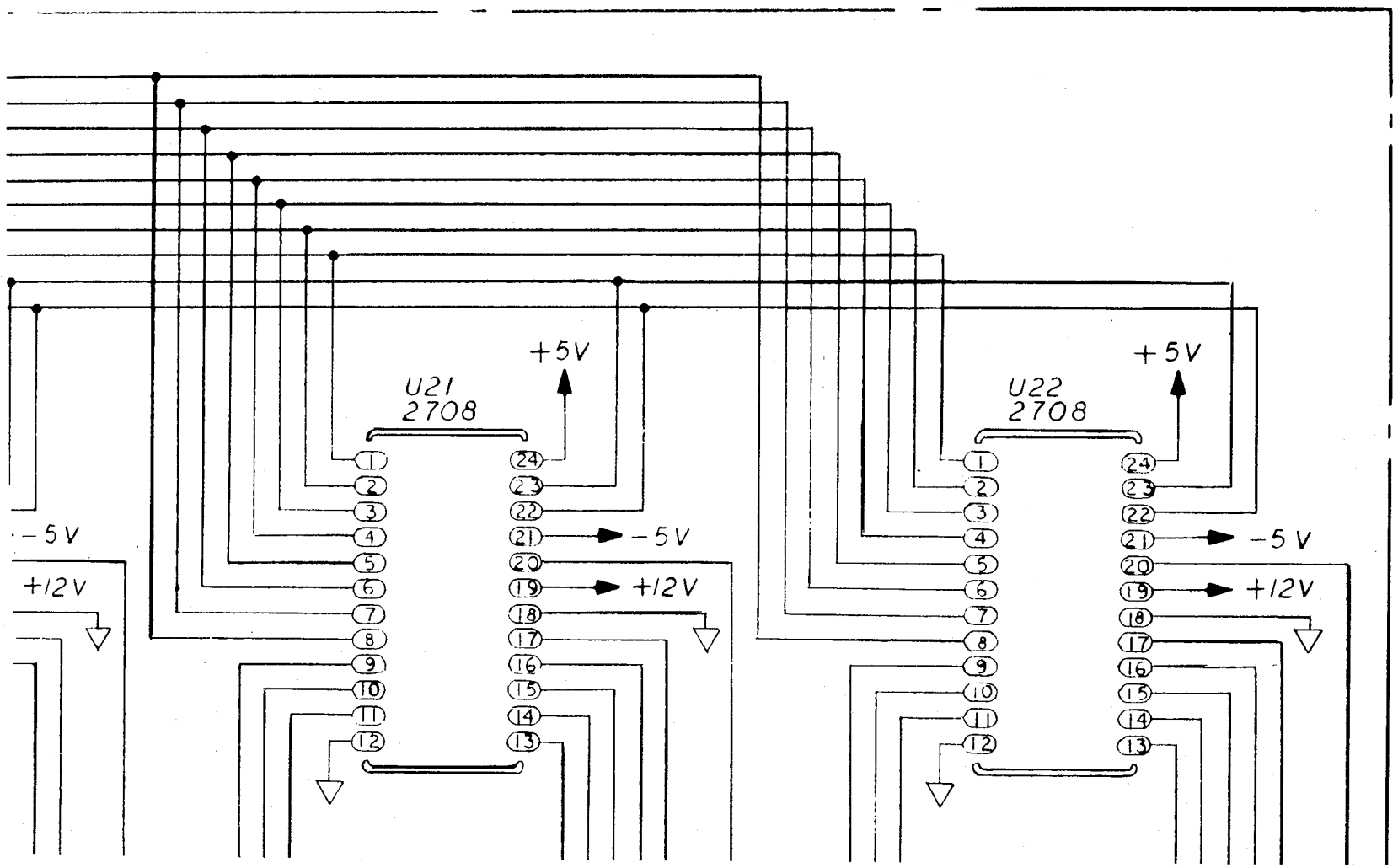
Figures 3, 12:
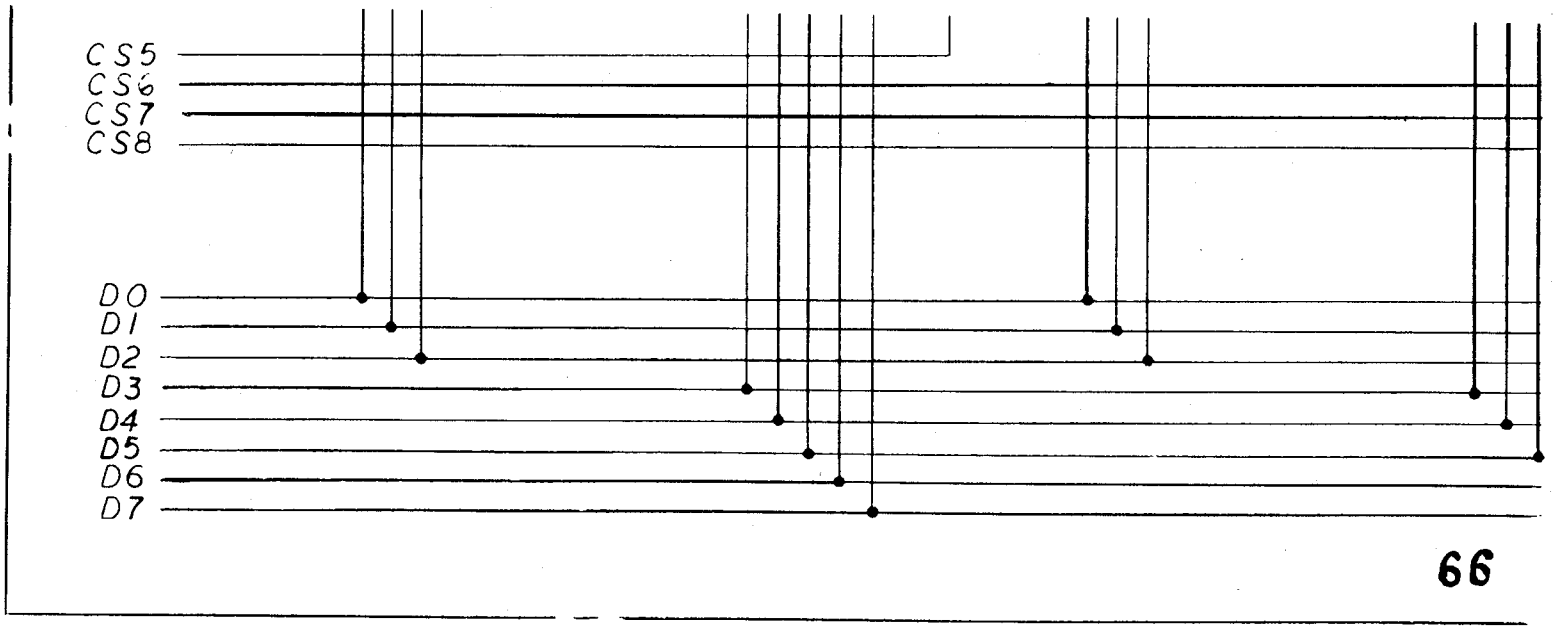
Figures 4, 12:
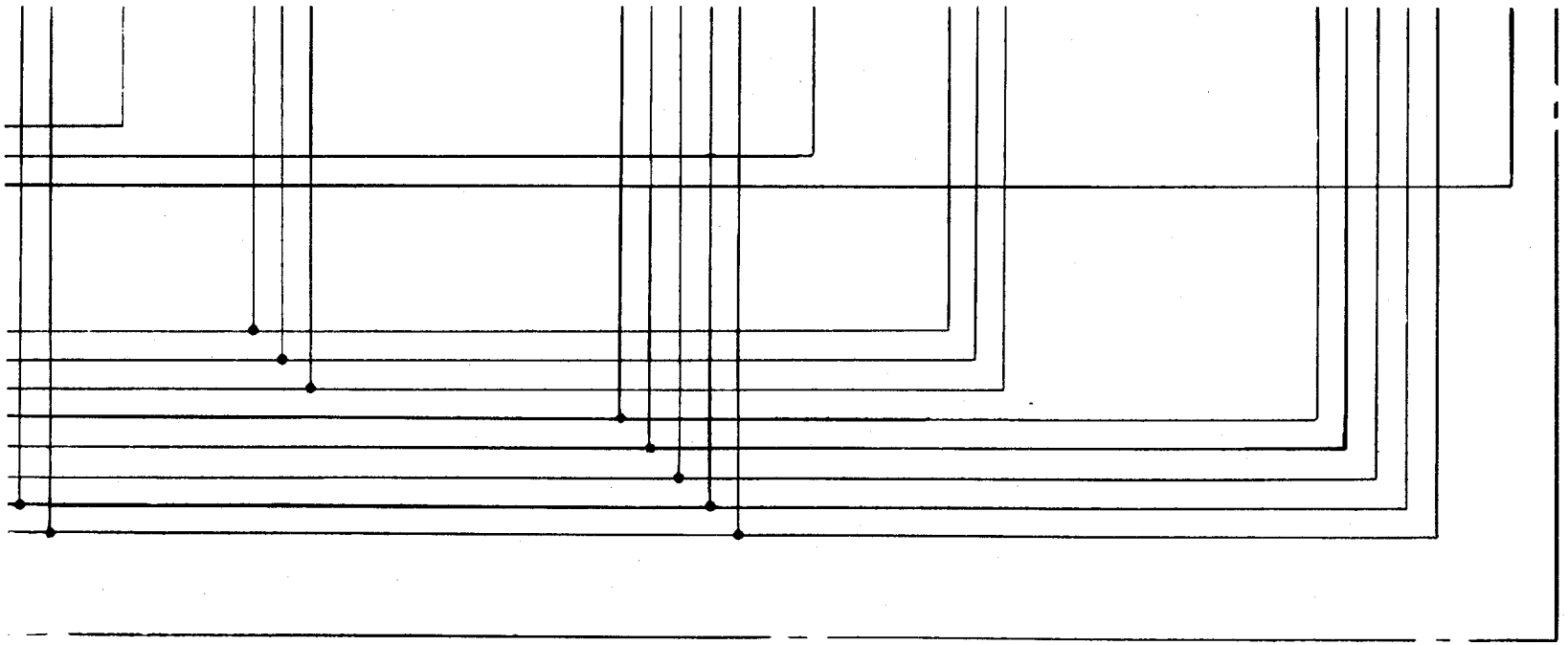

On the block diagram for the microprocessary system (FIG. 2) are shown installed five 1A5 PC boards (FIGS. 10 to 12). There can be from five to six 1A5 PC boards installed in the main frame and these 1A5 printed circuit boards house the digitized voice information stored in semiconductor ROMs mounted on these boards as will be discussed in detail below. A 1A2 printed circuit board shown in FIG. 2 is a board manufactured by Motorola, Inc. and is used to house additional ROM program chips for program storage. A detailed schematic of circuit board 1A2 can be found in referencing the M68MM04D Motorola manual, drawing number 63DW1201X.

Referring to the block diagram for the microprocessor unit, FIG. 2, and looking at the 1A3 printed circuit board diagram (FIGS. 5 to 7) there is essentially a 16 channel, 8 bit wide digital multiplexer circuit enclosed in the inscribed block number 51. The 16 channel multiplexer is addressed from the microprocessor address bus. The addresses for the 16 channel multiplexer are address decoded and the base addresses for the 16 channel multiplexer are 88FFO through 88FF. The output of the 16 channel, 8 bit multiplzer is an 8 bit data bus, D1 through D7, which feeds into data bus buffer drivers inscribed in block 50 and then interface with the microprocessor data bus structure. In block 52, the inscribed circuitry is utilized to essentially stop the processor during the time the external calendar block and/or temperature input sensors are updating. The output interfaces with the microprocessor control bus to inhibit the processor during any updating of the external inputs. Around the periphery of the 1A3 circuit board are all the inputs from the various devices that input to the digital multiplexer. Basically, there is a calendar clock that feeds month, day, hour and minute information which is introduced and fed into the 16 channel multiplexer for use in print out information. The input multiplexer also receives information from unit 3 front panel dial called a friction multiplier dial. The friction multiplier dial is a two digit BCD (binary coded decimal) output front panel switch that inputs information used in determining an overheated defective friction type bearings. The digital multiplexer also receives information from unit 3 front panel roller multiplier switch which also is a two digit BCD output switch for introducing a roller multiplier constant that is front panel adjustable and used in determining when a roller bearing, that is scanned by the sensors, has been overheated. Also, from the unit 3 front panel transducer spacing information is received, in the form of a two-digit binary coded decimal input constant which is front panel adjustable and is fed in through the digital multiplexer to be utilized in the computation of speed and length of train, such that any error in installation of the distance between the A and B rail mounted transducers from the prescribed 28 inches can be front panel adjusted for any mounting discrepancy of these transducers at the rail side.

Figures 1, 15:
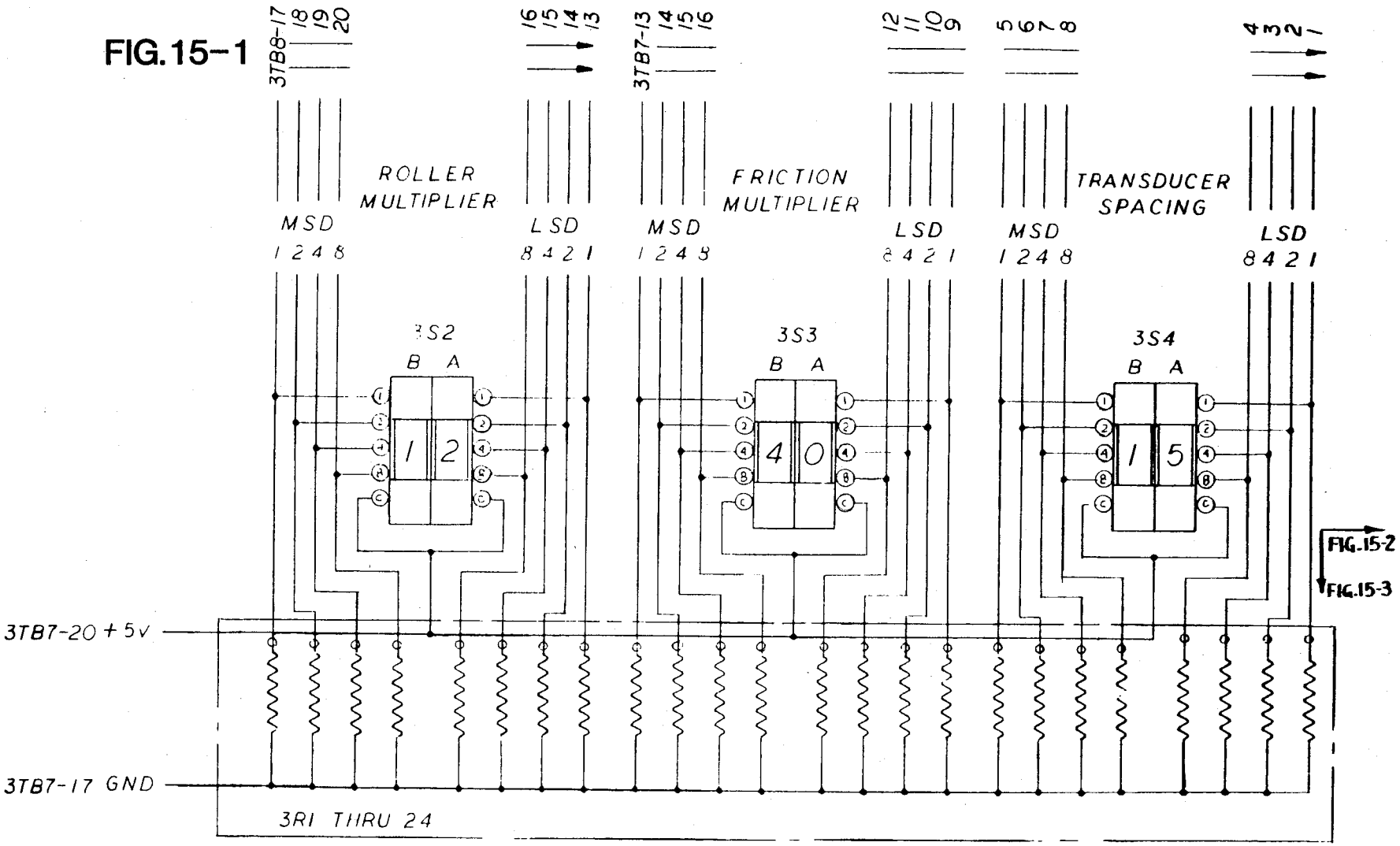
Figures 2, 15:
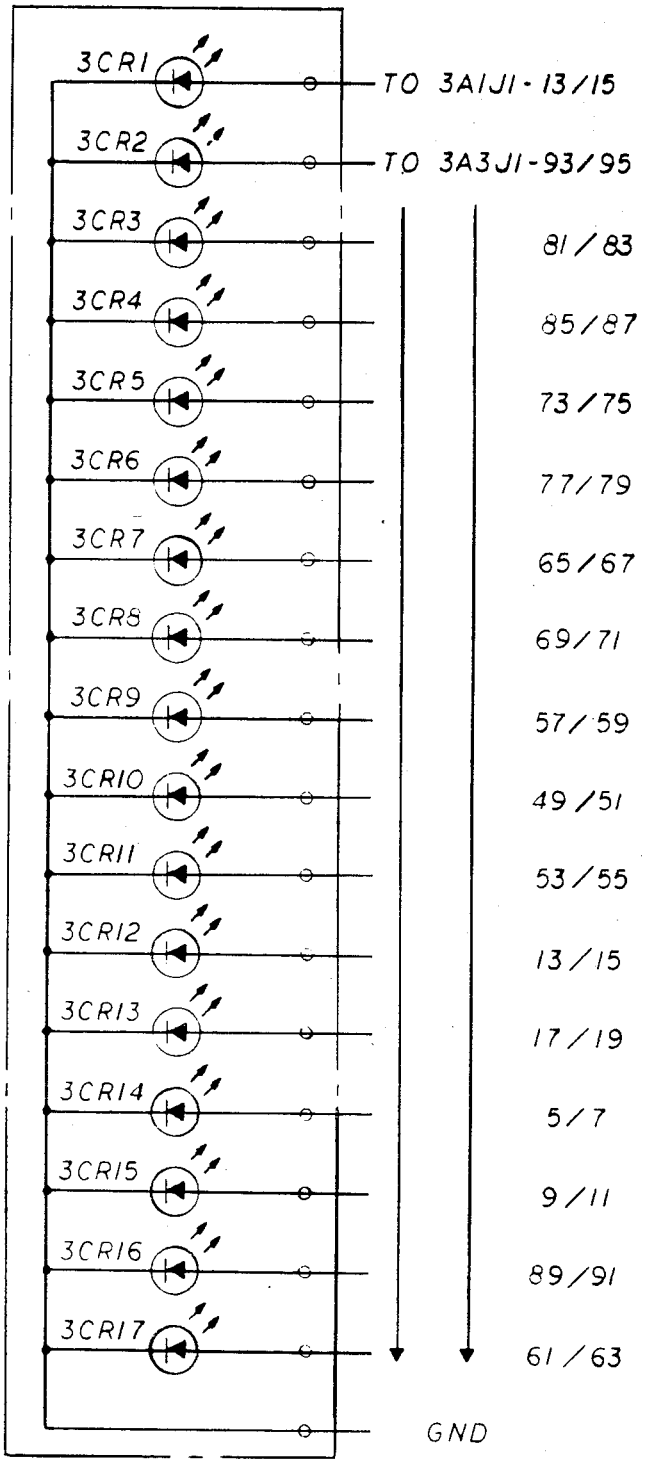
Figures 3, 15:
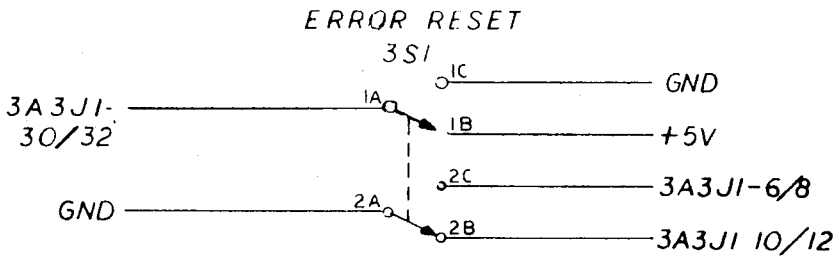
Figures 1, 2, 16:
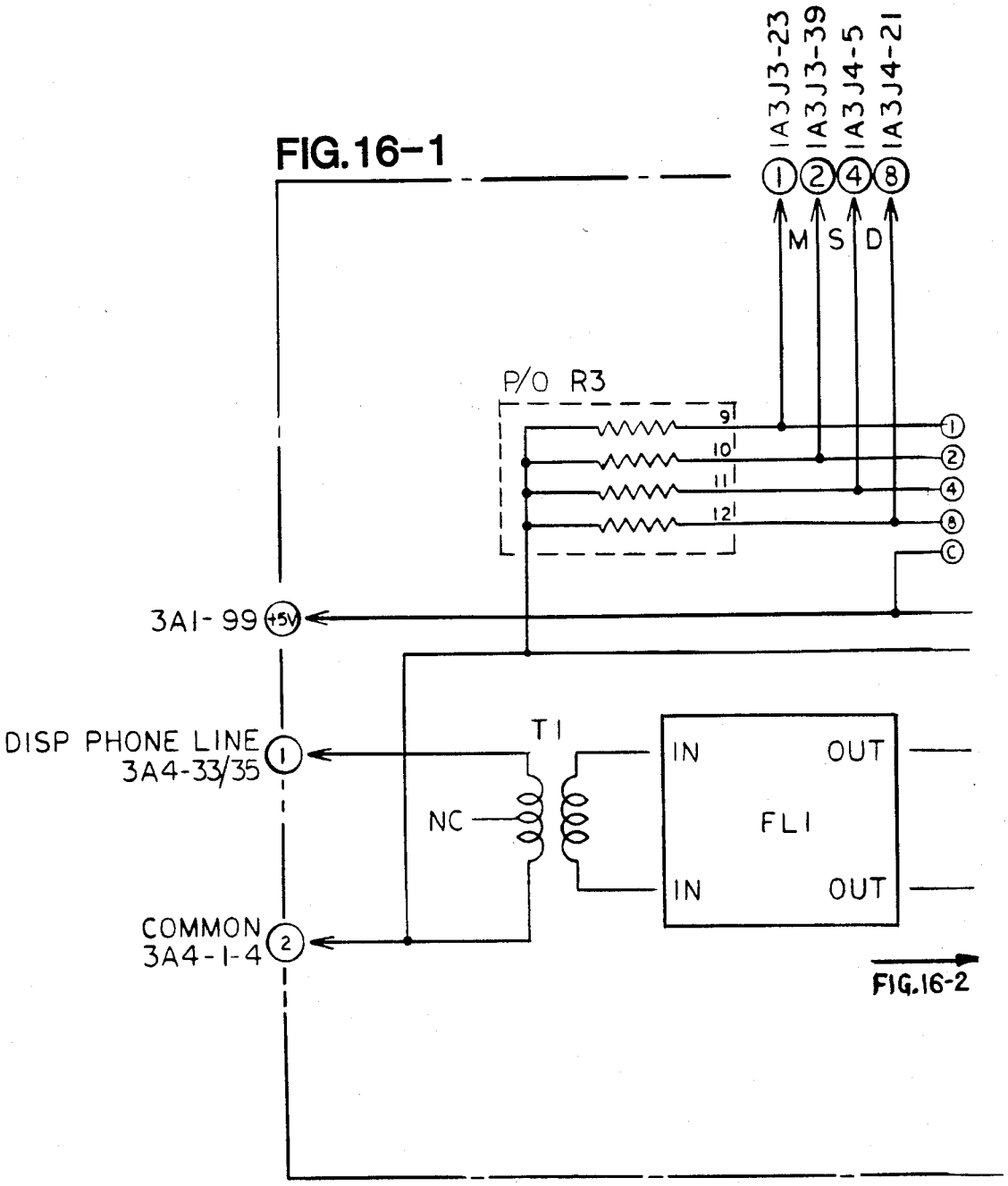
Figures 2, 16:
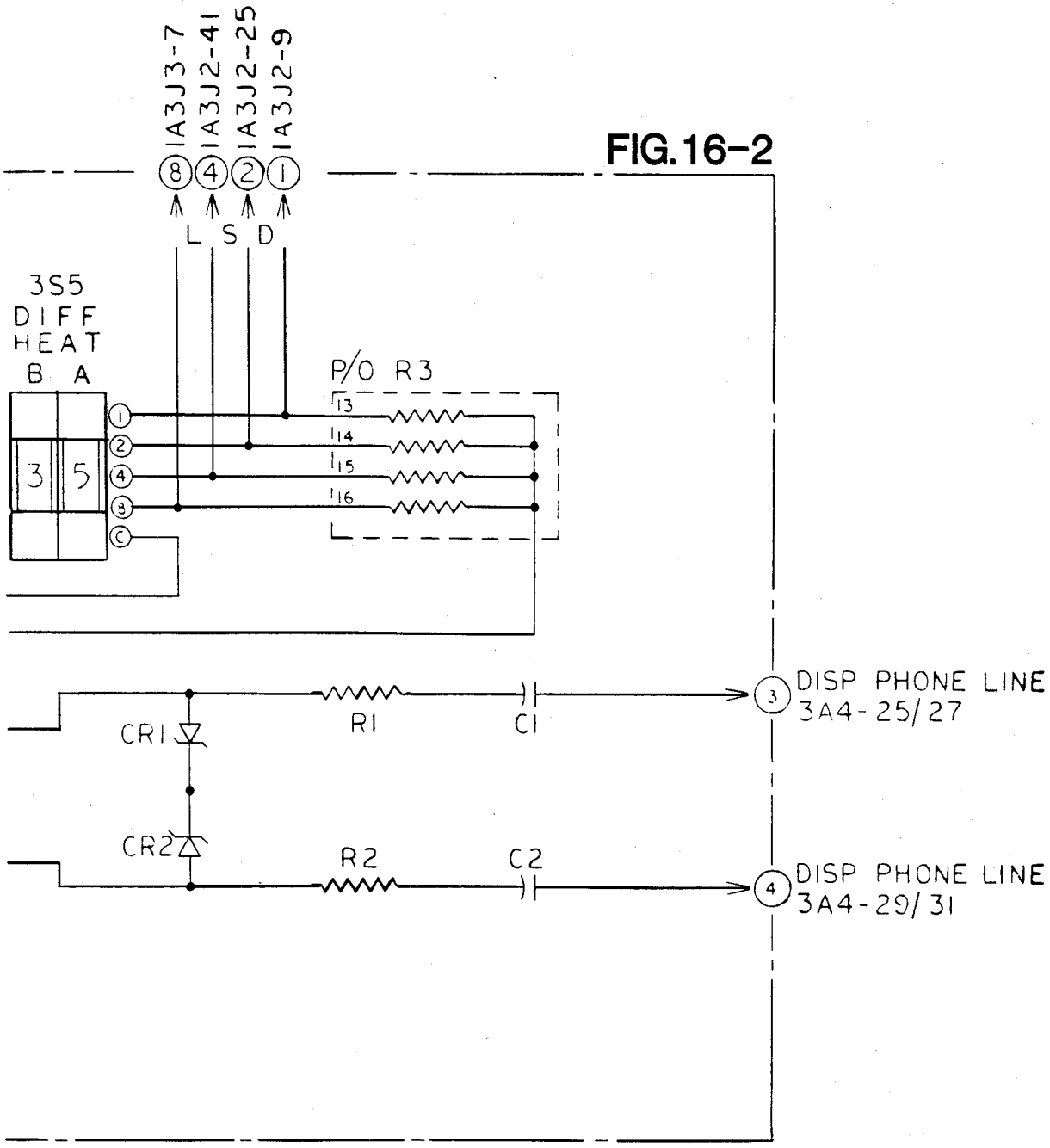

Refer to the unit 3 front panel schematic, FIG. 15, for the configuration of these switches and also the layout of the error lights used in conjunction with the 3A3 printed circuit board error detection output (FIGS. 13 and 14).

Referring to the 1A3 printed circuit board detailed schematic FIGS. 5 to 7, and at the inscribed block 49 in FIG. 5 which contains the address decoding circuitry, U1 and U2 are address buffer drivers that interface with the microprocessor 16 bit address buses A0 through A15. The outputs of these buffers are connected in a decoding scheme through U3A, U3B, U4A, U5, U3C, U3E and U4B such that, whenever the microprocessor is addressing addresses 88FO hexadecimal through 88FF hexadecimal, the digital multiplexer is enabled and will assume an input channel 1 through 16, depending on the specific address addressed at the time. For example, if the microprocessor puts out address 88FO hexadecimal on the address bus, the address bus buffers U1, U2, then feed the address decoding logic. The address decoding logic detects the address 88FO and pin 8 of NAND gate U4B enabling strobe or enabling gate which (a low digital level signal at this point) will enable, through the bus line to the 8 chips comprising the 16 bit channel multiplexer, all of these chips at this time.

Referring to block 51 and integrated circuit chips U8, U9, U10, U11, U12, U13, U14 and U15, these 1 bit 16 channel multiplexer chips make up the 8 bit, 16 channel multiplexer. A three line encoded bus, buses all 16 channel multiplexer chips together. At U8 on pins 11, 13, 14, 15 which make it a four line encoded bus, buses A, B, D and D on pins 15, 14, 13 and 11, respectively, comprise a four bit bus which, when decoded, will position each of these chips from channels 1 through 16. Now, in the example, if an address of 88FO is placed on the address bus, an enable strobe from the output of U4B is provided, enabling all multiplexer chips at this time, and since the last significant digit of the 88FO address is 0, the base address lines from the computer processor bus which are A0, A1, A2 and A3 are now binarily coded for a binary 0 which is all lines A0 through A3 in a low condition or low state. The multiplexer chips, on their buses, will receive the low state for code lines A, B, C and D, therefore positioning the multiplexer to pick up channel 1 input on all 8 multiplexers. This is a typical example of how the multiplexer is addressed and positioned. As the addresses 88FO through 88FF are placed on the address bus, the multiplexer can be made to switch to any one of 16 input channels to pick up the digital information from the external world.

Referring to FIG. 7 of the 1A3 schematic, block 50 has an 8 bit data bus buffer driver. The outputs from each of the multiplexer chips U8 through U15 feed the 8 bit data buffer driver U16 inscribed in block 50. Therefore the 8 bit binary word that has been input through the input digital multiplexer will now be presented to the microprocessor data bus at the card edge pins 29, 30, 31, 32, $\overline{L}$, $\overline{K}$, $\overline{J}$, and $\overline{H}$. This completes the cycling of the input multiplexer and the input digital 8 bit binary word through the input multiplexer onto the microprocessor data bus.

Referring now to the system timing 1A4 printed circuit board, FIGS. 8 and 9, and the block diagram, FIG. 2, the basic function of this board is to house the programmable timer used in system timing functions, 1K of random access memory used for scratch pad memory and a global timer and reset circuitry that will be discussed in more detail below. Referring now to the detailed circuit schematic diagram FIGS. 8 and 9 for the detailed circuit layout, on FIG. 8 of the detailed schematic, inscribed in block 57, are the input address bus buffer amplifiers that interface the 1A4 PC board to the address bus lines A0 through A15 as well as the VMA line, the read and not write line (R/$\overline{W}$), the memory clock and the system reset lines. The circuitry inscribed in block 58 is all the address decoding circuitry used to decode addresses as outlined above and in the notes 1, 2, 3, 4, and 5 in FIG. 8. Referring to the inscribed circuitry in block 53, the microcircuit logic chip U14, is a programmable timing device 6840 chip manufactured by Motorola and contains software programmable timers in this micrologic circuit chip. It is programmed by an 8 bit instruction word from the data bus and, with its associated control, and, noting pins 18, 19, 20, 21, 22, 23, 24 and 25 of this device, it will be seen that these pins do interface with the data bus lines D0 through D7. This device is under complete program control and not only receives data from the data bus, but outputs data to the data bus in its timing and control function for precise timing utilized in the execution of the operating software of this system. This timer has a master reset and, referring to inscribed block 56, the circuitry inscribed, U11 and the associated components comprise a basic monostable multivibrator. Pins 3 and 4 of U11 show that this monostable multivibrator responds to hexadecimal address of 88E7 and VMA from the microprocessor. For example, whenever an address of 88E7 is placed on the address bus by the microprocessor, and this is ANDED with the VMA, the U11 will respond and output a 1 microsecond pulse on pin 6 of U11 which is fed into the programmable timer U14 on pins 2 and 26. This is a master reset that will rest and clear any program instructions input into the programmable timer.

Referring to FIG. 9 of the 1A4 printed circuit board schematic diagram and the circuitry inscribed in block 54, there are two one K by 4 bit random access memory chips configured in a 1K by 8 bit memory configuration. The address lines respond from address lines A0 through A9. The data lines interface to the microprocessor data bus through data bus drivers contained in the inscribed block 59. U19 and U18 are bus compatible transceiver data bus drivers. The data bus drivers receive data input from the data bus and also output data from the programmable timer onto the data bus, under instructions and program control of the operating software.

Still referring to FIG. 9 of the schematic diagram, the circuitry inscribed in block 55 contains the reset circuitry for master or global timer reset control. The circuitry inscribed in this block is used in the event that the processor, through spurious transients or random interference, has been bumped from its program set of instructions. A global reset timer will eventually add a prescribed time delay, apply a reset pause. Transistor Q2 in the inscribed block 55 has its collector tied back (refer to FIG. 8) to card edge pin #5 which is the processor system reset bus line. In the event that the processor has lost control of its program (a time delay of two minutes is normally set) after two minutes of program loss, transistor Q2 (FIG. 9) is turned "on" to a conducting condition by the associated circuitry, thereby pulling the system reset line at pin 5 (FIG. 8) to a low condition. This causes the microprocessor to execute a master reset and will master reset through an initialization routine and will begin executing proper program instructions after the master reset has occurred. The components that comprise the circuit are as follows.

Referring to U23 in FIG. 9, which is a standard TTL 74121 monostable multivibrator, this monostable multivibrator has a time constant determined by R4 and C3 of approximately 500 milliseconds. Monostable multivibrator U22, using a 555 precision timing device, has its time constant set by R3 and C1. In the event the time of U22 is permitted to lapse, then its output at pin 3 will trigger monostable multivibrator U23, causing a half second or a 500 millisecond reset pulse through Q2 to reset the processor. The unique feature of the global reset timer circuitry involving U22, Q1 and SCR control device Q3, U20D, U21B, U21A, U15B, U12D, U15A and U13C will now be discussed with reference first to U15A and U15B in the inscribed block 55. These two five input NOR circuits comprise a data bus sampling circuitry. The inputs to U15A are tied to data bus line D0 through D4 and U15B inputs are tied to data bus lines D5 through D7. Pin 8 of U15B is tied back to the address decoding scheme and will respond to address 88E6 hexadecimal. All valid and legitimate routines in the program have subliminal or buried reset instructions contained in them so that, if the processor at any time is running a legitimate program set of instructions, periodically, the global reset timer chip U22 will be reset, to prohibit or prevent a system master reset occurring as long as the processor is executing legitimate routine program steps. A subliminal reset pulse is fed to prohibit the discharge or the reset occurring at the global reset timer chip U22. Before discussing the software control of this resetting function of the global timer, reference is made to FIG. 9 and U22, the global reset timer capaciter C1, connected to pins 6 and 7 of U22, resist R2, SCR Q1 and transistor Q3. The global reset timer chip U22, utilizing a 555 standard precision timing device, operates in the following manner. As capacitor C1, connected to pins 6 and 7, charges through adjustable resistor R3 toward +5 volts, when the capacitor reaches a charge of about 3 volts, the 555 timing device will first or discharge and generate an output pulse at pin 3, to initiate the master reset cycle. The function of transistor Q1 is to continually discharge capacitor C1, preventing the charge from reaching the firing point and thereby preventing U22 global timer from firing or its time to lapse to the point of firing U22. Q1 is an SCR semiconductor control rectifier device and a pulse occurring on the control gate from the emitter of Q3 will fire Q1 in a typical SCR conducting mode, thereby discharging the capacitor C1. Once the charge on capacitor C1 has been removed and the discharge current has dropped below quenching, the SCR device Q1 assumes a non-conducting state and capacitor C1 now attempts to charge again. The routines that are contained in this operating system have buried reset commands.

In all routines, there are instructions written to address a hexadecimal address of 88E6 on the address bus. At the same time 88E6 address has been placed on the bus, a data bus word of 00 hexadecimal is placed on the data bus. Referring to inscribed block 55, U15A and U15B will now sample the data bus and, if all data bus lines are zero, then at the output of U15B pin 6 will assume a high level state. The high level state of pin 6 is fed to U21A pin 1, and when VMA assumes a high state, a high state will occur at pin 3 of U21A. This is fed to pin 4 of U21B and, at the output of U21B, pin 6 will assume a high level when a write instruction has been placed on the read-write bus. The high level at the output of pin 6 is then fed to OR gage U20D, turning on transistor Q3, thereby firing SCR Q1, which will assume a conducting state and conduct until capacitor C1 is discharged. This concurrent and repetitive action occurs at proper intervals in all legitimate routines such that the master reset is prevented from occurring as long as the processor is running the proper and legitimate routine or program set of instructions. If the processor is bumped out of its proper program instructions then proper reset instructions will not be received, Q1 SCR will not be fired or energized and capacitor C1 will eventually charge to the firing level. This causes U22 to initiate a master reset pulse. The time constant established by R3 and C1 is normally set for two minutes. In other words, after a two minute lapse after having received a reset pulse at the gate of Q1, the global reset timer will discharge and initiate a master rest pulse cycle. This concludes the discussion of the 1A4 printed circuit board.

Referring to the block diagram FIG. 2, there is shown installed in the processor main frame five of the 1A5 PC boards. Referring now to FIGS. 10 to 12 for a discussion on this circuit board, this circuit board constitute the very heart and essence of this system in that this particular circuit board stores the digitized voice memory and the scheme by which this digital voice is accessed which, of course, is part hardware and part software. The hardware part will now be discussed. The automatic voice defect detector system has incorporated therein two basic outstanding features that no other system heretofore has incorporated. First is the digitized human voice stored in the memory of the computer itself thereby eliminating any other media of voice storage such as closed loop tape decks, rotating drums and other moving devices for recovering voice. Also incorporated in this system itself is the alarm and detection circuitry. Heretofore, the alarm and detection circuitry has been external to any voice portion of a system, but here these two basic features are integrated into the system itself.

Before discussing the circuit schematic of the 1A5 PC board FIGS. 10 to 12, in detail, the circuit board itself will generally be discussed. The digitized human voice is stored in the ePROM chips (eraseable, programmable read only memory chips) or the non-alterable read only memory chips. The chips are basically 24 pin and store 1,024 bits of digitized data. In other words, 1,024 by 8 bit pieces of information are stored in the individual ePROMs and are referred to as 1K ePROMS, 1K by 8 bit. The 1A5 printed circuit board hosts eight of the 1K by 8 bit ePROMs. In other words, contained on one 1A5 printed circuit board are stored 8K bytes of digitized human voice. The logical storage of the words in the digitized vocabulary of these memory chips is in a contiguous chain such that when a word is to be annunciated, a search is begun at the beginning of the chain, and the search will proceed until the voice word or the desired word to be annunciated is found and then the desired word will be annunciated (the memory information will be read out at the locations determined by the operating program or the driving routine). The speech or talk routine that initiates the search looks for the word to be annunciated. The first two bytes of every word have specific encoded information utilized by the processor to accomplish its search through the voice chain. The first byte of every word contains the forward address of the next work in the chain and this byte is accessed by the computer and stored for reference in forward addressing to the next word location. The second byte of every word is the word identification number. Each word in the chain has been assigned an identification number. Therefore, whenever the processor is making its search, when it accesses the word desired and there is an identification number match, then that voice information for that word will be read out and annunciated as a vocal word. If the current word that has been accessed does not match, in other words, its identification number does not match the identification number of the word desired, then the computer refers to the forward address of the next word and immediately jumps to the address location of the next word and continues to jump through the chain until the desired word is found. There are some unique features with regard to the design of the software and the hardware portion of this speech recovery mechanism. One outstanding feature is that there is access to practically unlimited voice annunciation. However only using 1K or 1,024 addresses from the processor base memory map in the present configuration, up to 34,000 bytes of information are available while only 1,000 address locations from the base memory map of the processor itself are used. The digital voice package scheme is designed such that there is easy vocabulary or word expansion. In its basic configuration, expansion is possible up to 255 vocal words quite easily.

Referring to FIGS. 11 and 12, the circuit schematic of the 1A5 PC board, there is shown the detailed circuit layout of the eight ePROM voice chips storing the digitized human voice. The chips are configured in a typical bus configuration, that is address lines A0 through A9 are common to and shared by all chips on the circuit board. Data lines D0 through D7 are common to and shared by all chips on the circuit board. There is a chip select bus. Note in FIG. 11 chip select lines 1, 2, 3, 4, 5, 6, 7 and 8. These are the individual select lines that select and turn on the desired chip that may contain the information desired or, in the event of a search, each chip is sequentially searched and therefore sequentially enabled by the chip select lines as the search progresses through the memory chain for the desired word. Looking at address lines A0 through A9, these are ten straight binary coded lines that uniquely address each individual chip at 1,024 discrete and specific locations internal to the chip and these 1,024 locations are 8 bits wide, in other words, each address contains one byte or one computer word at each of these locations. Whenever a computer address is placed on the bus and decoded and the address is presented to the internal bus of the 1A5 PC board and appears on address bus A0 through A9, concurrent with that, when a given chip select has been enabled, then the data stored in that location of the chip will appear on the data lines D0 through D7, constituting the eight bit straight binary word. This eight bit binary word appears on the 1A5 circuit card data bus lines D0 through D7. Referring to FIG. 10 and looking at the inscribed block 65 at data bus transceiver chips U14 and U13, the data lines D0 through D7 are fed to the two quad bus transceiver drivers and the data information on these data lines are then interfaced to card edge connector at pines 31, 29, $\overline{K}$, $\overline{H}$, 32, 30, $\overline{L}$ and $\overline{J}$ such that the data word presented to the card bus is now interfaced and transferred to the data bus of the microprocessor system to be utilized by the microcomputer. This is the manner in which the digital voice stored in the computer chips is addressed and transferred in eight bit bytes sequentially to the data bus. Now, examining the decoding scheme that is used in decoding and accessing the individual chips on the given 1A5 printed circuit board, on the left hand edge of FIG. 10 the inscribed block 60 contains all of the address and control bus buffer amplifiers and the logic contained in block 61 has been arranged such that the decoding will occur at a hexadecimal address of 88CF. The hexadecimal address 88CF is used as a chip or block select address in setting up a specific chip to be selected such that the data in that chip may be addressed and recovered.

Referring to NAND gate U5 in block 61, if in fact the computer has put out a hexadecimal address of 88CF and issued a write instruction on the read/write control bus, then pin 9 of U5 will assume a digital low state. When pin 9 of U5 assumes a digital low state, following the digital control lines over to block 63, a control line is tied to pin 9 on U12 which is a standard TTL 74LS173 quad data latch. The low state that is now occurring at pin 9 of U12 will enable this chip to receive data input on its data input terminals 14, 13, 12 and 11. Now, to follow the other leg of the control line leaving pin 9 of U5, this control leg is fed down to block 65 and ties to pin 1 of U14 and pin 1 of U13. At such time as this control line has assumed a low state, the bus receiver portion of U14 and U13 bus transceivers is now enabled and the data from the data bus now appears at the receiver output terminals of U14 and U13 which happen to be pins 2, 5, 11 and 14 of each transceiver chip. Therefore the eight bit data word is now interfaced from the microprocessor data bus onto the 1A5 PC board and the data is now transferred to inscribed block 63. The data contains card select and chip select information and the format of the data word or block select word for selecting the proper board and proper chip will be discussed below.

Referring to the lower right hand corner of FIG. 10, there is an illustration of the block select word format. Looking at data bits D0, D1, and D3 these three data bits make up the chip select group of the data block select word. In other words, by using these three binary bits, the system can decode three binary bits to eight unique chip select lines. Now, examining the group block select word data bits D3, D4, D5, D6 and D7, these five bits make up the card select group of data bits. These five data bits, when decoded, can be decoded into 32 unique separate states or lines. Therefore using this scheme of block select with an eight bit data word the system may select any one of eight chips on any one of thirty-two circuit boards. Each individual circuit board is strapped and, noting inscribed block 63 note 1 of FIG. 10, the individual jumper straps that are placed on the circuitry involving integrated circuit chip U10, which is a standard TTL logic 6 bit comparator. The five bits from the block select or the card select group of the data word data bits D3 through D7 are utilized in conjunction with digital comparator U10 and the strapping involved at circuit U10 to identify each individual board uniquely. In the present configuration, circuit boards 0, 1, 2, 3, 4, and 5 are used.

Now examining the method of selecting a particular chip, before attempting to address that chip to recover data from the chip, the events that occur are as follows: The processor will place hexadecimal address of 88CF on address bus lines A0 through A15. At such time as the address 88CF is placed on the data bus and a write command on the control read/write bus has been issued, then pin 9 of U5 in inscribed block 61 will assume a low data state. Simultaneous to that occurrence, the processor has placed an eight bit block select word onto the data bus D0 through D7. The select address line has assumed a low state and the data word on the data bus has now been interfaced by U14 and U13. Now, address lines D3 through D7 make up the card select group and if, for instance, the board under consideration has been strapped for its unique identification number of zero, and if data bits D3 through D7 contain the unique binary number "0", then digital comparator U10 will decode this card select group word and an output will occur on pin 9 of U10. The output from pin 9 of U10 will then appear at the input pin 11 of U12, the quad data latch.

Referring now to U12, the chip select group data bits D0, D1, and D2 of the block select word will concurrently appear at the input to the quad data latch U12 on pins 14, 13 and 12. These three binary bits make up the chip select group. Now, if there is concurrently a compare in the digital comparator U10, which ascertains the proper card to be selected, and as three data bits for the chip select group have been input to the quad latch U12, the information that has been input to the data latch input will be stored in the data latch in Ø2 clock time of the microprocessor. Referring to pin 7 of U12, it is driven by control bus Ø2 input from the microprocessor bus and, at the positive going or high state of Ø2, the data presented to the input of the data latch is lateched into the data latch or stored and held until new information is presented and clocked into the data latch. The input data the occurred on pins 14, 13, 12 and 11 now occur respectively on pins 3, 4, 5 and 6 output pins of data latch. Pins 3, 4 and 5 now have the data D0, D1 and D2 on these lines and these three bits of chip select data are now fed to a three to eight line decoder U11 on pins 1, 2 and 3 and the data bits arrive at pins 1, 2 and 3 in a D0, D1, D2 format respectively. These three data bits, when decoded by U11, will enable a chip select line 1, 2, 3, 4, 5, 6, 7 and 8 respectively, depending on the three bit binary information input to pins 1, 2 and 3 of the three line decoder U11. For example, if a chip select 1 is desired (it is desired to select ship 1 of the PC board) then the data bits contained in the chip select group of the eight bit block select word would contain binary "0" chip select information. In other words, D0 would be "0", D1 would be "0". D2 would be "0". The three line to eight line decoder would then decode the binary word "0" and chip select 1 would be selected. Now the chip select decoder U11 is enabled by an enable gate on pin 6 of U11. Following the enable gate line back to the output of quad latch U12, pin 6 the enable line at pin 6 of U12, comes from the output of the 6 bit comparator, pin 9 of U10. If there has been a proper card select decode, then pin 9 of U10 has an output that will enable the chip select decoder U11. In summary, what has occurred in order to select a given chip, is that the select address 88CF hexadecimal is placed on the address bus of the computer processor, a write command is placed on the read/write line, a data word has been placed on the data bus containing the chip select information and the card select information. The chip select and card select information has been decoded by the proper card and the proper chip has now been selected. If, for example, chip number 1 has been selected the system now addreses the chip, placing sequential addresses on the address line with a read command. The data that is stored sequentially in the 1,024 address locations of chip number 1 that has been selected, is read.

In order to address the chips properly, refer to FIG. 10 at the circuitry inscribed in blocks 62. The circuitry inscribed here is the decoder for the base address 8000 through 83FF. Looking at the read/write line input to the 1A5 card edge connector at pin 6, FIG. 10, if a read command has been placed on the read/write control line coming into pin 6 or the read/write line is in a high condition and if, concurrently, any address in the range of 8000 through 83FF has been placed on address lines A0 through A15 of the microprocessor bus, then U8A of inscribed block 62 output pin U3 will be enabled. Low level will be fed to pin 15 of U14 bus transceiver and pin 15 of U13 data bus transceiver, thereby enabling the drivers of the bus transceivers such that the data that is addressed in chip 1 is now presented on the 1A5 printed circuit board data buses D0 through D7. These data bits will now be interfaced and fed out to the microprocessor data lines D0 through D7. As the processor places unique addresses on the address bus in the range of 8000 to 83FF in a sequential manner, then the chip being selected, in this case chip number 1, is addressed sequentially through its 1,024 unique address locations and the data stored in each unique address location is transferred to the card data bus and placed on the computer processor data bus for processing. This now completes the cycle of proper card, proper chip select and addressing the selected chip to extract the data contained in the 1,024 unique address locations of each chip.

Referring now to FIG. 10, block 64, there is a typical TTL 74121 monostable circuit with a time constant of approximately 1 microsecond. Whenever an address in the hexadecimal range of 8000 to 83FF is placed on the computer address bus, this monostable will set placing a low state on the memory ready line via transistor Q1 & card edge pin # "R". This stretches or "halts" processing for the 1u sec. time duration of this monostable in order to ensure adequate set up time for extracting the voice data from the voice ePROMs on the 1A5 PCBs.

This now concludes the discussion of the various input/output hardware circuitry as well as the digital voice storage circuitry.

The system of the present invention is operated from a program stored in the program memory. The program is in hexadecimal format and is in machine code for the Motorola 6800 series microprocessor systems. The appendix provides a program for use in the system described hereinabove wherein the left column comprises the instruction addresses and the other columns comprise the instructions.

Referring to FIG. 2, the PIA1 and PIA1 elements are Motorola MC821 interface chips. The M6800 is a Motorola computer chip. The AC1A (asynchronous communications interface) is a Motorola MC 6850 chip. The PIA1, PIA2, M6800 CPU, ACIA and buffers in FIG. 2 are on one circuit board which can be purchased as an off the shelf item from Motorola with all buses on the card under the designation M68MM01A(O).

Though the invention has been described with respect to a specific preferred embodiment thereof many variations and modifications become apparent to those skilled in the art. It is therefore the intention that the appended claims be interpreted as broadly as possible in view of the prior art to include all such variations and modifications.

APPENDIX

```
3000 08 6A 26 17 7D 00 6C 26 0B 4B 26 05 BD C1 A4 20  ..8....8.M8.=A$
3010 15 7C 00 6C 8D 30 BD C1 32 20 0B DF 6C DE 68 A7  .....0=A2 ._. .
3020 00 0B DF 68 DE 6C 32 08 09 8C CC 39 26 BC 3B 27  .. . .2...L98 ;'
3030 10 03 E8 00 64 00 0A 00 01 4F 5F CE 00 10 0C 74  .........0 N....
3040 00 6E 76 00 6F 24 04 BB 71 99 70 46 56 76 00 72  .....$.[...FV...
3050 76 00 73 09 26 E8 39 FE 88 EC DF 78 73 00 78 73  ....8.9..._.....
3060 00 79 7D 01 80 2F 03 7A 01 80 BD CB 31 30 A6 00  ...../....=K108.
3070 8A 10 A7 00 96 78 26 13 96 79 81 5A 22 0D 7A 02  .. ...8....Z"...
3080 1F 26 08 86 05 CE C2 CD 7E C4 73 96 8F 8A 20 97  .8...NBM.D.... .
3090 8F 3B BD C8 C1 86 0C 97 8F CE 03 FA BE C8 2E AF  .;=HA....N...H./
30A0 04 35 07 36 7E CC A7 FE 88 EC B6 88 E7 DF 74 73  .5.6.L'...6._..
30B0 00 74 73 00 75 96 8F 84 DF 97 8F BD CB 21 0E 4F  ........_..=K!.O
30C0 97 85 97 86 86 08 B7 84 06 CE 00 00 FF 02 2C FF  ......7..N....,.
30D0 02 2E 86 88 B7 84 06 01 B6 88 F0 C6 09 F7 84 06  ....7...6..F....
30E0 43 36 86 89 B7 84 06 01 B6 88 F0 43 C6 08 F7 84  C6..7...6..CF...
30F0 06 B6 8F C5 20 26 20 9B 86 97 86 24 08 7C 02 2F  .V.E 8 ....$.../
3100 26 03 7C 02 2E 32 9B 85 97 85 24 08 7C 02 2D 26  &....2....$...-&
3110 03 7C 02 2C 08 20 BB FF 02 23 31 7D 01 F5 27 01  ...,. ;..#1... .
3120 3B B6 84 07 49 2A 26 B6 84 02 85 08 27 1F FE 01  ;6..I*&6....'...
3130 F2 8C 02 1F 27 17 8D 23 FF 01 F2 7C 01 F4 B6 02  .... ..#......6.
3140 21 81 07 22 05 7D 02 20 27 03 BD B8 A6 B6 84 06  !.."... .=836..
3150 85 40 27 70 B6 88 E1 2A 21 20 0F 36 B6 02 20 F6  .@'.6..*! .66. .
3160 02 21 E7 00 08 A7 00 08 32 39 FE 02 42 8C 02 36  .!...'..29..B..6
3170 27 08 8D E7 FF 02 42 7C 02 4A 81 40 27 10 FE 02  .....B..J.@'...
3180 44 8C 02 3C 27 08 8D B3 FF 02 44 7C 02 49 B6 88  D..<'..S..D..I6.
3190 E0 B6 88 E3 2A 2E FE 02 46 8C 02 42 27 08 8D BB  `6..*...F..B'..;
31A0 FF 02 46 7C 02 48 B6 88 E2 B6 02 4A BB 02 48 BB  ..F..H6..6.J;.H;
31B0 02 49 27 10 B6 02 21 81 07 22 05 7D 02 20 27 04  .I'.6.!.."... '.
31C0 4F 8D B8 A6 7F 88 E6 96 78 26 14 96 79 81 5A 22  O=8.....8....Z"
31D0 0E BD CF 21 96 8F 85 0C 27 01 3B BD CE 89 3B 96  .=8!.... .;=N.;.
31E0 79 80 E2 96 78 82 03 25 07 86 01 B7 02 4B 20 E1  .......I...7.K .
31F0 7C 02 21 26 03 7C 02 20 FE 02 23 BF 6C 96 85 97  ..!&... ..N_....
3200 69 FE 02 2C DF 67 7F 00 6A CE 00 09 BD CB 5F 96  ...,_....N..=K_.
3210 6A 97 85 FE 02 23 BF 6C 96 86 97 69 FE 02 2E BF  .....8 ........_
3220 67 7F 00 6A CE 00 09 BD CB 5F 96 6A 97 86 96 8F  ....N..=K......
3230 85 04 27 21 84 FB 97 8F 7F 02 27 7F 02 25 7F 02  ..'!..... '..%..
3240 26 96 86 97 88 96 85 97 87 DE 78 FF 02 2A 86 01  &.......^...*..
3250 97 7C 7E CF 3B 7B 00 74 26 1B B6 75 C1 5A 22 15  ...0=...8.V.AZ".
3260 7B 00 8F 2A 03 BD CF 21 7A 02 22 26 08 86 05 CE  ...*.=0!.."&...N
3270 C2 CD 7E C4 73 85 08 27 43 7F 02 25 84 F7 97 8F  BM.D...'C..%....
3280 DE 74 8F 7B FF 02 28 20 35 96 74 B6 75 BB 77 99  ^._...( 5..V.C..
3290 76 97 68 B7 69 86 00 97 6A 49 97 67 DE 7A DF 6C  ...U.....I..^._.
32A0 CE 00 11 BD CB 5F 96 6A BB 02 27 B7 02 27 96 69  N..=K_..;.'7.'..
32B0 B9 02 26 B7 02 26 24 03 7C 02 25 39 8B CB DE 74  9.&7.&$...%9.K^.
32C0 8F 76 DE 78 DF 7A 7E CE C9 96 8F 2A 3A 85 40 27  _.^._..NI..*:.@'
32D0 0A 84 8F C6 01 B7 7C 97 8F 20 2C 96 7B B6 7E 44  ..7F.8... ,..V.D
32E0 56 9B 7E 99 7B B0 75 92 74 25 1F 96 7C 2B 05 4C  VC...P...Z...*.L
32F0 97 7C 20 0F 84 7F 91 7F 26 06 96 8F 8A 40 97 8F  .. .....8....@..
3300 7C 00 7F DE 74 8F 7B 7E CF 3B 96 7C 2A 05 BB CF  ...^._..8=..*.=O
3310 21 20 F4 81 01 27 F7 8A 80 97 7C 86 02 97 7F 20  ! ...'........
3320 E6 96 8F 84 7F 97 8F FE 00 81 5F B6 00 90 27 09  ..........._6..'.
```

```
3330 BD CF 5B 4A 26 FA FF 00 81 F7 00 90 39 B6 86 DE  =O1JB.......9V.^
3340 83 7B 00 8A 26 2B 96 88 BD 08 23 27 86 FF 97 8A  ....8-....8'....
3350 20 21 10 24 01 40 81 05 39 E6 00 20 02 E7 00 08   !.$.@..9.. ....
3360 BD CA E7 30 E6 04 C5 3F 26 08 C0 40 24 02 6A 03  =J.O..E?8.@@$...
3370 E7 04 3B BD E8 B6 85 7D 00 89 26 09 96 87 BD D2  ..;..V....8....R
3380 23 03 7C 00 89 BD B6 BF 83 96 8F 2B 1A 4F 97 90  #.....V_...+.8..
3390 DE 81 B6 90 BD C7 5B 27 0B 7F 00 90 B6 8C BD BD  ^.V..83'....V..=
33A0 B6 BB BD B9 BF 81 3B 7B 00 90 26 0A 86 FF 97 8B  V..9_.;...8.....
33B0 97 8C 97 8D 97 8E 7C 00 90 96 85 91 8D 22 08 B6  .............".V
33C0 8D 97 8B B7 8D 20 06 91 8D 22 02 97 8D 96 86 91  ...8. ..."......
33D0 8C 22 08 B6 8C 97 8C B7 8E 20 06 91 8E 22 02 97  ."..V...W. ..."..
33E0 8E 96 8F 85 40 27 BF 96 8D 9B 8D 46 97 8D 96 8C  ....@'?....F....
33F0 9B 8E 46 97 8C 20 99 3B C1 01 CF F7 CF F7 C1 FB  ..F.. .;A.8.8.A.
3000 D7 DF 6E BD C7 B2 97 5C B7 5B 39 DF 6C DE 85 DF  W .=62.\W79 .^.
3010 67 4F 97 69 97 6A CE 00 11 BB CB 5F DE 69 39 36  .O....N..=K_^.96
3020 44 44 44 44 C6 0A BD CB 37 32 84 0F 1B 39 B6 88  DDDDF.=K72...96.
3030 F7 BB C8 88 B7 02 0E B6 88 F8 BD C8 88 B7 02 0C  .=H.7..6..=H.7..
3040 B6 88 FB BD C8 1F B7 02 0B 86 02 97 5B 0E B6 02  6..=H.7.....[.6.
3050 21 81 07 23 F9 7F 84 04 7D 84 01 2B 0E 96 8F 85  !..#.......+....
3060 01 24 08 86 09 CE C8 A6 7E C4 73 86 08 BA 84 00  .$...HH8.D...:..
3070 B7 84 00 BD BC AB 27 03 BD B8 A6 B6 84 02 97 60  7..= + .=886...`
 80 DE 7B FF 02 2A 7E BE A4 [illegible] 84 0F CE C8 [illegible] BD B9  ...+. $...HH.=9
 90 5F A6 00 C4 F0 58 24 02 C6 E0 1B 39 00 03 06 0A  8.B.X$.F`.9....
3A0 0D 10 13 16 1A 1D 41 50 50 52 4F 41 43 48 20 54  ......APPROACH T
3B0 52 41 4E 53 44 55 43 45 52 20 46 41 55 4C 54 59  RANSDUCER FAULTY
30C0 04 4F B7 02 4B B7 01 F5 97 01 B7 02 4A B7 02 49  .O7.K7....7.J7.I
30D0 B7 02 48 B7 01 F4 B7 01 83 97 90 97 89 97 8A 43  7.H7..7........C
30E0 B7 01 80 CE 00 00 DF 09 FF 02 20 CE 01 00 DF 83  7..N.._... N.._.
30F0 DF 0C CE 01 40 DF 81 DF 0E 86 10 B7 02 22 B7 02   .N.@_. ...7."7.
3100 1F B7 01 FA B7 01 FB BD 46 CE CC A7 FF 02 05 CE  .7..7...FNL'...N
3110 BA 32 FF 01 FF 7D 84 06 7D 88 E0 7D 08 E2 7F 88  :2........ .....
3120 E6 B6 84 01 84 FE B7 84 01 B6 84 00 4F B7 88 E9  .6....7..6..O7..
3130 B7 88 E8 CE FF FF FF 88 EC CE 00 4F FF 88 EA B6  7..N.....N.O....
3140 41 B7 88 E9 B6 01 B7 88 E8 B6 82 B7 88 E8 39 CE  A7....7....7..9N
3150 02 0F DF 02 CE 01 84 FF 01 81 CE 02 19 FF 01 F2  .. .N.....N.....
3160 CE 02 30 FF 02 42 CE 02 36 FF 02 44 CE 02 3C FF  N.O..BN.6..DN.<.
3170 02 46 39 BD BB F5 96 01 4C 97 61 B6 01 F4 4C 97  .F9=...L..6..L.
3180 62 B6 02 4A 4C 97 63 B6 02 48 4C 97 65 B6 02 49  .6.JL..6.HL..6.I
3190 4C 97 64 BD C7 C4 CE C3 A8 BD B9 41 BD C7 8E CE  L..=6DNC(=9A=G.N
31A0 C3 A2 8D 40 BD B9 E3 CE C3 AF 8D 38 BD B9 4D BD  C".@=9.NC/.8=9M=
31B0 C7 6E CE C3 B5 8D 2D BD B9 E3 CE C3 C0 8D 25 BD  G.NC5.-=9.NCP.%=
31C0 B9 E3 CE C3 CC 86 0B D6 60 C5 02 26 03 BD B9 5F  9.NCL..V`E.&.=9_
31D0 8D 12 BD B9 E3 BD BC AB 26 10 CE C3 E2 BD 05 8D  ..=9.=<+&.NC....
31E0 06 7E B9 1F 7E C1 88 7E C1 96 CE C3 EB BD C1 86  ..9..A..A.NC.=A.
31F0 BD C9 4F B6 84 06 48 2A 05 CE C4 2B 8D E6 8D E7  =IO6..H*.ND-....
3200 7D 00 85 27 BC 7D 00 01 26 06 86 2B 8D 48 20 64  ...'\...&..+.H .
3210 B6 61 B0 01 7A 00 01 BE 02 A6 01 36 37 5F 48 59  V.P....^.&.67_HY
3220 48 59 F7 84 00 4F BD C5 34 7F 84 00 33 32 36 BD  HY...O=E4...326.
3230 2A BF 02 32 36 BD BB 96 48 48 48 CE C2 4B BD B9  *_.26=.HHHNBK=9
3240 5F 8D A1 33 BD B8 FA C5 30 26 23 86 09 8D 07 20  _.!3=8.E0&N....
3250 23 86 05 8C 86 14 7E C1 AB 8D F6 4F BD CB D4 8D  #......A+..O=KT.
3260 F0 E6 00 08 A6 00 08 BD BD C2 BD CB D4 39 CE C4  ....&..==B=KT9ND
3270 6A BD B9 63 7D 01 F4 26 04 8D B9 20 1C B6 62 F0  .=9....&..Y .V..
3280 01 F4 7A 01 F4 FE 01 F2 8D CF FF 01 F2 C6 04 F7  .........O...F..
3290 B4 00 4F BD C5 34 7F B4 00 7D 02 4A 26 04 8D B4  ..O=E4.....J&..4
32A0 20 10 B6 63 F0 02 4A 7A 02 4A FE 02 42 8D AA FF   .V...J..J..B.*.
32B0 02 42 7D 02 49 26 04 8D 9B 20 10 B6 64 F0 02 49  .B..I&... .V...I
32C0 7A 02 49 FE 02 44 8B 91 FF 02 44 7D 02 48 27 11  ..I..B....D..H'.
32D0 B6 65 F0 02 4B 7A 02 4B FE 02 46 BD CA 59 FF 02  V...H..N..F=JY..
32E0 46 BD BC AB 7E C9 FE 36 37 07 36 8D 1E 37 36 EE  F=<+.I.67.6..76.
32F0 05 8D 18 A7 07 E7 08 EE 02 8D 10 A7 02 E7 03 A6  ...'.......'...&
3300 06 36 A6 04 E6 05 EE 07 06 32 39 B6 02 0A F6 02  .6&......296....
3310 0B FF 02 0A 30 39 8D CF B6 01 B7 88 E9 B7 88 E8  ....09.O..7..7..
3320 3B B6 16 C6 07 CE B4 00 E7 03 E6 02 A7 05 A6 04  ;..F.N.....'.&.
3330 39 B6 1E C6 06 20 EE 97 66 CE 00 08 4F 0C C5 01  9..F. ...N..O.E.
3340 27 02 9B 66 46 56 09 26 F4 39 8D EB CE 00 03 58  '...FV.&.9..N..X
3350 49 25 09 09 26 F9 CB 80 B9 00 24 02 B6 FF 39 4F  I%..&.K...$...9O
3360 4C 78 00 6B 79 00 6C 2A F7 4A 74 00 6C 76 00 6B  L......*.J......
3370 4B 27 0C 78 00 69 79 00 6B 79 00 67 4A 20 F1 7F  H'.........J ..
3380 00 6B 96 68 90 6B 97 68 96 67 92 6C 97 67 20 0C  ............. .
3390 96 68 9B 6B 97 68 96 67 99 6C 97 67 79 00 6A 79  ................
```

```
33A0 00 69 79 00 6B 79 00 67 07 B6 6B 97 6B 53 C4 01  .........V...BD.
33B0 B8 6A B7 6A 09 27 06 C5 01 27 B5 20 C5 56 B6 6B  X.W..'.E.'U EVV.
33C0 96 67 25 06 BD 6D 99 6C 20 04 B0 6D 92 6C 2B 03  ..%.E... .P...+.
33D0 7C 00 6A 39 7F 00 6A 7F 00 6C 20 08 BF 6B 7F 00  ...9...... ._...
33E0 6A 7C 00 6A BD CA E7 CE CC 2F 7F 00 67 20 03 7C  ....=J.NL/... ..
33F0 00 67 E0 01 A2 00 24 F7 EB 01 A9 00 36 96 67 7B  ..`."..$...).6...
3000 49 44 45 20 20 20 20 43 41 52 20 54 59 50 45 20  IDE    CAR TYPE
3010 20 43 4F 4D 4D 45 4E 54 20 20 20 20 20 44 52 41   COMMENT     DRA
3020 47 20 45 51 49 50 20 20 41 58 4C 45 04 20 20 20  G EQIP  AXLE.
3030 20 20 4B 4F 54 20 57 48 45 45 4C 20 20 41 58 4C    NOT WHEEL  AXL
3040 45 20 20 20 20 20 57 49 44 45 20 4C 4F 41 44 20  E     WIDE LOAD
3050 20 41 58 4C 45 20 20 20 20 20 48 49 47 48 20 4C   AXLE     HIGH L
3060 4F 41 44 20 20 41 58 4C 45 04 4D 41 58 20 48 45  OAD  AXLE.MAX HE
3070 41 54 04 0F BD B8 A6 8D 2C 8D 7C BD CD 31 8E 03  AT..=8&.,..=K1..
3080 FF C6 16 F7 84 05 0E 7F 88 E6 F6 84 05 58 2A 06  .F...........X*.
3090 F6 84 04 F6 88 E7 B6 8F C5 10 27 EB 0F BD CD 16  ......V.E.'..=K.
30A0 8D 19 7E DA 9F BD CA E7 84 0F B7 84 04 C6 A0 F7  ...&.=J...7..F .
30B0 84 02 5A 26 FD C6 80 F7 84 02 3B BD CA E7 B6 84  ..Z&.F....;=J.6.
30C0 00 36 8A C0 B7 84 00 CE 0D 05 BD C1 7F 09 26 FA  .6.87..N..=A..&.
30D0 32 36 84 7F 8A 40 B7 84 00 B7 84 00 C6 02 8D 42  26...@7..7..F..B
30E0 86 20 37 C6 28 BD C5 34 C6 10 4C BD C5 34 33 5A  . 7F(=E4F.L=E43Z
30F0 26 EC 32 B7 84 00 3B BD CA E7 BD BD F5 8D 07 BD  &.27..;=J.==...=
3100 C1 86 BD C1 96 3B BD CA E7 BD C1 96 8D 09 CE C2  A.=A.;=J.=A...NB
3110 63 BD C1 88 8D 01 3B 86 2A C6 1E BD C1 32 5A 26  .=A...;.*F.=A2Z&
3120 FA 39 BD CA E7 86 24 C6 AF BD C5 34 86 FE C6 1E  .9=J..$F/=E4..F.
3130 BD C5 34 3B BD CA E7 36 37 CE 84 00 A6 03 84 FB  =E4;=J.67N..&...
3140 A7 03 C6 C0 EA 02 E7 02 8A 04 A7 03 A6 07 84 FC   .F@...... .&...
3150 8A 04 A7 07 6D 07 2B 1C BD C1 7F 6D 07 2B 15 CE  ..'...+.=A...+.N
3160 B6 C6 C6 01 32 32 86 0A BD C6 29 27 03 7E C4 73  ;FF.22..=F)'..D.
3170 BD BB A4 3B 6D 06 6D 07 2A 06 6D 06 6D 07 2B DF  =;$;....*.....+_
3180 C6 FE BD BB B5 33 C1 FF 27 12 86 80 B7 84 02 4F  F.=;53A.'...7..O
3190 6B 07 2A FC 6B 06 4C 26 F7 5A 26 F3 CE C0 1B 6F  ..*...L&.Z&.N...
31A0 00 08 8C 00 3B 26 F8 32 4D 27 CB BD C6 31 27 13  ....;&.2M M=F1'.
31B0 CE C7 2B BD C1 86 BD C6 37 CE C7 4B BD C1 86 C6  NG+=A.=F7NGK=A.F
31C0 18 B7 1A CE 00 00 DF 13 7F 88 CF CE 80 00 8D 61  .W.N.._...ON....
31D0 27 0E 8B 65 7A 00 1A 26 07 C6 20 B7 1A BD C1 96  '.....&.F W.=A.
31E0 E6 00 11 26 03 7E C6 7B 5B 26 59 EE 01 8C FF FF  ...&..F.3&Y.....
31F0 27 63 BD C6 C5 25 31 8D 38 26 22 B6 5B 27 29 5A  '.=FE%1.8&"VE')Z
3200 B7 5B 36 5F CE C7 10 86 01 BD C6 29 27 03 7E C4  WE6_NG...=F) ..D
3210 73 BD BB A4 CE C7 40 BD C1 88 32 8D 1C CE C7 5C  .=;$NG@=A.2..NG\
3220 BD C1 88 8D 12 BD C1 96 3B 36 B6 84 00 B5 20 32  =A...=A.;66... 2
3230 39 C6 20 F5 84 06 39 97 13 DF 16 CE 00 13 BD C1  9F ...9.._.N..=A
3240 B5 DE 16 39 BD C6 B6 25 A9 8D 11 B7 13 F7 88 CF  5^.9=F6%)..W...O
3250 DE 18 7E C5 CE 8D 18 B7 14 7E C5 CB EE 01 DF 18  ^..EN..W..EK.._.
3260 B6 18 37 C4 03 CA 80 B7 18 33 57 57 BB 14 39 CE  V.7D.J.W.3WWE.9N
3270 80 00 7C 00 13 B6 13 F7 88 CF 39 36 DF 16 8D BC  .....V...096_..\
3280 B7 15 DE 16 08 08 08 A6 00 C6 04 7B 84 07 2A FB  W.^....&.F....*.
3290 B7 84 02 7B 84 06 48 48 5A 26 F0 08 8C 84 00 26  7.....HHZ&.....&
32A0 02 8D CC 9C 18 26 E0 96 15 91 13 26 DA 86 40 B7  ..L..&`....&Z.@7
32B0 84 02 32 8D 12 3B BD CA E7 17 0B CE 00 1B 8D 0B  ..2..;=J...N....
32C0 07 30 A7 00 3B 0B B5 0C CE 00 3B DF 11 16 37 07  .0 .;...N.;_..7.
32D0 97 18 C4 07 4F FB C7 6B B9 C7 6C 8D 22 33 37 54  ..D.O.G.9B..^37T
32E0 54 54 4F BB 12 99 11 8D 16 96 18 06 17 25 04 53  TTOE.........%.S
32F0 E4 00 8C EA 00 0C A5 00 27 01 0B E7 00 32 39 97  .......%.'....29.
3300 16 B7 17 E6 00 BE 16 39 01 02 04 08 10 20 40 80  .8...^.9..... @.
3310 45 52 52 4F 52 20 49 4E 20 54 48 45 20 53 50 45  ERROR IN THE SPE
3320 45 43 48 20 4D 45 4D 4F 52 59 04 53 45 41 52 43  ECH MEMORY.SEARC
3330 48 49 4E 47 20 46 4F 52 20 57 4F 52 44 20 23 04  HING FOR WORD #.
3340 41 54 20 42 4C 4F 43 4B 20 23 04 42 4C 4F 43 4B  AT BLOCK #.BLOCK
3350 20 23 27 53 20 41 52 45 3A 20 20 04 45 52 52 4F   #'S ARE:  .ERRO
3360 52 20 4F 4E 20 57 4F 52 44 20 23 04 C7 08 FE 02  R ON WORD #.G...
3370 2A BF 6C BE 5C BF 68 4F 97 67 97 6A CE 00 11 BD  *_.^\_.O....N..=
3380 CB 5F 96 6A 5F 8B 80 B9 69 4F BD CB B4 39 CE 00  K__..._.Y.O=KT9N.
3390 00 BF 74 BD CE 09 FE 02 2A BF 7A FE 02 28 BF 76  ._.=N...*_...(_.
33A0 BD CE 89 FE 02 25 BF 6E BE 5E BF 70 8D 04 BD CD  =N...%_.^^_...=K
33B0 B4 39 BD CC 39 78 00 72 59 49 7B 00 72 2A 04 5C  T9=L9...YI...*.\
33C0 26 01 4C 39 B6 88 F9 5F 81 49 23 03 80 50 5C B7  &.L96..._IN..P\W
33D0 85 8D 4C 5F 7B 00 85 27 05 40 25 01 5A 53 8B C0  ..L_...'.@%.ZS.@
33E0 C9 01 48 59 48 59 48 59 48 59 48 59 B7 85 97 86  I.HYHYHYHYHYW...
33F0 CE 60 00 8D 16 BF 5E CE 70 00 8D 0F BF 70 CE 26  N`... ^N...._.N&
```

```
3000 0C 7E BE A4 BD CA E7 BD CB 16 86 06 36 4C 4C 34  ..>¤=J.=K...6LL4
3010 4A 26 FC 30 6F 02 6F 01 6F 00 63 00 BD 64 7F 88  J&.0............
3020 E6 BD 2E BD 3D A7 00 30 BD 4B 26 F5 BD 69 BD 21  ....='.0.K&....!
3030 BD 30 E6 00 11 27 70 E6 00 11 27 03 7E C0 BF CE  .0...'....'..@?N
3040 C3 C3 BD C1 86 30 08 08 08 BD C1 B3 BD C1 96 20  @C=A.0...=A3=A.
3050 56 7D 84 01 2B 07 B6 84 05 49 2B 01 39 31 31 7E  V...+.6..I+.911.
3060 C0 B3 A6 07 4C B1 03 26 01 4F A7 07 BD B9 5F A6  @3&.L..&.O'.=9_&
3070 00 30 EE 05 39 6C 04 26 02 6C 03 6C 05 26 02 6A  .0..9..&.....&..
3080 06 39 A6 09 46 24 08 63 00 63 02 63 01 20 08 AE  .9&.F$.c.c.c. ..
3090 01 A6 00 AF 00 A7 02 A6 0B A7 06 6F 05 6F 07 AE  .&./.'.&.'.....
30A0 0C AF 03 35 34 34 39 30 ED CB 26 82 6A 08 27 03  ./.54490.K&... .
30B0 7E C0 1C C6 FD E4 09 86 0A 31 4A 26 FC 37 3B C6  .@.F.....1J&.7;F
30C0 FF 20 F4 2A 2A 2A 2A 2A 2A 2A 2A 2A 2A 2A 2A 20  . .************
30D0 57 41 52 4E 49 4E 47 20 2A 2A 2A 2A 2A 2A 2A 2A  WARNING ********
30E0 2A 2A 20 53 4F 46 54 20 4D 45 4D 4F 52 59 20 45  ** SOFT MEMORY E
30F0 52 52 4F 52 20 41 54 20 41 44 44 52 45 53 53 20  RROR AT ADDRESS
3100 04 B6 BB E9 85 02 27 03 7E 01 FE B6 84 03 2A 07  .6....'.~....6..*.
3110 85 01 27 03 7E 02 01 B6 84 05 85 40 27 07 85 08  ..'.~...6...@'...
3120 27 03 7E 02 04 B6 84 01 2A 07 85 01 27 03 7E 02  '.~...6..*... ...
3130 07 3B 37 C6 02 D5 80 33 27 01 39 BD CA E7 BD 19  .;7F.U.3 '.9=J...
3140 28 0F BD 31 BD 13 28 09 86 04 CE C1 49 BD BB A4  (..1..(...NAI=;$
3150 3B B7 84 09 53 BD BD B5 3B BD 12 CE 00 50 C6 02  ;7..S=;5;..N.PF.
3160 09 27 08 BD 1A F5 84 08 27 F6 C5 0B 39 36 86 09  .'..... .E.96..
3170 B7 84 08 32 39 36 86 4B 20 F6 36 86 49 20 F1 36  7..296.K .6.I .6
3180 4F 4C 26 FD 32 39 BB 0E 36 A6 00 81 04 27 05 BD  OL&.29..6&...'..
3190 A1 08 20 F5 32 39 36 86 CA BD 97 86 0D BD 93 4F  !. .296........O
31A0 BD 90 32 39 36 86 20 BD B9 32 39 36 BD F6 4A 2E  ..296. ..296..J.
31B0 FD 32 39 BD 05 BD 03 BD ED 39 36 A6 00 BD 03 08  .29......96&....
31C0 32 39 36 BD 06 32 36 BD 06 32 39 44 44 44 44 B4  296..26..29DDDD.
31D0 0F BD 30 81 39 23 02 BB 07 BD C1 32 39 CE BB B9  ..0.9#...=A29N89
31E0 FF 02 0B CE CC 92 FF 02 05 CE CC 57 FF 02 02 CE  ...NL....NLW...N
31F0 01 FE B6 7E A7 00 A7 03 A7 06 A7 09 39 0F BE 03  .... .'. . .9...
3200 FF BD BA BD BA 66 B6 84 04 B6 84 00 7F BB E6 CE  ..Z=:.6..6.....N
3210 C2 29 FF 01 FF B6 10 B7 84 00 BD C9 2C 0E B6 84  B)....7..=I,.6.
3220 05 49 BA 84 01 2B DF 20 F5 BD CB 16 BE 00 00 CE  .I:..+_ .=K....N
3230 00 3D AF 00 08 08 BC 00 5D 26 F7 BE 03 FF 7F 00  .;/.....[&......
3240 80 7F 84 00 86 02 97 5D 7E BA 9F 20 20 20 42 4F  .......[.:.   BO
3250 54 4B 04 20 20 52 49 47 48 54 04 20 20 20 4C 45  TH.  RIGHT.   LE
3260 46 54 04 53 59 53 54 45 4D 20 45 52 52 4F 52 04  FT.SYSTEM ERROR.
3270 50 41 52 54 49 41 4C 20 43 41 52 04 41 4C 4C 20  PARTIAL CAR.ALL
3280 45 51 55 41 4C 20 48 45 41 54 53 2D 2D 53 49 44  EQUAL HEATS--SID
3290 45 20 31 04 41 4C 4C 20 45 51 55 41 4C 20 48 45  E 1.ALL EQUAL HE
32A0 41 54 53 2D 2D 53 49 44 45 20 32 04 43 4F 50 59  ATS--SIDE 2.COPY
32B0 52 49 47 48 54 20 31 39 37 38 2C 20 44 45 56 54  RIGHT 1978, DEVI
32C0 52 4F 4E 49 43 53 20 49 4E 43 2E 04 04 57 48 45  RONICS INC...WHE
32D0 45 4C 20 47 41 54 45 20 54 52 41 4E 53 44 55 43  EL GATE TRANSDUC
32E0 45 52 20 45 52 52 4F 52 04 44 52 41 47 47 49 4E  ER ERROR.DRAGGIN
32F0 47 20 45 51 55 49 50 4D 45 4E 54 20 53 45 4E 53  G EQUIPMENT SENS
3300 4F 52 20 42 52 4F 4B 45 4E 04 31 36 20 4D 41 58  OR BROKEN.16 MAX
3310 20 48 45 41 54 53 2D 2D 53 49 44 45 20 31 04 31   HEATS--SIDE 1.1
3320 36 20 4D 41 58 20 48 45 41 54 53 2D 2D 53 49 44  6 MAX HEATS--SID
3330 45 20 32 04 53 45 52 56 4F 20 50 4F 57 45 52 20  E 2.SERVO POWER
3340 53 55 50 50 4C 59 04 43 52 49 54 45 52 49 4F 4E  SUPPLY.CRITERION
3350 04 43 41 52 20 54 59 50 45 04 53 49 4E 47 4C 45  .CAR TYPE.SINGLE
3360 20 41 58 4C 45 04 20 20 20 46 52 49 43 54 49 4F   AXLE.   FRICTIO
3370 4E 04 20 20 20 20 20 52 4F 4C 4C 45 52 04 53 49  N.     ROLLER.SI
3380 44 45 20 31 20 48 45 41 54 04 53 49 44 45 20 32  DE 1 HEAT.SIDE 2
3390 20 48 45 41 54 04 41 58 4C 45 20 4E 55 4D 42 45   HEAT.AXLE NUMBE
33A0 52 04 20 46 45 45 54 04 4C 45 4E 47 54 48 04 53  R. FEET.LENGTH.S
33B0 50 45 45 44 04 20 4D 2E 50 2E 48 2E 20 20 20 04  PEED. M.P.H.   .
33C0 44 49 52 45 43 54 49 4F 4E 3A 20 04 53 4F 55 54  DIRECTION: .SOUT
33D0 48 42 4F 55 4E 44 04 4E 4F 52 54 48 42 4F 55 4E  HBOUND.NORTHBOUN
33E0 44 04 4E 4F 20 44 45 46 45 43 54 53 04 48 4F 54  D.NO DEFECTS.HOT
33F0 20 42 4F 58 45 53 20 20 41 58 4C 45 20 20 20 53   BOXES  AXLE   S
3000 54 2D 2D 46 41 54 41 4C 20 45 52 52 4F 52 04 50  T--FATAL ERROR.P
3010 54 4D 20 43 4C 4F 43 4B 20 54 49 4B 49 4E 47 20  TM CLOCK TIMING
3020 49 53 20 49 4E 41 43 43 55 52 41 54 45 04 4B 41  IS INACCURATE.NA
3030 52 44 20 45 52 52 4F 52 20 49 4E 20 54 48 45 20  RD ERROR IN THE
3040 55 50 50 45 52 20 4D 45 4D 4F 52 59 04 48 41 52  UPPER MEMORY.HAR
3050 44 20 45 52 52 4F 52 20 49 4E 20 54 48 45 20 42  D ERROR IN THE B
3060 4F 54 54 4F 4B 20 4D 45 4D 4F 52 59 04 7B 00 B9  OTTOM MEMORY....
3070 26 08 B6 02 CE C2 7C 7E C4 73 7D 00 8A 26 07 B6  &...NB..D....&..
```

```
3080 03 CE C2 94 20 F1 B6 84 02 B5 08 27 0A C6 20 8D  .NB. .6....'.F .
3090 15 4F CE C2 E9 20 E0 85 04 26 21 C6 10 8D 07 86  .ONB.  ..&!F....
30A0 0B CE C3 34 20 D1 DA 80 D7 80 39 96 01 BB 01 F4  .NC4 QZ.W.9..;..
30B0 BB 02 4A BB 02 4B BB 02 49 97 85 39 B6 84 00 84  ;.J;.H;.I..96...
30C0 7F 8A 60 B7 84 00 8D E3 C6 02 B7 00 81 01 26 03  ..`7....F.W...&.
30D0 78 00 00 BD C5 22 7D 00 85 26 0C 86 22 01 01 01  ...=E"...&.."...
30E0 C6 20 BD C5 34 20 31 86 23 CE 02 0F D6 01 8D 36  F(=E4 1.#N..V..6
30F0 86 15 CE 02 19 F6 01 F4 8D 2C 86 27 CE 02 30 F6  ..N......,.'N.0.
3100 02 4A 8D 22 86 25 FE 02 3C F6 02 48 8D 18 86 26  .J."&%..<..H...&
3110 CE 02 36 F6 02 49 8D 0E BD 8D CF 7A 00 00 26 B3  N.6..I..==O...&3
3120 7F 84 00 7E C9 73 BD CA E7 37 26 02 33 3B 7F 88  ....I.=J.7&.3;..
3130 E6 30 A6 00 A0 02 8F 1B C6 32 8D 32 A6 03 C6 10  .0&. ...F2.2&.F.
3140 8D 2C 81 23 26 10 8D 62 8D 4C 8D 17 C6 3C 8D 1E  .,.#&....L..F<..
3150 86 1A C6 0C 20 04 86 16 C6 3C 8D 12 30 8D 12 30  ..F. ...F<..0..0
3160 A6 05 8B 02 26 02 6C 04 A7 05 6A 02 20 BC 7E C5  &...&...'... <.E
3170 34 8D 37 8D 4B CE 01 40 BD CB DC C6 32 86 00 8D  4.7.MN.@=K\F2...
3180 ED 08 A6 00 27 04 C6 03 20 03 C6 02 08 8D 22 5A  ..&.'.F. .F...*Z
3190 26 FB 86 14 20 1D 5F 48 24 04 2A 03 4F 39 53 53  &... ._H$.*.O9SS
31A0 86 01 D8 60 C5 02 27 01 4C 39 EE 04 E6 00 A6 01  ..X`E.'.L9....&.
31B0 39 86 0A 37 E6 00 27 02 C0 0A 1B C6 1E 8B AF 08  9..7..'.@..F../.
31C0 33 39 84 03 43 53 DB 0A 99 09 CB 01 89 00 39 C6  39..CS[...K...9F
31D0 01 F5 84 02 27 08 B1 85 26 05 B5 00 26 01 39 86  ....'.0.&.U.&.9.
31E0 28 C6 32 8C C6 10 BD C5 34 4C 81 2C 26 F6 96 09  (F2.F.=E4L.,&...
31F0 D6 0A 7E BD 75 BD CA E7 BD C1 96 BD C1 96 CE BE  V..=.=J.=A.=A.N>
3200 6D 8D 57 7F 88 CF B6 80 01 44 44 B7 88 CF CE 83  ..W..#6..DD7.#N.
3210 C0 8D 47 8D 52 CE BE 7C 8D 40 CE 88 F3 8D 44 CE  @.G.RN>..@N...DN
3220 88 F4 8D 3A 8D 41 CE BE 83 8D 2F CE 88 F5 8D 33  ...:.AN>../N...3
3230 86 3A CE 88 F6 8D 29 8D 2E CE BE 8A 8D 1C F6 88  .:N...)..N>.....
3240 F1 2B 05 86 2B BD C1 32 C4 0F 27 02 CB 30 17 CE  .+..-=A2D.'.KO.N
3250 88 F2 8D 0C CE BE 98 8D 01 3B BD C1 88 39 86 2F  ....N>...;=A.9./
3260 BD C1 32 BD C1 BA 39 86 05 BD C1 AB 39 53 43 4C  =A2=A:9..=A+9SCL
3270 20 52 41 49 4C 52 4F 41 44 2C 20 04 44 41 54 45   RAILROAD, .DATE
3280 3A 20 04 54 49 4D 45 3A 20 04 54 45 4D 50 45 52  : .TIME: .TEMPER
3290 41 54 55 52 45 3A 20 04 20 44 45 47 52 45 45 53  ATURE: . DEGREES
32A0 20 46 2E 04 96 0F 91 82 26 1C 7D 01 80 26 08 86   F......&...&..
32B0 BF B4 84 00 B7 84 00 96 8F 85 10 27 E7 96 0F 91  ?4..7......'....
32C0 82 26 03 7E BC 6B BE 0E BD CF 59 B7 04 F7 01 F9  .&..<.^.=OYW....
32D0 26 2B 7C 01 F9 86 08 97 0B BF 0E BE 0C BD CF 59  &+......._.^.=OY
32E0 17 BB CF 59 36 10 32 23 01 17 BB 02 0B 25 05 B1  .=OY6.2#..;..%.1
32F0 88 FA 23 03 B6 88 FA 97 07 97 08 20 5F BD CF 59  ..#.6.....  =OY
3300 B7 0B BD CF 59 BF 0E B7 07 96 8F 85 02 26 0E 8A  W.=OY_.W.....&..
3310 02 97 8F 96 07 97 05 96 08 97 06 20 1C 96 05 48  ........... ...H
3320 91 07 2F 20 96 06 48 91 08 2F 19 96 07 9B 05 46  ../ ..H../.....F
3330 97 05 96 08 9B 06 46 97 06 86 04 97 0B F6 02 0C  ......F.........
3340 B7 10 20 08 F6 02 0E 7F 00 0B B7 10 96 07 BD CB  W. .......W...=K
3350 4A 97 07 B6 10 96 08 BD CB 4A 97 08 BE 09 FF 01  J..V...=KJ..^...
3360 F7 BE 0C 7F 01 F6 BD CF 59 F1 88 FA 25 0F 86 A0  .^....=OY...%..
3370 7A 01 FB 26 14 CE C3 1F 86 07 7E C4 73 86 10 B7  ...&.NC....D...7
3380 01 FB 4F B1 08 25 0B 86 80 9A 0B 97 0B 86 02 BD  ..O0.%.........=
3390 88 A6 BD CF 59 F1 88 FA 25 0F 86 50 7A 01 FA 26  08=OY...%..P...&
33A0 14 CE C3 0A 86 06 7E C4 73 86 10 B7 01 FA 4F B1  .NC....D...7..O0
33B0 07 25 0B 86 40 9A 0B 97 0B 86 01 BD B8 A6 96 0B  .%..@......=08..
33C0 85 F0 27 2B B6 01 C1 05 27 21 5C B7 01 7B 01 F6  ..'+V.A.'!\W....
33D0 26 06 7C 01 F6 BD B9 EB BF 0C BE 02 B6 0A E7 00  &....=9._.^.V...
33E0 16 9A 09 08 A7 00 08 BF 02 BE 0C C4 0F B7 0B 7C  ....'.. _.^.D.W..
33F0 00 0A 26 03 7C 00 09 7A 00 04 2F 03 7E BF 66 BF  ..&.....'/..7._
3000 FF FF FF FF FF FF FF FF FF FF FF FF FF FF FF FF  ................
3010 FF FF FF FF FF FF FF FF FF FF FF FF FF FF FF FF  ................
3020 FF FF FF FF FF FF FF FF FF FF FF FF FF FF FF FF  ................
3030 FF FF FF FF FF FF FF FF FF FF FF FF FF FF FF FF  ................
3040 FF FF FF FF FF FF FF FF FF FF FF FF FF FF FF FF  ................
3050 FF FF FF FF FF FF FF FF FF FF FF FF FF FF FF FF  ................
3060 FF FF FF FF FF FF FF FF FF FF FF FF FF FF FF FF  ................
3070 FF FF FF FF FF FF FF FF FF FF FF FF FF FF FF FF  ................
3080 FF FF FF FF FF FF FF FF FF FF FF FF FF FF FF FF  ................
3090 FF FF FF FF FF FF FF FF FF FF FF FF FF FF FF FF  ................
30A0 FF FF FF FF FF FF BD CA E7 B6 F0 B7 84 00 7B 01  ......=J...7....
30B0 80 2A 05 C6 3C F7 01 80 3B BD C9 0F 4F 0E F6 84  .+.F<...;=I.O...
30C0 00 F6 88 EC 7B 84 01 2B 0A C5 80 26 F4 BB CB 16  .......+.E.&.=K.
30D0 7E BA 9F 53 27 E3 F6 88 E7 4C 81 03 2B E0 C6 08  .:.S'....L..+`F.
30E0 FA 84 00 F7 84 00 C6 80 F7 84 04 81 07 2B CF 0F  ......F......+O.
```

```
30F0 B6 BD 97 BF BD C8 C1 7E C8 2E C5 08 27 06 CE C3  ....=HA.H.E.'.NC
3100 5A BD 60 39 C5 04 27 05 CE C3 66 20 F4 CE C3 72  Z.`9E.'.NC. .NC.
3110 20 EF BD 01 82 B7 01 82 24 13 7C 01 81 20 0E 7D   .;..7..$.... ..
3120 01 83 26 03 7E BA 9F CE 01 84 FF 01 81 CE C3 51  ..&..:.N.....NC@
3130 BD 0F 86 03 BD 1F BD C2 20 30 36 86 02 BD 16 32  ........@ 06....2
3140 39 BD C1 86 BD 07 39 BD FB BD B9 E3 39 36 86 3A  9=A...9..=9.96.:
3150 BD C1 32 32 39 FE 01 81 BD 05 E6 00 39 08 4A 4D  =A229.......9.JM
3160 26 FB 39 BD C1 A4 BD C1 88 39 BD 77 86 04 CE C3  &.9=A$=A.9....NC
3170 7E BD 59 86 05 CE C3 BA BD 52 CE C3 96 BD CB BD  ..Y..NC..RNC..K.
3180 B9 37 4F BD B0 37 4C BD CC 32 BD BD C2 BD 4E C0  9?0.P7L.L2==B.N@
3190 01 82 00 30 6A 00 26 F5 31 CE C3 7E 86 07 BD 15  ...0..&.1NC.....
31A0 CE C3 BA 86 06 BD 0E 7A 01 83 27 03 7E B9 12 BD  NC.......'..9.=
31B0 C1 96 7E BA 9F BD BA BD 2A BD B9 3A 37 36 BD 95  A..:....*=9:76..
31C0 BD 1A 32 BD 02 30 6A 00 2E F3 31 39 BD 98 BD B9  ..2..0....19..=9
31D0 55 CE C3 47 BD BD BD B9 4D BD 01 39 4F BD CB D4  UNCG..=9M..9O=KT
31E0 BD 01 39 36 86 04 BD C1 AB 32 39 BD CA E7 B6 01  ..96..=A+29=J.6.
31F0 83 81 05 27 2A 4C B7 01 83 F6 01 F7 BD 22 F6 01  ...'*L7......"..
3200 F8 BD 1D F6 01 F9 BD 18 D6 0B BD 14 B6 07 BD 10  ........V...V...
3210 B6 08 BD 0C B6 01 F9 48 BD 10 BD 04 4A 26 F9 3D  V...6..H....J&.;
3220 FE 01 81 E7 00 08 FF 01 81 39 BE 0C BD CF 59 BF  .........9`.=OY_
3230 0C 39 7F 88 E6 BD CB 16 BD CB 31 B6 84 05 84 F7  .9...=K.=K16....
3240 B7 84 05 7B 02 20 26 14 B6 02 21 81 07 22 0D BE  7.... &.6.!..".
3250 03 FF 4F B7 84 00 B7 84 04 7E BA 9F B6 8F CA 70  ..O7..7...:.V.J.
3260 7C 01 F5 B7 8F 3B 7F 88 E6 CE 84 00 6F 01 6F 03  ...W.;...N......
3270 6F 05 6F 07 86 FF A7 00 A7 04 86 9F A7 06 86 E0  ......'.'...'..`
3280 A7 02 86 06 A7 03 A7 01 86 16 B7 88 E1 B7 88 E3  '...'.'...7..7..
3290 A7 05 86 14 A7 07 6F 00 6F 02 6F 04 6F 06 39 0F  '...'.........9.
32A0 8E 03 FF BD C1 86 80 A7 02 86 07 A7 01 BD C1 BD  ....A..'...'.=A]
32B0 BD CB 16 BD CB 31 0E 86 04 5F BD C1 3B 7F 88 E6  =K.=K1..._=A;...
32C0 5C 26 F7 BD C1 7A BD C6 31 27 07 C6 FF 86 FD BD  \&.=A.=F1'.F...=
32D0 C5 34 CE 8C 00 86 04 C6 80 BD C0 04 28 0A CE 8C  E4N....F.=@.(.N<
32E0 2E 86 0C BD BD A4 20 4A 53 BD BD B5 0F 8E 8F FF  ...=;$ JS=;5....
32F0 96 80 36 CE 00 3B A6 00 36 08 8C 00 5B 26 F7 CE  ..6N.;&.6...[&.N
3300 00 00 86 04 BD C0 04 07 CE 00 5A 33 E7 00 09 8C  ....=@..N.Z3....
3310 00 3A 26 F7 33 B7 80 8E 03 FF 36 BD C1 BD 32 C6  .:&.3H....6=A]2F
3320 40 06 0E 28 09 86 0C CE 8C 4D 8D 78 20 04 53 BD  @..(...N<M.. .S=
3330 BD B5 CE BD 5C FF 01 FF BD C9 2C CE 00 00 5F B6  ;5N;\...=I,N.._6
3340 88 E7 4F 4C 26 FB 5C 26 FA 7F 88 E6 08 8C 02 EE  ..OL&.\&........
3350 26 F1 CE BD B9 86 08 8D 52 7E C1 FD BD CB 16 0E  &.N;Y...R.A.=K..
3360 30 A6 02 E6 01 EE 03 8E 03 FF 8C 00 1A 26 08 C1  0&...........&.A
3370 8F 26 04 81 C8 22 0D C6 04 CE 8C 0F 86 08 8D 24  .&..H".F.N<....$
3380 20 04 C6 FB 8D 2F C6 10 86 04 CE FF FF 7F 88 E6   .F../F...N.....
3390 B5 84 02 26 25 BD C1 7F 09 26 F2 86 0B CE C3 34  5..&%=A..&...NC4
33A0 8D 02 20 19 B5 80 26 0C BD 8C A6 BD C4 BD BD C4  .. .U.&.=<&=D;=D
33B0 F7 BD C4 A5 39 B4 80 B7 80 39 53 8D F8 C6 01 4F  .=DE9T.W.9S..F.O
33C0 BD C5 34 7E BA 9F 43 56 53 44 20 43 4C 4F 43 4D  =E4.:.CVSD CLOCK
33D0 20 46 41 49 4C 55 52 45 04 50 52 4F 47 52 41 4D   FAILURE.PROGRAM
33E0 4D 41 42 4C 45 20 54 49 4D 45 52 20 4D 4F 44 55  MABLE TIMER MODU
33F0 4C 45 20 46 41 49 4C 53 20 54 4F 20 43 4F 55 4E  LE FAILS TO COUN
```

I claim:

1. A method of detecting hot axle bearings on cars of a train, which comprises the steps of:

(a) obtaining measurements indicative of the heat of the axle bearings on one side of a car of a train, (b) averaging the two lowest measurements from said axle bearings on said one car side to obtain a first average measurement, (c) comparing each of the remaining axle bearing measurements on one side of said car with said first average measurement and providing an alarm if any remaining axle bearing measurements on one side of said car exceed said first average measurement by a predetermined amount whereby said axle bearing is classified as being overheated.

2. A method according to claim 1 wherein said comparing step (c) includes the steps of:

(1) determining the particular axle bearing causing an alarm, and (2) enunciating the location by axle count of the overheated axle bearing from one end of the train.

3. A method according to claim 1 further comprising the steps of:

(d) establishing a running average measurement based on said first average measurements of prior friction bearings of prior cars of said train, (e) comparing said running average measurement with said first average measurement, (f) determining prior to step (c) whether the comparison in step (e) exceeds a predetermined level whereby the axle bearings of one side of a car are classified as roller bearings, said axle bearings otherwise being classified as friction bearings, (g) altering the prior running average measurement with said first average measurement if a friction bearing (is determined by step (f)) according to a predetermined averaging function, and storing said altered running average measurement.

4. A method according to claim 3 wherein, if step (f) results in a "roller bearing" classification, said comparing step (c) includes the steps of:

(1) determining the particular roller bearing causing an alarm, and (2) enunciating the location by axle count of the overheated roller bearing from one end of the train.

5. A method according to claim 3 wherein, if step (f) results in a "friction bearing" classification, said comparing step (c) includes the steps of:

(1) determining the particular friction bearing causing an alarm; and (2) enunciating the location by axle count of the overheated friction bearing from one end of the train.

6. A method according to claim 3 wherein said comparing step (c) includes the step of:

(1) determining the particular friction or roller bearing causing an alarm; and (2) enunciating the location by axle count of the overheated friction or roller bearing from one end of the train.

7. A system for detecting hot axle bearings, which comprises:

(a) means for obtaining measurements indicative of the temperature of axle bearings on a single side of a car of a train, (b) means for determining the passage of the last wheel of a single car of a train, (c) means responsive to said means for determining the passage of the last wheel of a car for averaging the two lowest measurements from said axle bearings of a single side of said car to obtain a single side car average measurement, and (d) means to provide an alarm when any of the remaining axle bearing measurements on one side of a car exceeds said single side car average measurement by a predetermined amount whereby said axle bearing is classified as being overheated.

8. A system according to claim 7 wherein said means to provide (d) includes:

(e) means to count the wheels of each car and, responsive to an alarm to indicate the wheel and car side causing the alarm, and (f) means responsive to said alarm for automatically enunciating the location of said overheated axle bearing from one end of the train.

9. A system according to claim 8 further including:

(e) a data base having a running friction bearing average measurement stored therein, (f) means to compare said single side car average measurements with said running friction bearing average measurement, and (g) means for determining when said comparison of said single side car average measurement exceeds a predetermined level of said running friction average measurement whereby the bearings of said axles of one side of a car are classified as roller bearings.

10. A system according to claim 9 wherein said means to provide (d) includes:

(f) means to count the wheels of each car and, responsive to an alarm to indicate the wheel and car side causing the alarm, and (g) means responsive to said alarm automatically enunciating the location of said overheated roller axle bearing from one end of the train.

11. A system according to claim 8 further including:

(e) a data base having a running friction bearing average measurement stored therein, (f) means to compare said single side car average measurements with said running friction bearing average measurement, and (g) means for determining when said comparison of said single side car average measurement does not exceed a predetermined level of said running friction average measurement whereby the bearings of said axles of one side of a car are classified as friction bearings.

12. A system according to claim 11 wherein said means to provide (d) includes:

(h) means to count the wheels of each car and, responsive to an alarm to indicate the wheel and car side causing the alarm, and (i) means responsive to said alarm for automatically enunicating the location of said overheated friction axle bearing from one end of the train.

13. A system for detecting hot axle bearings, which comprises:

(a) a data base having a running friction bearing average measurement stored therein, (b) means for obtaining measurements indicative of the temperature of axle bearings on a single side of a car of a train, (c) means for determining the passage of the last wheel of a single car of a train, (d) means responsive to said means for determining the passage of the last wheel of a car for averaging the two lowest measurements from said axle bearings of a single side of said car to obtain a single side car average measurement, (e) means to compare said single side car average measurements with said running friction bearing average measurement, (f) means for determining whether said comparison of step (e) exceeds a predetermined level whereby the bearings of axles on one side of a car are classified as roller bearings, said axle bearings otherwise classified as friction bearings, (g) means for altering said running friction bearing average measurement in said data base with said single side car average measurement for friction bearings (as determined by step (f)) according to a predetermined averaging function to provide an altered running friction bearing average measurement and replacing the prior said running friction average measurement in said data base with said altered running friction bearing average measurement, and (h) means to provide an alarm when any of the remaining axle bearing measurements on one side of a car exceeds said single side car average measurement by a predetermined amount whereby said axle bearing is classified as being overheated.

14. A system according to claim 13 wherein said means to provide (g) includes:

(h) means to count the wheels of each car and, responsive to an alarm to indicate the wheel and car side causing the alarm, and (i) means responsive to said alarm for automatically enunciating the location of said overheated axle bearing from one end of the train.

15. A system according to claim 13 wherein said means to provide (h) includes:

(i) means to count the wheels of each car and, responsive to an alarm to indicate the wheel and car side causing the alarm, and (j) means responsive to said alarm, if step (f) resulted in a "roller bearing" classification, for automatically enunciating the location of said overheated roller axle bearing from one end of the train.

16. A system according to claim 13 wherein said means to provide (h) includes:

(i) means to count the wheels of each car and, responsive to an alarm to indicate the wheel and car side causing the alarm, and (j) means responsive to said alarm, of step (f) resulted in a "friction bearing" classification, for automatically enunciating the location of said overheated friction axle bearing from one end of the train.

17. A method of sampling the axle count and inter axle space data of the passage of cars in a train wherein each car includes spaced trucks carrying wheels, comprising the steps of:

(a) locating the first axle of a single car of said train to commence axle count and inter axle space data, (b) determining the time period between axles of said single car, (c) storing a representation of the time period determined, (d) comparing said representation with a previously stored such representation, (e) determining an inner truck space of said single car when the representation of the time period exceeds said previously stored representation by a predetermined multiple, and (f) counting a number of succeeding axles equal to the number of axles counted prior to the determined time period of said inter truck space signalling the complete passage of said single car.

18. A method as set forth in claim 17 further including the step of (g) storing the axle count and truck data on a car by car basis.

19. A method as set forth in claim 17 further including the steps of (g) determining the average speed of at least some of said axles, (h) determining the distance between each adjacent pair of axles, and (i) calculating the train length.

20. A method of detecting hot axle roller and friction bearings on cars of a train, which comprise the steps of:

(a) counting the axles of said cars of said train, (b) obtaining measurements indicative of the temperature of the axle bearings on each of said cars, (c) determining the inter axle time of passage data from a passing car, (d) storing said axle count and inter axle time data and axle bearing temperature data on an axle by axle basis.

(e) determining the passage of a car from said axle count and inter axle time data, (f) classifying the axle bearing as a roller bearing or a friction bearing from said axle bearing temperature data, (g) providing reference alarm thresholds for respective roller and friction bearings measured in step (b), and (h) providing an alarm when said axle bearing temperature data from said axle bearing equals or exceeds respective said alarm thresholds for respective roller and friction bearings.

* * * * *